US010327562B2

(12) United States Patent
Scarleski

(10) Patent No.: US 10,327,562 B2
(45) **Date of Patent: *Jun. 25, 2019**

(54) FOUR-IN-ONE MATTRESS MANAGEMENT SYSTEM

(71) Applicant: Levitation Sciences LLC, Chicago, IL (US)

(72) Inventor: William J. Scarleski, Chicago, IL (US)

(73) Assignee: Levitation Sciences LLC, Chicago, IL (US)

( * ) Notice: Subject to any disclaimer, the term of this patent is extended or adjusted under 35 U.S.C. 154(b) by 496 days.

This patent is subject to a terminal disclaimer.

(21) Appl. No.: 13/838,408

(22) Filed: Mar. 15, 2013

(65) Prior Publication Data

US 2013/0269108 A1 Oct. 17, 2013

Related U.S. Application Data

(63) Continuation-in-part of application No. 13/534,674, filed on Jun. 27, 2012, now Pat. No. 9,021,630, which (Continued)

(51) Int. Cl.
*A47C 21/06* (2006.01)
*A47C 21/00* (2006.01)

(52) U.S. Cl.
CPC ..... *A47C 21/06* (2013.01); *A47C 21/00* (2013.01)

(58) Field of Classification Search
CPC ..... A47C 21/00; A47C 21/028; A47C 21/06
(Continued)

(56) References Cited

U.S. PATENT DOCUMENTS 2,849,729 A 9/1958 Goodey, Jr. et al.
3,261,177 A 7/1966 Amann et al.
(Continued)

FOREIGN PATENT DOCUMENTS

EP 1 106 115 6/2001
EP 1 645 258 4/2006
(Continued)

OTHER PUBLICATIONS

U.S. Appl. No. 14/015,223, William J. Scarleski.
(Continued)

*Primary Examiner* — Eric J Kurilla
(74) *Attorney, Agent, or Firm* — Clark Hill PLC; John S. Paniaguas

(57) ABSTRACT

A four-in-one mattress management system and method is disclosed for facilitating various tasks associated with beds of all sizes including making beds; rotating mattresses; holding a bed skirt in place while a mattress is rotated; installing or removing and re-installing a mattress, for example, in order to replace a bed skirt. The system includes an active mode and a passive mode. In an active mode, all four tasks mentioned above can be performed. A passive mode selectable. In a passive mode, the mattress can be easily rotated in a horizontal plane. During that mode, the system holds down the bed skirt while the mattress is being rotated. In an active mode, the present invention facilitates bed making and thus increases the efficiency of the housekeeping staff leaving more time for the housekeeping staff to attend to the rest of the room. The active mode also facilitates installation and replacement of bed skirts.

9 Claims, 116 Drawing Sheets

Related U.S. Application Data is a continuation-in-part of application No. 13/078,385, filed on Apr. 1, 2011, now Pat. No. 8,246,706, which is a continuation of application No. 12/772,572, filed on May 3, 2010, now Pat. No. 8,006,331.

(58) Field of Classification Search
USPC .... 5/411, 488, 510, 511, 659, 926, 81.1 HS, 5/81.1 RP, 658, 925; 414/676
See application file for complete search history.

(56) References Cited

U.S. PATENT DOCUMENTS

| | | | | |
|---|---|---|---|---|
| 3,416,626 | A | 12/1968 | Nagamatsu | |
| 3,667,073 | A | 6/1972 | Renfroe | |
| 4,046,317 | A | 9/1977 | Hein, Jr. | |
| 4,095,299 | A * | 6/1978 | Schweiso | G09F 3/00 2/80 |
| 4,155,421 | A | 5/1979 | Johnson et al. | |
| 4,517,690 | A | 5/1985 | Wegener | |
| 4,944,053 | A | 7/1990 | Smith | |
| 5,022,110 | A | 6/1991 | Stroh | |
| 5,088,952 | A | 2/1992 | Goldblatt | |
| 5,168,589 | A | 12/1992 | Stroh et al. | |
| 5,257,430 | A | 11/1993 | Yamaguchi | |
| 5,313,679 | A | 5/1994 | Yamaguchi | |
| 5,318,481 | A | 6/1994 | St. Germain | |
| 5,360,363 | A | 11/1994 | Levin | |
| 5,414,882 | A | 5/1995 | Goodale | |
| 5,473,783 | A | 12/1995 | Allen | |
| 5,628,077 | A | 5/1997 | Briganti | |
| 5,631,074 | A | 5/1997 | Herlihy | |
| 5,632,054 | A | 5/1997 | Hutton et al. | |
| 5,815,865 | A | 10/1998 | Washburn et al. | |
| 5,860,174 | A * | 1/1999 | Failor | A61G 7/103 5/703 |
| 6,073,291 | A | 6/2000 | Davis | |
| 6,274,520 | B1 | 8/2001 | Cordell | |
| 6,457,196 | B1 | 10/2002 | Dykes et al. | |
| 6,684,434 | B2 | 2/2004 | Ellis et al. | |
| 6,728,978 | B1 | 5/2004 | Nordin | |
| 6,795,989 | B2 | 9/2004 | Fairchild et al. | |
| 6,886,203 | B2 | 5/2005 | Drakos | |
| 6,966,083 | B1 | 11/2005 | Cheng | |
| 7,051,388 | B1 | 5/2006 | Taddeo | |
| 7,089,618 | B1 * | 8/2006 | Metzger | A47C 27/087 5/709 |
| 7,120,952 | B1 | 10/2006 | Bass et al. | |
| 7,155,763 | B2 | 1/2007 | North | |
| 7,228,581 | B2 | 6/2007 | Mezue | |
| 7,481,290 | B2 | 1/2009 | Pendzich | |
| 7,581,270 | B1 | 9/2009 | Levesque | |
| 7,617,556 | B2 | 11/2009 | Rensink | |
| 7,644,671 | B2 | 1/2010 | Smith | |
| 7,725,963 | B2 | 6/2010 | Johnson | |
| 7,730,567 | B2 | 6/2010 | Jaeger | |
| 7,735,164 | B1 | 6/2010 | Patrick | |
| 7,849,533 | B1 | 12/2010 | Receveur et al. | |
| 7,917,979 | B2 | 4/2011 | Amsler, Jr. et al. | |
| 7,975,330 | B2 | 7/2011 | Receveur et al. | |
| 8,006,331 | B1 | 8/2011 | Scarleski | |
| 8,122,541 | B1 | 2/2012 | Georgatos | |
| 8,201,292 | B2 | 6/2012 | Dionne et al. | |
| 8,246,706 | B2 | 8/2012 | Scarleski | |
| 8,510,880 | B2 | 8/2013 | Scarleski | |
| 8,549,681 | B2 | 10/2013 | Scarleski | |
| 9,021,630 | B2 * | 5/2015 | Scarleski | 5/488 |
| 2003/0029062 | A1 | 2/2003 | Esterman | |
| 2003/0079292 | A1 | 5/2003 | Ellis et al. | |
| 2004/0133978 | A1 | 7/2004 | Fairchild | |
| 2004/0226089 | A1 | 11/2004 | Miranda | |
| 2005/0172412 | A1 | 8/2005 | Pearson | |
| 2005/0229318 | A1 | 10/2005 | Peng | |
| 2006/0010608 | A1 | 1/2006 | DeFranks et al. | |
| 2007/0022533 | A1 | 2/2007 | Borino | |
| 2007/0251017 | A1 | 11/2007 | Speer et al. | |
| 2008/0028522 | A1 | 2/2008 | Atwood | |
| 2008/0040858 | A1 | 2/2008 | Sakaldasis | |
| 2008/0096001 | A1 | 4/2008 | Emden et al. | |
| 2008/0141463 | A1 | 6/2008 | Dionne | |
| 2008/0264983 | A1 | 10/2008 | Kastan | |
| 2008/0301876 | A1 | 12/2008 | Assink | |
| 2009/0004452 | A1 | 1/2009 | Assink | |
| 2009/0056030 | A1 | 3/2009 | Bolden | |
| 2009/0083909 | A1 | 4/2009 | Amsler | |
| 2009/0106893 | A1 | 4/2009 | Blevins | |
| 2010/0258344 | A1 | 10/2010 | Creasy | |
| 2011/0041247 | A1 | 2/2011 | Moon | |
| 2011/0099713 | A1 | 5/2011 | Gonser | |
| 2011/0265268 | A1 | 11/2011 | Scarleski | |
| 2011/0265269 | A1 | 11/2011 | Scarleski | |
| 2011/0278888 | A1 | 11/2011 | Miles | |
| 2012/0117778 | A1 | 5/2012 | Scarleski | |
| 2012/0137433 | A1 | 6/2012 | Snell et al. | |
| 2012/0151680 | A1 | 6/2012 | Scarleski | |
| 2012/0174323 | A1 | 7/2012 | Platek | |
| 2012/0246834 | A1 | 10/2012 | Scarleski | |
| 2012/0260432 | A1 | 10/2012 | Scarleski | |
| 2013/0019411 | A1 | 1/2013 | Scarleski | |
| 2013/0232698 | A1 | 3/2013 | Ward | |
| 2013/0212809 | A1 | 8/2013 | Scarleski | |
| 2014/0026318 | A1 | 1/2014 | Bethel et al. | |

FOREIGN PATENT DOCUMENTS

| | | |
|---|---|---|
| WO | PCT/US11/34537 | 5/2011 |
| WO | PCT/US11/034551 | 8/2011 |
| WO | PC/US13/47883 | 10/2013 |

OTHER PUBLICATIONS

U.S. Appl. No. 13/534,674, filed Jun. 27, 2012, William Scarleski.
U.S. Appl. No. 13/796,434, filed Mar. 12, 2013, William Scarleski.
U.S. Appl. No. 14/046,047, William J. Scarleski.
U.S. Appl. No. 14/046,113, William J. Scarleski.
http:/questoutfitters.com/coated.html—May 6, 2010.
http:/www.rockywoods.com—May 6, 2010.
http:/www.rockywoods.com/Fabrics-Hardware-Patterns-Kits/Medium-Weight-Nylon-Fabrics/Heat-Sealable-70-Denier-Nylon-Taffeta—May 6, 2010.
http:/www2.dupont.com/Products_and Services/en VN/nwyn.html—May 6, 2010.
http:/www.seattlefabrics.com/nylons.html—May 6, 2010.
http:/www.mattressdirectonline.com—May 5, 2010.
http:/www.nextag.com/INVACARE-MicroAir-Lateral-Rotation-628052627/prices-html Sep. 14, 2009.
http:/uncyclopedia.wikia.com/wiki/Mattress_racing—Sep. 14, 2009.
http:/www.primeconveyor.com/productDetail.asp_Q_catID_E_92_A_subCatID_E_129_ . . . Sep. 14, 2009.

* cited by examiner

Fig. 115
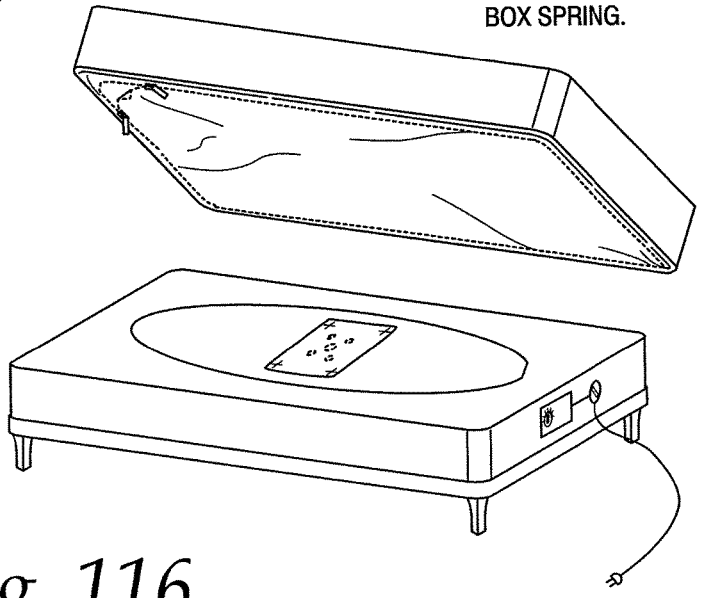
Fig. 116
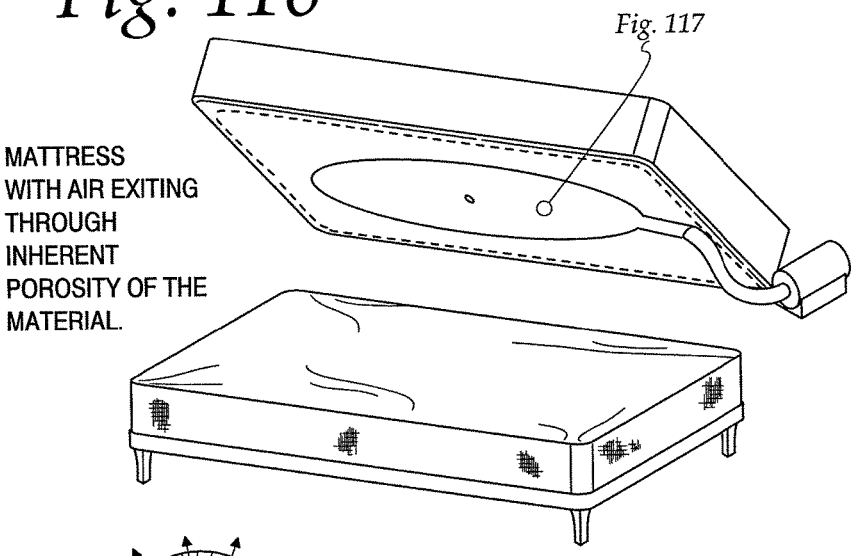
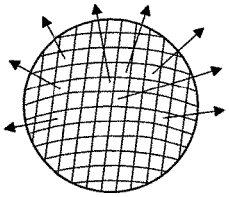
Fig. 117

MATTRESS ON ADJUSTABLE PLATFORM IN ADJUSTED STATE, PLATFORM COVERED BY PASSIVE BEDMAKER.

EXPLODED VIEW OF MATTRESS ON ADJUSTABLE PLATFORM IN ADJUSTED STATE, PLATFORM COVERED BY ACTIVE BEDMAKER.

EXPLODED VIEW OF MATTRESS ON ADJUSTABLE PLATFORM IN ADJUSTED STATE, MATTRESS COVERED BY ACTIVE BEDMAKER.

FOUR-IN-ONE MATTRESS MANAGEMENT SYSTEM

CROSS REFERENCE TO RELATED APPLICATIONS

This application is a continuation-in-part of co-pending U.S. patent application Ser. No. 13/534,674, filed on Jun. 27, 2012, which, in turn, is a continuation-in-part of U.S. patent application Ser. No. 13/078,385, which, in turn, is a continuation of U.S. patent application Ser. No. 12/772,572, now U.S. Pat. No. 8,006,331.

BACKGROUND OF THE INVENTION

1. Field of the Invention

The present invention relates to a four-in-one mattress management system and method for facilitating various tasks associated with beds of all sizes including making beds; rotating mattresses; holding a bed skirt in place while a mattress is rotated; installing or removing and re-installing a mattress, for example, in order to replace a bed skirt.

2. Description of the Prior Art

A conventional bed includes a box spring or bottom mattress or platform, (hereinafter "foundation") and a top mattress. Top mattresses are relatively heavy items. The weight of a mattress varies as a function of the coil core, the gauge of the coil and the type of material or foam material used. An average king size mattress weighs between 85 and 115 pounds. High end king size mattresses with latex or memory foam can weigh as much as 300 pounds (http:/ www.mattressdirectonline.com). As such, various tasks associated with the bed can be relatively strenuous.

For example, hotel and motel chains as well as healthcare facilities which include hospitals, nursing homes and extended care facilities (hereinafter "commercial facilities") are known to only use flat sheets in their facilities due to the lower cost of flat sheets relative to fitted sheets and the desire to maintain fewer items in their respective inventories. As such, in order to properly make the beds in such facilities with flat sheets, housekeeping personnel need to lift the top mattress, which can be quite heavy, as discussed above. More particularly, in such facilities beds are made with a top sheet and a bottom sheet and a blanket. Both the top sheet and the bottom sheets are flat sheets.

In order to properly make the bed, the top and bottom sheets are tucked in between the top mattress and the foundation. More specifically, the bottom sheet is placed on the bed so that an equal amount of the sheet hangs off each side of the bed and an equal amount of the sheet hangs off the head and foot regions of the bed. The excess is tucked in at the head and foot regions of the bed to form so called "hospital corners". Next, the excess portions of the bottom sheet are tucked in next between the mattress and the box spring. The top sheet is then placed on top of the bottom sheet and placed and tucked in the same manner as the bottom sheet with hospital style corners except the head region is left open. In other words, only the foot and side portions of the top sheet are tucked between the mattress and the box spring. Next, a blanket is placed on the bed and may be tucked in the same manner as the top sheet.

In order to tuck the top and bottom sheets between the mattress and the box spring, the top mattress must normally be lifted. As mentioned above, mattresses can weigh up to 300 pounds. In order to make a bed, a housekeeping employee may need to lift a mattress up to ten (10) times per bed-four (4) times for the bottom sheet and three (3) times for the top sheet and the blanket. Assuming that each housekeeping employee in a hotel, motel or healthcare facility makes at least 20-30 beds in a single shift, each housekeeping employee would typically lift a mattress at least 150-200 times per shift. Since bed making is a daily chore, housekeeping employees probably lift mattresses 150-200 times per shift on a daily basis.

Such sustained and repetitive lifting leads to employees developing back problems, resulting in employees missing work or, in severe cases, being placed on disability. Measures have been taken to mitigate such health problems. For example, simply using fitted sheets for the lower sheet reduces the number of times the mattress is to be lifted by 40%. However, fitted sheets do not provide the "hospital corners" in the lower bed sheets that hospitals are known for. Moreover, even using fitted sheets for the bottom sheet still requires a housekeeping employee to lift mattresses at least 90-160 times per day using the example above.

The use of fitted sheets is not without its drawbacks. For example, fitted sheets cost more than flat sheets. Also, frequent washing of sheets in commercial facilities tends to wear out the elastic in fitted sheets. As such, fitted sheets used in such facilities need to be replaced in applications in commercial facilities more frequently than straight sheets.

Other tasks associated with the bed can also be relatively strenuous. These tasks include rotating the mattress, both with and without a bed skirt, and removing the mattress in order to replace a bed skirt.

Thus, there is a need to facilitate these tasks.

SUMMARY OF THE INVENTION

Briefly, the present invention relates to a four-in-one mattress management system and method for facilitating various tasks associated with beds of all sizes including making beds; rotating mattresses; holding a bed skirt in place while a mattress is rotated; installing or removing and re-installing a mattress, for example, in order to replace a bed skirt. The system includes an active mode and a passive mode. In an active mode, all four tasks mentioned above can be performed. A passive mode is selectable. In a passive mode, the mattress can be easily rotated in a horizontal plane. During that mode, the system may hold down a bed skirt if there is one present while the mattress is being rotated. In an active mode, the present invention facilitates bed making and thus increases the efficiency of the housekeeping staff leaving more time for the housekeeping staff to attend to the rest of the room. The active mode also facilitates rotating mattresses; holding a bed skirt in place while a mattress is rotated; installing or removing and re-installing a mattress, for example, in order to replace a bed skirt.

DESCRIPTION OF THE DRAWING

These and other advantages of the present invention will be readily understood with reference to the following specification and attached drawing wherein:

FIGS. 29*h* and 29*i* illustrate a cover in which the connection of the side panels is adjustable.

FIG. 81 is a partial elevational view in section illustrating a sheet being tucked in.

FIG. 101 is similar to FIG. 96 but also illustrating a first embodiment of an adjustable air exit valve.

FIG. 102 is similar to FIG. 94 but also illustrating a second embodiment of an adjustable air exit valve.

FIG. 103 is similar to FIG. 95 but also illustrating a second embodiment of an adjustable air exit valve.

FIG. 104 is similar to FIG. 96 but also illustrating a second embodiment of an adjustable air exit valve.

FIG. 105 is similar to FIG. 97 but also illustrating a second embodiment of an adjustable air exit valve.

FIG. 106 is similar to FIG. 96 but also illustrating a third embodiment of an adjustable air exit valve.

FIG. 107 is similar to FIG. 97 but also illustrating a third embodiment of an adjustable air exit valve.

FIG. 108 is similar to FIG. 96 but also illustrating a third embodiment of an adjustable air exit valve.

FIG. 109 is similar to FIG. 97 but also illustrating a third embodiment of an adjustable air exit valve.

FIG. 110 is an alternate embodiment of the invention illustrating a single cover with a rectangular stitch pattern between the two sheets forming the expandable volume having a plurality of centrally located air exit holes with a second cover disposed over the air exit holes embedded in a platform.

FIG. 111 is similar to FIG. 110 but shown with the single cover embedded in the underside of a mattress.

FIG. 112 is similar to FIG. 110 but illustrating a circular or oval stitch pattern.

Figure 111:
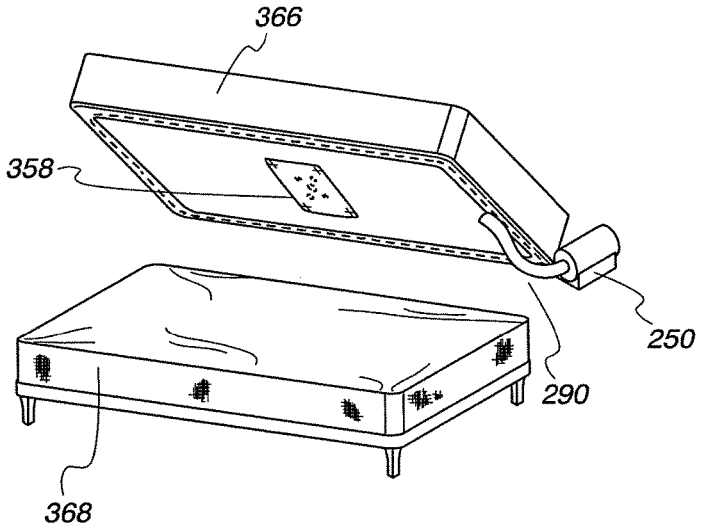
Figure 113:
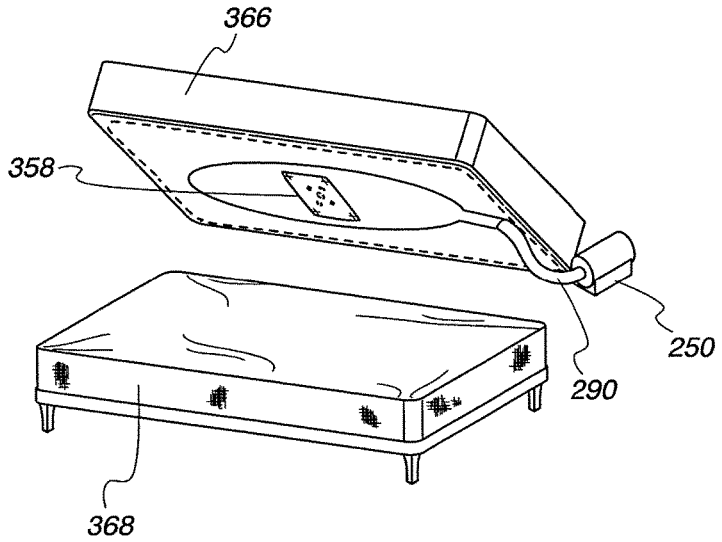

FIG. 113 is similar to FIG. 111 but illustrating a circular or oval stitch pattern.

Figure 114:
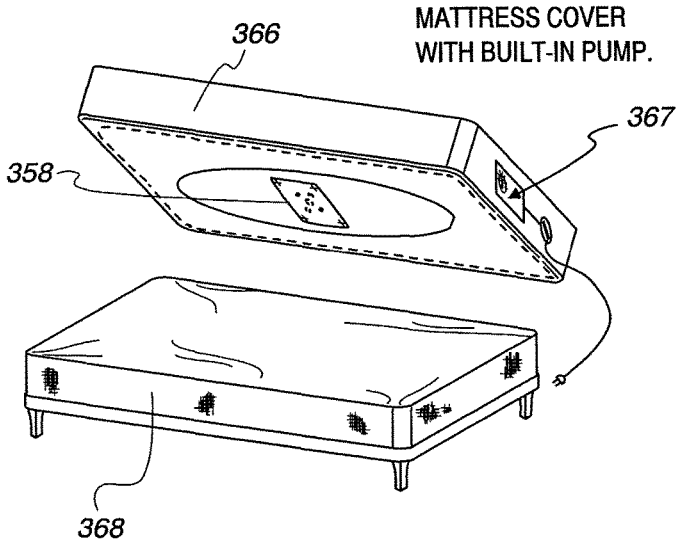

FIG. 114 is similar to FIG. 113 but illustrating a built in pump.

Figure 112:
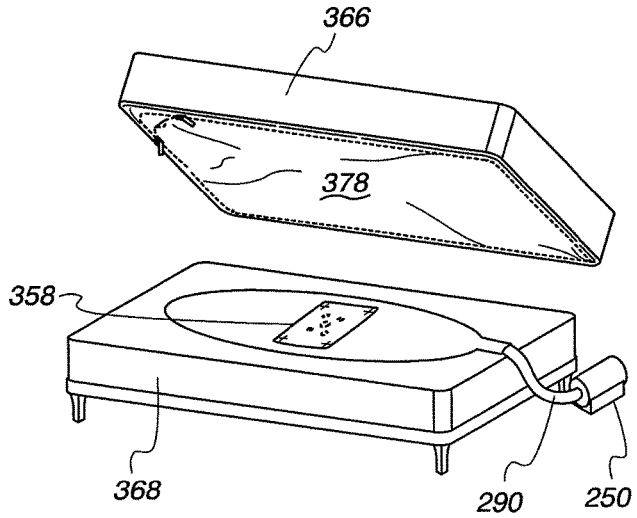

FIG. 115 is similar to FIG. 112 but illustrating a built in pump.

FIG. 116 is similar to FIG. 113 with shown with no air exit and relies on the porosity of the material used for the mattress to release air.

FIG. 117 is an exploded sectional view of a section of material in the mattress illustrating the air flowing out, as indicated by the arrows, based upon the porosity of the material used for the mattress cover.

Figure 98:
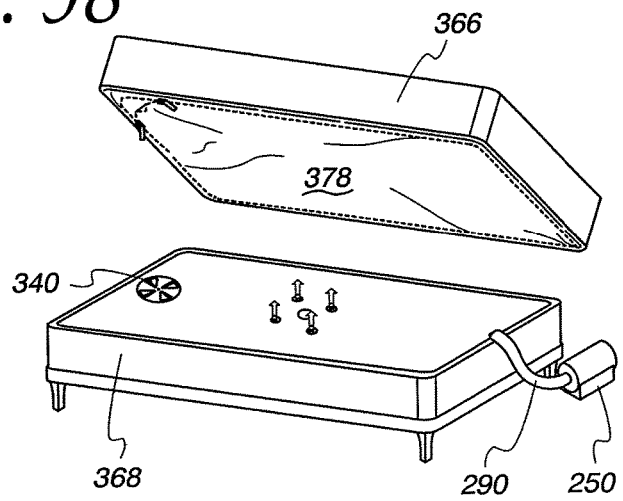
FIG. 98 is similar to FIG. 94 but also illustrating a first embodiment of an adjustable air exit valve.
Figure 118:
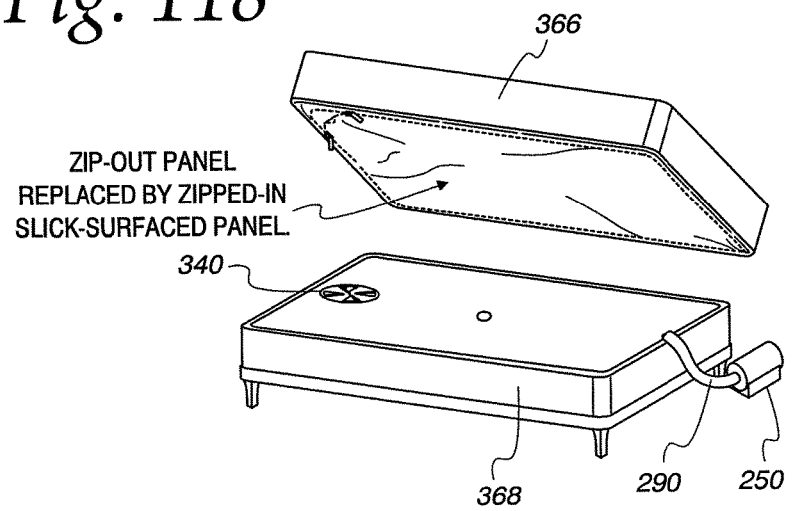

FIG. 118 is similar to FIG. 98 except no air exit holes are provided.

Figure 99:
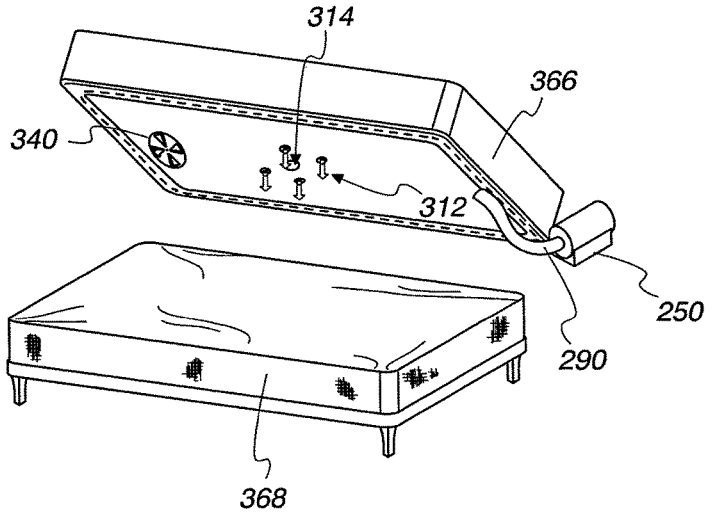
FIG. 99 is similar to FIG. 95 but also illustrating a first embodiment of an adjustable air exit valve.
Figure 119:
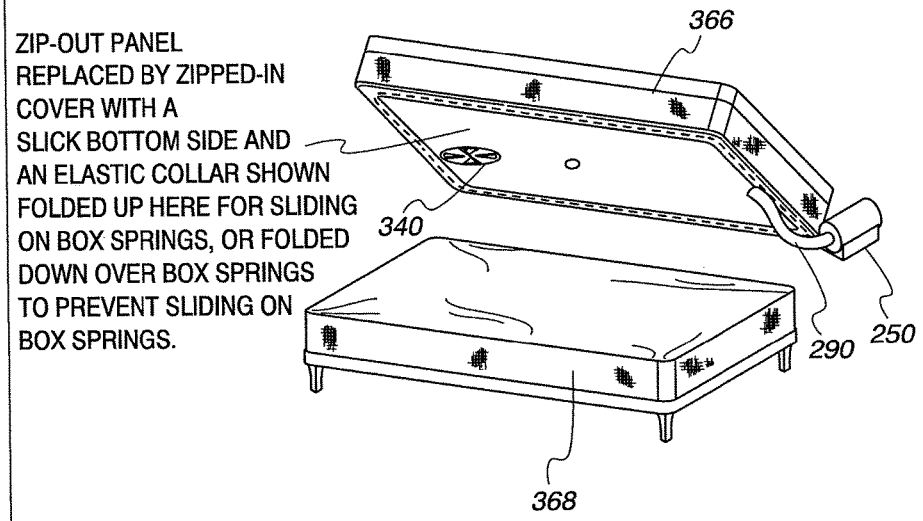

FIG. 119 is similar to FIG. 99 except no air exit holes are provided.

Figure 102:
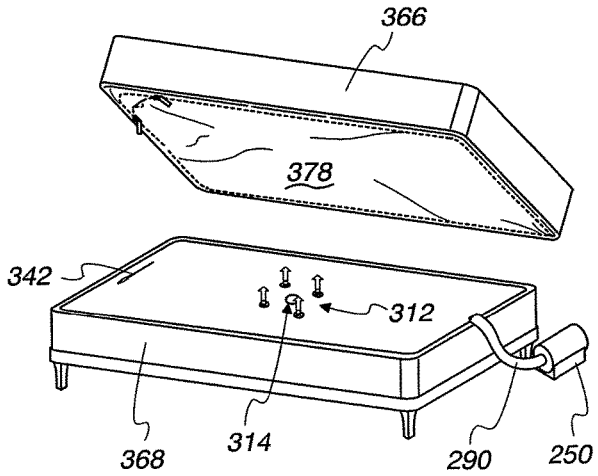
Figure 120:
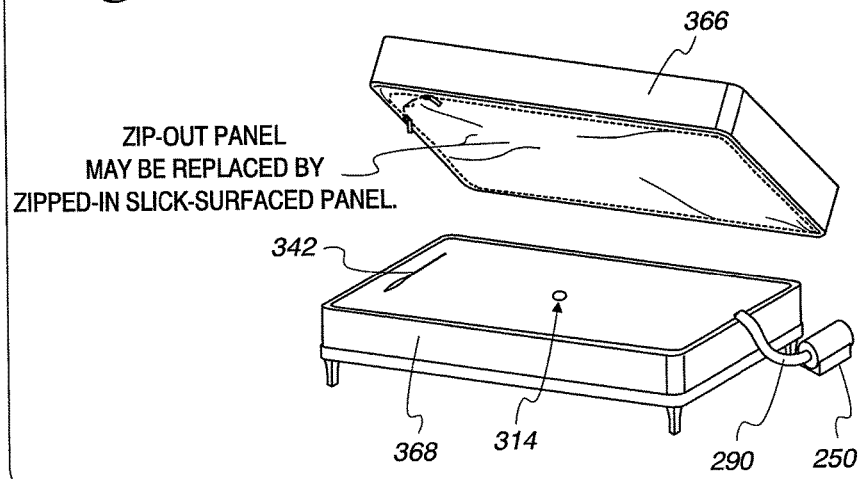

FIG. 120 is similar to FIG. 102 except no air exit holes are provided.

Figure 103:
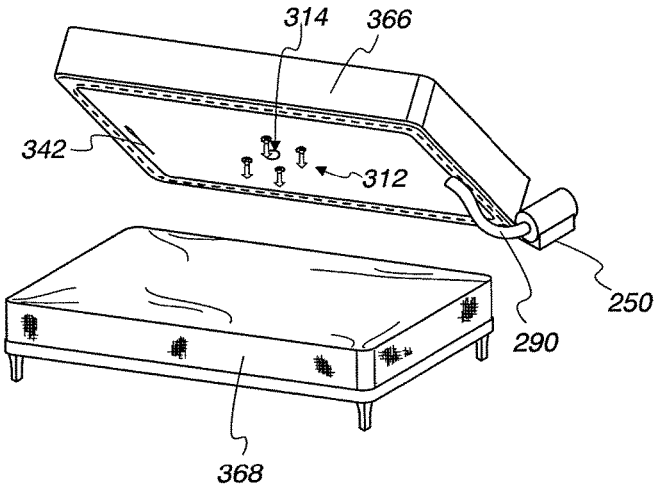
Figure 121:
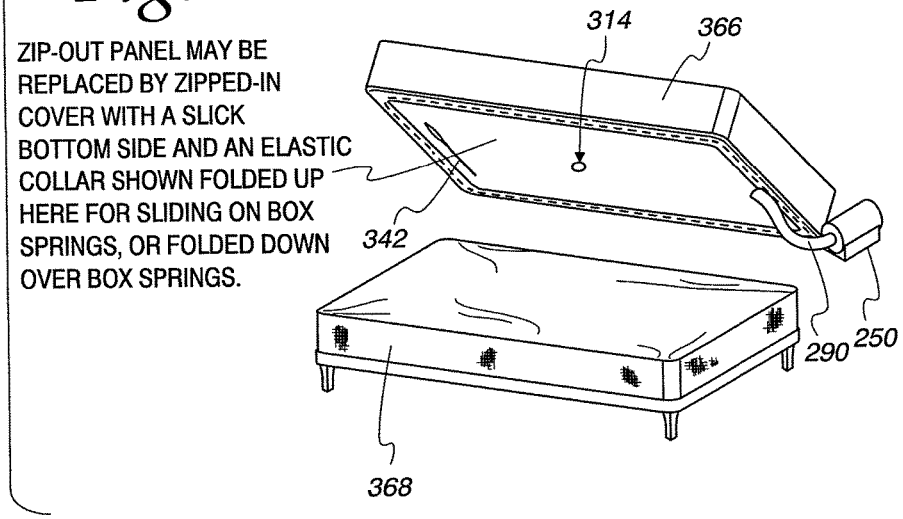

FIG. 121 is similar to FIG. 103 except no air exit holes are provided.

Figure 122:
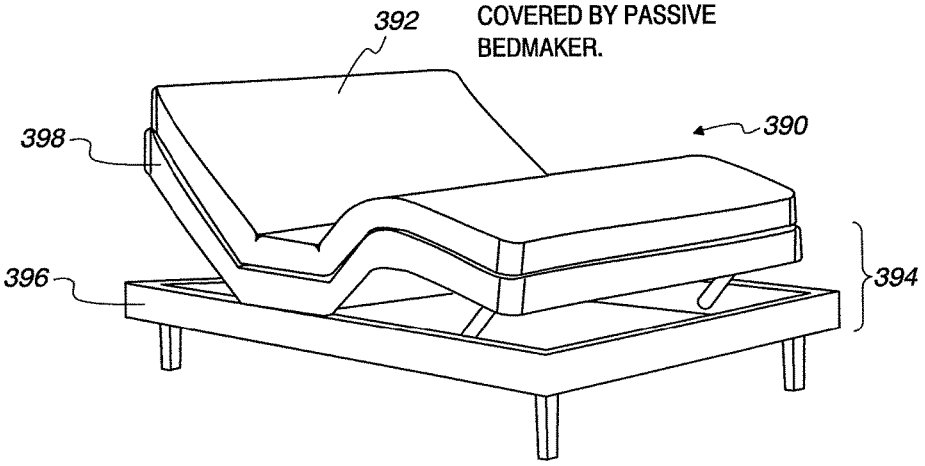

FIG. 122 is an isomeric view of a conventional bed with an adjustable platform shown with a mattress in a adjusted position.

Figure 123:
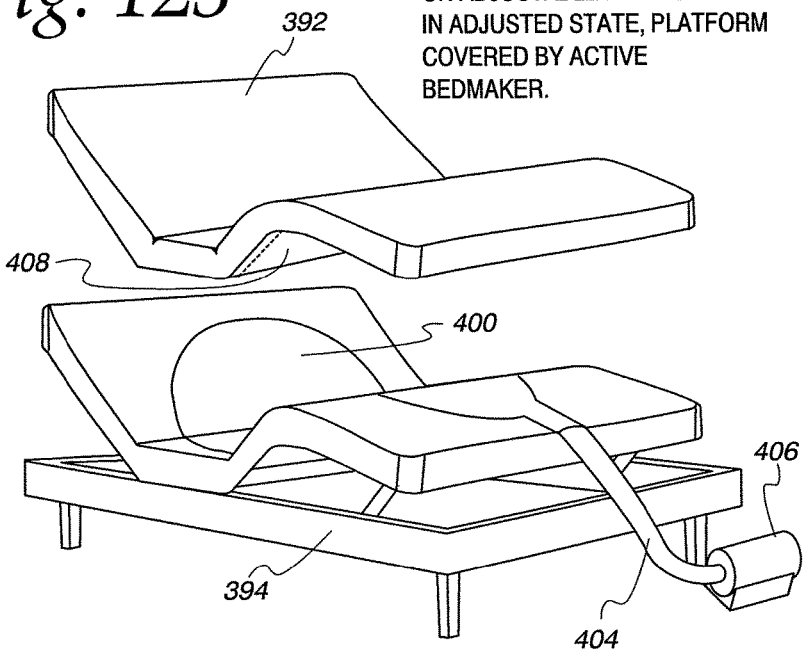

FIG. 123 is similar to FIG. 114 but illustrating a single cover in accordance with the present invention carried by the adjustable platform.

Figure 124:
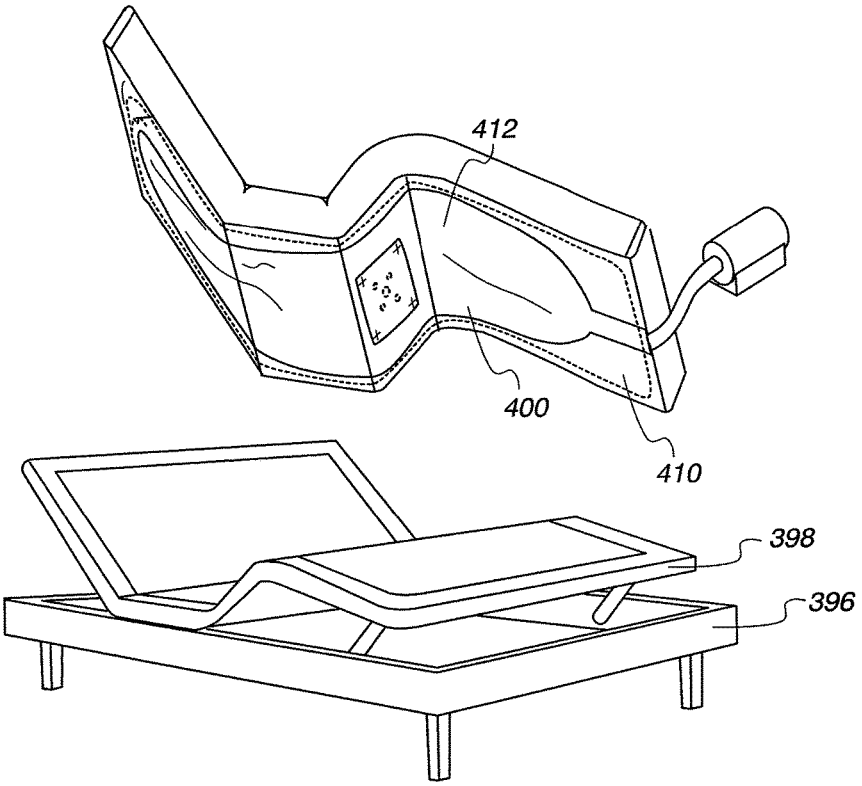

FIG. 124 is similar to FIG. 115 but shown with the single cover in accordance with the present invention embedded in the underside of the mattress.

Figure 125:
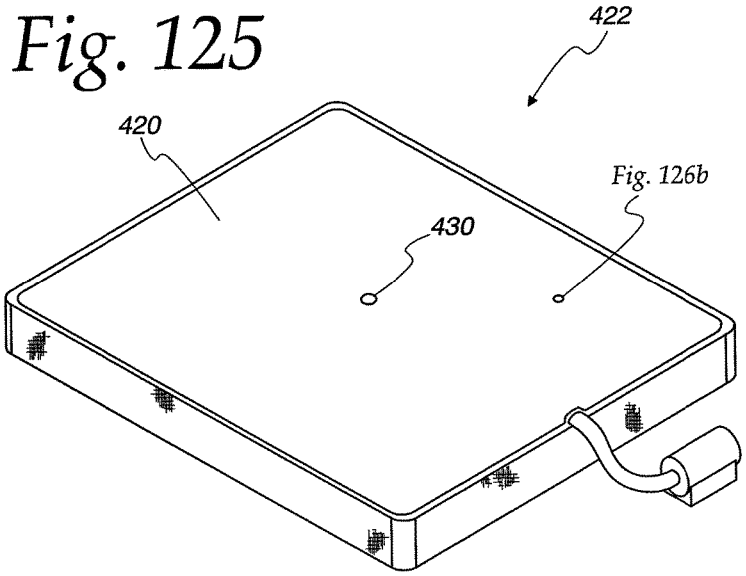

FIG. 125 illustrates a one-piece cover in accordance with the present invention having a rectangular stitch pattern that relies on the porosity of the cover to release air.

Figure 126:
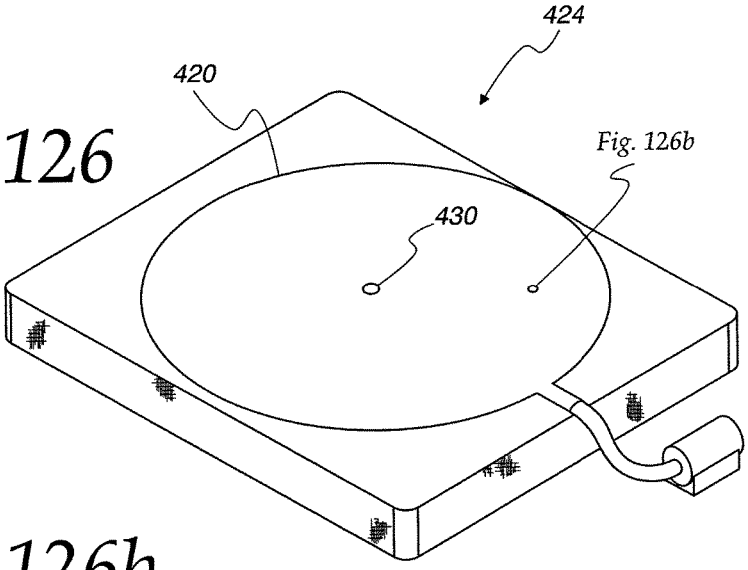

FIG. 126 is similar except a circular stitch pattern is illustrated.

Figure 126B:
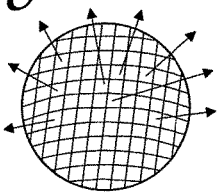

FIG. 126*b* illustrates air escape through a material with an exemplary porosity.

Figure 127:
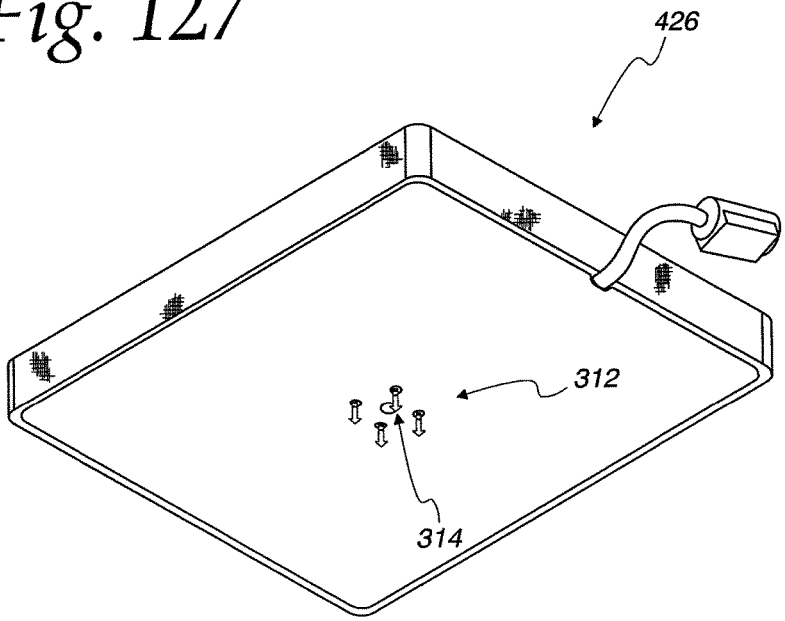

FIG. 127 is similar to FIG. 125 except the embodiment includes air exit holes for releasing air.

Figure 128:
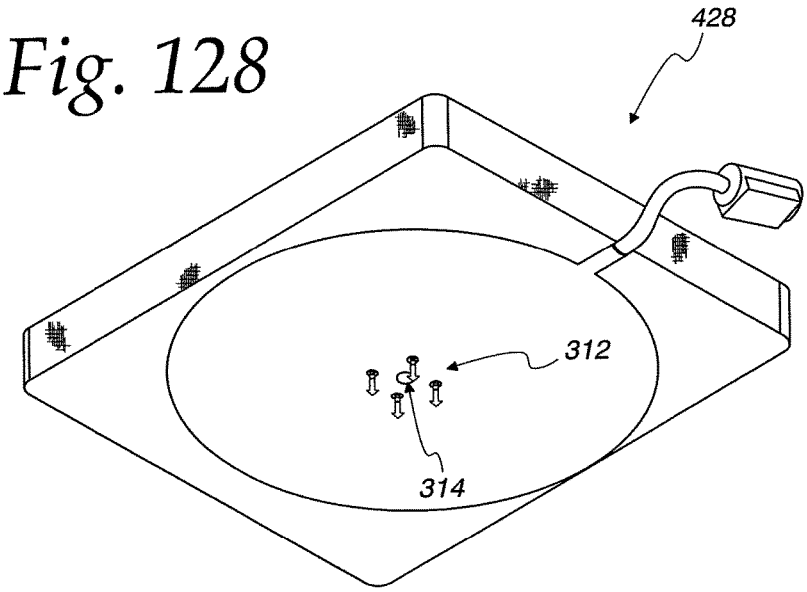

FIG. 128 is similar to FIG. 126 except the embodiment includes air exit holes for releasing air.

Figure 129:
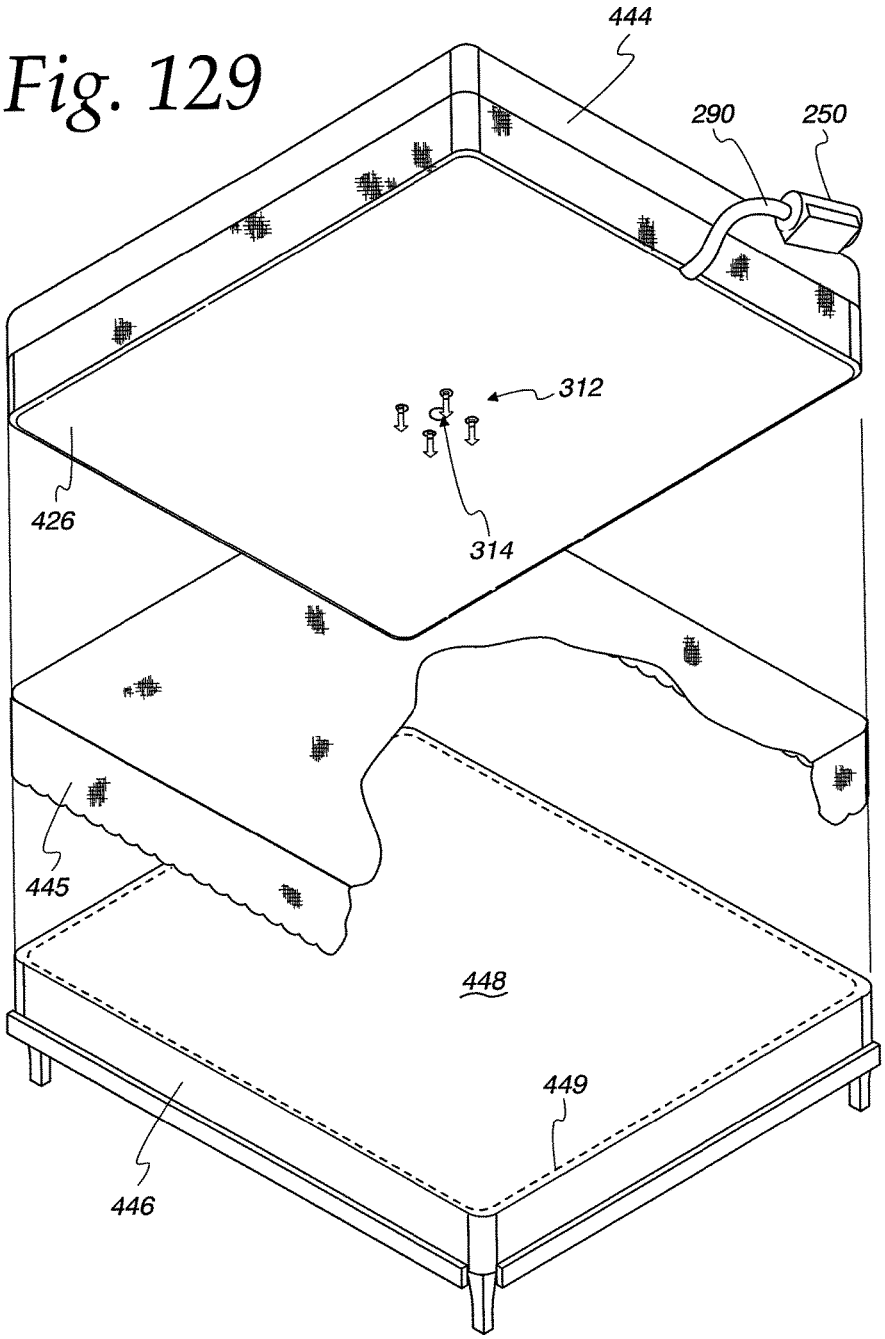

FIG. 129 is an exploded isomeric view of one embodiment of a mattress management system in accordance with the present invention illustrating a one piece cover with a rectangular stitch pattern attached to the underside of a mattress in an application which includes a bed skirt over the foundation.

Figure 130:
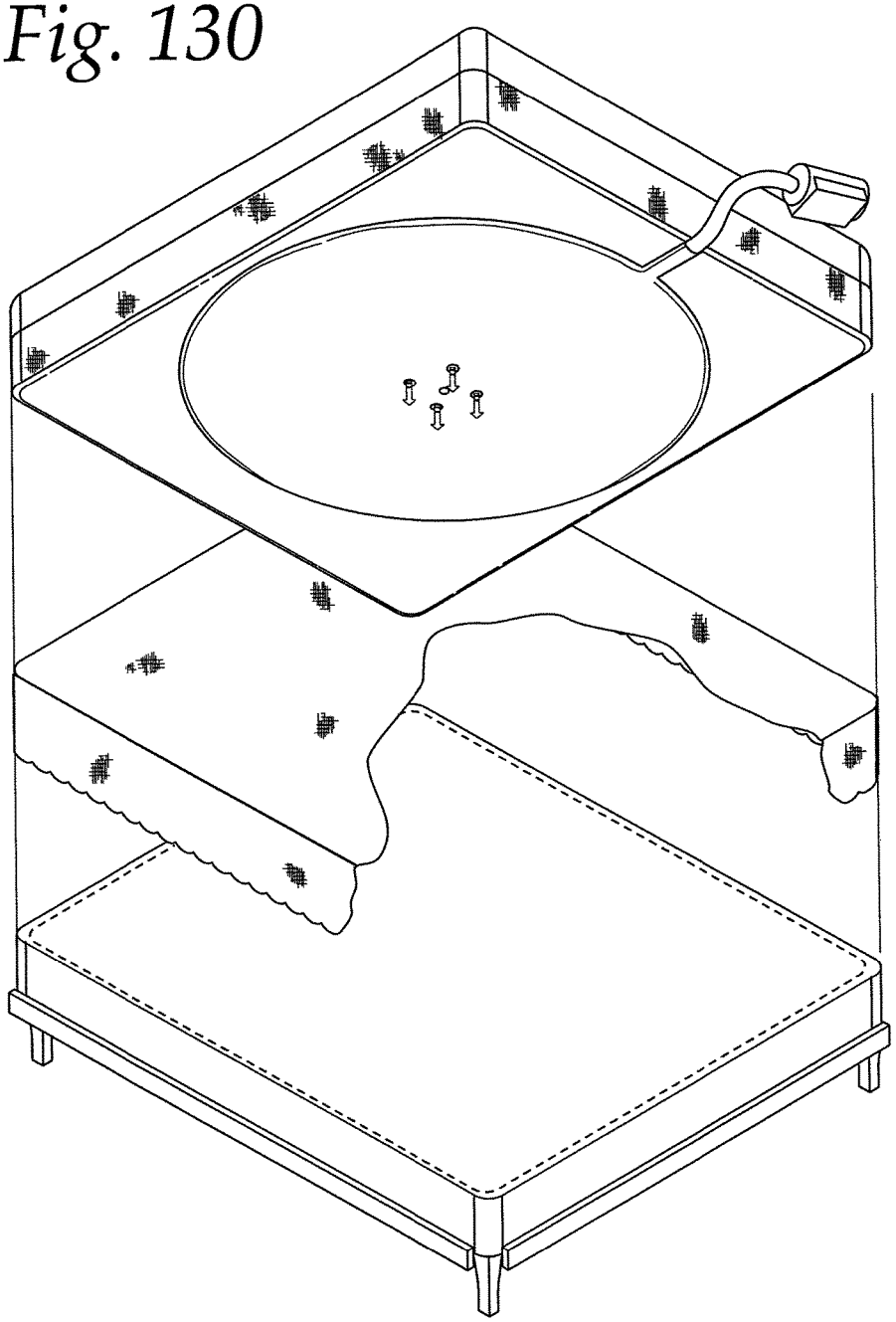

FIG. 130 is similar to FIG. 129 but illustrates a circular stitch pattern.

Figure 131:
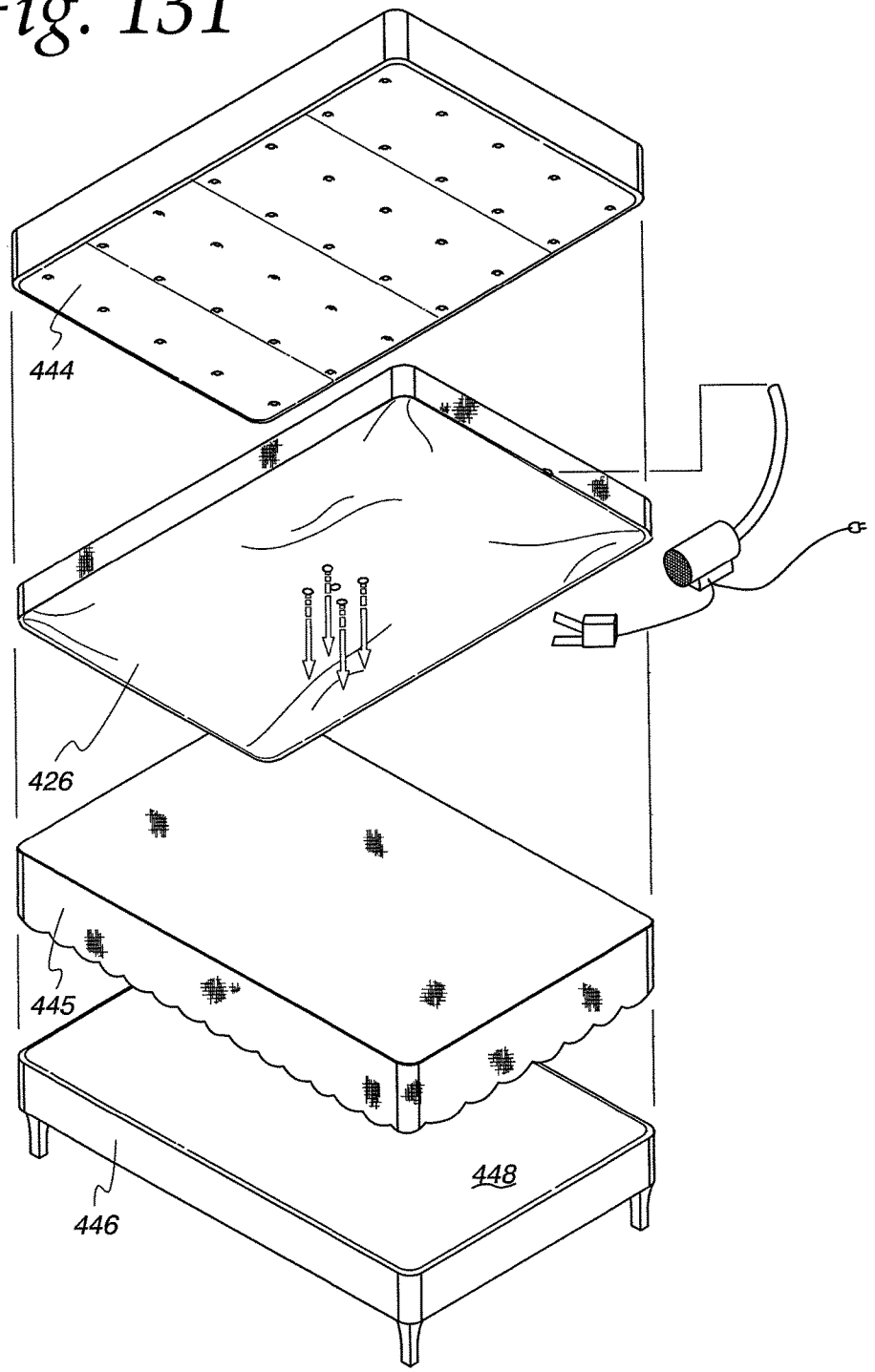

FIG. 131 is similar to FIG. 129 but illustrates the one-piece cover removed from the upper mattress and illustrates an alternate location for the air intake.

Figure 132:
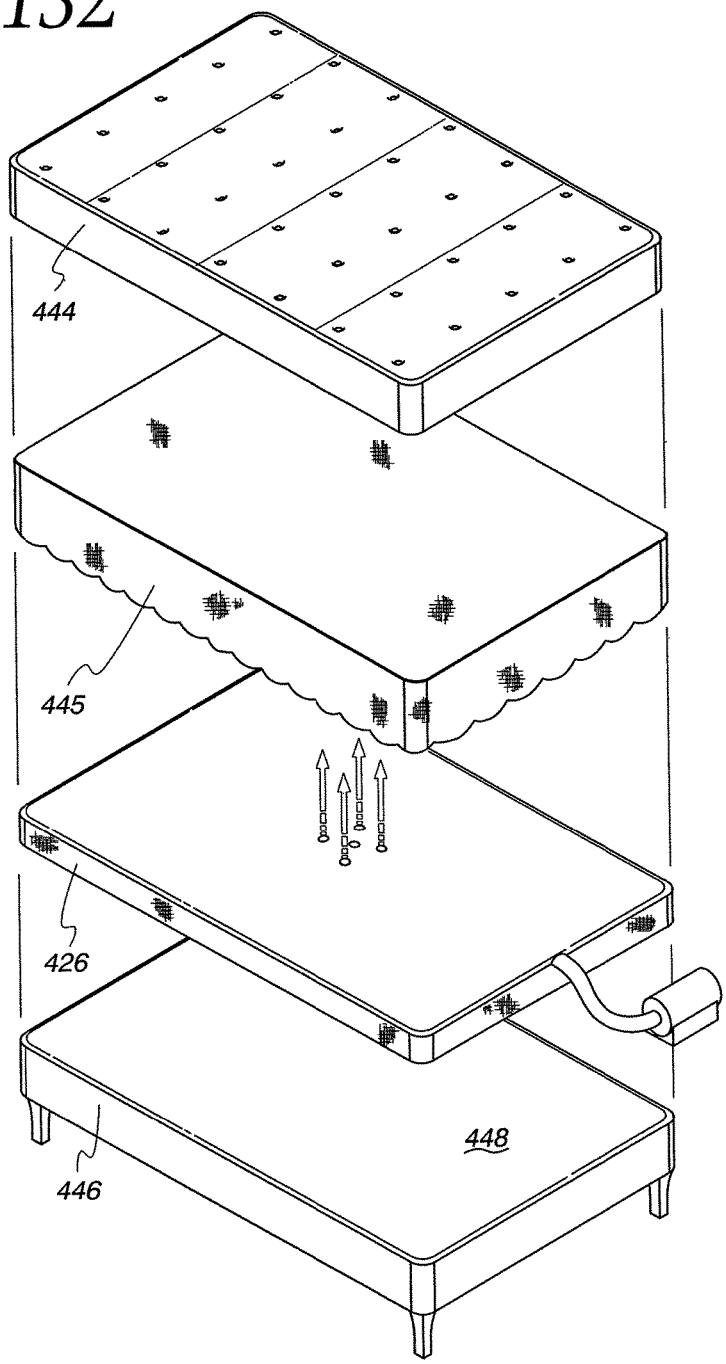

FIG. 132 is similar to FIG. 131 but illustrates the one-piece cover attached to the foundation so air blows up.

Figure 133:
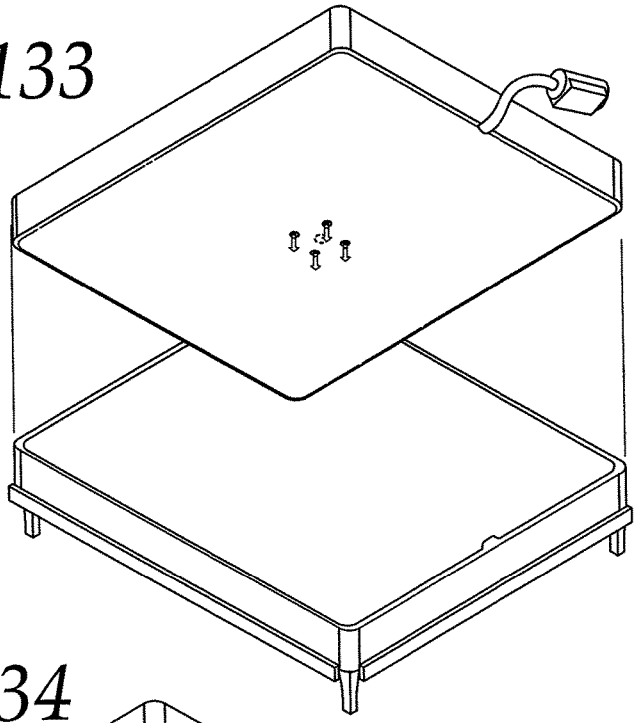

FIG. 133 is similar to FIG. 129 but built in and without a bed skirt.

Figure 134:
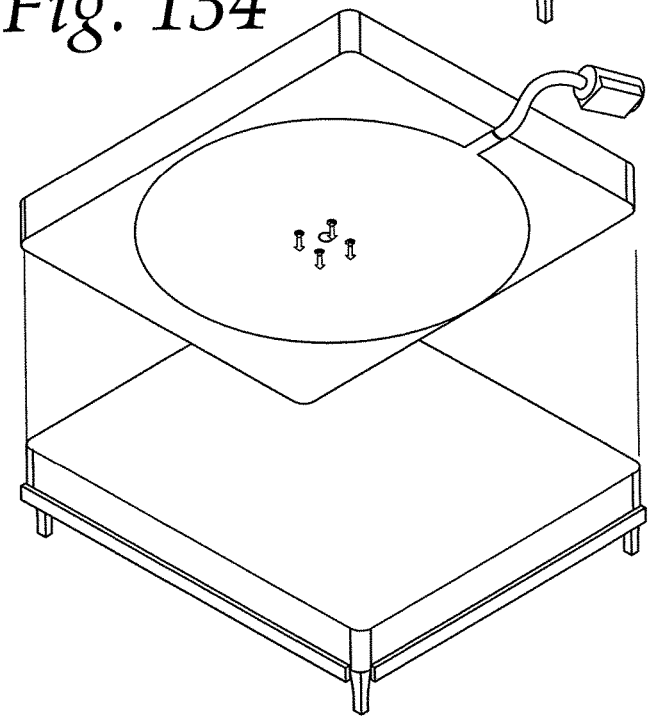

FIG. 134 is similar to FIG. 130 but built in and without a bed skirt.

Figure 135A:
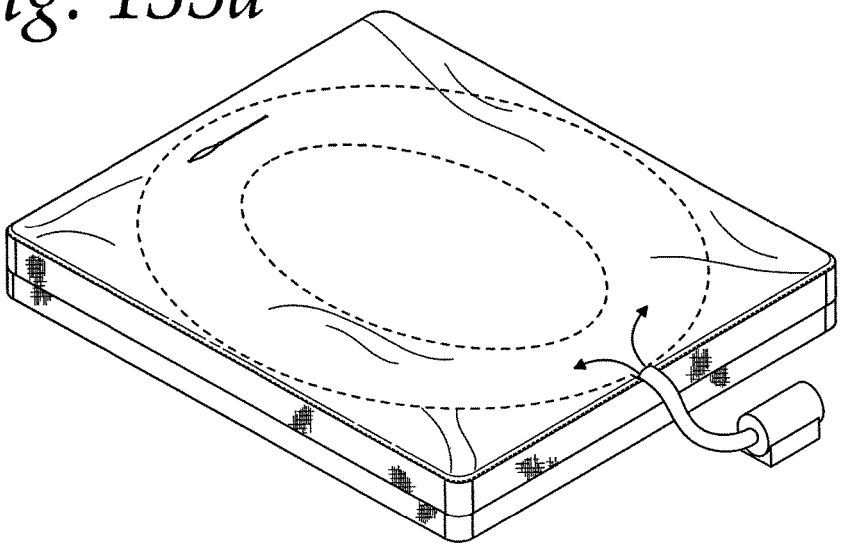

FIG. 135*a* is an isometric view of a one-piece cover in accordance with the present invention with an oval stitch pattern.

Figure 135B:
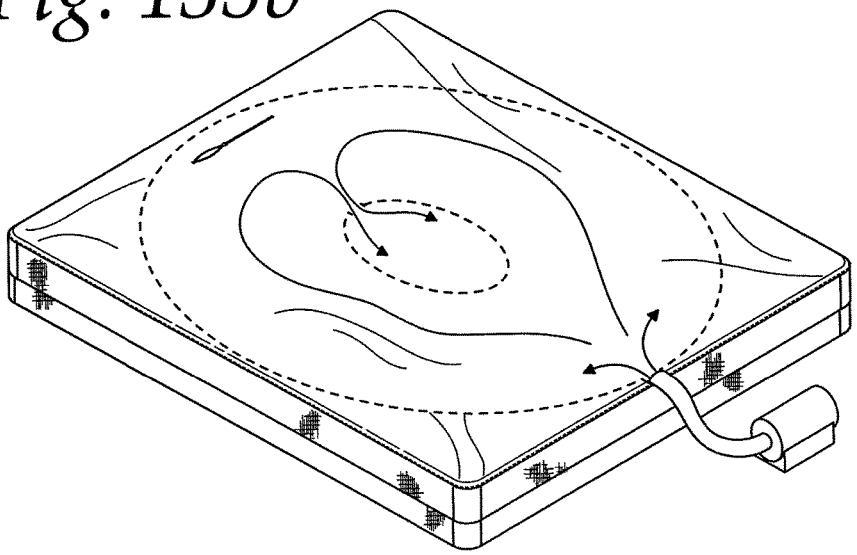

FIG. 135*b* is similar to FIG. 135*a* but with a different stitch pattern and showing the air flow through the inflatable volume.

Figure 135C:
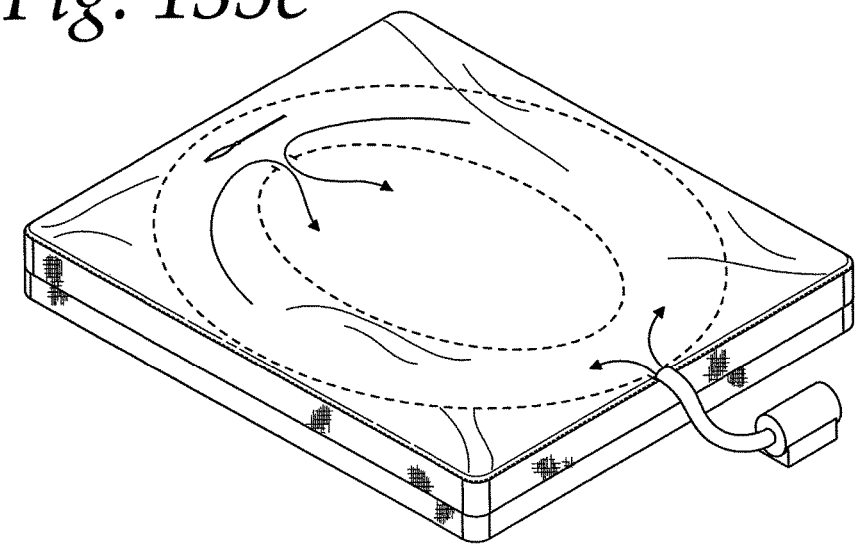

FIG. 135*c* is similar to FIG. 135*a* but showing the air flow through the inflatable volume.

Figure 136A:
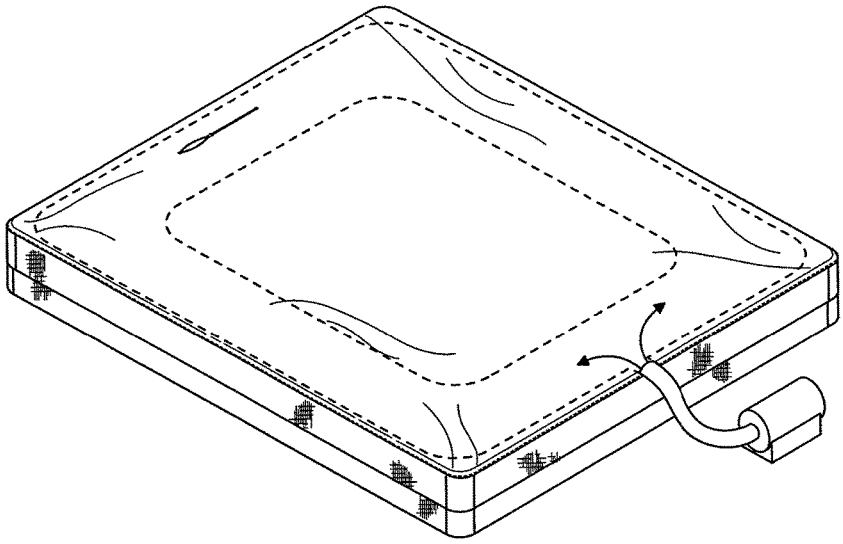

FIG. 136*a* is similar to FIG. 135*a* but with a rectangular donut stitch pattern with no air exit holes but with one embodiment of an adjustable air exit valve.

Figure 136B:
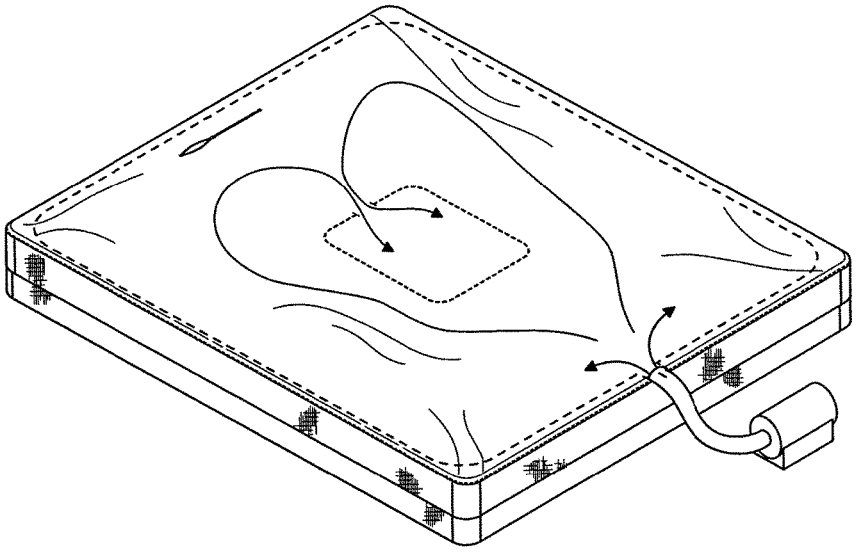

FIG. 136*b* is similar to FIG. 136*a* but with a different stitch pattern and showing the air flow through the inflatable volume.

Figure 136C:
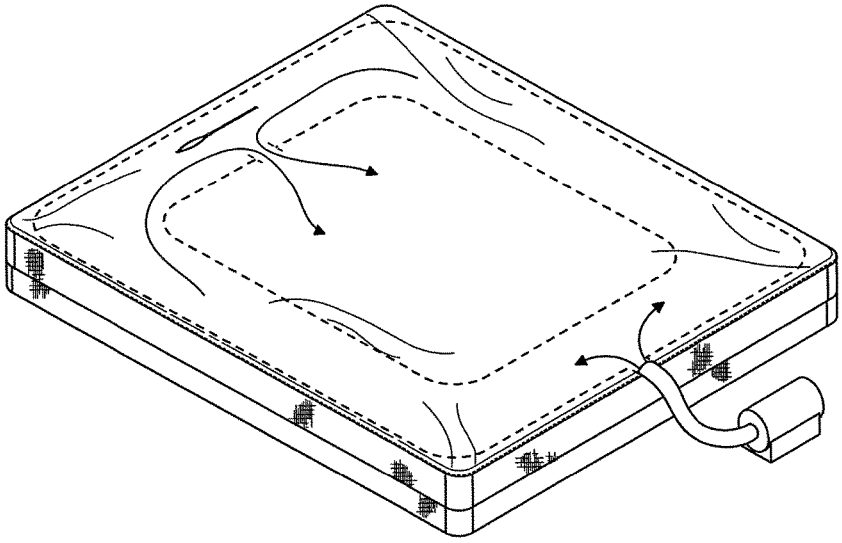

FIG. 136*c* is similar to FIG. 136*a* but showing the air flow through the inflatable volume.

Figure 137:
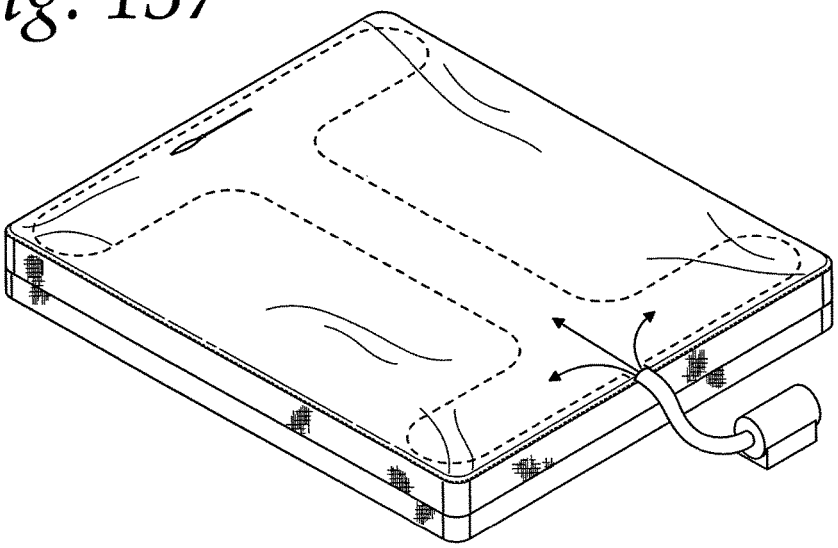

FIG. 137 is similar to FIG. 135*a* but with a capital I stitch pattern.

Figure 138:
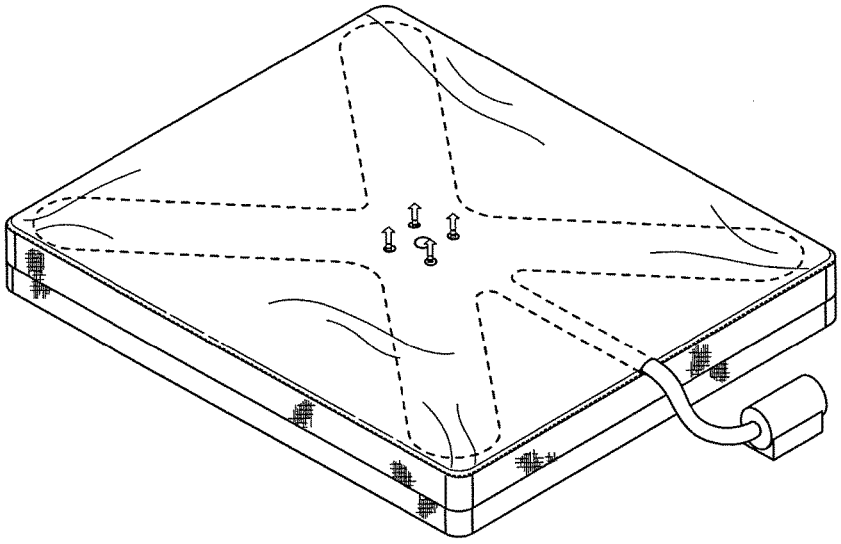

FIG. 138 is similar to FIG. 135*a* but with a capital X stitch pattern but illustrating air exit holes and without an adjustable air exit valve.

Figure 78:
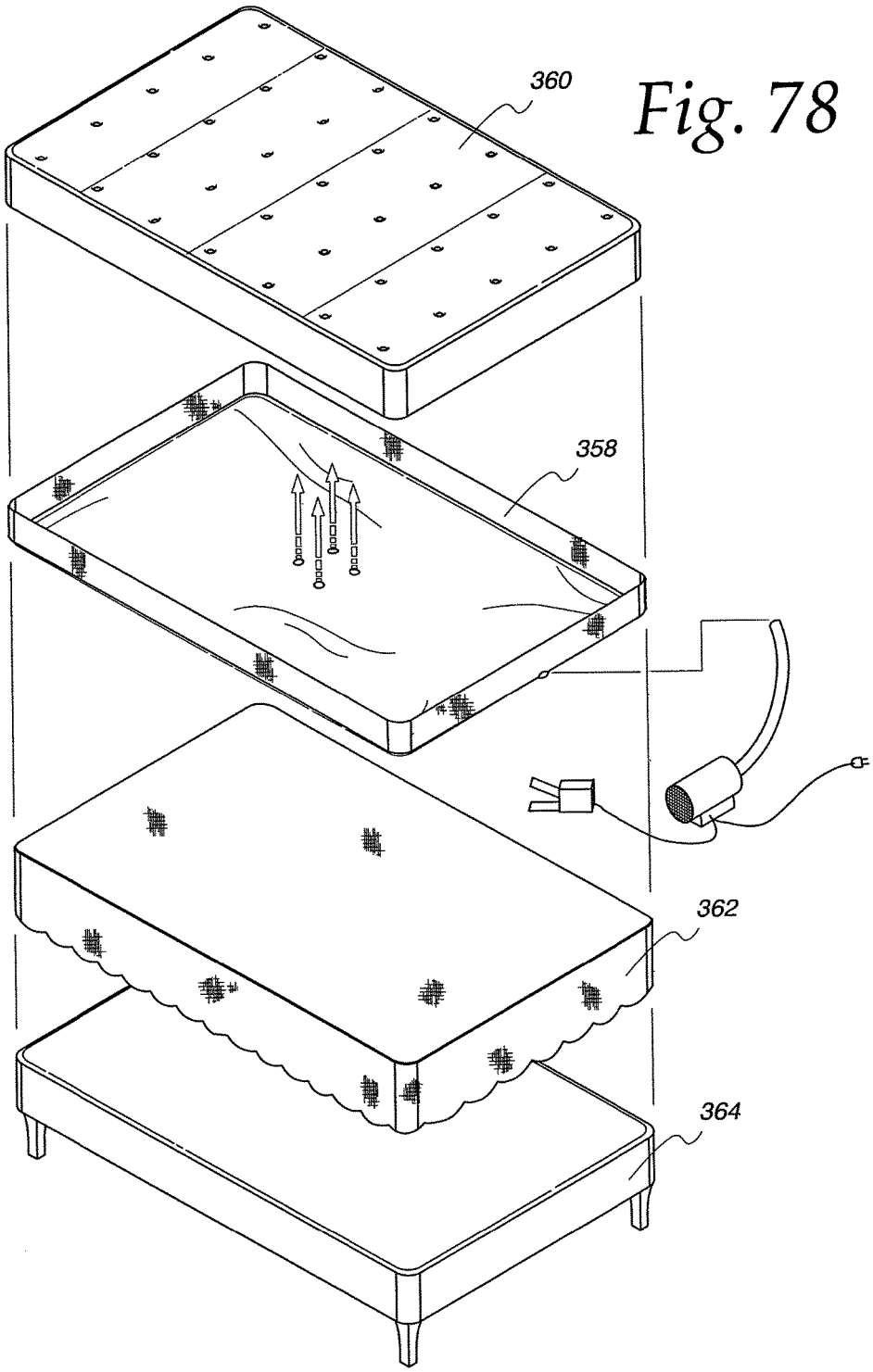
FIG. 78 is an exploded perspective of the installed embodiment illustrated in FIG. 77.

FIGS. 139*a*, 139*b*, and FIGS. 139*d*-139*g* are similar to FIG. 78 in which the inflatable air volume is embedded in the underside of the mattress and shown with attachment members on both the cover and the mattress for selectively securing the cover to the mattress.

Figure 95:
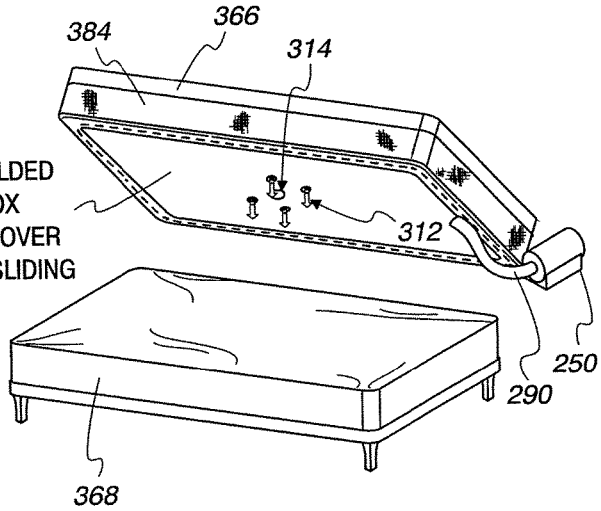
FIG. 95 is similar to FIG. 94 but shown with the cover in accordance with the present invention embedded in the underside of the mattress.

FIG. 139*c* and FIGS. 139*h*-139*j* are similar to FIG. 95.

Figure 139A:
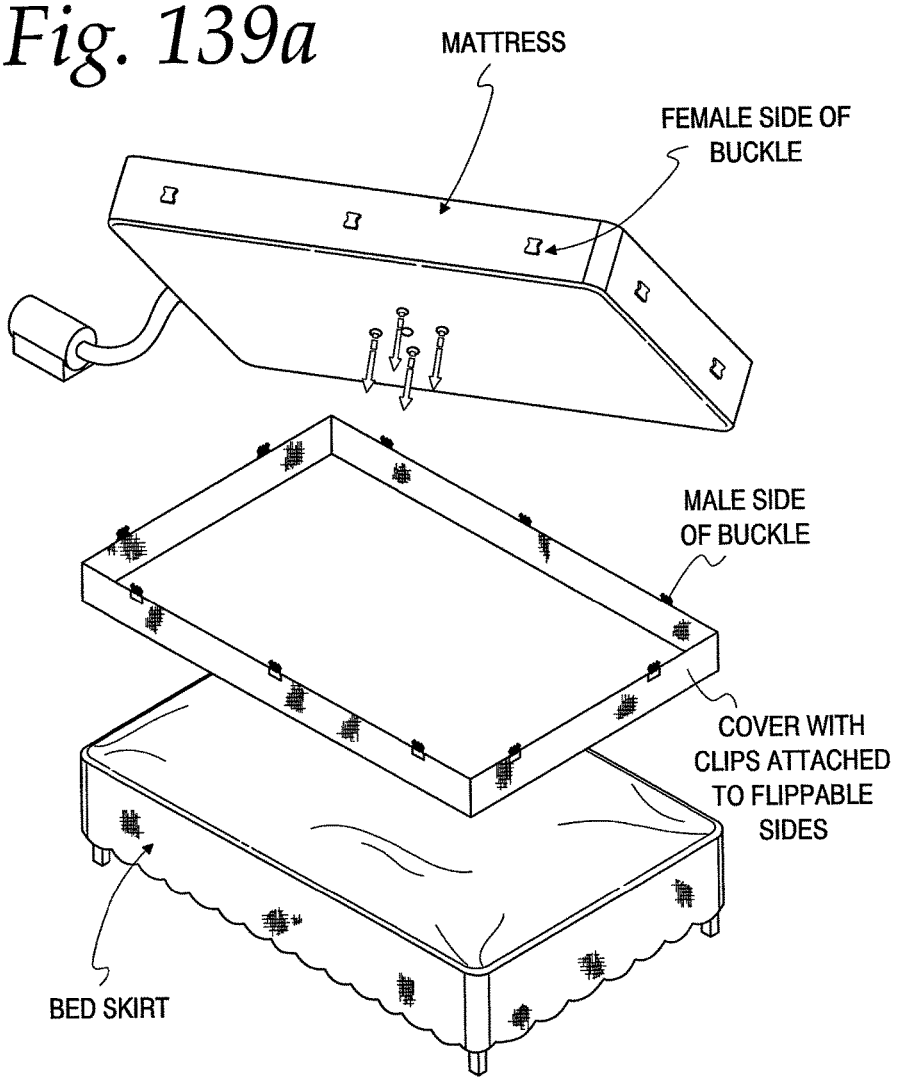
Figure 139B:
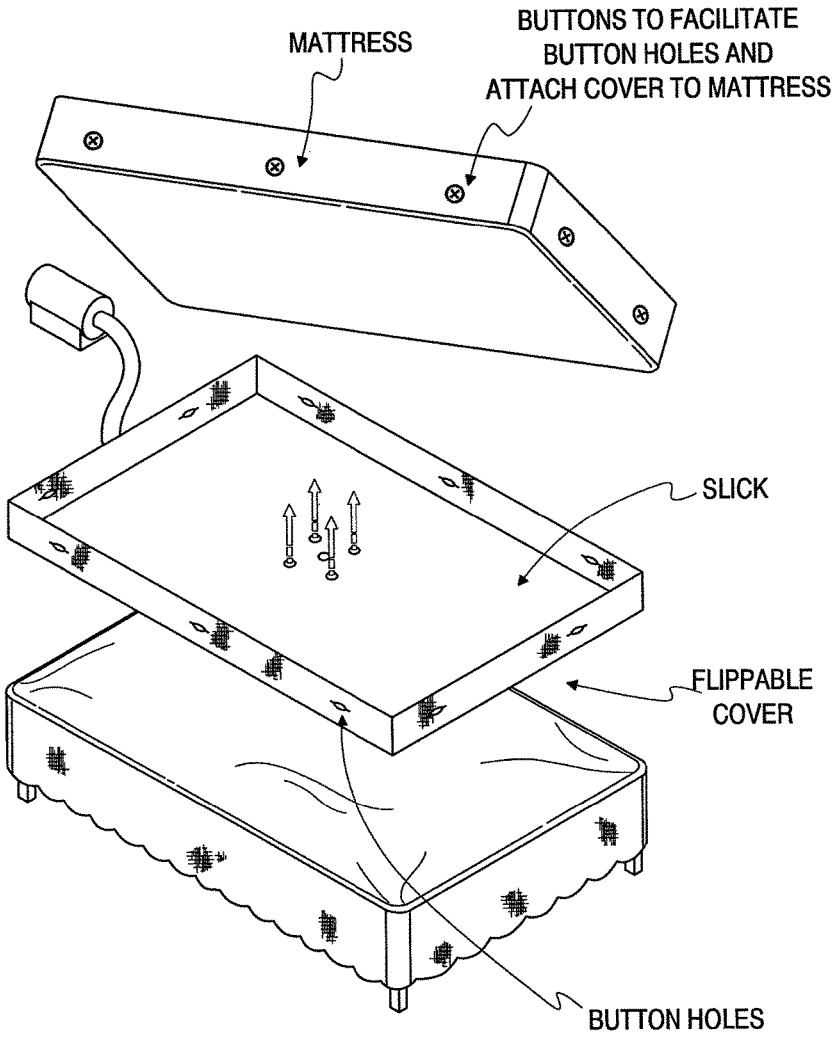
Figure 139C:
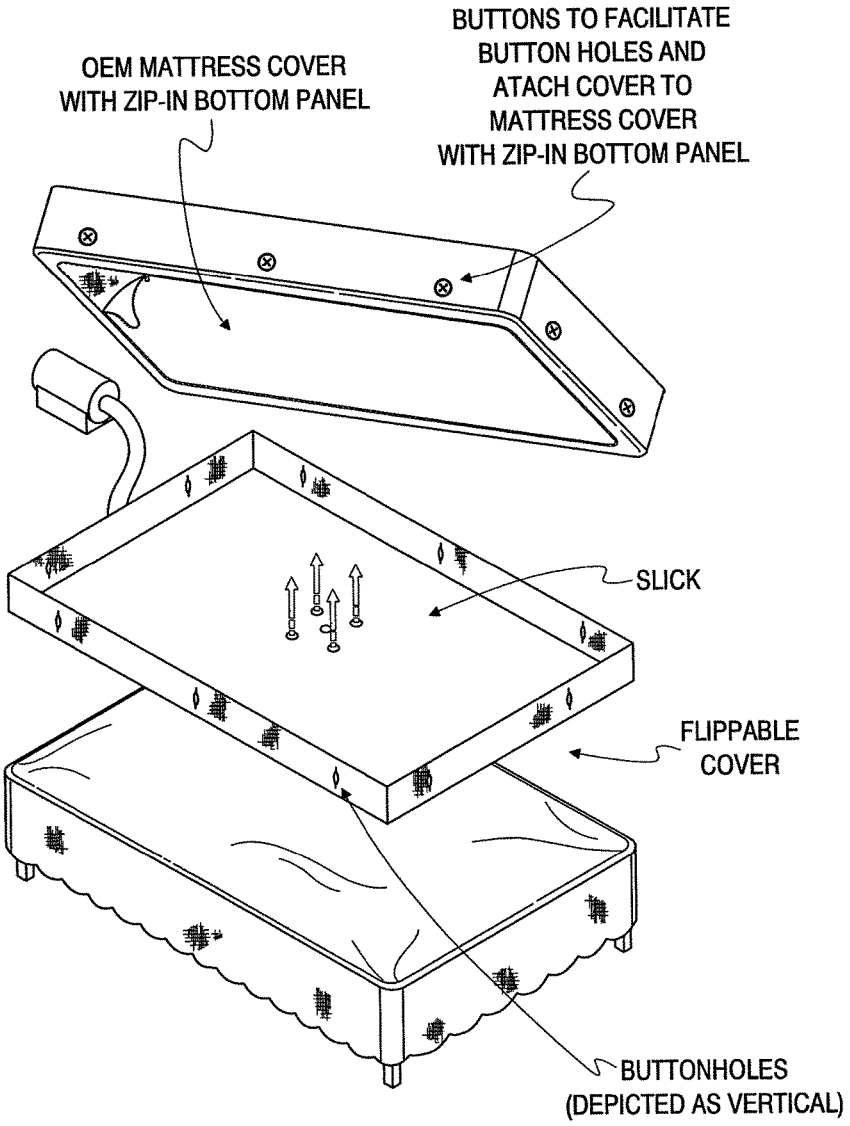
Figure 139D:
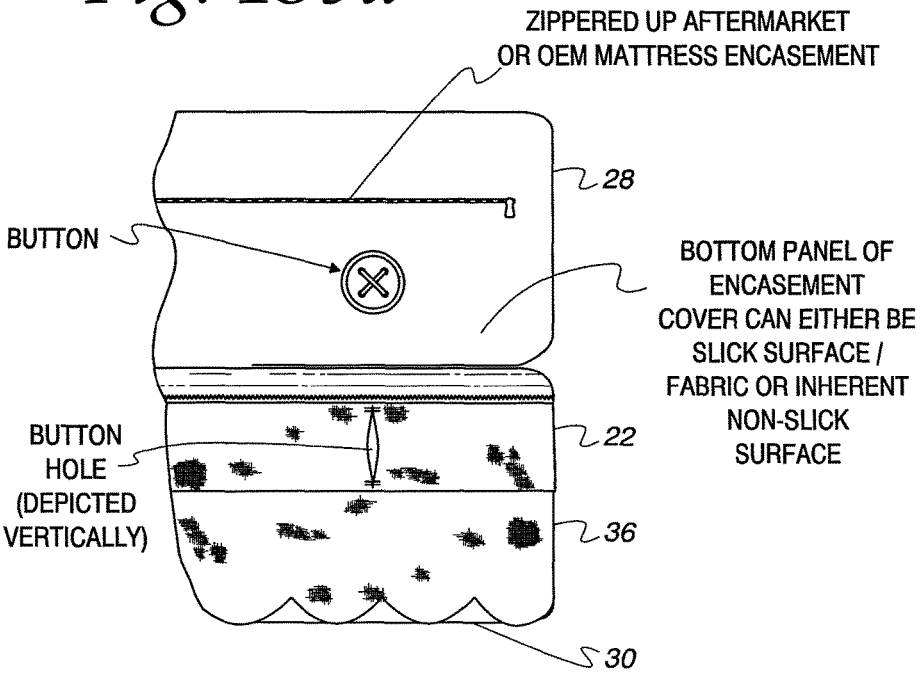
Figure 139E:
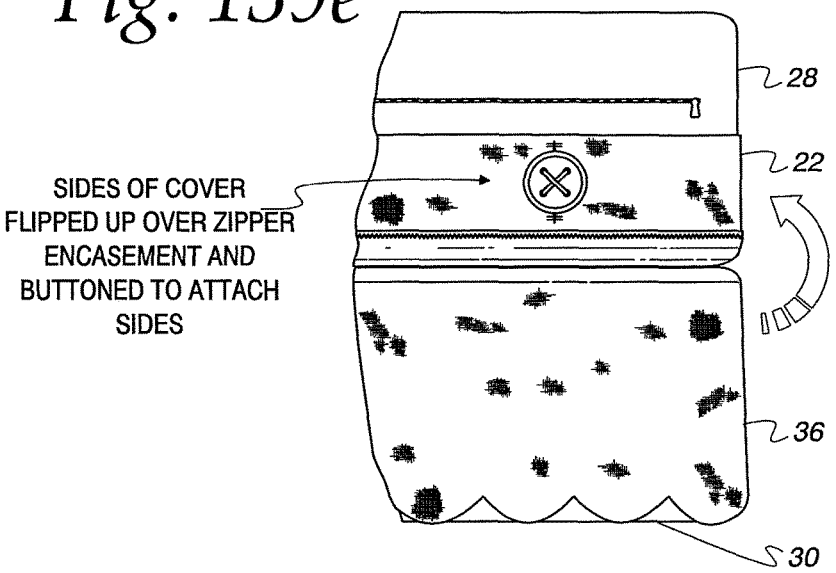
Figure 139F:
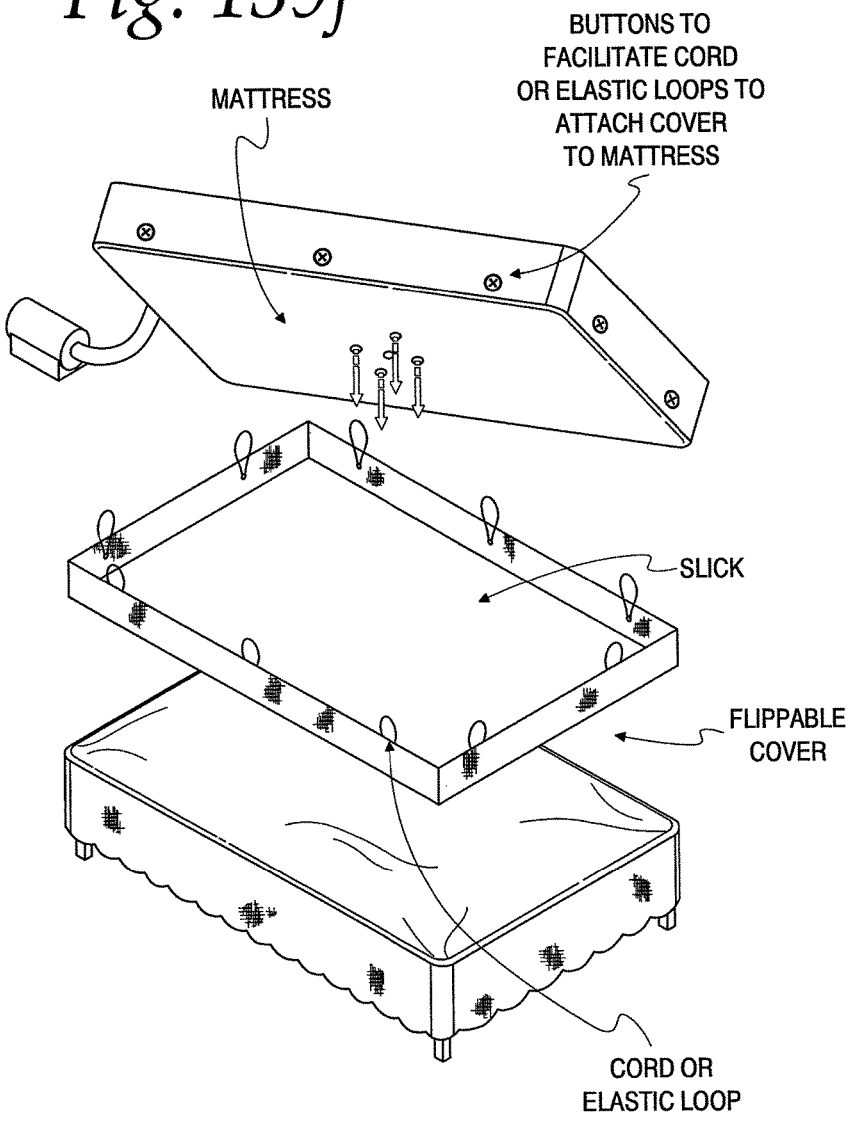
Figure 139G:
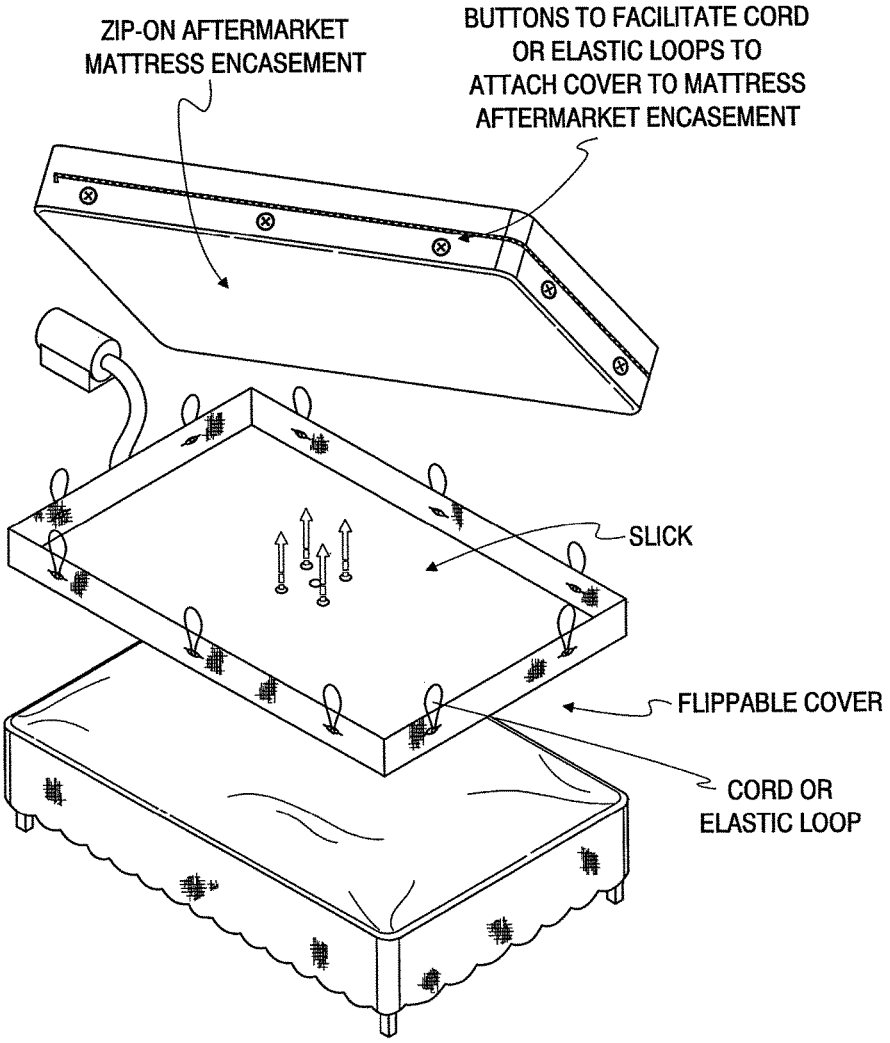
Figure 139H:
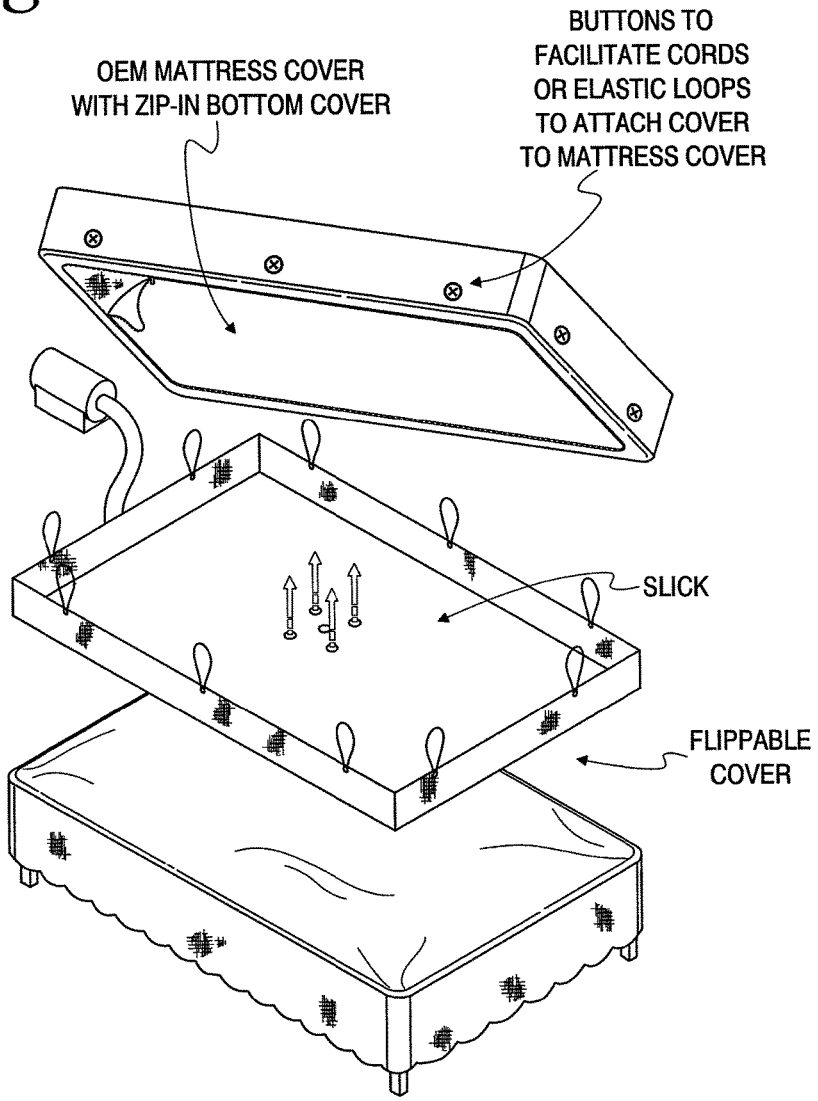
Figure 139I:
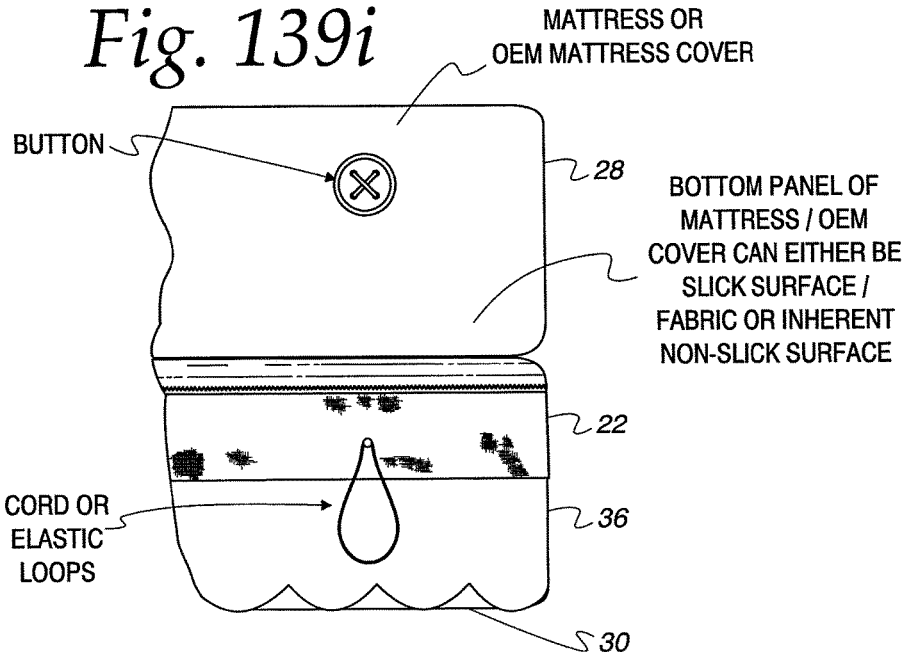
Figure 139J:
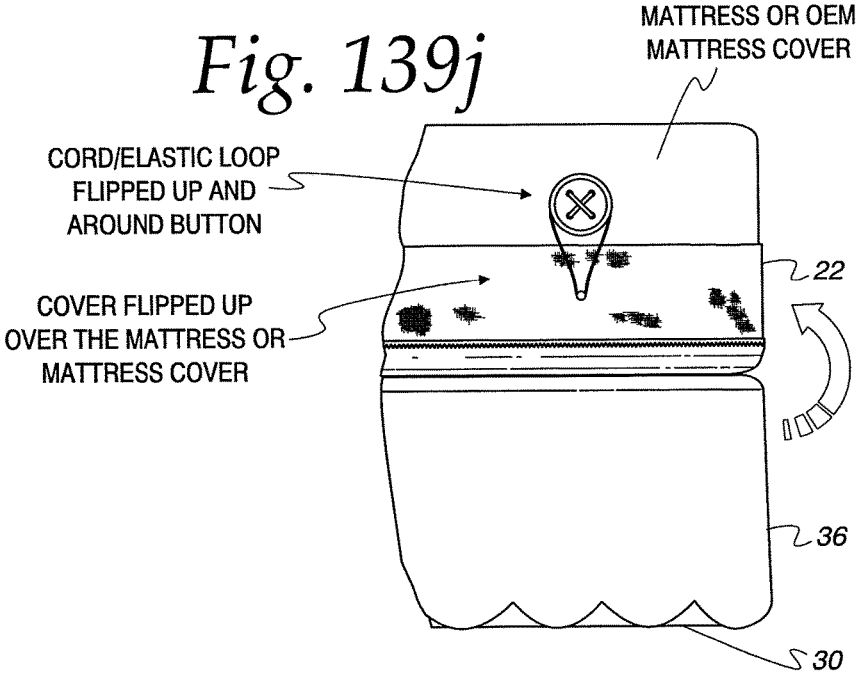
Figure 139K:
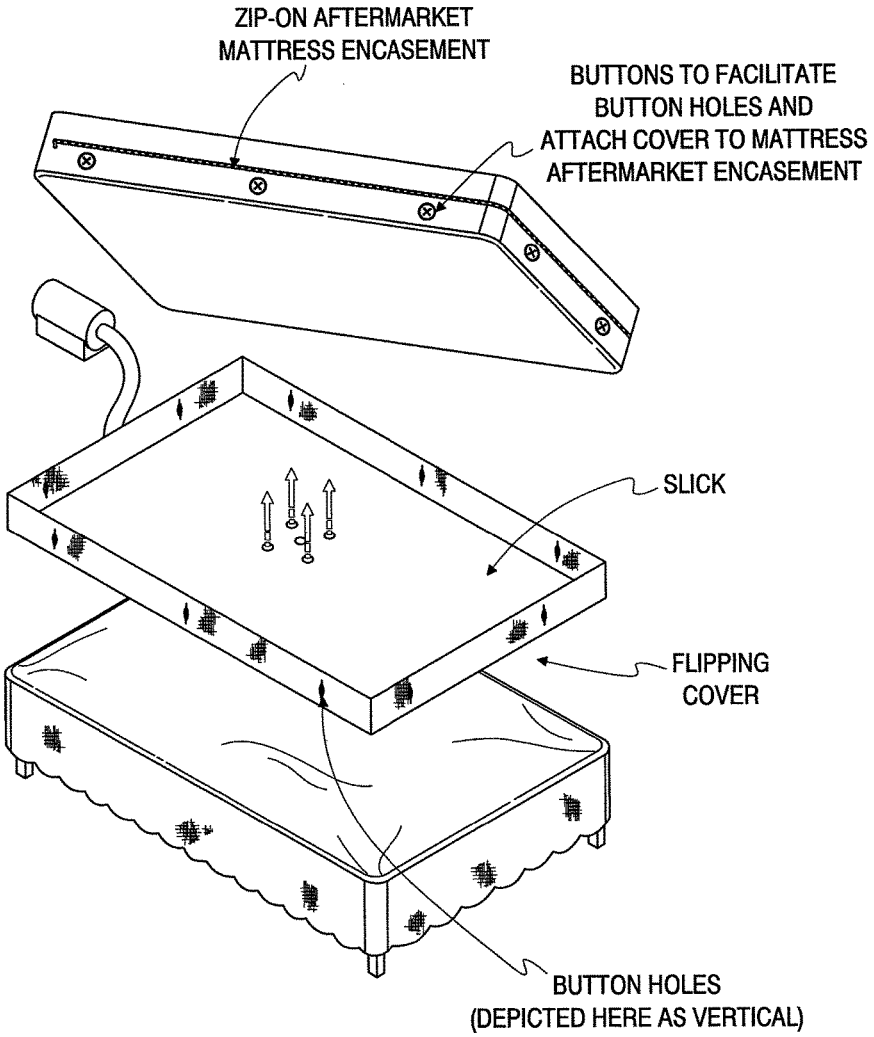

FIG. 139*k* is an exploded isometric view illustrating an embodiment in which the mattress is encased in an encasement and a flappable cover is configured to be attached to the encasement.

Figure 140A:
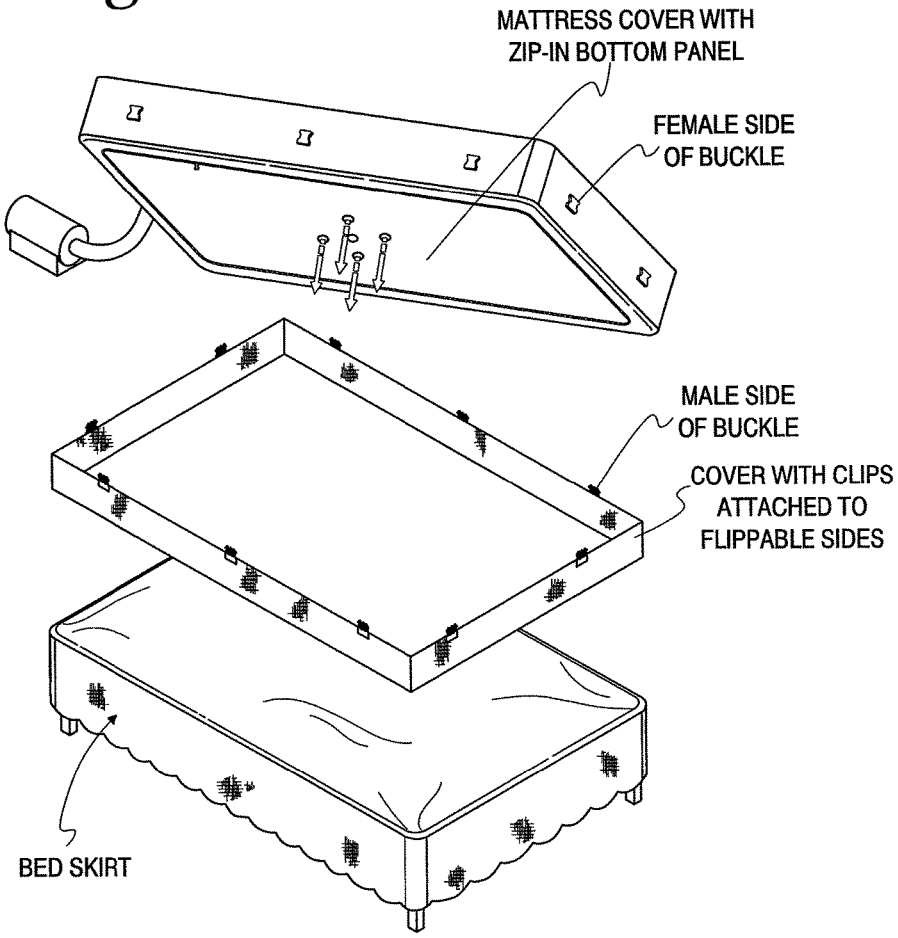
Figure 140B:
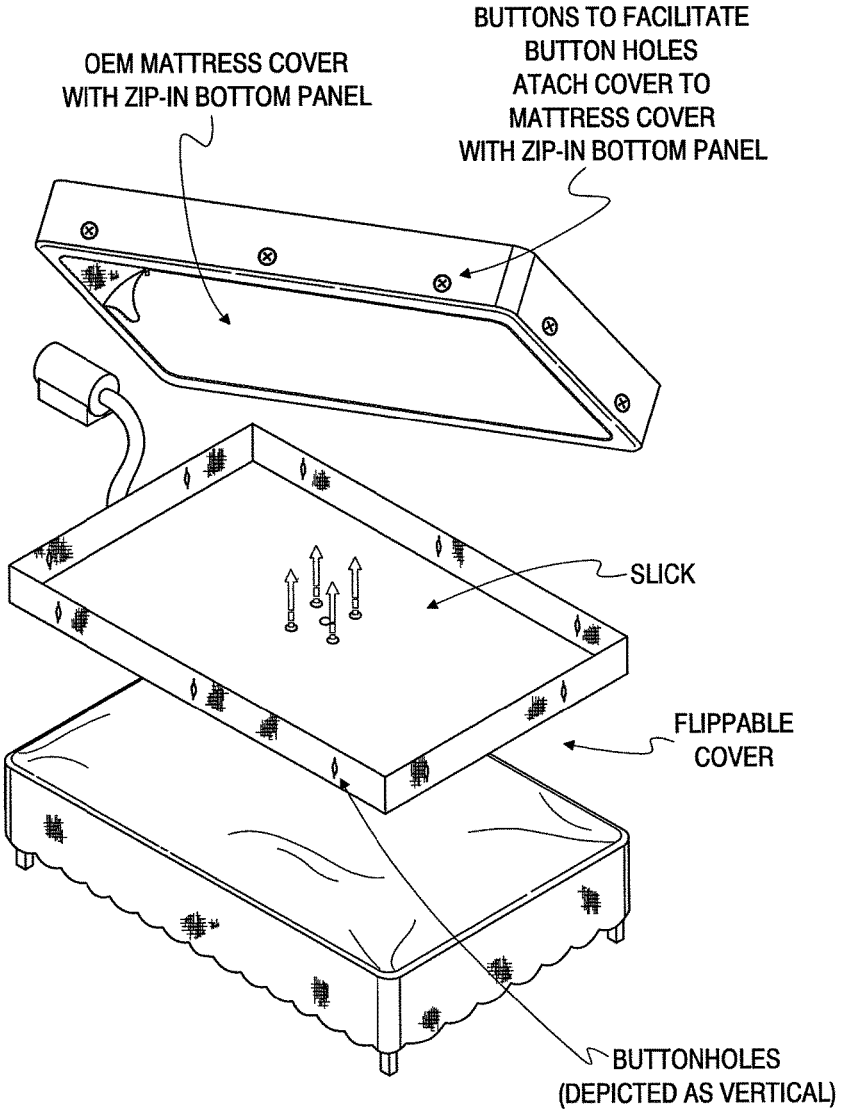

FIGS. 140*a*-140*b* are similar to FIG. 95 but are shown and shown with attachment members on both the cover and the mattress for selectively securing the cover to the mattress.

Figure 24A:
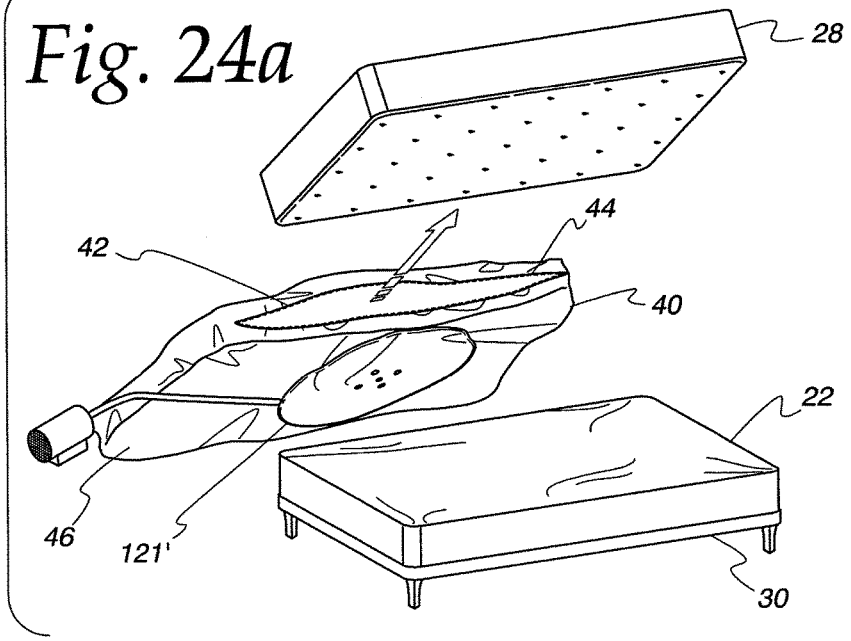
FIG. 24*a* illustrates an alternate embodiment of the invention in which the mattress cover is a protective cover or encasement having at least one slick surface, shown with the protective cover removed from the mattress and the mattress suspended relative to the box spring, shown with an air pump and conduit attached to the encasement.
Figure 25A:
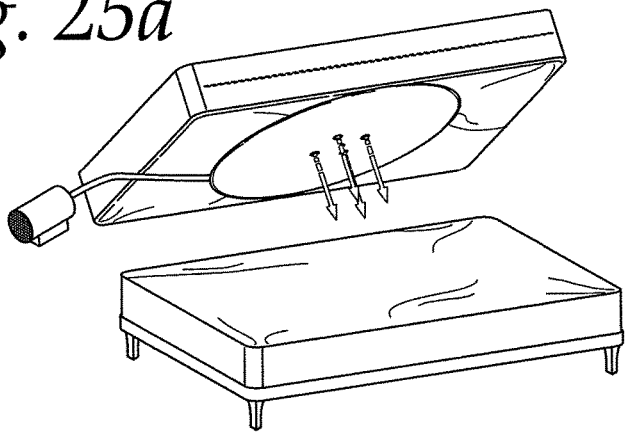
FIG. 25*a* is similar to FIG. 9*b* but shown with the protective cover installed on the mattress
Figure 141A:
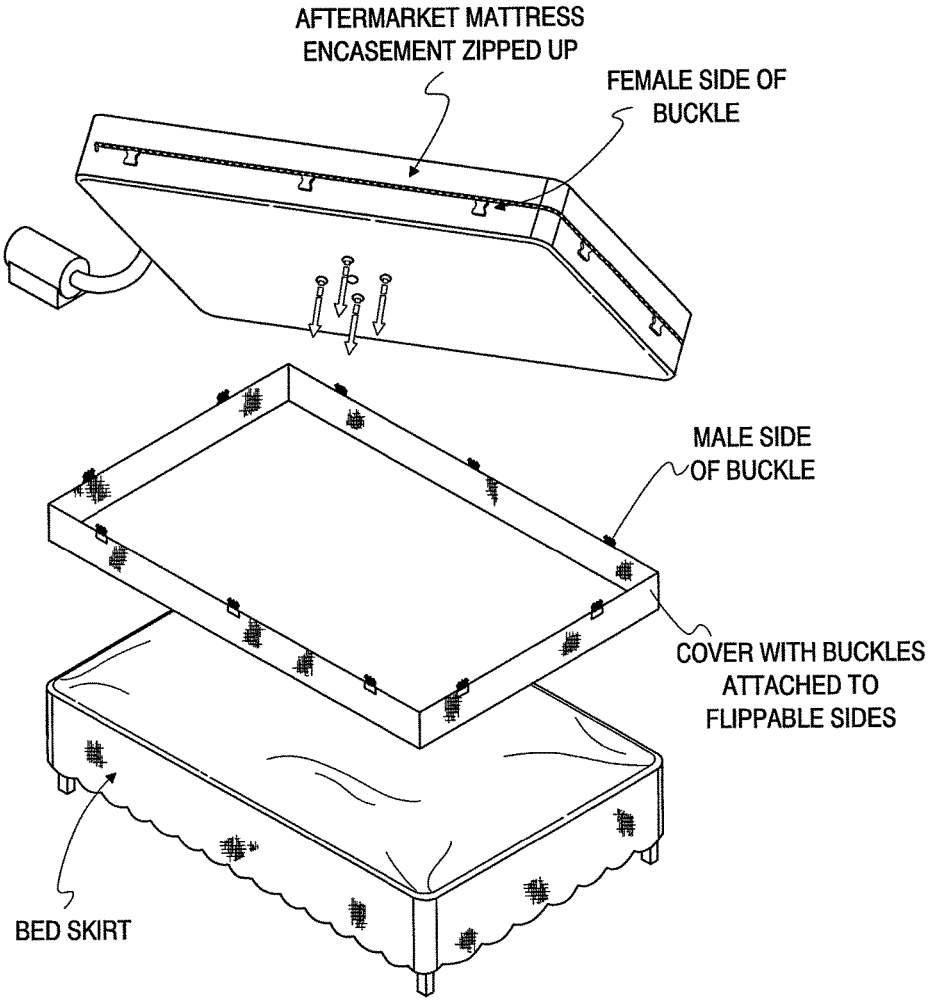
Figure 141B:
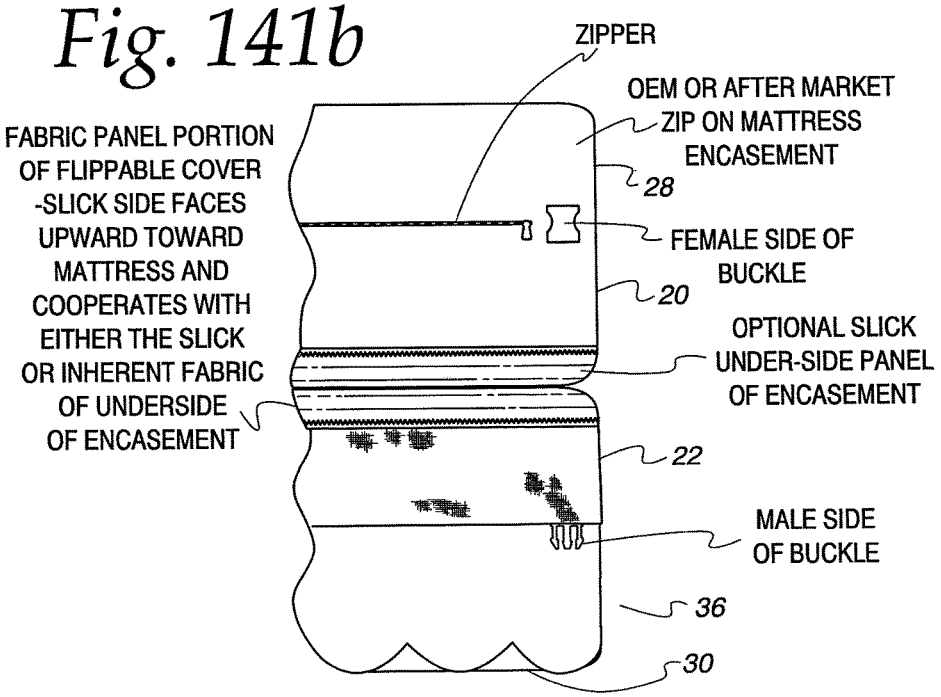
Figure 141C:
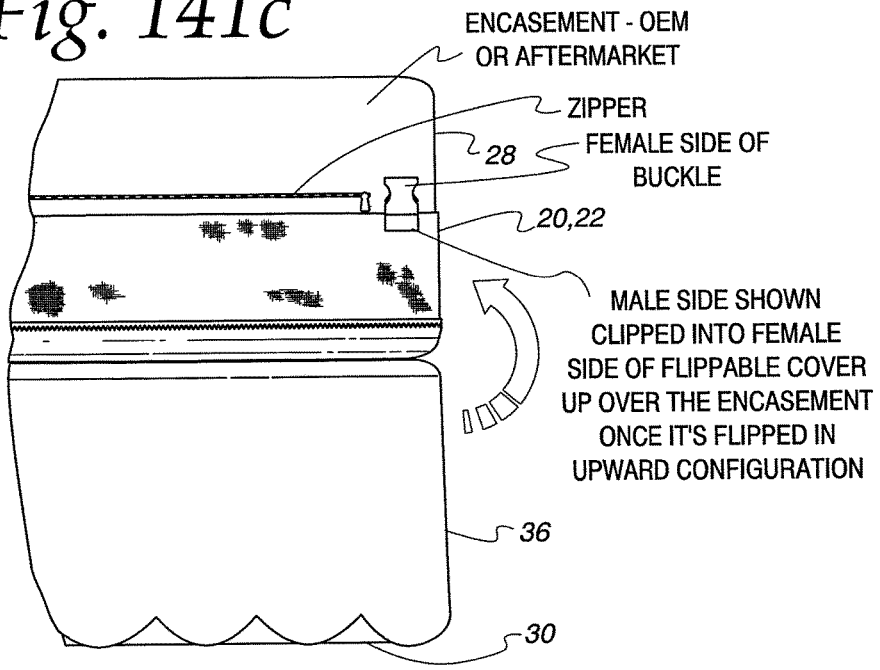

FIGS. 141*a*-141*c* are similar to FIGS. 140*a* and 140*b* but illustrate an embodiment in which the mattress is encased in an encasement similar to FIG. 24*a*.

Figure 142A:
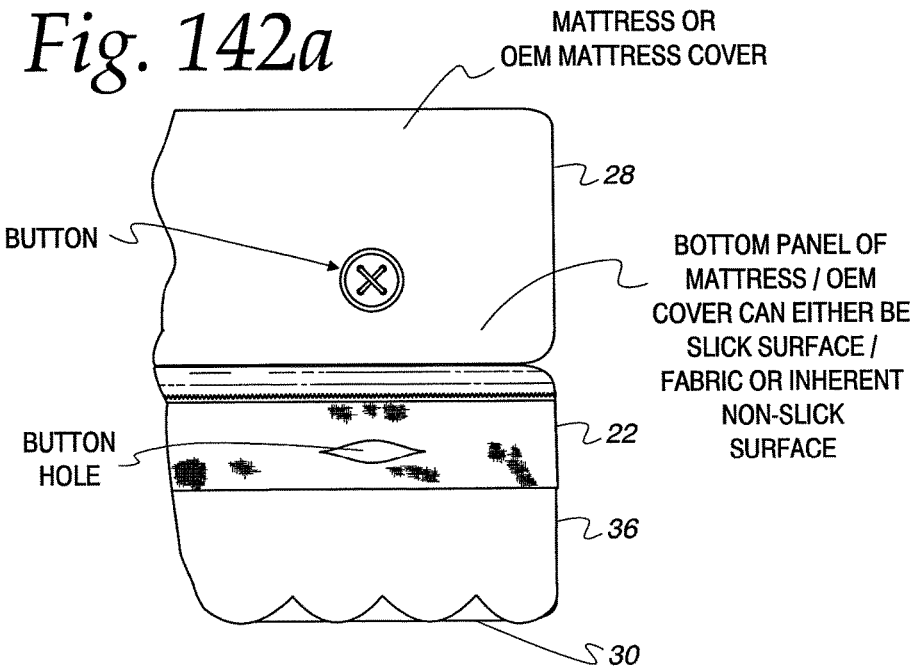
Figure 142B:
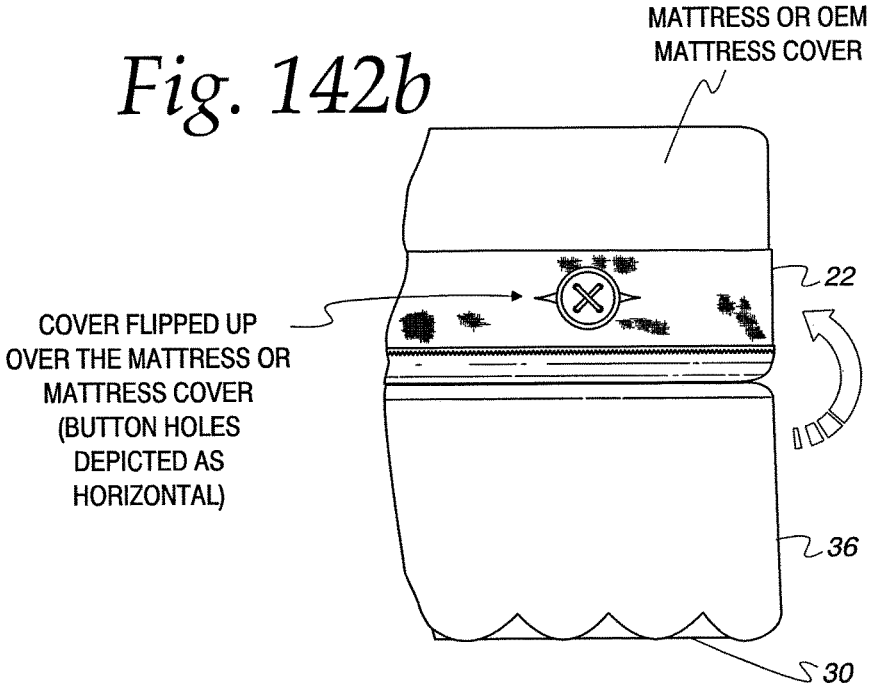

FIGS. 142*a* and 142*b* are similar to FIGS. 141*a*-141*c* but illustrate a different method for securing the foundation to the mattress.

Figure 16:
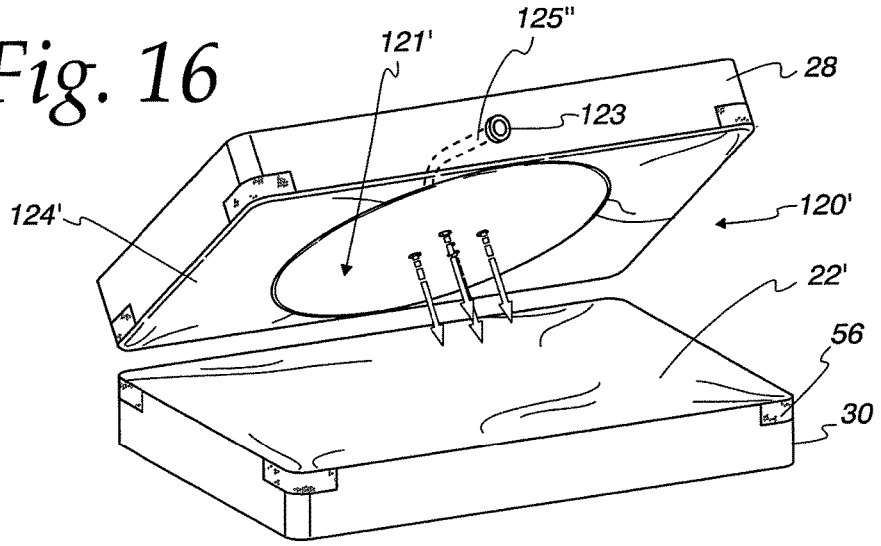
FIG. 16 is an alternate embodiment of the invention in which slick surfaces are integrated into both the mattress and box spring along with a portion of the levitation device, shown with the mattress removed from the box spring and fastener strips integrated into the corners of the mattress and box spring.
Figure 17:
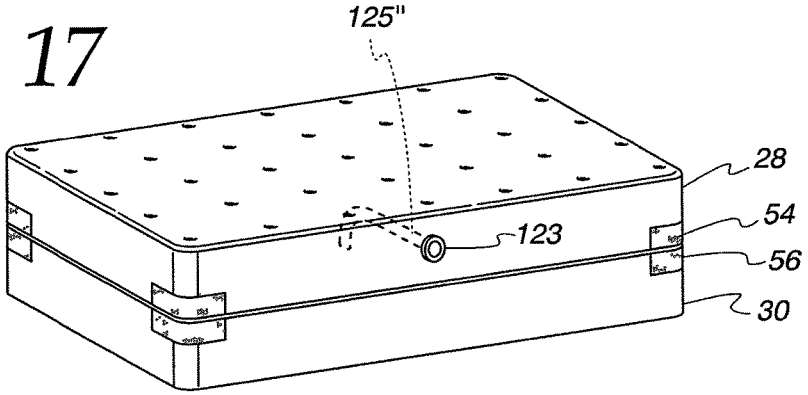
FIG. 17 is similar to FIG. 16 but shown with the mattress placed on the box spring illustrating integrated fastener strips aligned with one another.
Figure 18:
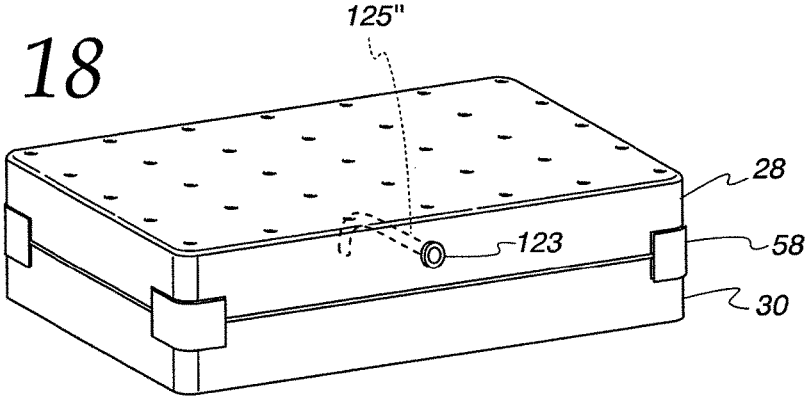
FIG. 18 is similar to FIG. 17, illustrating cooperating removable fastener strips attached to the integrated fastener strips in order to secure the mattress to the box spring.
Figure 143:
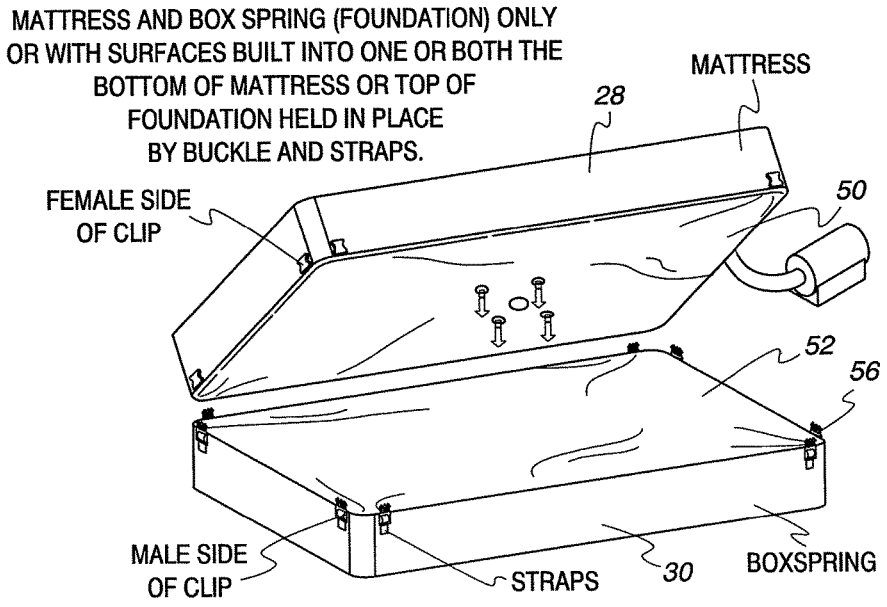
Figure 144A:
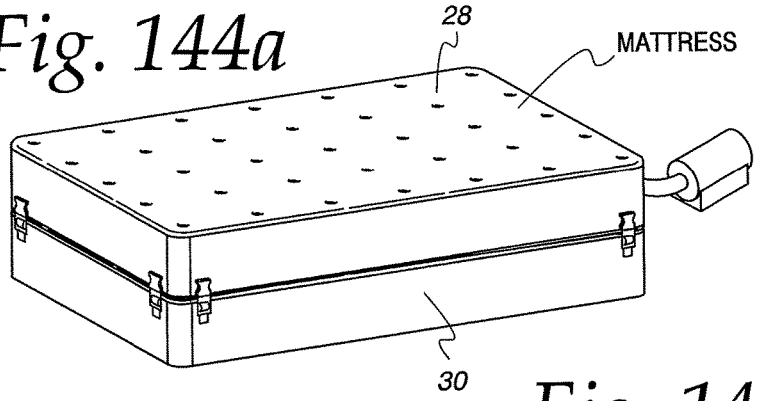
Figure 144B:
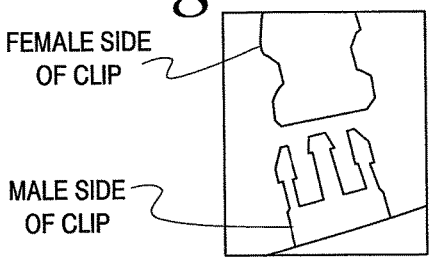
Figure 145:
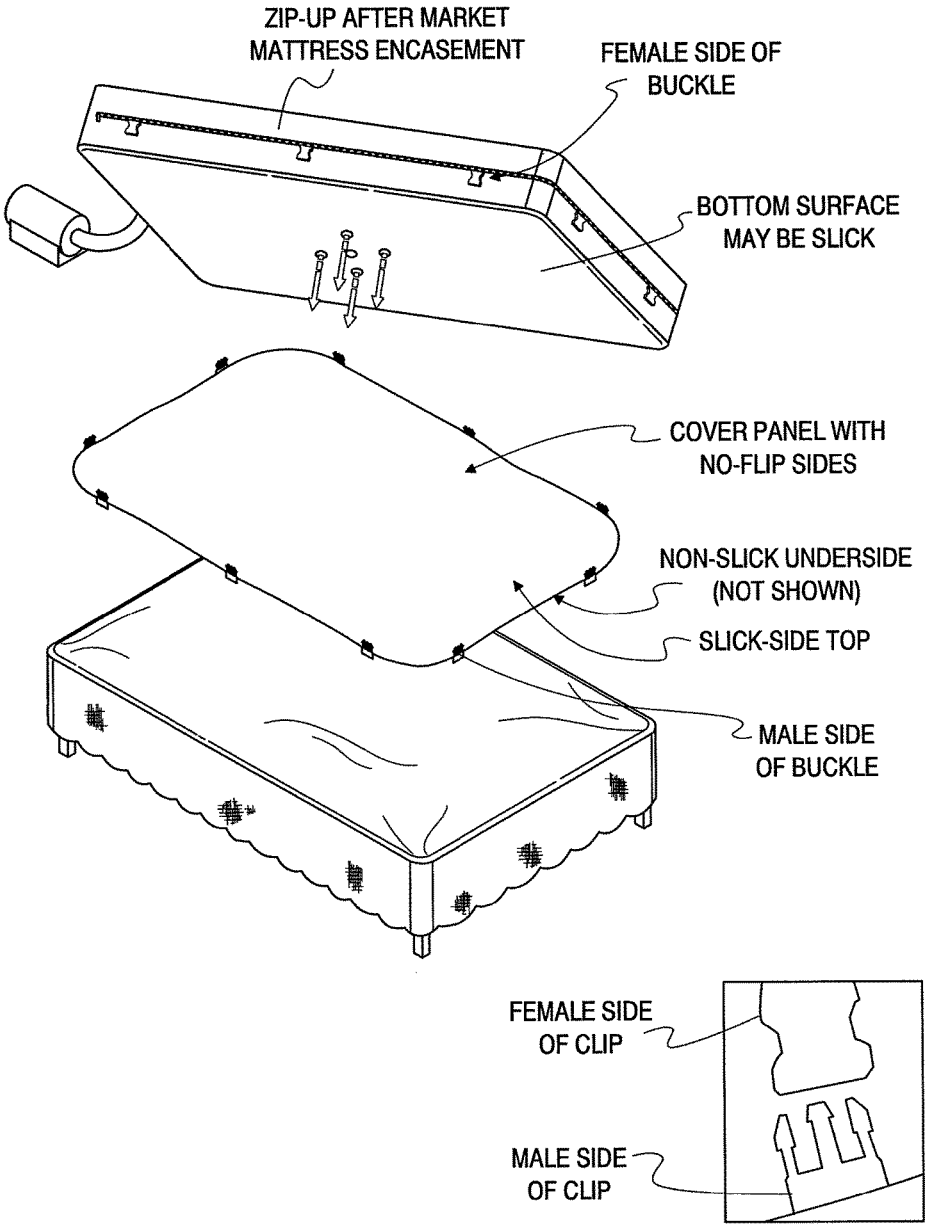
Figure 146:
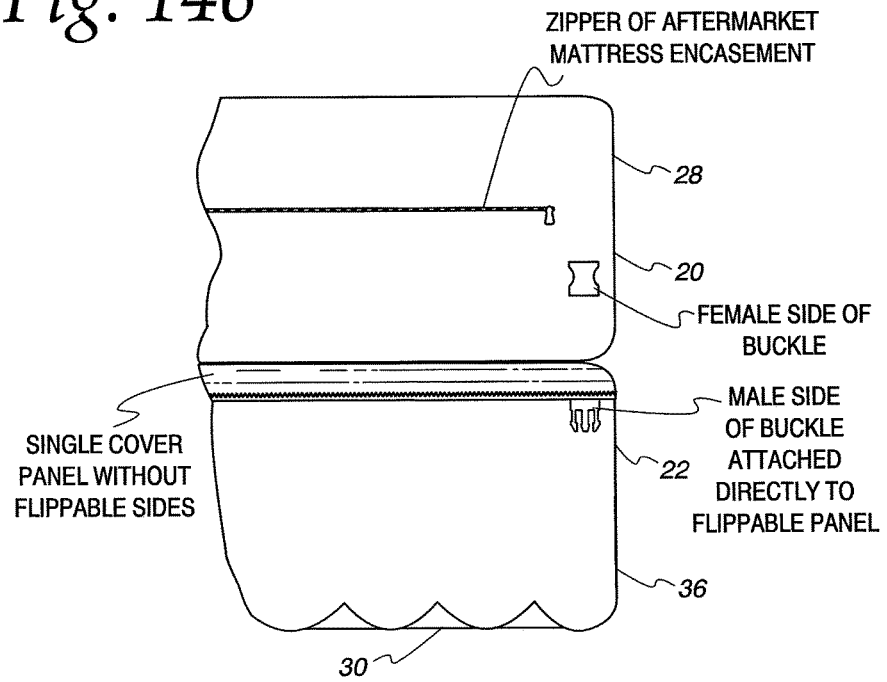
Figure 147:
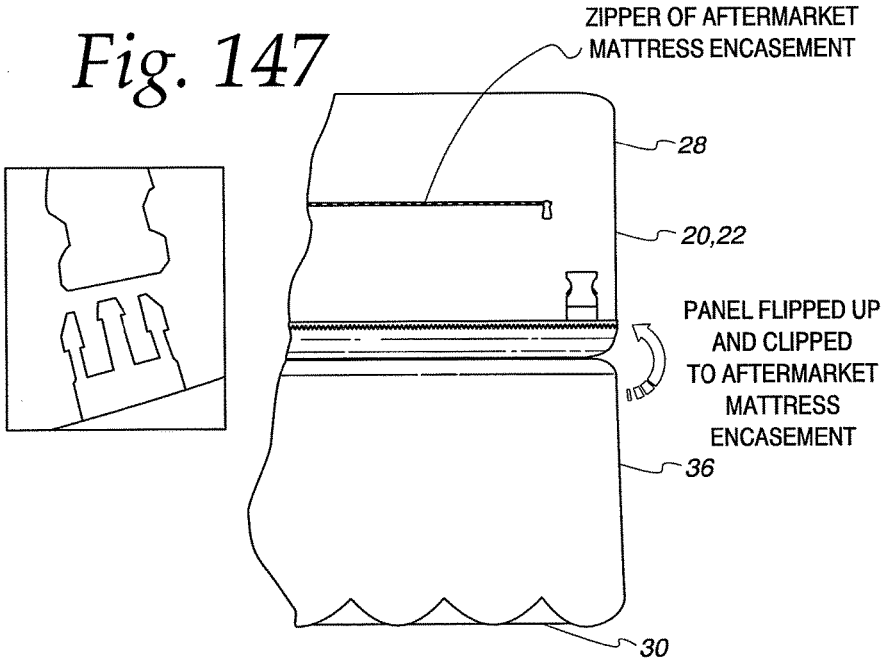
Figure 148:
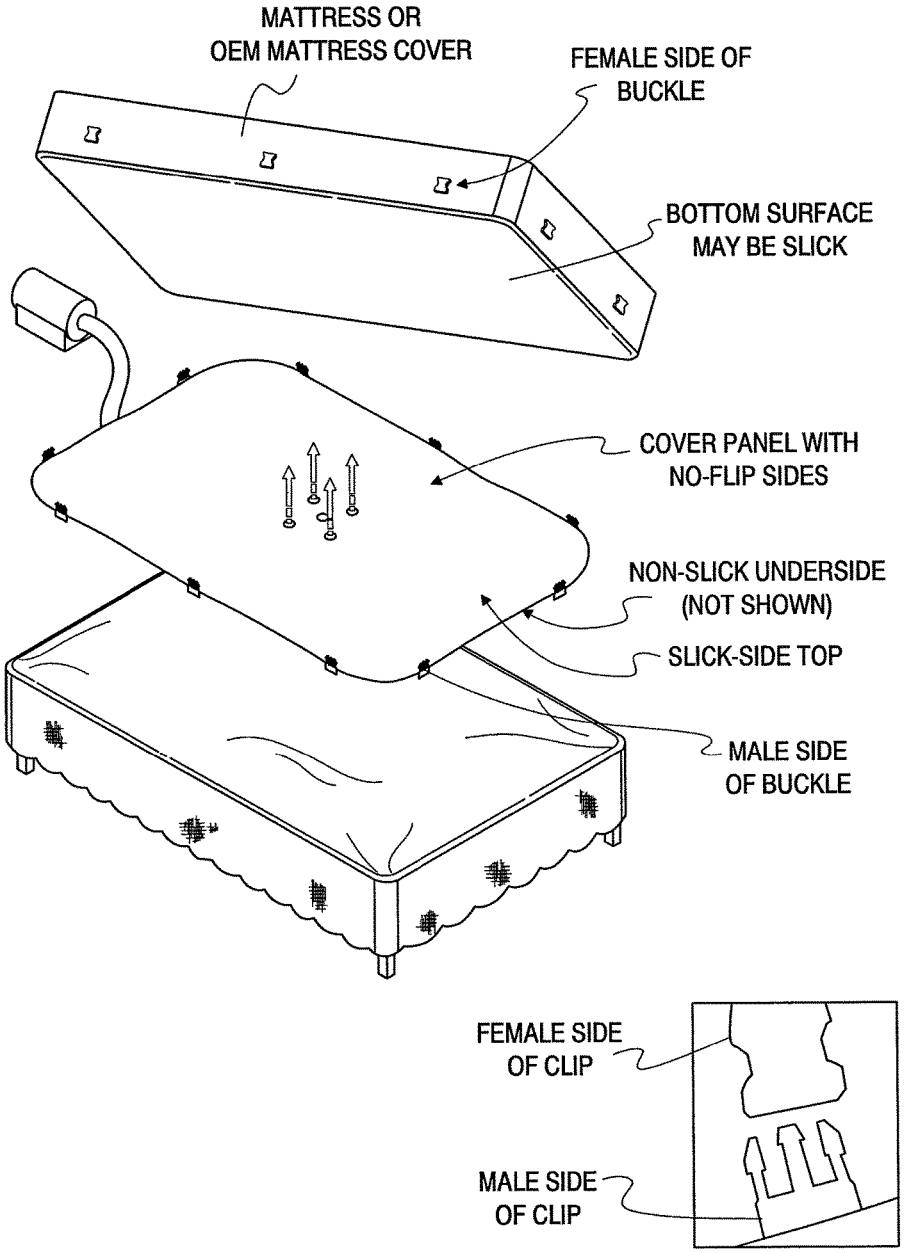

FIGS. 143 and 144*a* are similar to FIGS. 16-18 but illustrate an alternative method of securing the mattress to the foundation, for example, with the attachment members illustrated in FIG. 144*b*.

FIG. 144*b* illustrates a conventional attachment devise comprising male and cooperating female attachment members.

FIGS. 145-148 are similar to FIG. 139*g*. except the cover has no side panels and the vertical attachment members are attached on the edge of the cover.

Figure 149:
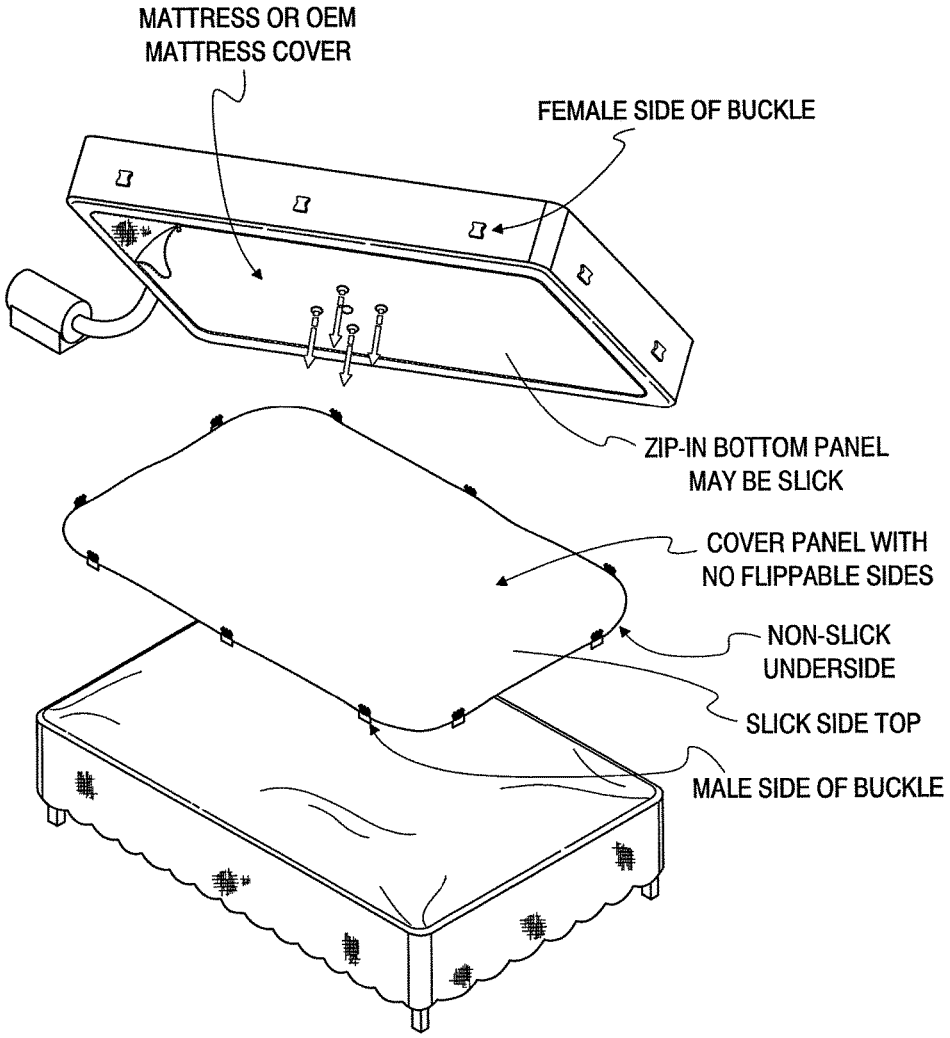
Figure 150:
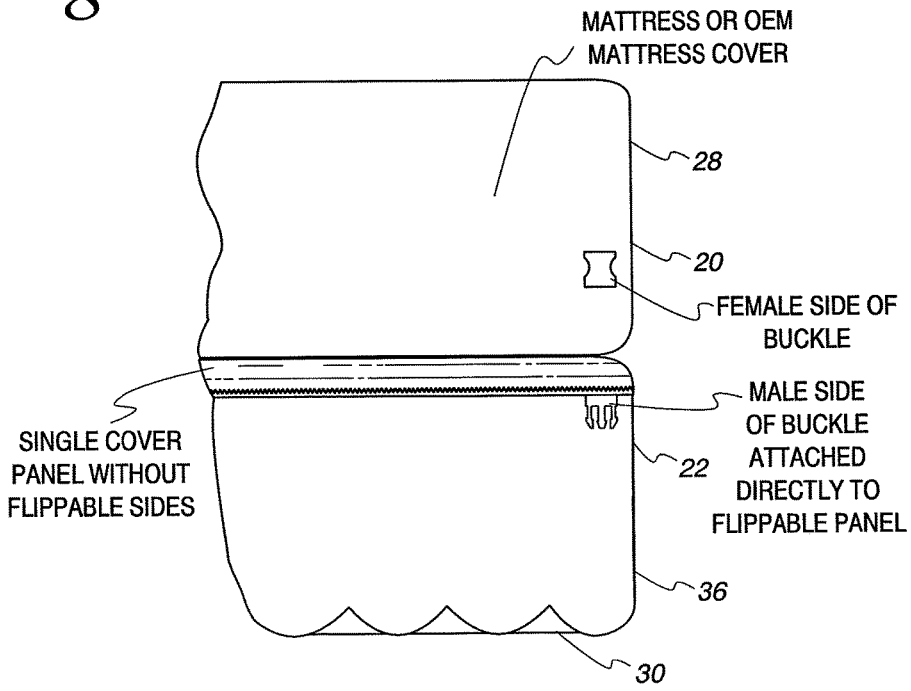
Figure 151:
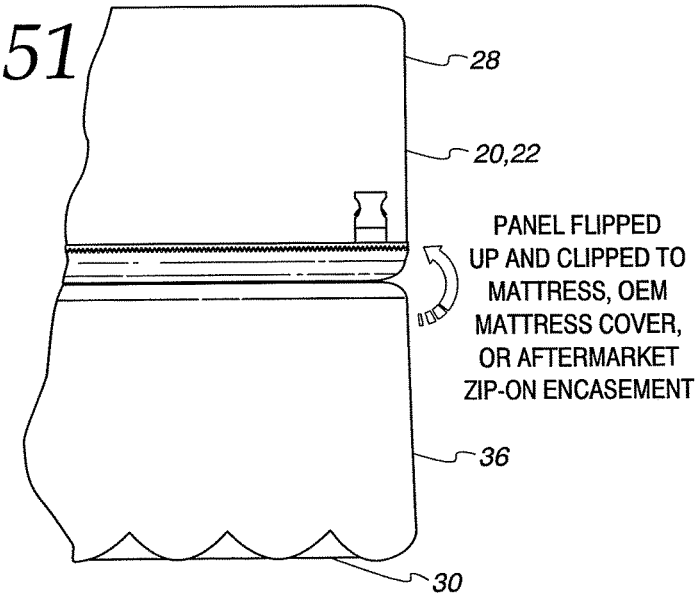
Figure 152:
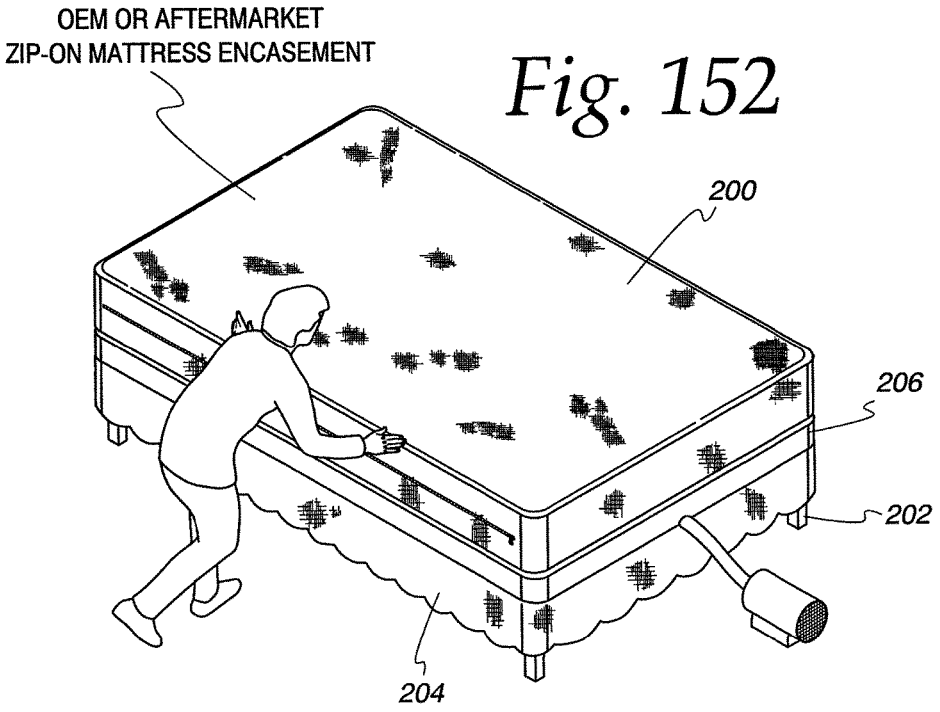
Figure 153:
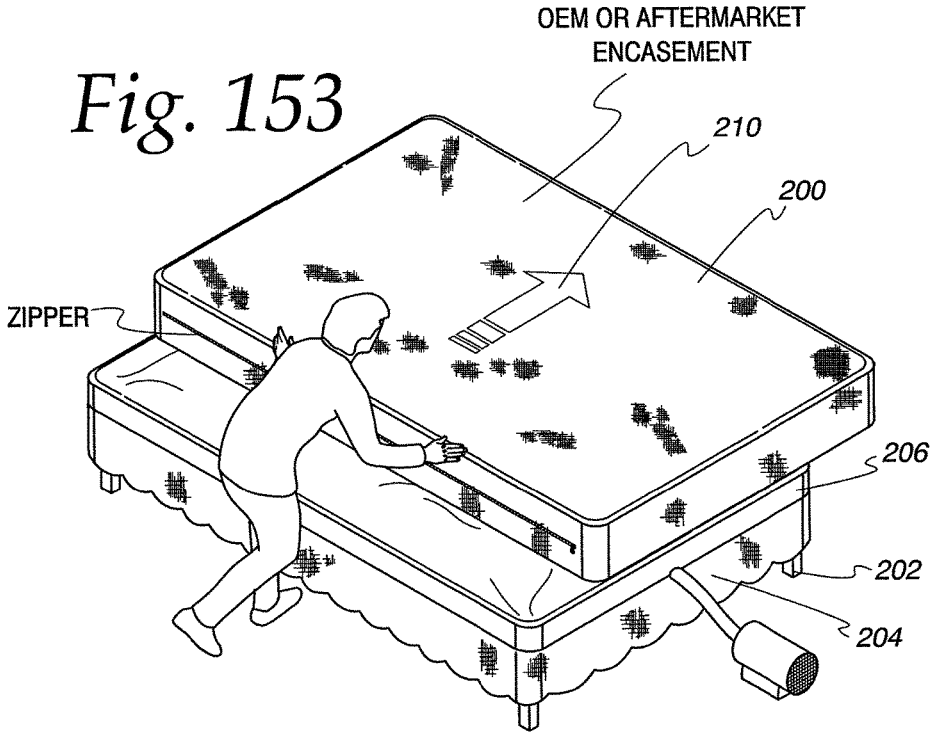
Figure 154:
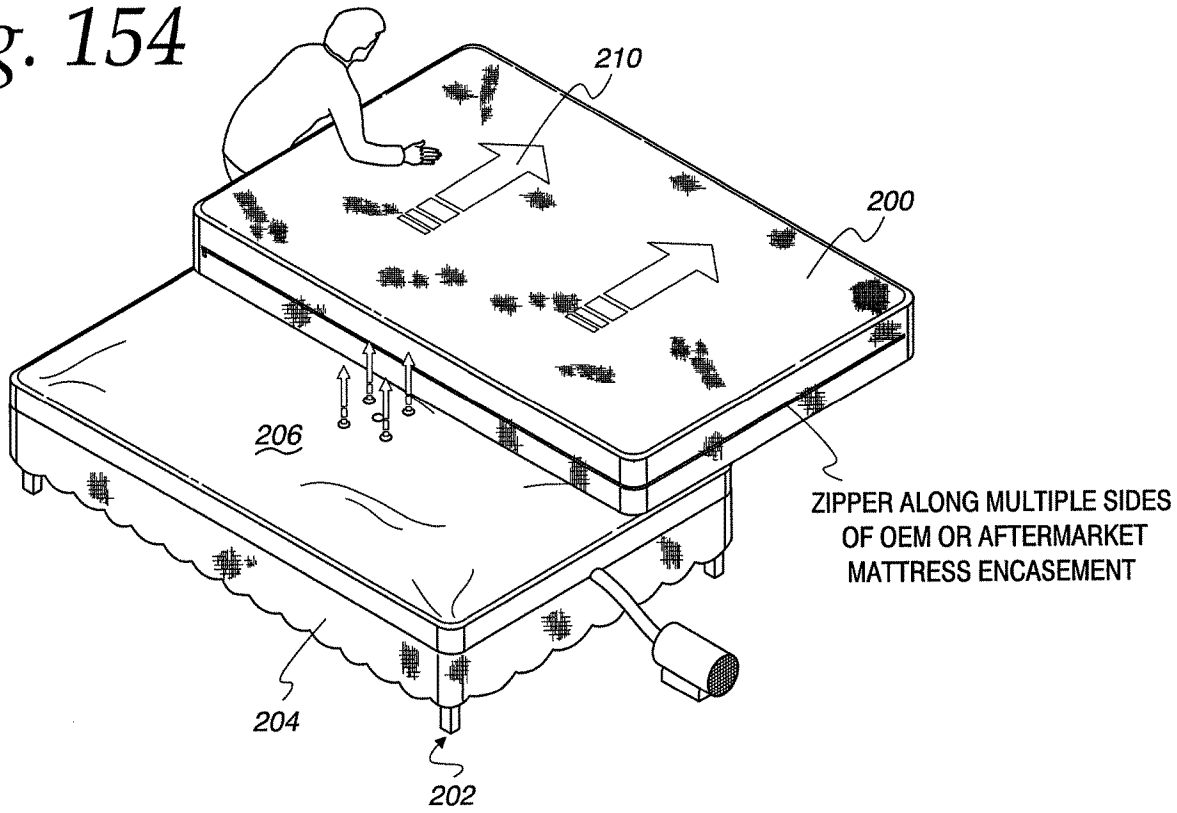
Figure 155:
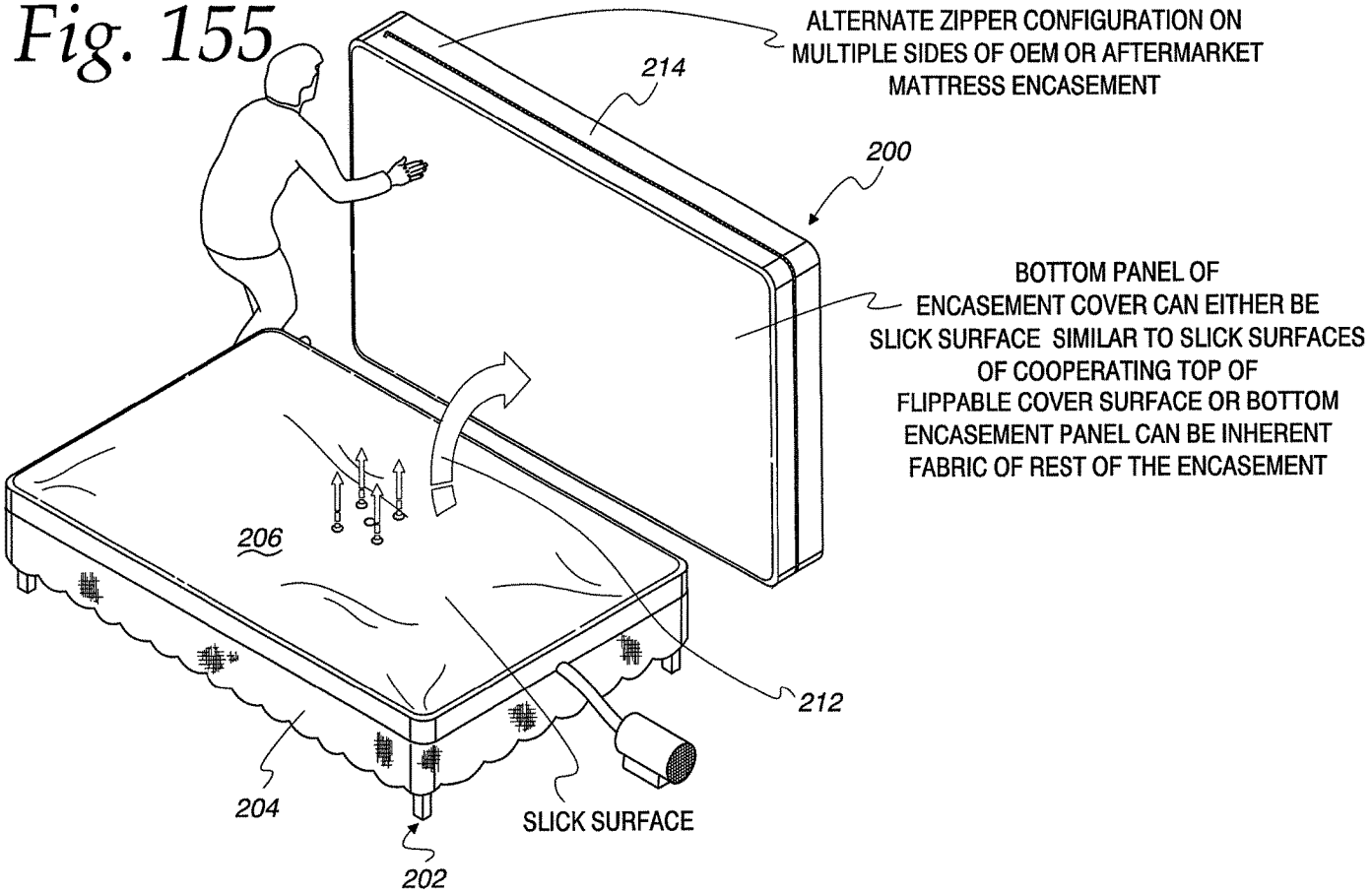
Figure 156:
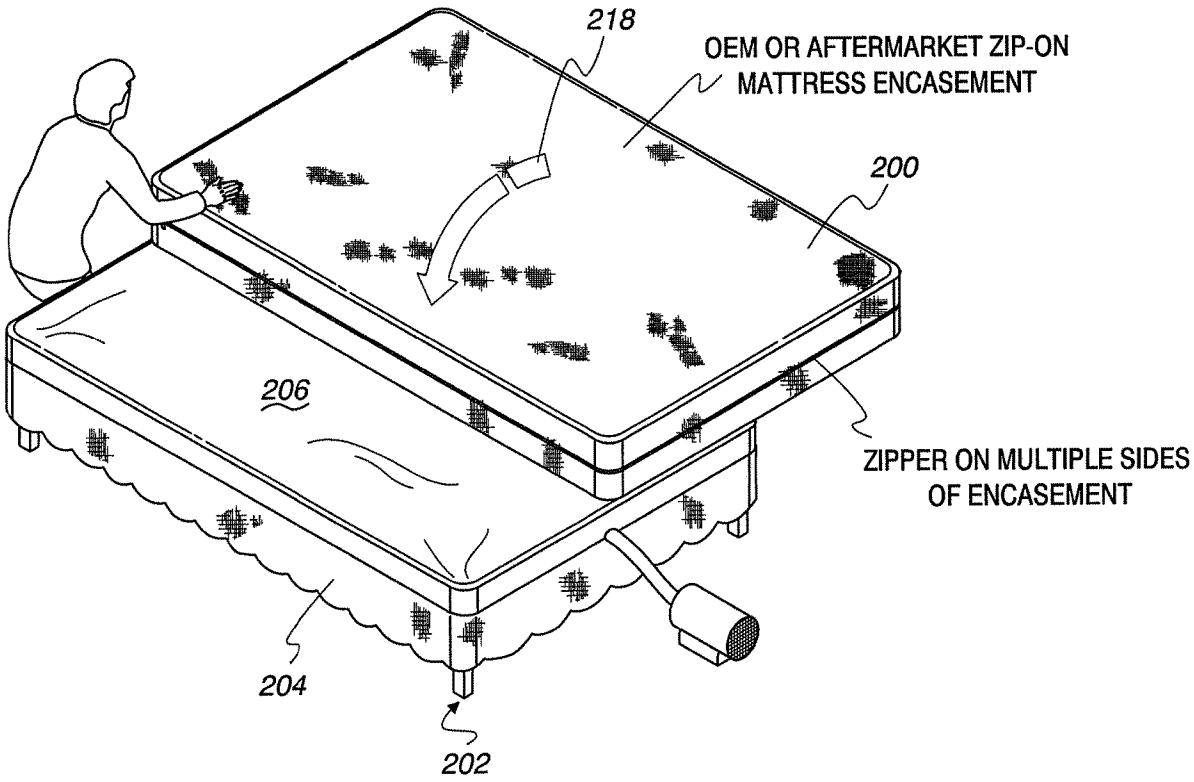
Figure 157:
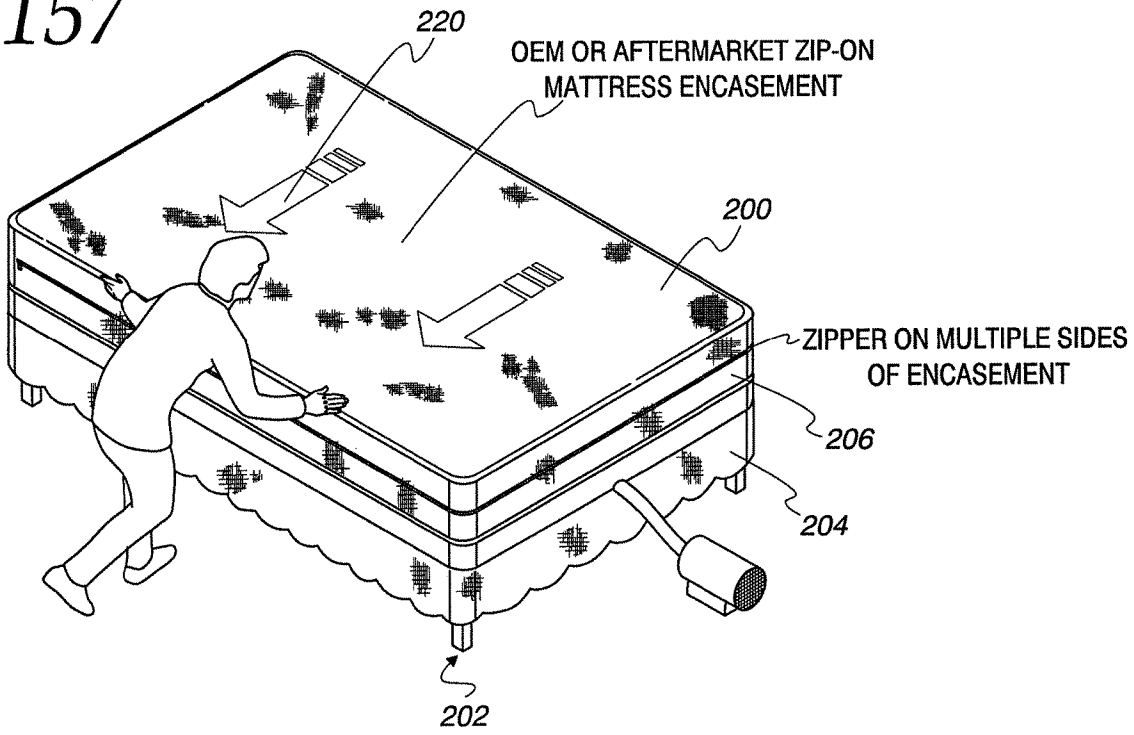

FIGS. 149-151 are similar to FIG. 139 *h* except the cover has no side panels and the vertical attachment members are attached on the edge of the cover.

Figure 24B:
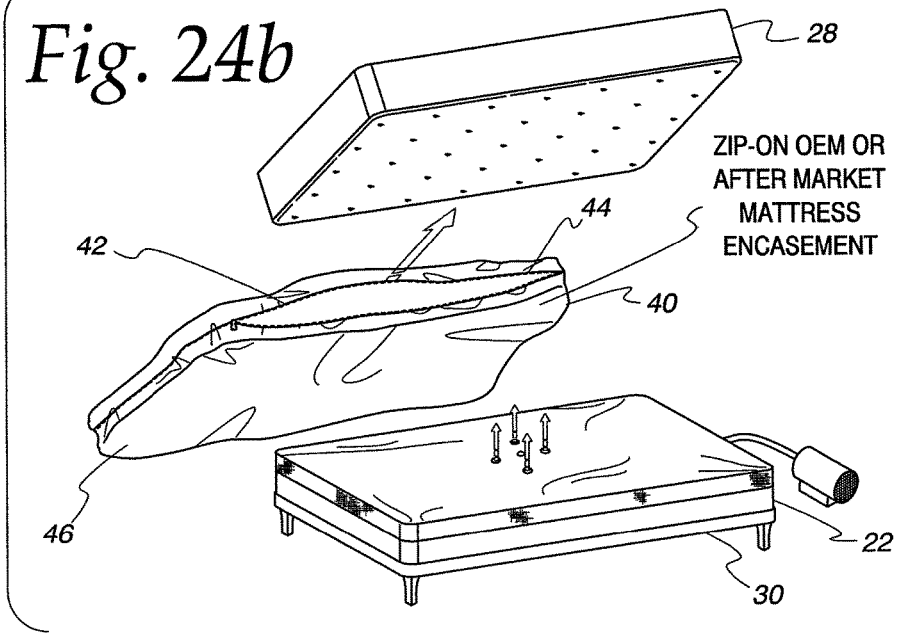
FIG. 24*b* is similar to FIG. 9*b* but illustrating an alternative embodiment of the encasement illustrated in FIG. 24*a* but shown without a stitch pattern the inflatable volume built into the encasement.

FIGS. 152-157 are similar to FIGS. 84-91 but illustrate the mattress encased in an encasement, as illustrated in FIG. 24*a* or 24*b*.

DETAILED DESCRIPTION

The present invention relates to a four-in-one mattress management system and method for facilitating various tasks associated with beds of all sizes including making beds; rotating mattresses; holding a bed skirt in place while a mattress is rotated; installing or removing and re-installing a mattress, for example, in order to replace a bed skirt.

FIGS. 1-29*p* relate to an active mattress spinner for rotating mattresses in a horizontal plane. FIGS. 30*a*-43 relate to a method for facilitating making a bed without the need to lift the top mattress. FIGS. 44, 45, 135*a*-135*c*, 136*a*-136*c*, 137 and 138 illustrate alternate stitch patterns for the various embodiments discussed above.

Figure 79:
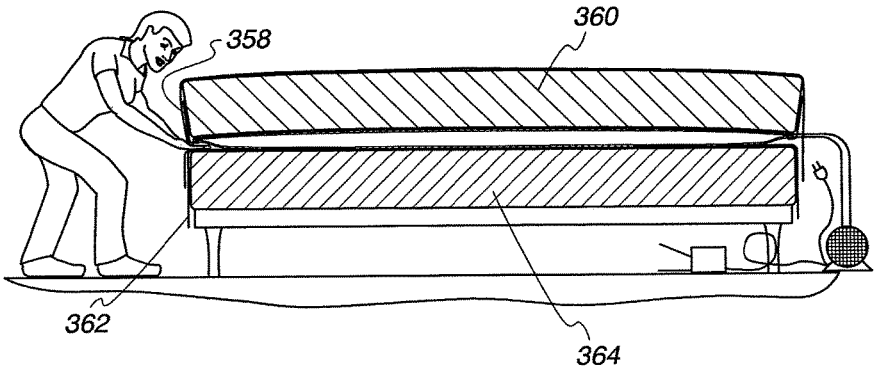
FIG. 79 is a side elevational view in section illustrating the present invention being used to facilitate bed making.
Figure 80:
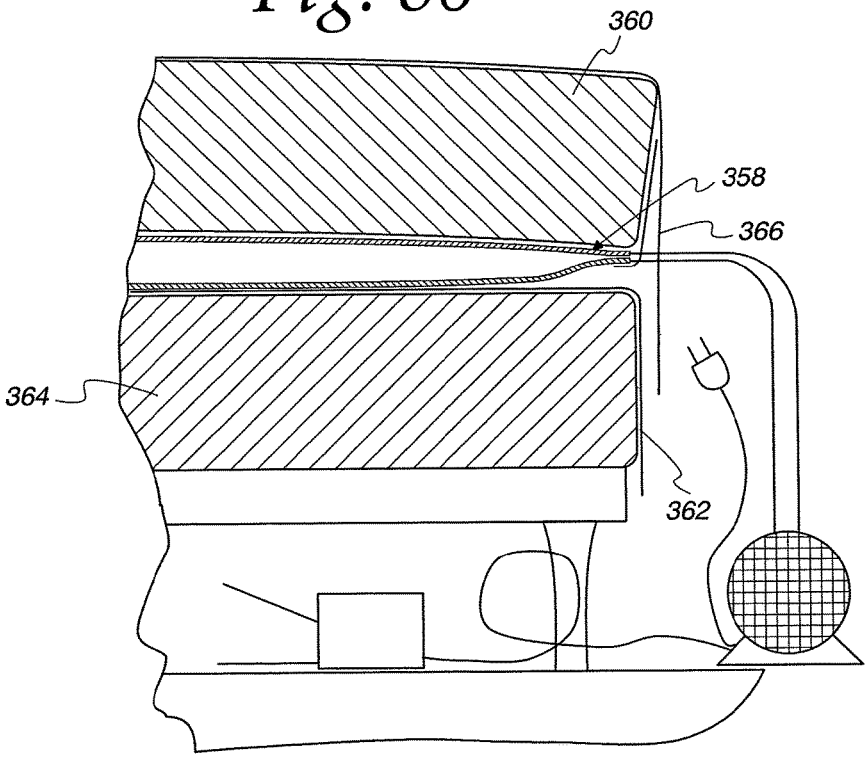
FIG. 80 is a partial side elevational view in section illustrating the present invention, showing the bed sheet dangling before being tucked in between the foundation and the mattress.
Figure 81:
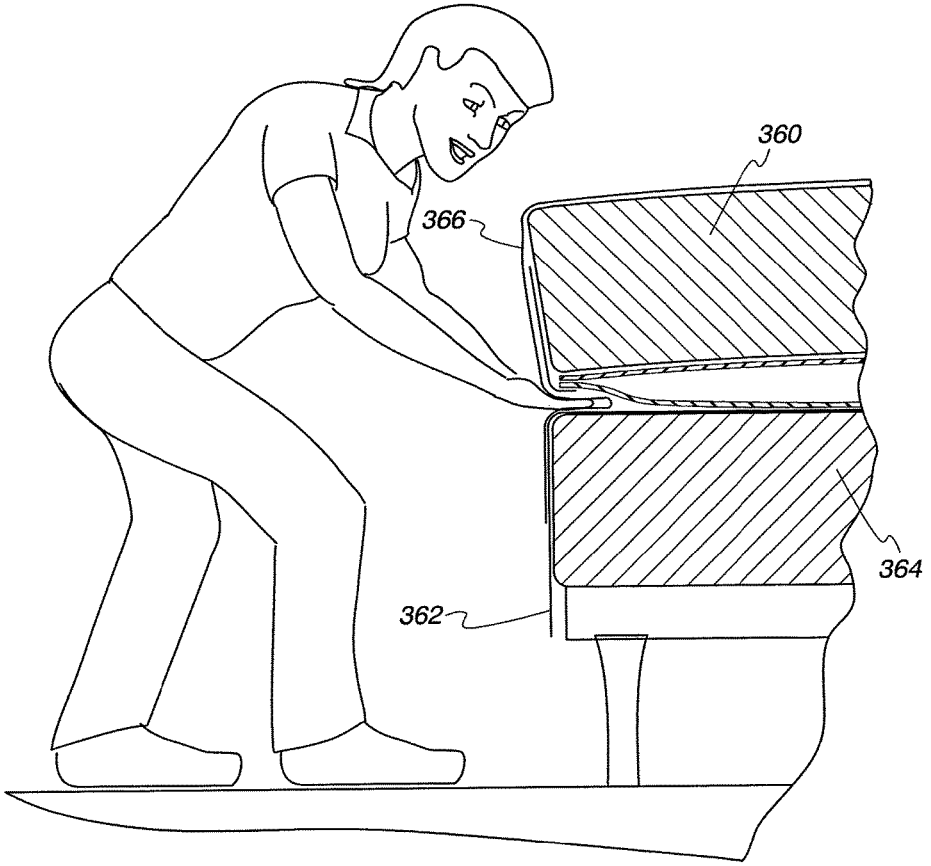

FIGS. 79-81 illustrate use of the present invention to facilitate bed making. FIGS. 82*a*-82*c*, 83*a* and 83*b* illustrate mattress rotation. FIGS. 83*c*, 83*d*, 84-91 and 152-157 illustrate installing or removing and re-installing a mattress, for example, in order to replace a bed skirt.

Various embodiments of the invention are illustrated. FIGS. 46*a*-47*b*, 52, 53, 55, 56, 58, 59, 63-78, 95, 95*a*, 95*b*, 125-128, 131*a*-142*b* and 145-151 illustrate a single flippable cover embodiment of the invention. FIGS. 49-51, 94, 96-124, and 143 illustrate an embedded embodiment of the invention. FIGS. 129-130 illustrate an embodiment with a single flippable cover and embedded cover.

The present invention is suitable for use in various applications. These applications include, a conventional bed and mattress; a conventional bed and mattress in which the mattress is covered with an encasement. The principles of the invention are also applicable to foam mattresses that are encased in a mattress cover with a zip-out bottom panel. The invention can also be used on mattresses that are supported by fixed and adjustable platforms.

Mattress Management System

The present invention relates to a mattress management system. In one embodiment of the invention, the mattress management system includes an inflatable air volume formed as a one-piece cover formed from two sheets of material fastened together by any conventional means, such as stitching. The cover further includes side panels for attaching the cover to the underside of a mattress or to a foundation. As used herein, a foundation is defined to include a stationary platform, an adjustable platform or a box spring.

The mattress management system may be operated in an active mode or in a dual mode consisting of an active mode and a passive mode, as discussed above. An air inlet nozzle is provided to receive air from an air pump. The mattress management system enables the following tasks to be performed with respect the mattress. These tasks include:

- bed making
- installing or removing and re-installing a mattress, for example, in order to replace a bed skirt.
- rotating the mattress in a horizontal plane
- in applications where bed skirts are used, holding the bed skirt in place.

The mattress management system may be used in an active mode in which the bed making and mattress rotation can be done in an active mode under the influence of air from the air pump. In a dual mode, the bed making is done under the influence of air flow from the air pump and mattress rotation is accomplished in a passive mode based upon the relative co-efficient of friction between an underside of the cover and the co-efficient of friction between of the underside of the mattress or the foundation. The mattress management system may be configured to provide one or more of the 4 functions described above.

Mattress rotation can be accomplished in an active mode or a passive mode. In a passive mode, the cover may be initially attached to the underside of a mattress so that air exit holes, for example, face downward toward the foundation. In order to rotate the mattress in a passive mode, the cover is flipped down from the mattress to the foundation, i.e. unattached from the mattress and attached to the foundation, for mattress rotation. If a bed skirt is being used, the cover is will hold the bed skirt in place while the mattress is rotated. In this position, the underside of the cover is in contact with the underside of the mattress. By forming the underside of the cover with a relatively slick surface, as described below, the mattress can be rotated relatively easily. If the mattress is rotated in an active mode, the cover is preferably attached to the foundation with the air exit holes facing upward. In this mode, the mattress is slightly levitated facilitating rotation of the mattress. As such, the cover may be used in applications where the air exit holes face up or down.

As will be discussed in more detailed below, in an active mode, the principles of the invention are based upon a controlled release of air from the inflatable air volume against selected resistance, as discussed below, to enable the various tasks to be performed with respect the mattress. As will be discussed below, various embodiments of this concept are contemplated. For example, the inflatable air volume may include one or more air exit holes and/or an adjustable air exit valve. Various embodiments of the adjustable air exit valve are contemplated as illustrated and discussed below. As an alternative to or in combination with air exit holes or an air exit valve, the porosity of the material used for the air bladder or the porosity of the material in contact with the bladder may be selected to provide a controlled release. Moreover, the controlled release may include attaching a supplemental interfacing material over the air exit holes, for example, to control the air release, depending on the characteristics of the material that will contact the air exit holes.

In general, the inflatable air volume is formed from two sheets of material as discussed below, which are attached together, for example, by stitching, or other conventional methods, as described below. As will be illustrated and discussed in more detail below, the principles of the present invention apply to various stitching patterns and in fact apply to virtually any stitching pattern. In some embodiments of the invention, the center points of the two sheets of material forming the inflatable air volume are attached together by way of a grommet, stitching or otherwise. In other embodiments, the center points of the two sheets of material are not attached together. Suitable materials for the inflatable air volume are discussed below.

In order to attach the inflatable air volume to a mattress or foundation, various embodiments are contemplated. In one embodiment, the inflatable air volume is embedded in a mattress or foundation. In other embodiments, the inflatable air volume includes side panels. These side panels are used to attach the inflatable air volume to a mattress or foundation. Various embodiments of the side panels are discussed below. In addition to the embodiments discussed above, the cover may be incorporated as one panel of an encasement or mattress protector, which may be at least partially water proof which slips over the entire mattress. In this embodiment, the cover in accordance with the present invention is incorporated into a bottom panel of the encasement that will be in contact with the foundation.

The mattress management system also includes a conduit and an air pump. In some embodiments, the air pump and conduit are external to the mattress or foundation. In other applications where the inflatable air volume is embedded into a mattress or foundation, as discussed above, the air pump and conduit may be built in to the mattress or foundation. In some embodiments as illustrated in FIGS. 46*b* and 47*b*, multiple air inlet nozzles may be provided around the perimeter of the expandable air volume. Each air inlet nozzle may be provide with a check valve as illustrated in FIG. 47*c*.

One or more of the various permutations of the invention as discussed herein can be combined to form a mattress management system in accordance with the present invention. All such combinations are considered to be within the broad scope of the invention. It is to be understood that only exemplary combinations of those permutations are illustrated and discussed below.

FIGS. 46*a*-76, 135*a*-135*c*, 136*a*-136*c*, 137 and 138 illustrate various exemplary embodiments of a mattress management system. FIGS. 24*a* and 24*b* illustrate embodiments of the encasement. Other embodiments of the encasement version are discussed above with respect to the use of air exit holes, an adjustable air exit valve and attachment of the center point of the two sheets forming the inflatable air volume.

Figure 46A:
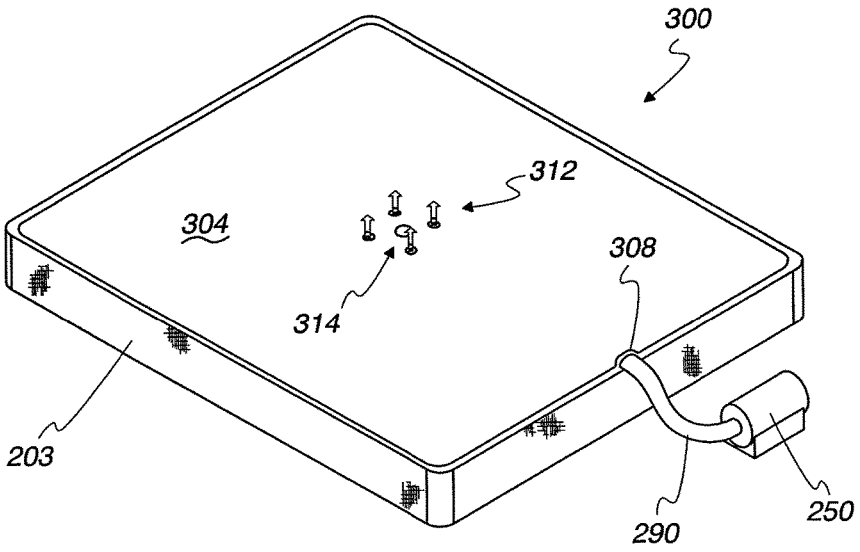
FIG. 46*a* is an isometric view of a two-sheet single cover active embodiment with a generally rectangular stitch pattern.
Figure 47A:
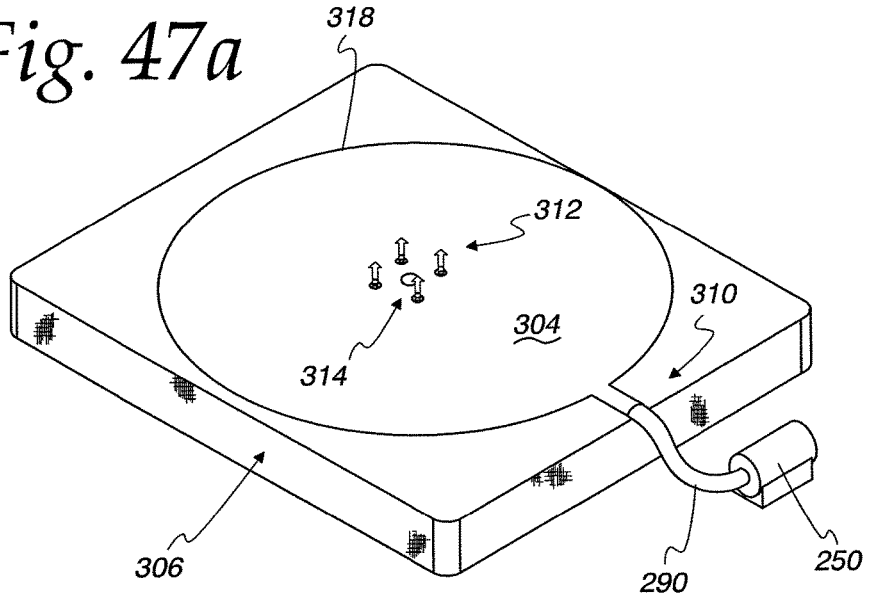
FIG. 47*a* is similar to FIG. 46*a* but with a circular stitch pattern joining the two sheets.
Figure 46B:
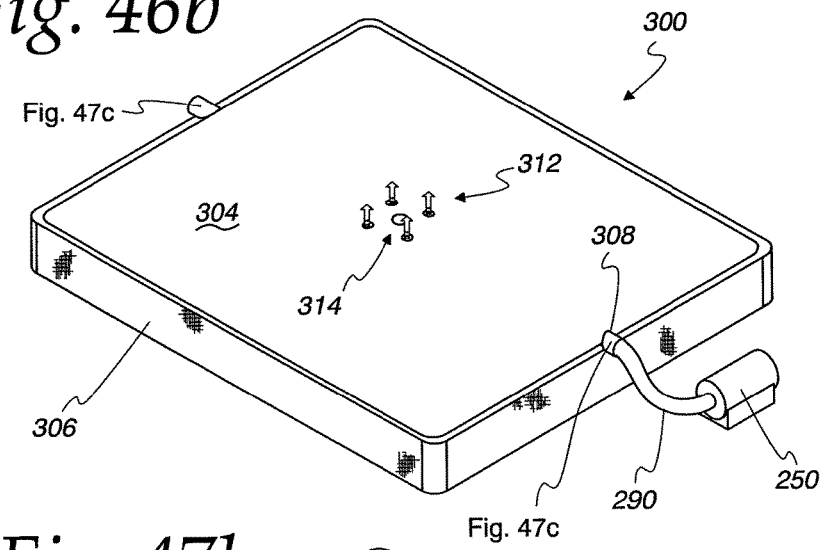
FIGS. 46*b* and 47*b* are similar to FIGS. 46*a* and 47*a* but illustrate multiple air inlet point feeding the inflatable volume of air.
Figure 47B:
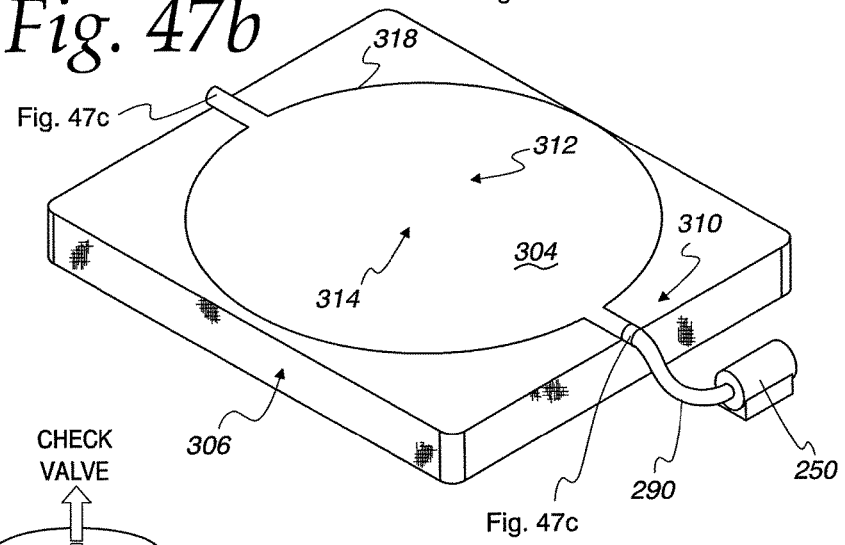
Figure 47C:
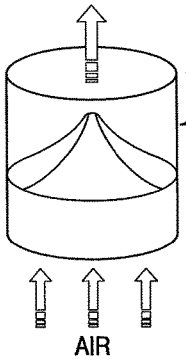
FIG. 47*c* is an exemplary check valve for use in the multiple air inlets illustrated in FIGS. 46*b* and 47*b*.

FIGS. 46*a* and 47*a* illustrate a pair of exemplary standalone covers 300 and 303, respectively, for example a packaged aftermarket accessory. These covers 300, 302 each contain an inflatable air volume portion 304 attached to side panels, generally identified with the reference numeral 306, which allows the cover 300,302 to be attached to the underside of a mattress or a foundation (not shown). Each cover 300,302 includes an air inlet nozzle 308 and 310, respectively, for attachment to a conduit 290 and air pump 250.

Both covers 300, 302 include a plurality of air exit holes, generally identified with the reference numeral 312. The sheets making up the inflatable air volume portion 304 are attached together at their center points, as generally indicated by the reference numeral 314. The only difference between the embodiments is the stitch pattern. The cover 300 is formed with a rectangular stitch pattern, as indicated by the line 316, wherein the cover 302 includes a generally circular stitch pattern, as indicated by the line 318.

The covers 300 and 302 illustrate a packaged aftermarket bedding accessory and include a single cover BedMaker™ unit comprised of 2 individual king size sheets of Nylon RipStop fabric (polyurethane coated on 1 side), joined together via perimeter and center stitching, with 4 air exit holes around the center stitch, perimeter-sewn polyester side-skirt material, and an air inlet to accommodate an air-inlet hose attached to an air pump. Once actuated, the pump provides a continuous source of air into the expandable volume, provided by the 2 layers of joined Nylon fabric, to provide mattress lift for the purpose of facilitating ease of sheet tucking between the mattress and mattress foundation. This sample is designed to easily install to one of either the mattress or foundation as a packaged aftermarket bedding accessory variation of the BedMaker™ technology.

Exemplary specifications for the covers 300 and 302 are set forth below.

| | | |
|---|---|---|
| Fabric 300, 302: | 2 x | Sheets of polyurethane coated Nylon Ripstop, 75" × 79" each |
| Side-panels 306: | 1 x | Polyurethane coated Polyester Jersey-knit material 10" depth |
| Conduit 290: | 1 x | PVC Hosing, 1.5" i.d. × 2.5' length |
| Air Pump 250: | 1 x | Coleman 120 V Electric Quick Pump (Model #5999C120) |

A two cover version of the packaged aftermarket version is contemplated. The two cover version is comprised of 2 individual king size sheets of Nylon RipStop fabric (polyurethane coated on 1 side), joined together via perimeter and center stitching, with 4 air exit holes around the center stitch, perimeter-sewn polyester side-skirt material, and an air inlet to accommodate an air-inlet hose attached to an air pump. Once actuated, the pump provides a continuous source of air into the expandable volume, provided by the 2 layers of joined Nylon fabric, to provide mattress lift for the purpose of facilitating ease of sheet tucking between the mattress and mattress foundation. This sample is designed to easily install to one of either the mattress or foundation as a packaged aftermarket bedding accessory variation of the BedMaker™ technology. In addition, a 2$^{nd}$, single layer Nylon RipStop cover (polyurethane coated on one side/slick coated on the other), with perimeter-sewn polyester side-skirt material, works in unison with the single cover BedMaker™ unit to allow for mattress maneuvering by flipping this cover up over the mattress or down over the foundation.

Exemplary specifications for the two cover version are set forth below:

| | | |
|---|---|---|
| Fabric: | 2 x | Sheets of polyurethane coated Nylon Ripstop, 75" × 79" each |
| Fabric 2$^{nd}$ Cover: | 1x | Sheet of polyurethane/slick coat Nylon Ripstop, 75" × 79" each |
| Side-panel: | 2 x | Polyurethane coated Polyester Jersey-knit material 10" depth |
| Conduit: | 1 x | PVC Hosing, 1.5" i.d. × 2.5' length |
| Air Pump: | 1 x | Coleman 120 V Electric Quick Pump (Model #5999C120) |

Figure 48:
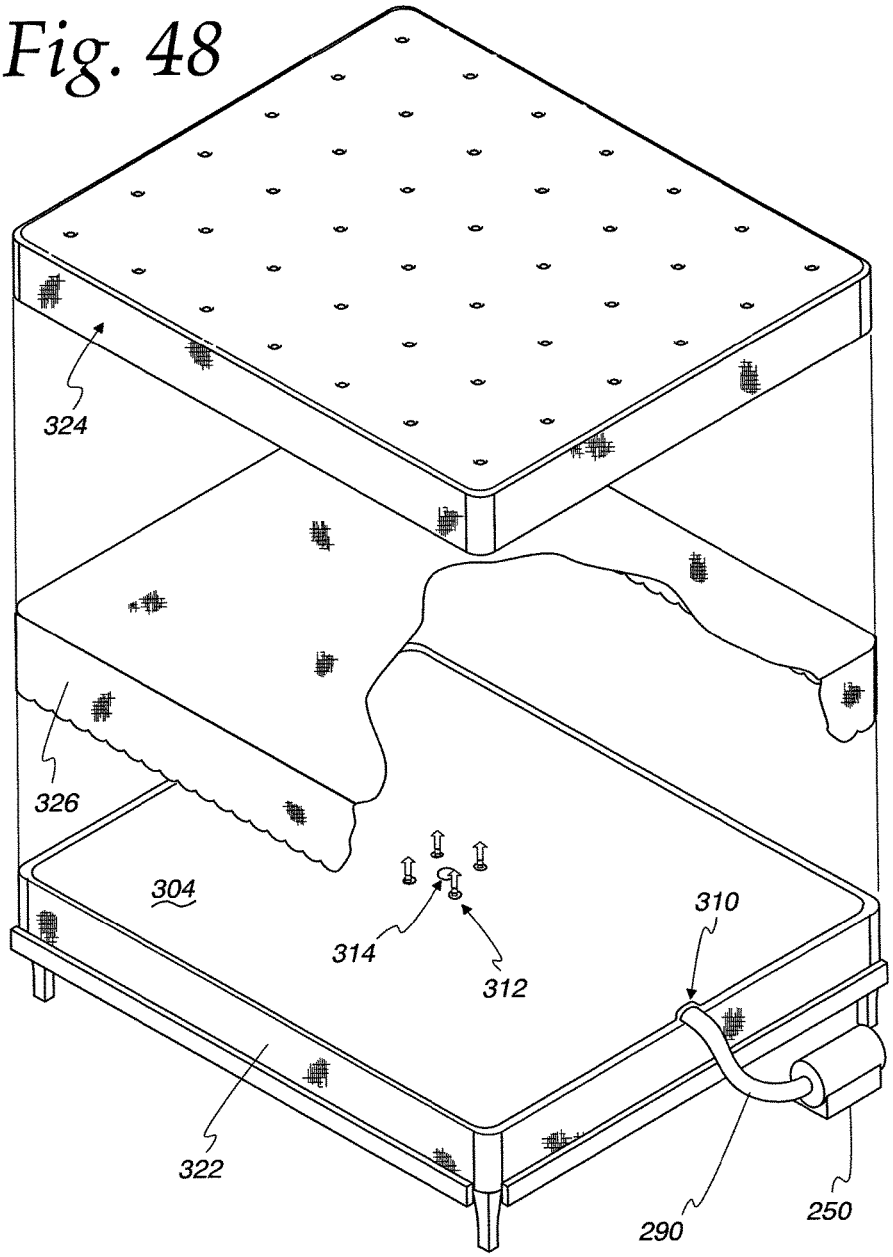
FIG. 48 is an isometric view of a bed having a foundation, bed skirt and a top mattress illustrating a single cover embodiment of the invention with a rectangular stitch pattern built into the foundation.
Figure 49:
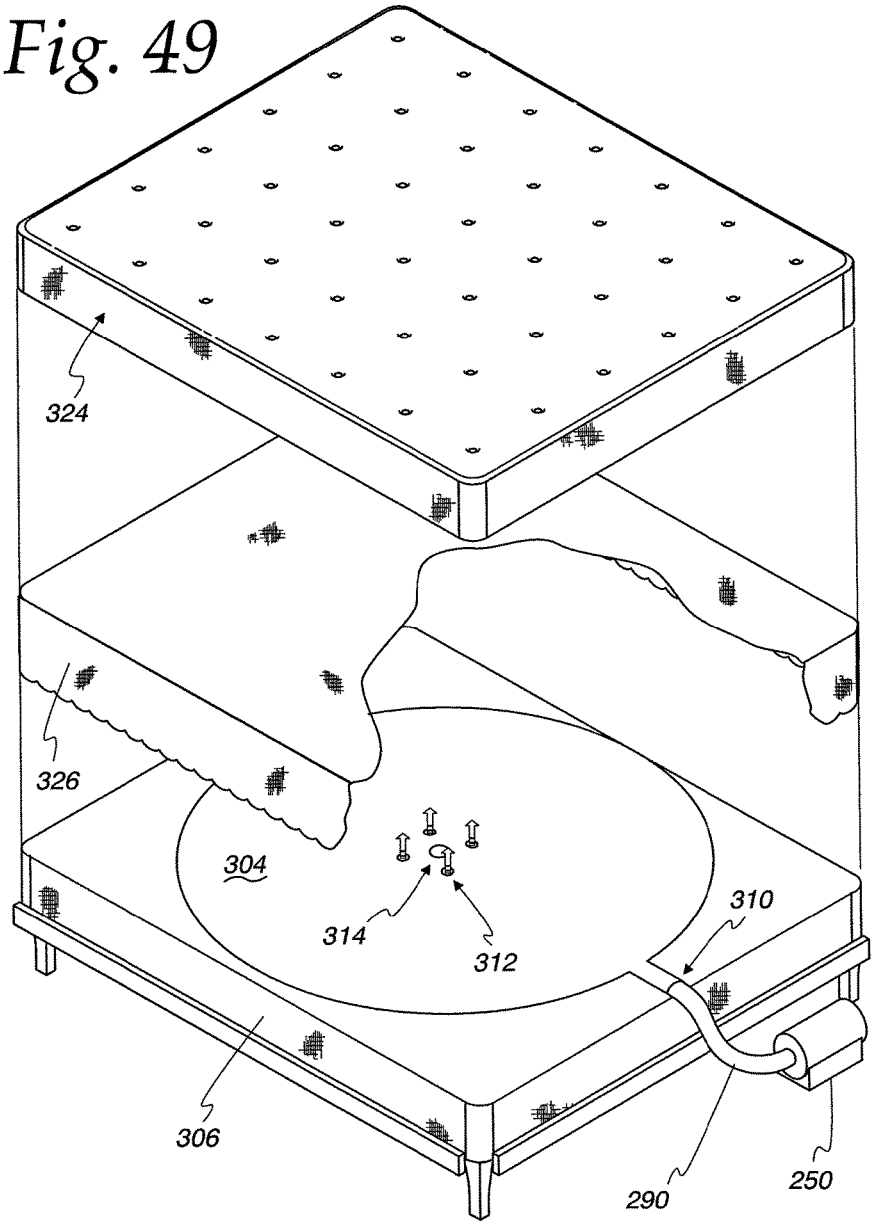
FIG. 49 is similar to FIG. 48 but illustrating a circular stitch pattern.

FIGS. 48 and 49 are similar to FIGS. 46*a* and 47*a* but illustrate an embedded version of the cover in accordance with the present invention. Referring first to FIG. 48, the inflatable air volume portion 304 is attached to the foundation 322, for example, a box spring, by conventional means, such as stitching or other conventional methods. The inflatable air volume portion 304 could have alternatively been embedded in the underside of a mattress 324 which rests on the foundation 322. A bed skirt 326 may be interposed between the foundation 322 and the mattress 324, In this application, all four tasks as discussed are not supported. Specifically, the bed skirt 326 would not be held down during mattress rotation. As such, this embodiment is primarily used in for bed making.

FIG. 49 is similar to FIG. 48. In this embodiment the cover 302 is attached to the foundation 306, as discussed above. The only difference between the embodiments illustrated in FIGS. 48 and 49 is the stitch pattern as discussed above.

Figure 50:
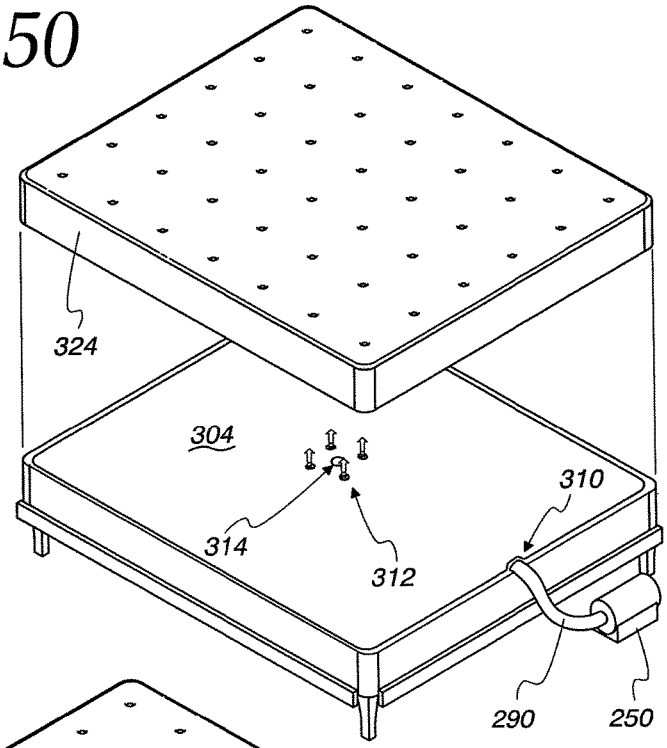
FIG. 50 is similar to FIG. 48 but does not include a bed skirt.
Figure 51:
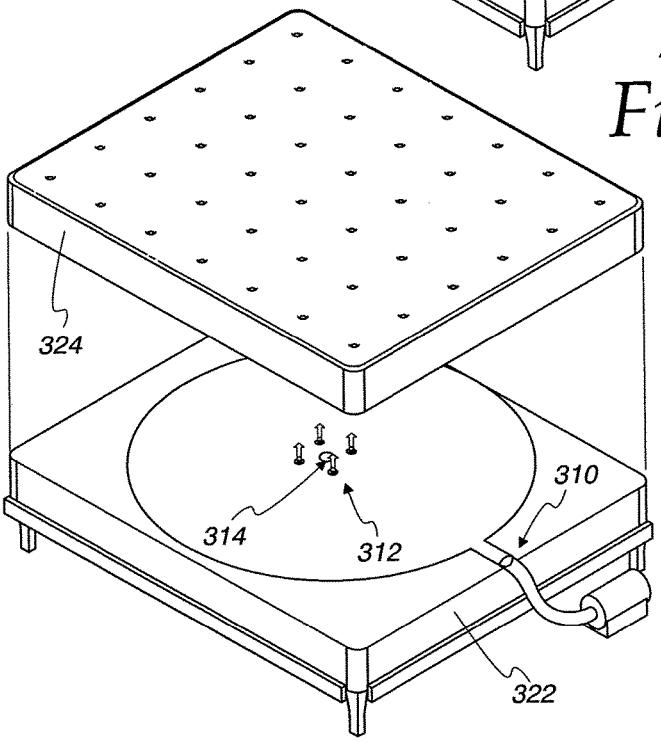
FIG. 51 is similar to FIG. 49 but does not include a bed skirt.
Figure 52:
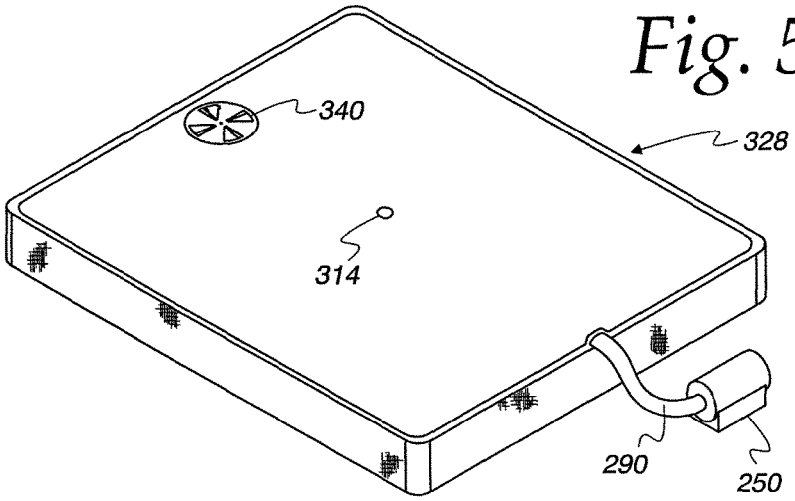
FIG. 52 illustrates a two-sheet single cover embodiment with a rectangular stitch pattern joining the two sheets with no air exit holes and a first embodiment of an adjustable air exit valve.
Figure 53:
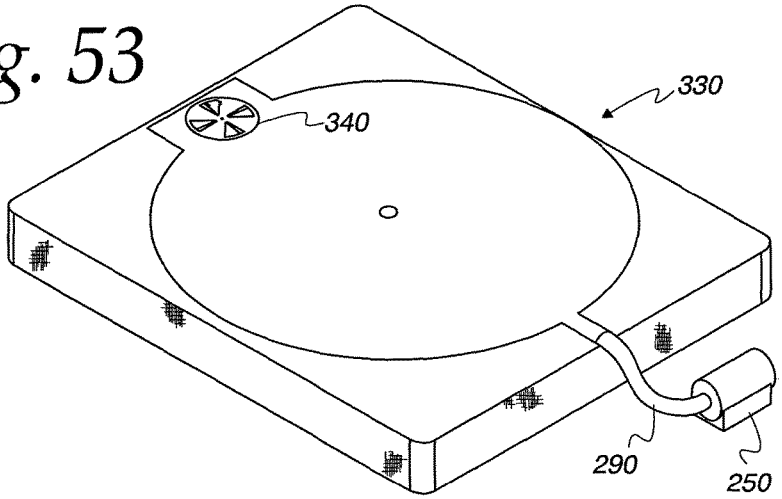
FIG. 53 is similar to FIG. 52 but illustrating a circular stitch pattern.

FIGS. 50 and 51 are similar to FIGS. 48 and 49, respectively. The only difference is that in this application, no bed skirt is used. As such, in this application, the mattress management system can be used for bed making, mattress rotation and removing the mattress from the foundation.

These embodiments relate to an embedded OEM sample of a single cover BedMaker™ unit comprised of 2 individual king size sheets of Nylon RipStop fabric (polyurethane coated on 1 side of 1 sheet, polyurethane/slick coated on the other sheet), joined together via perimeter and center stitching, with 4 air exit holes around the center stitch, perimeter-sewn polyester side-skirt material, and an air inlet to accommodate an air-inlet hose attached to an air pump. Once actuated, the pump provides a continuous source of air into the expandable volume, provided by the 2 layers of joined Nylon fabric, to provide mattress lift for the purpose of facilitating ease of sheet tucking between the mattress and mattress foundation. This embodiment is designed to attach to one of either the mattress 324 or the foundation 322 to simulate a built-in (OEM) variation of the BedMaker™ technology. In addition, this single cover embodiment can be detached from said mattress or foundation and temporarily attached by way of zippers or other attachment means to the other of the mattress or foundation to allow for ease of mattress maneuvering.

Exemplary specifications for the OEM embedded sample is as follows:

| | | |
|---|---|---|
| Fabric 304: | 2 x | Sheets of polyurethane/slick coated Nylon Ripstop, 75" × 79" each |
| Side-panels 322: | 1 x | Polyurethane coated Polyester Jersey-knit material 10" depth |

-continued

| | | |
|---|---|---|
| Conduit 290: | 1 x | PVC Hosing, 1.5" i.d. × 2.5' length |
| Air Pump 250: | 1 x | Coleman 120 V Electric Quick Pump (Model #5999C120) |

Figure 41:
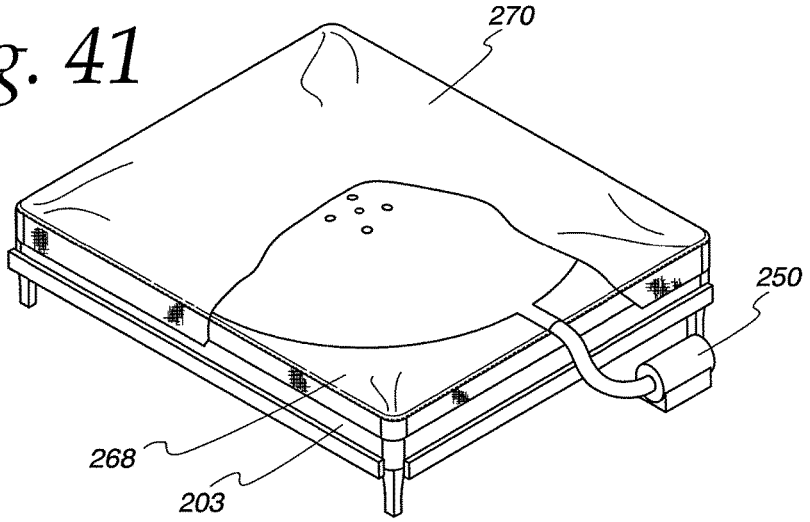
FIG. 41 is an isometric view of the aftermarket levitation device, illustrated in FIG. 40, installed on a box spring and shown with a portion of the top cover removed.

FIGS. 48-51 illustrate single cover embedded versions embedded in either the foundation 322 or the mattress 324. An alternative two cover version is also contemplated, as illustrated in FIG. 41. The two cover version is comprised of 2 individual king size sheets of Nylon RipStop fabric (polyurethane coated on 1 side), joined together via perimeter and center stitching, with 4 air exit holes around the center stitch, and an air inlet to accommodate an air-inlet hose attached to an air pump. Once actuated, the pump provides a continuous source of air into the expandable volume, provided by the 2 layers of joined Nylon fabric, to provide mattress lift for the purpose of facilitating ease of sheet tucking between the mattress and mattress foundation. This sample is designed to attach to one of either the mattress or foundation to simulate a built-in (OEM) variation of the BedMaker™ technology. In addition, a 2$^{nd}$, single layer Nylon RipStop cover (polyurethane coated on one side/slick coated on the other), with perimeter-sewn polyester side-skirt material, works in unison with the single cover BedMaker™ unit to allow for mattress maneuvering by flipping this cover up over the mattress or down over the foundation.

Exemplary specifications for the two cover version are as follows:

| | | |
|---|---|---|
| Fabric: | 2 x | Sheets of polyurethane coated Nylon Ripstop, 75" × 79" each |
| Fabric 2$^{nd}$ Cover: | 1x | Sheet of polyurethane/slick coat Nylon Ripstop, 75" × 79" each |
| Side-panel: | 1 x | Polyurethane coated Polyester Jersey-knit material 10" depth |
| Conduit: | 1 x | PVC Hosing, 1.5" i.d. × 2.5' length |
| Air Pump (P): | 1 x | Coleman 120 V Electric Quick Pump (Model #5999C120) |

FIGS. 52-62 and 65-70 illustrate various exemplary embodiments of the cover forming the mattress management system in accordance with the present invention. FIGS. 52, 53, 55, 56, 58, 59 illustrate embodiments of a cover 328, 330, 332, 334, 336 and 338 in which the center points of the two sheets forming the cover are attached together as indicated by the reference numeral 314. In these embodiments, no air exit holes are provided and the air release is controlled by an adjustable air exit valve.

Figure 54:
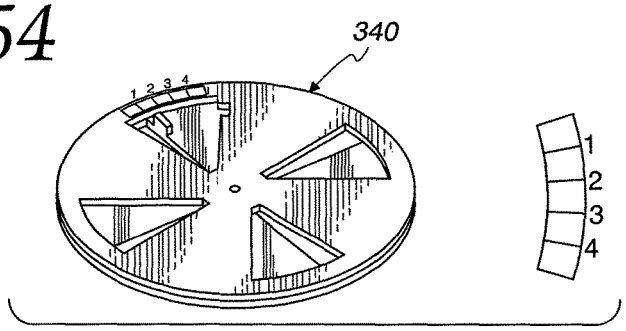
FIG. 54 is an isometric view of the adjustable air exit valve illustrated in FIGS. 52 and 53.
Figure 55:
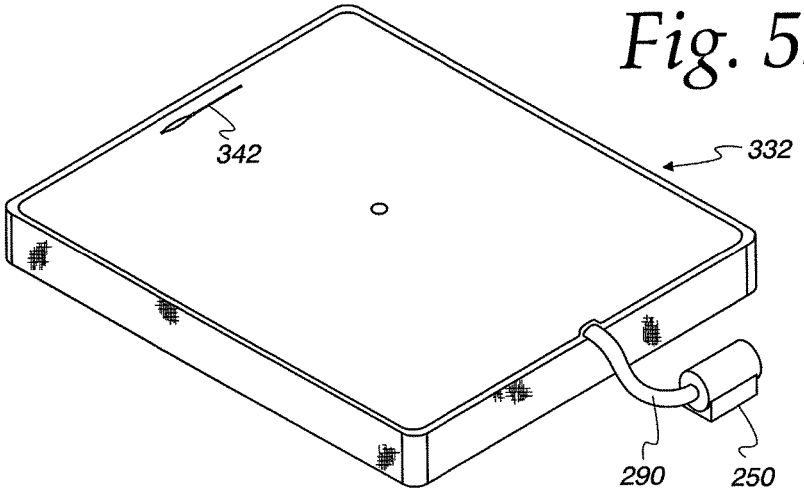
FIG. 55 is similar to FIG. 52 but illustrating a zipper as a second embodiment of an adjustable air exit valve.
Figure 56:
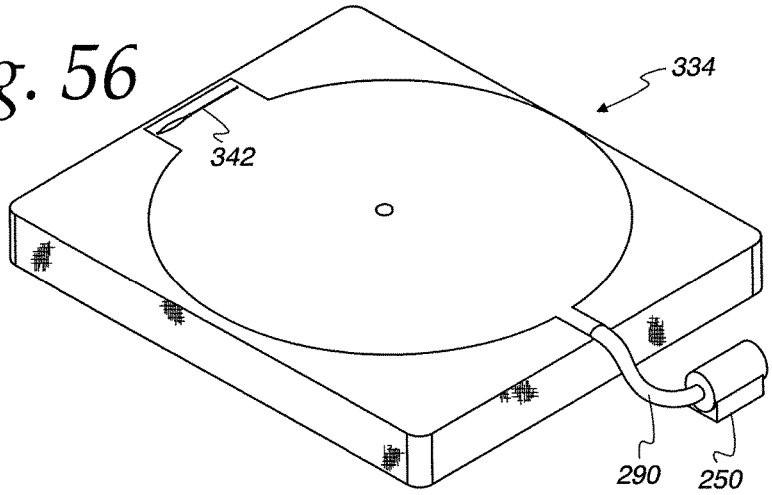
FIG. 56 is similar to FIG. 53 but illustrating a zipper as a second embodiment of an adjustable air exit valve.

The covers 328 and 330 may include a first type of adjustable air exit valve 340, as indicated in FIG. 54. As shown, the adjustable air exit relief valve 340 may include adjustment marks so hotel house keepers, for example, can quickly and easily set all of the beds under their control to the same value.

Figure 57:
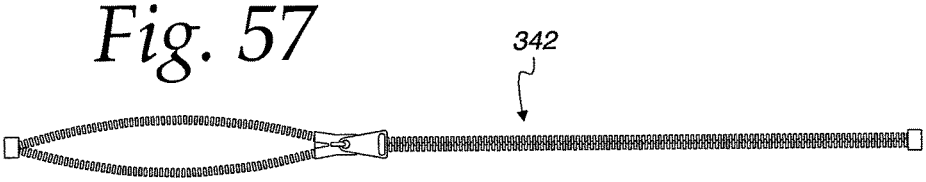
FIG. 57 is an isometric view of the zipper illustrated in FIGS. 55 and 56.
Figure 58:
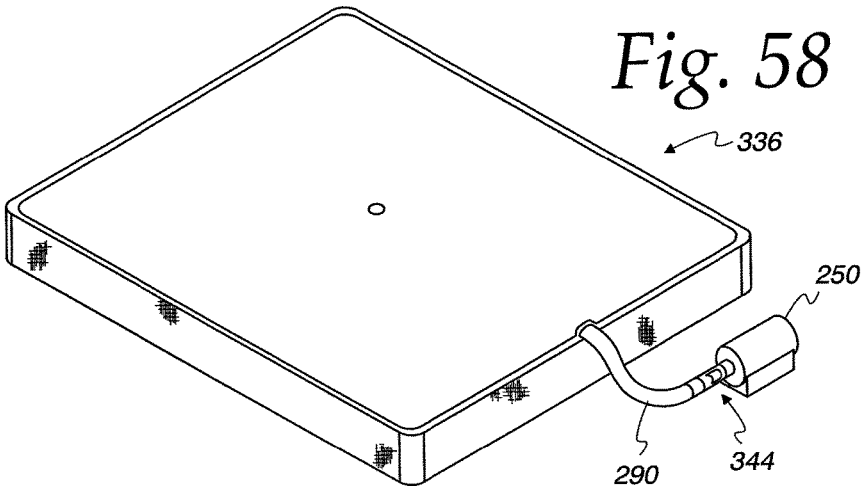
FIG. 58 is similar to FIG. 52 but illustrating a third embodiment of the adjustable air exit valve at the discharge of the air pump.
Figure 59:
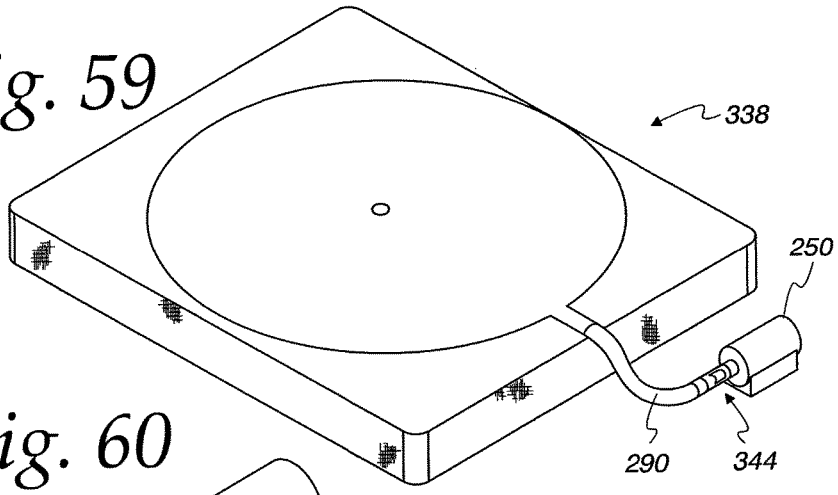
FIG. 59 is similar to FIG. 53 but illustrating the third embodiment of the adjustable air exit valve.

The covers 332 and 334 may include a second type of adjustable air exit valve 342, as indicated in FIG. 57, for example, a zipper. As shown, the adjustable air exit relief valve 342 may include adjustment marks so hotel house keepers, for example, can quickly and easily set all of the beds under their control to the same value.

Figure 60:
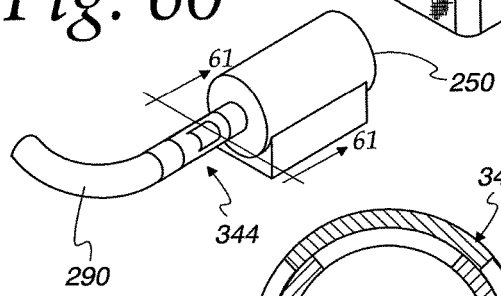
FIG. 60 is an isometric view of the third embodiment of the adjustable air exit valve illustrated in FIGS. 58 and 59.
Figure 61:
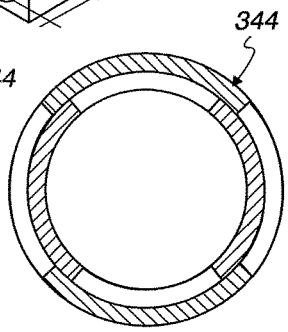
FIG. 61 is a sectional view of the adjustable air exit valve illustrated in FIGS. 58-60 in a fully closed position.
Figure 62:
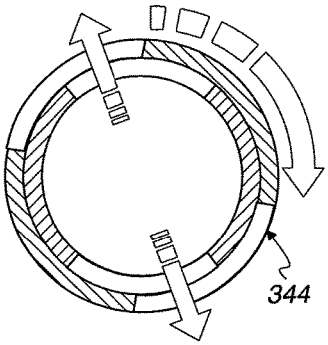
FIG. 62 is similar to FIG. 61 illustrating the valve in a partially closed position and further illustrating adjustment marks.
Figure 63:
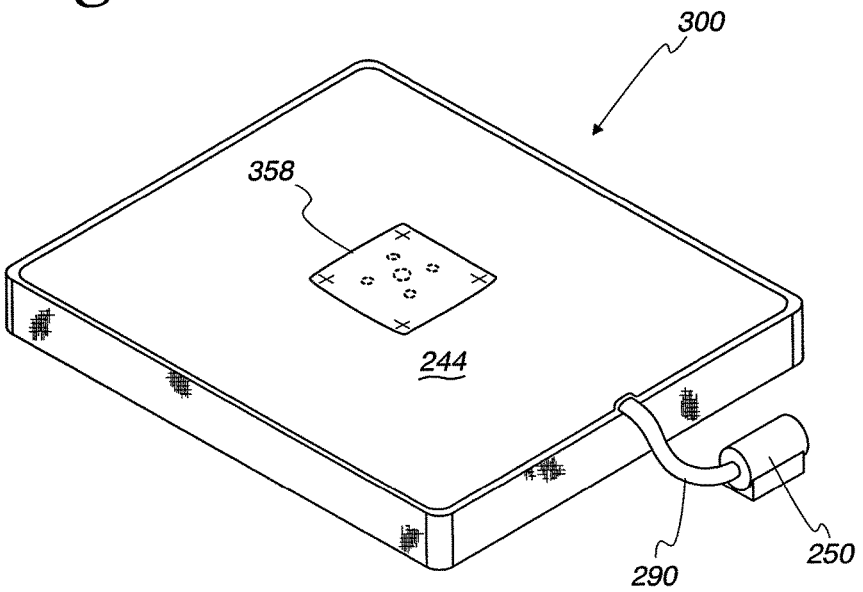
FIG. 63 is an alternate embodiment of the invention illustrating a single cover with a rectangular stitch pattern between the two sheets forming the expandable volume having a plurality of centrally located air exit holes with a second cover disposed over the air exit holes.
Figure 64:
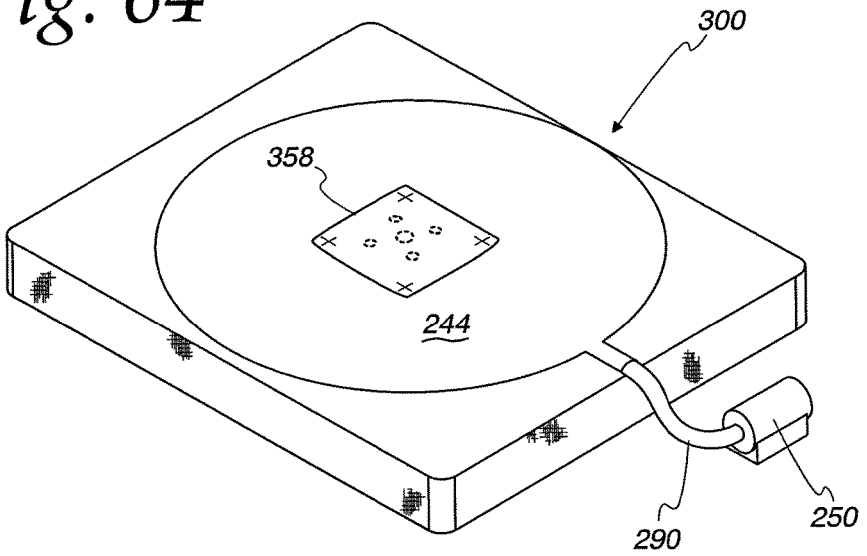
FIG. 64 is similar to FIG. 63 but illustrating a circular stitch pattern.
Figure 65:
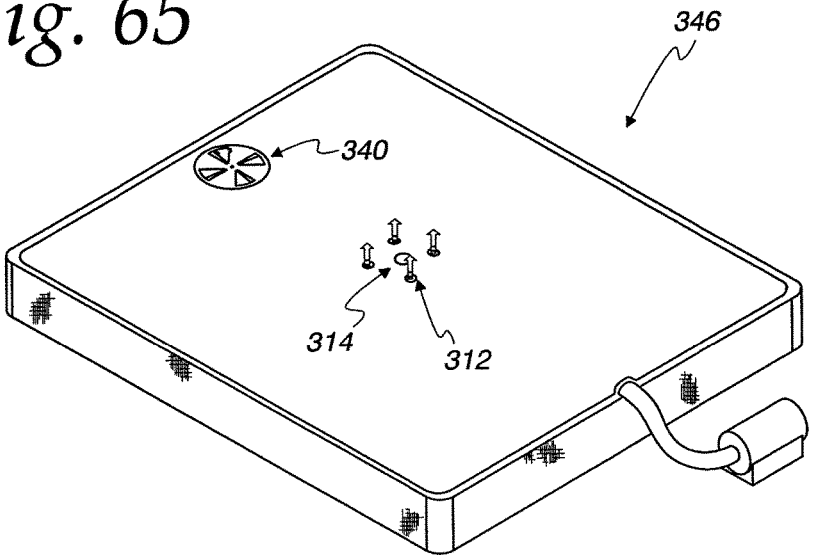
FIG. 65 is similar to FIG. 52 but illustrating centrally located air exit holes.
Figure 66:
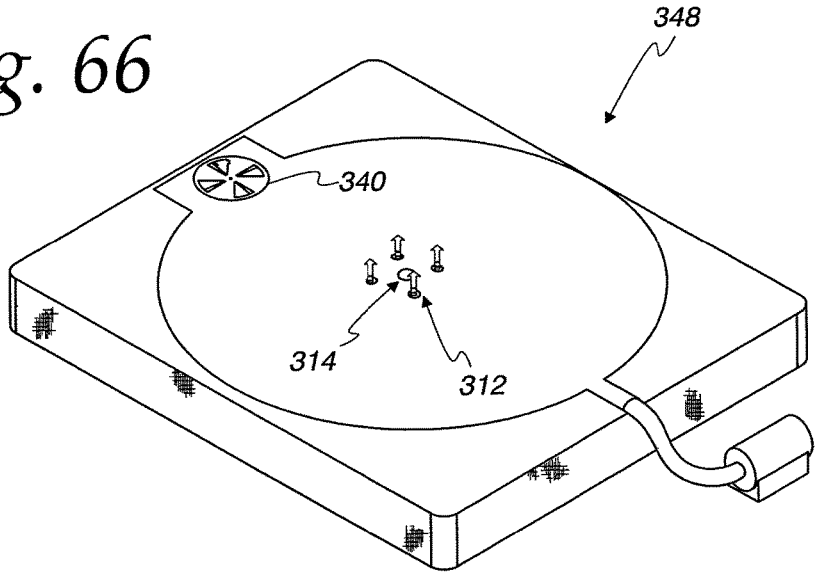
FIG. 66 is similar to FIG. 53 but illustrating centrally located air exit holes.
Figure 67:
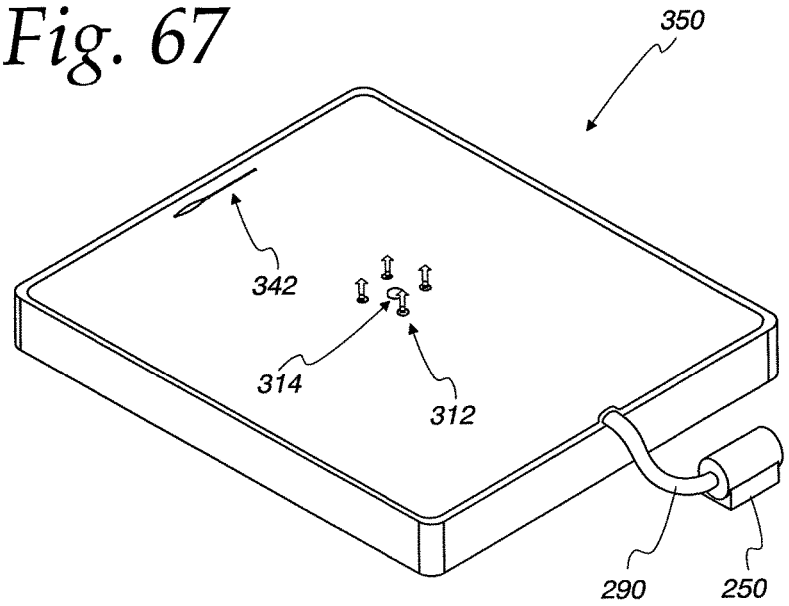
FIG. 67 is similar to FIG. 55 but illustrating centrally located air exit holes.
Figure 68:
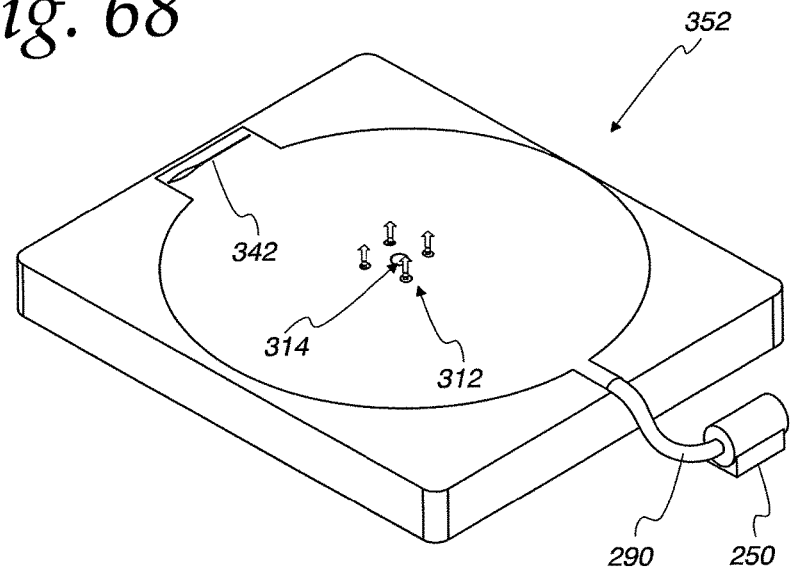
FIG. 68 is similar to FIG. 56 but illustrating centrally located air exit holes.
Figure 69:
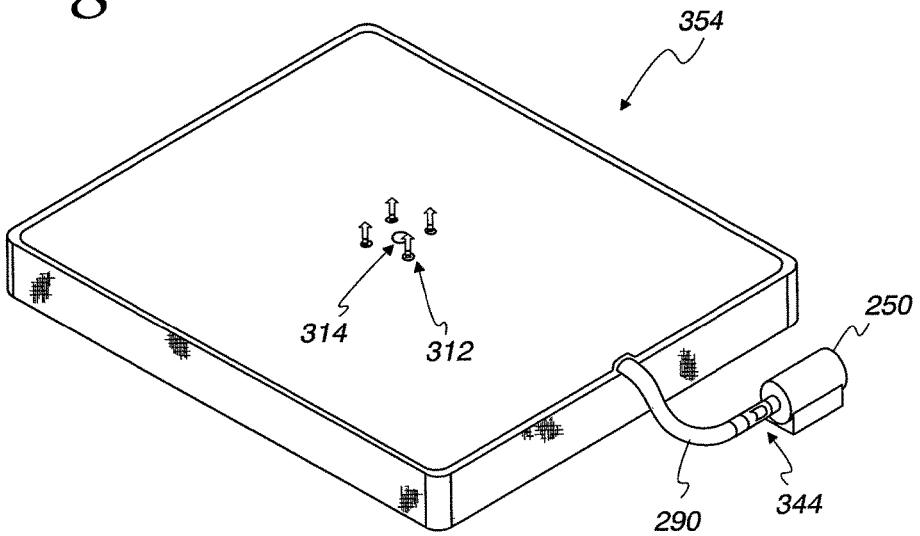
FIG. 69 is similar to FIG. 58 but illustrating centrally located air exit holes.
Figure 70:
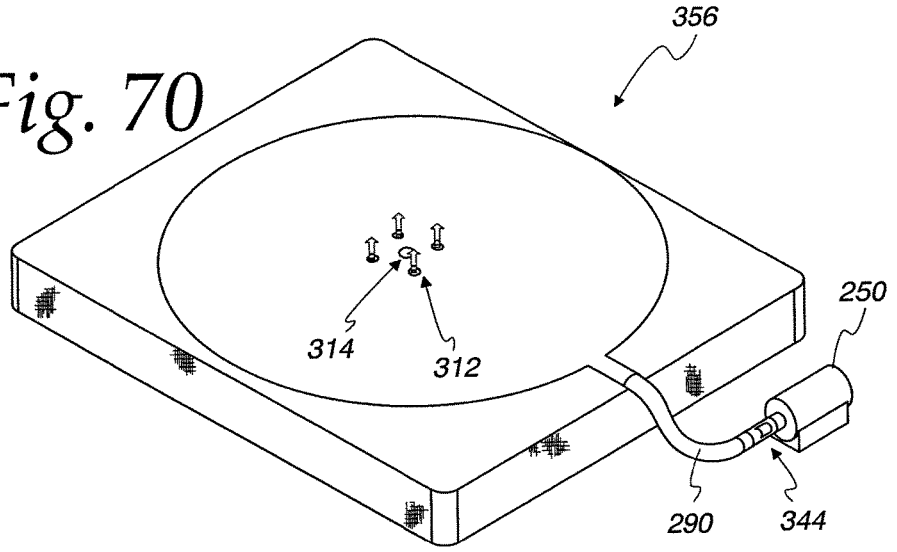
FIG. 70 is similar to FIG. 59 but illustrating centrally located air exit holes.
Figure 71:
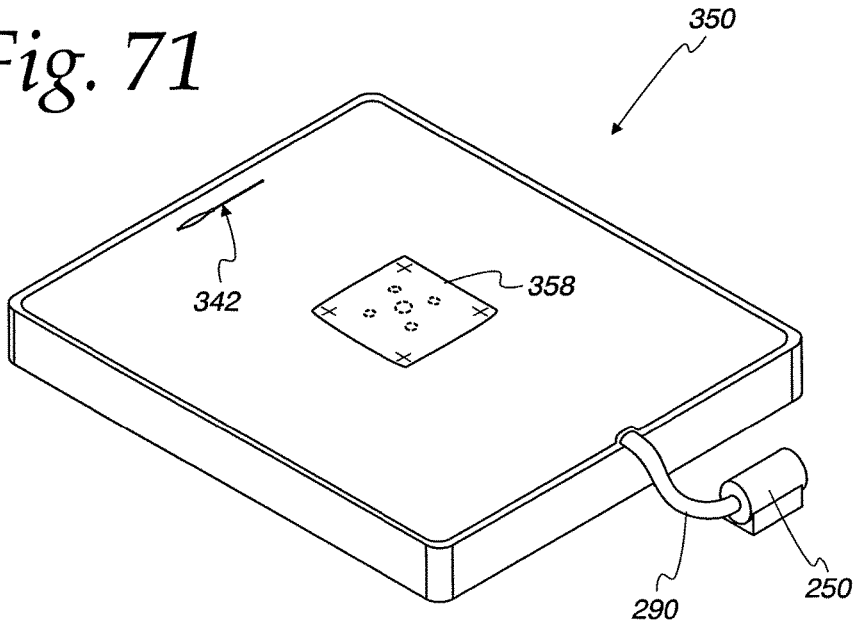
FIG. 71 is similar to FIG. 63 but including one embodiment of an adjustable air exit valve.
Figure 72:
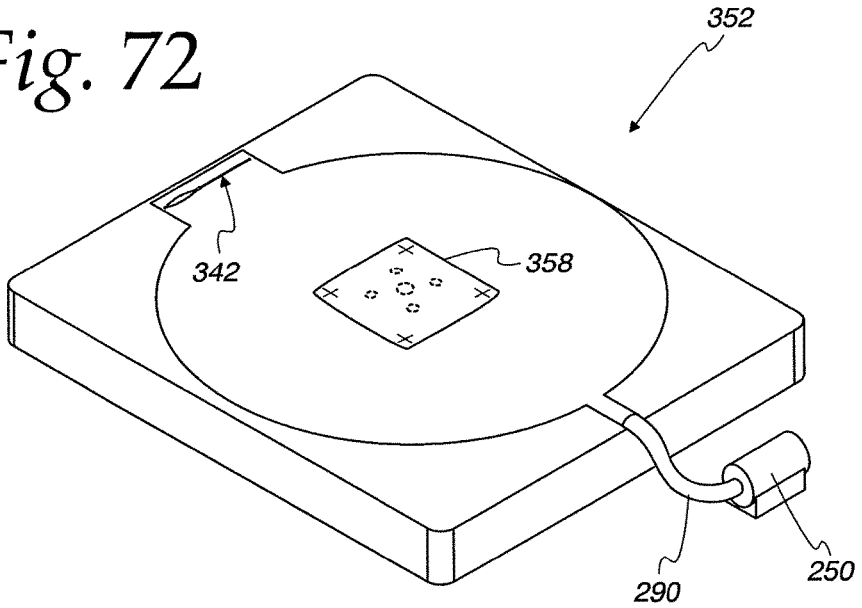
FIG. 72 is similar to FIG. 64 but including one embodiment of an adjustable air exit valve.
Figure 73:
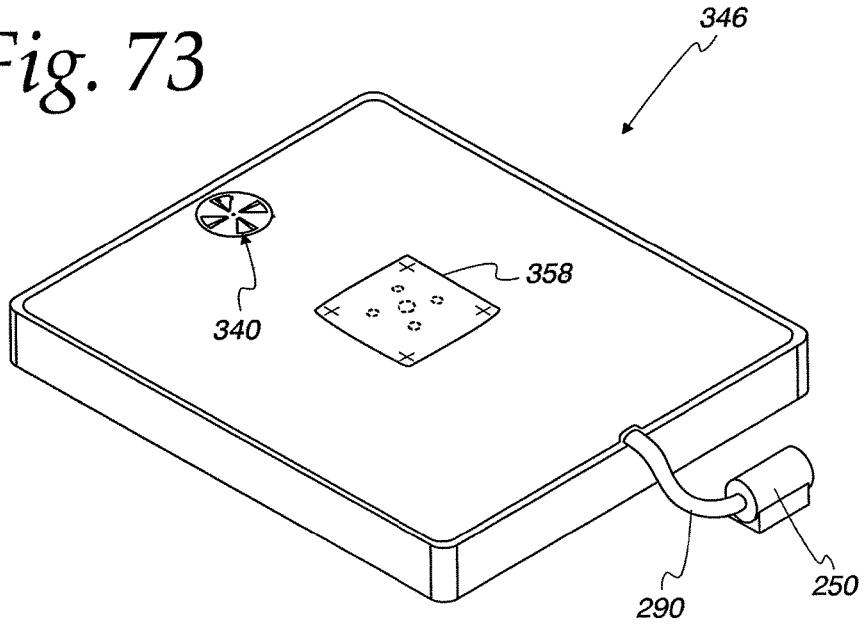
FIG. 73 is similar to FIG. 63 but including a second embodiment of an adjustable air exit valve.
Figure 74:
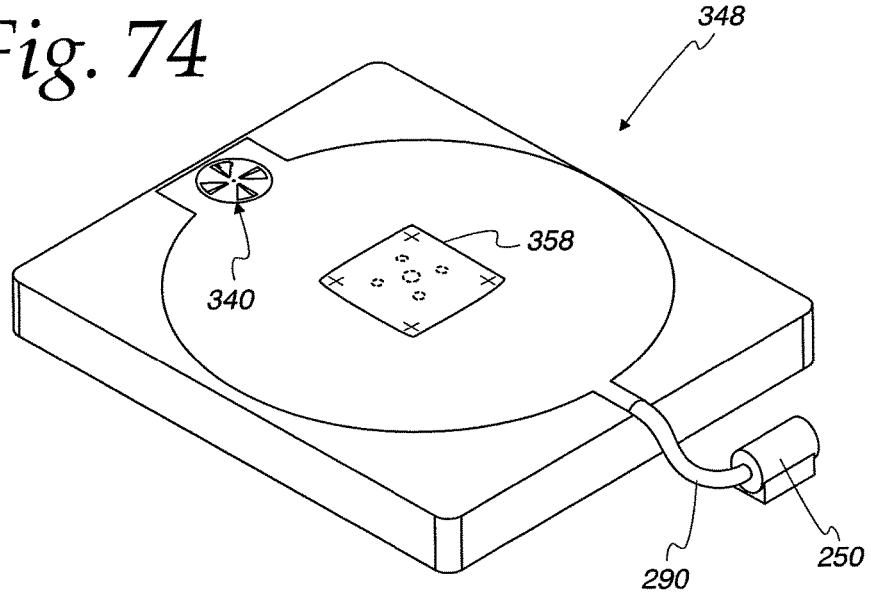
FIG. 74 is similar to FIG. 64 but including a second embodiment of an adjustable air exit valve.
Figure 75:
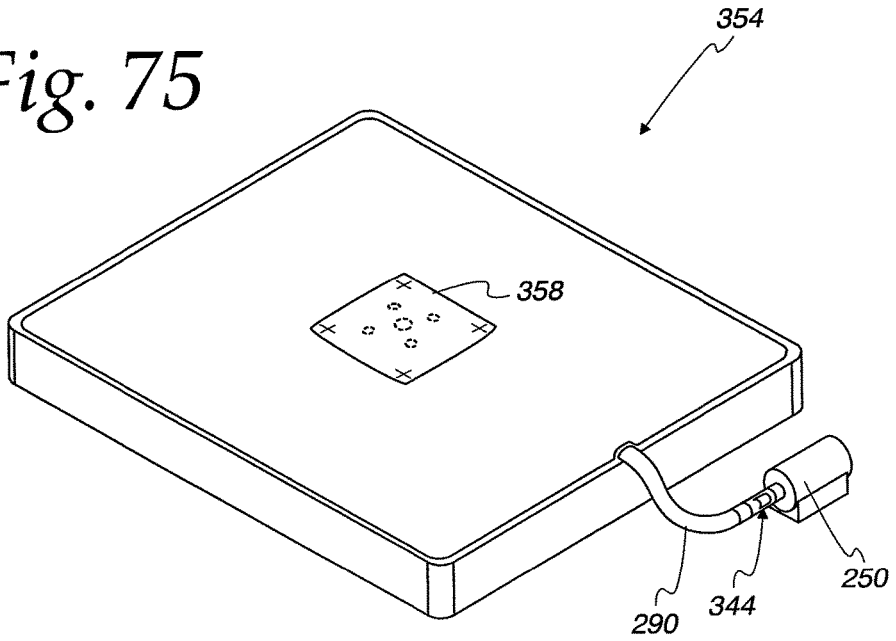
FIG. 75 is similar to FIG. 63 but including a third embodiment of an adjustable air exit valve.
Figure 76:
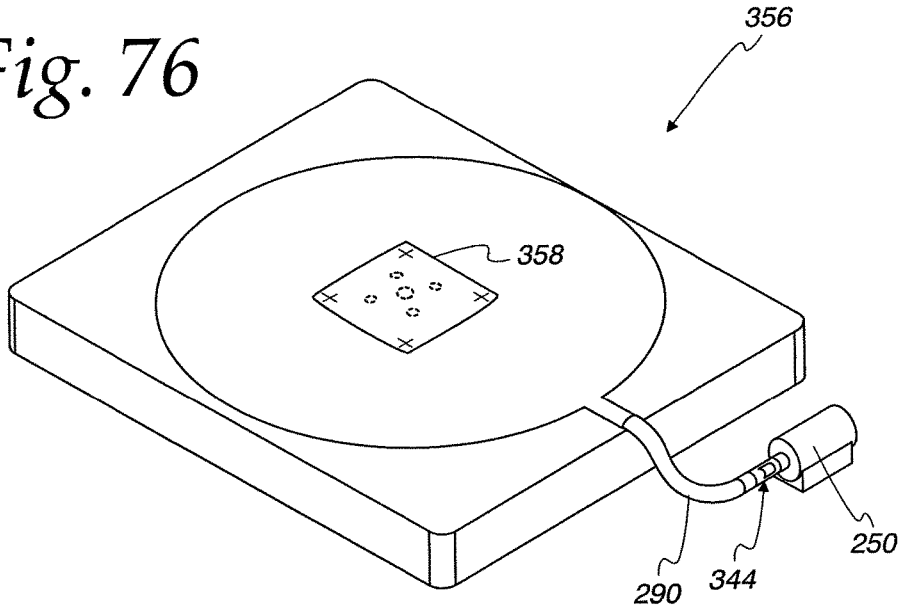
FIG. 76 is similar to FIG. 64 but including a third embodiment of an adjustable air exit valve.

The covers 336 and 338 may include a third type of adjustable air exit valve 344, as indicated in FIGS. 60-62. As shown, the adjustable air exit relief valve 344 is incorporated into the conduit 290 attached to the air pump 25. The adjustable air exit valve 344 may include adjustment marks so hotel house keepers, for example, can quickly and easily set all of the beds under their control to the same value.

FIGS. 65-70 are similar to the embodiments illustrated in FIGS. 52, 53, 55, 56, 58 and 59. These embodiments, identified with the reference numerals 346, 348,350, 352, 354 and 356 all include the air exit holes 312 and one of the adjustable air exit valves 340 (FIG. 54); 342 (FIG. 57) or 344 (FIGS. 60-62).

FIGS. 63, 64, 71-76 illustrate exemplary embodiments of the invention which utilize a separate piece of material over the air exit holes to resist air flow. One of the principals of the invention is that the interfacing material in contact with the air exit holes must provide some resistance to the effluent air flow. In many applications, the porosity of the material of the underside of the mattress or the foundation is sufficient to provide enough resistance to cause levitation of the mattress. In other applications. the porosity of the interfacing material is not sufficient. In those applications, a small piece of supplemental interfacing material, for example nylon ripstop, is placed over the air exit holes 312 of the covers 300, 302, 350, 352, 346, 348, 354 and 356, as shown. The supplemental interfacing material 358 may be attached to the various covers 300, 302, 350, 352, 346, 348, 354 and 356 by various conventional attachment means, such as Velcro, stitching or other attachment means.

Figure 77:
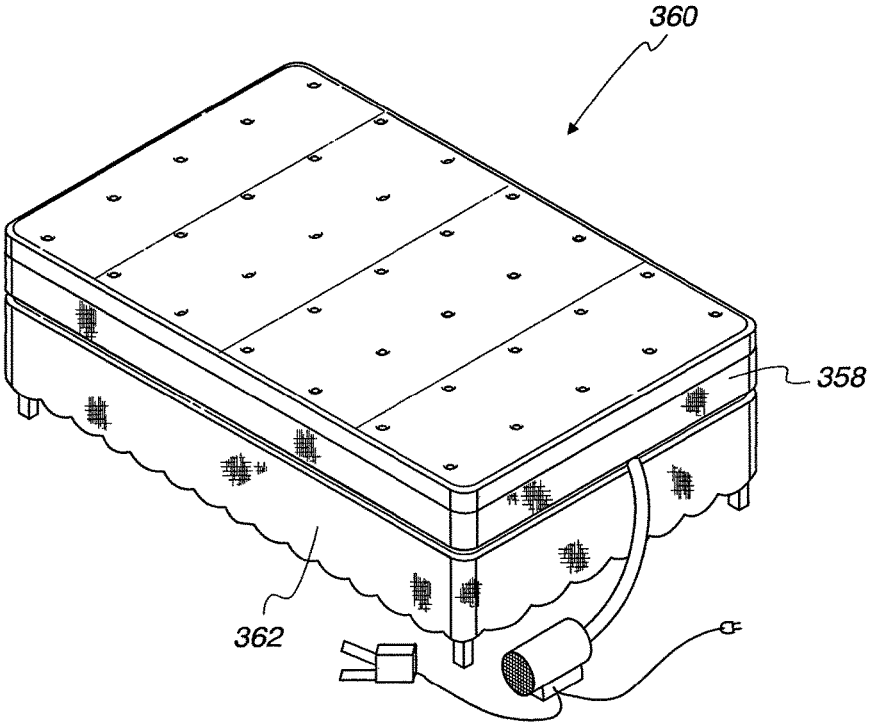
FIG. 77 is an isometric view of single cover version of the present invention, shown installed on the underside of a mattress.

FIG. 77 illustrates an exemplary application of the mattress management system. In this embodiment, a cover 358 is installed on the underside of a mattress 360 that rests on a foundation 364 (FIG. 78). A bed skirt 362 is disposed on the foundation 364. As shown in FIG. 78, the cover is attached to the mattress 360 so that air holes go up and contact the underside of the mattress 360. Alternatively, the cover 358 could have been juxtaposed relative to the mattress so the air flowed downwardly (not shown).

FIGS. 79-81 illustrate the use of the mattress management system illustrated in FIGS. 78 and 79 for bed making. As shown in FIGS. 79 and 80, the inflatable air volume portion of the cover 358 inflates lifting the mattress 360 from the foundation 364. In order to allow a bed sheet 366 to be easily tucked in, as illustrated in FIG. 81.

Figure 82A:
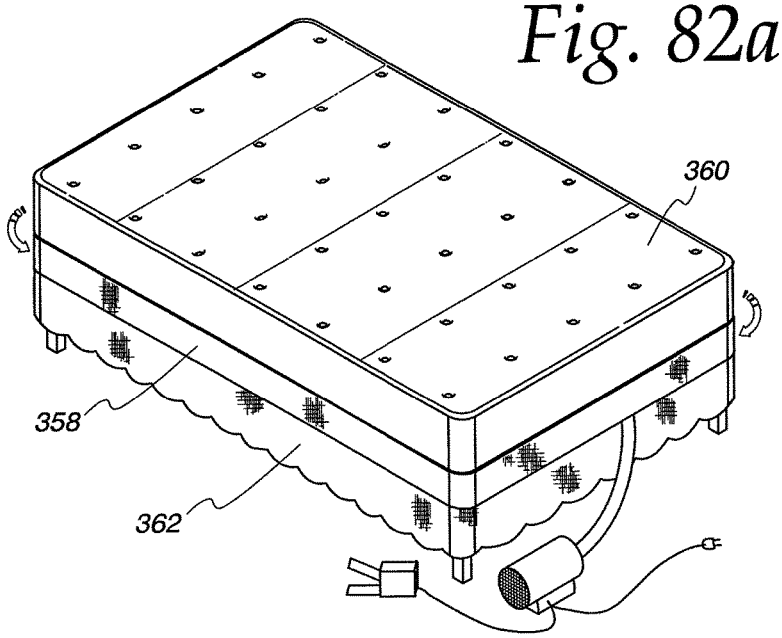
FIG. 82*a* is an isomeric view of a single cover mattress management system installed on the underside of a mattress and illustrating a bed skirt installed on the foundation.
Figure 83A:
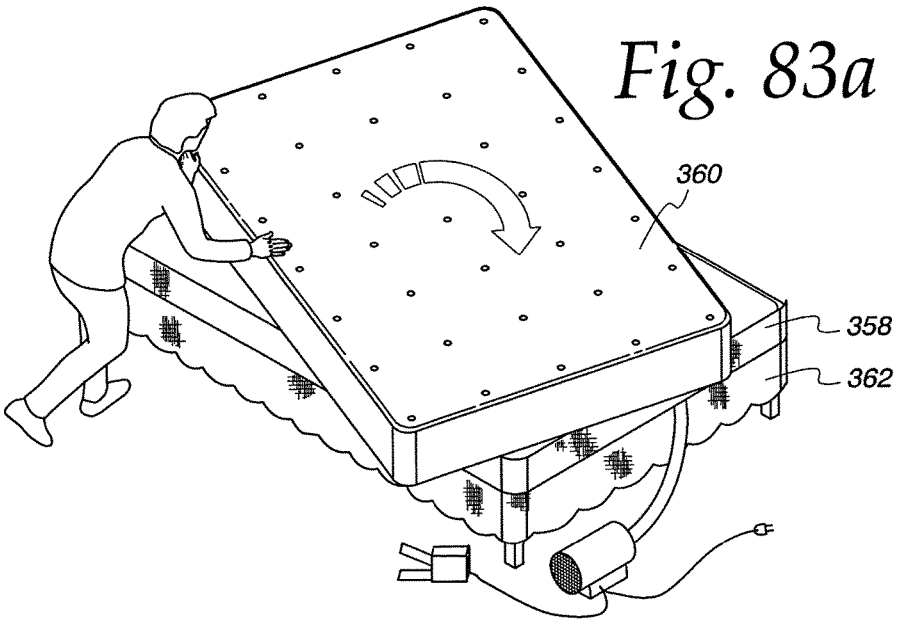
FIG. 83*a* is an isometric view illustrating the cover illustrated in FIG. 82*a* flipped down over the bed skirt while the mattress is being rotated.

FIGS. 82*a* and 83*a* illustrate mattress rotation of the mattress 360 with respect to the foundation 364 in an application as illustrated in FIG. 78. As shown in FIG. 78, the cover 358 is initially attached to the underside of the mattress 360. In order to rotate the mattress 360, the cover 358 is flipped down, i.e. detached from the mattress 360 and attached to foundation 364 over the bed skirt 362 as illustrated in FIG. 82*a*. In this position, the cover 358 holds the bed skirt 362 in place while the mattress 360 is rotated, as illustrated in FIG. 83. Once the mattress is rotated to the desired position, the cover 358 may be re-attached to the underside of the mattress 360.

Figure 82B:
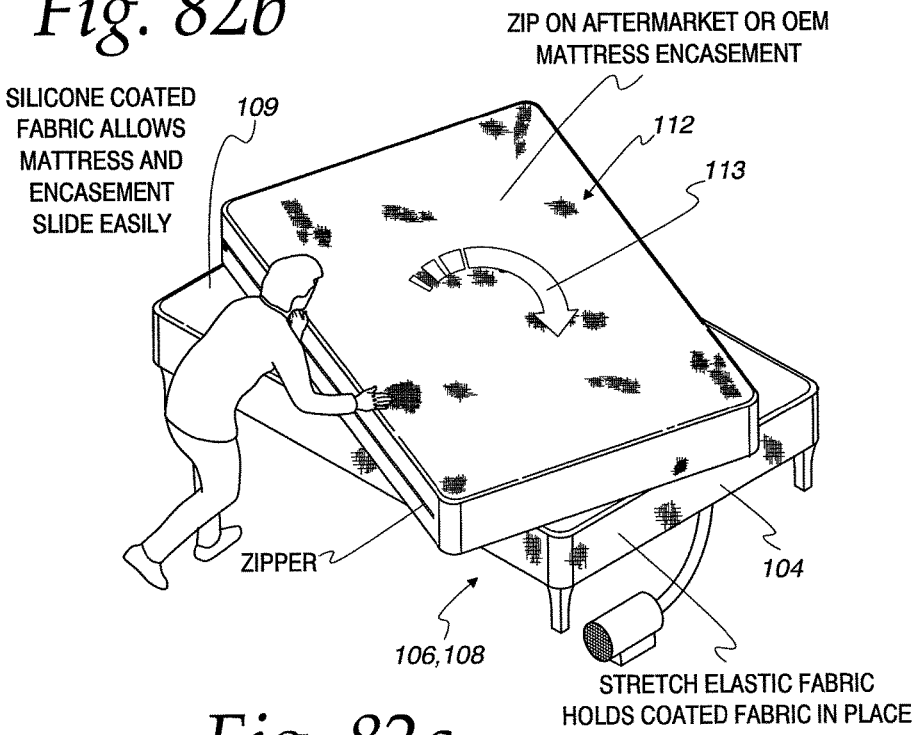
FIGS. 82*b* and 82*c* are similar to FIG. 82*a* but are shown without a bed skirt and with the mattress encased with an encasement as illustrated in FIGS. 24*a* and 24*b*.
Figure 82C:
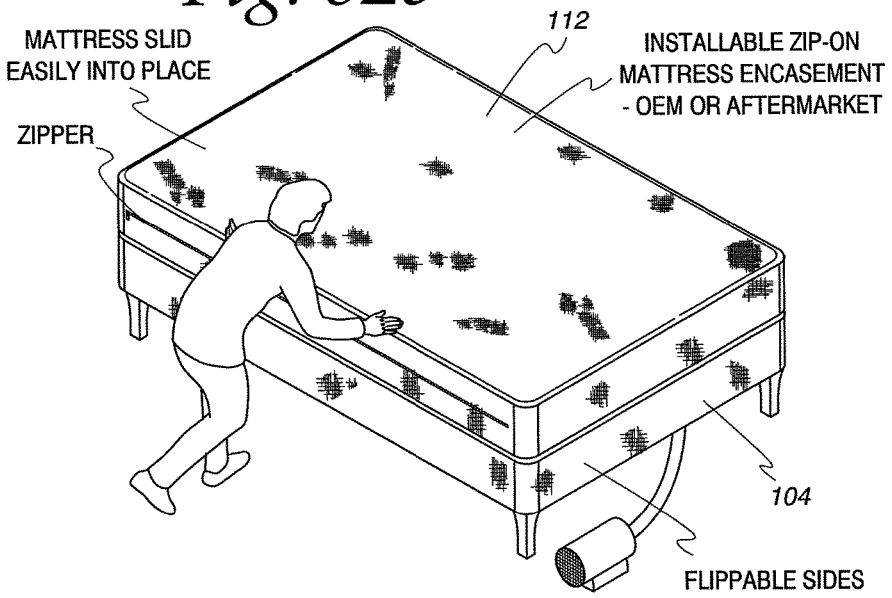
Figure 83B:
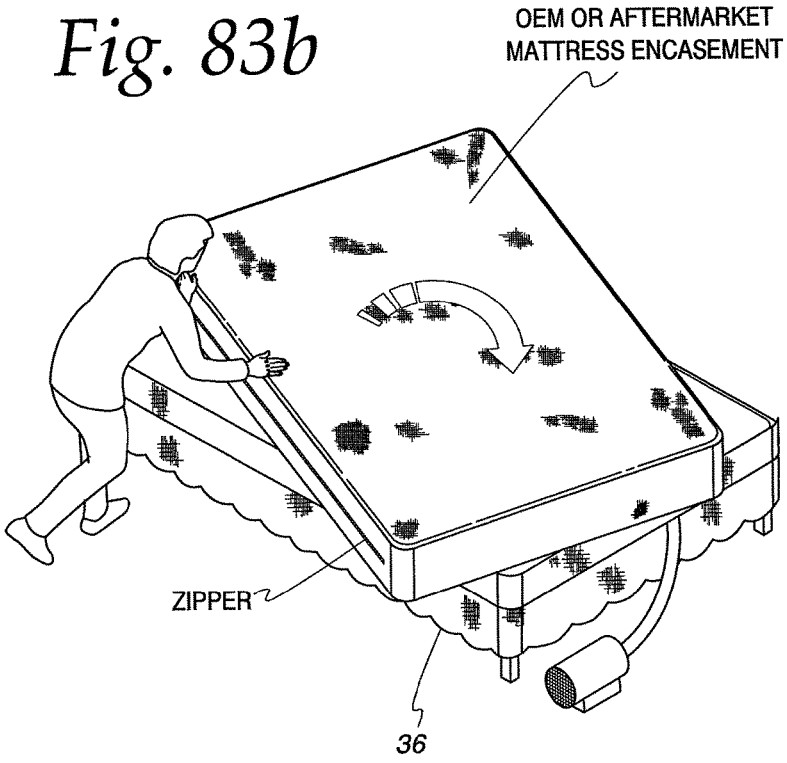
FIG. 83*b* is similar to FIG. 83*a* but illustrating the mattress encased in an encasement as illustrated in FIGS. 24*a* and 24*b*, FIGS. 83*c* and 83*d* are similar to FIG. 83*b* but without a bed skirt and illustrating the cover hiding the zipper of the encasement.
Figure 83C:
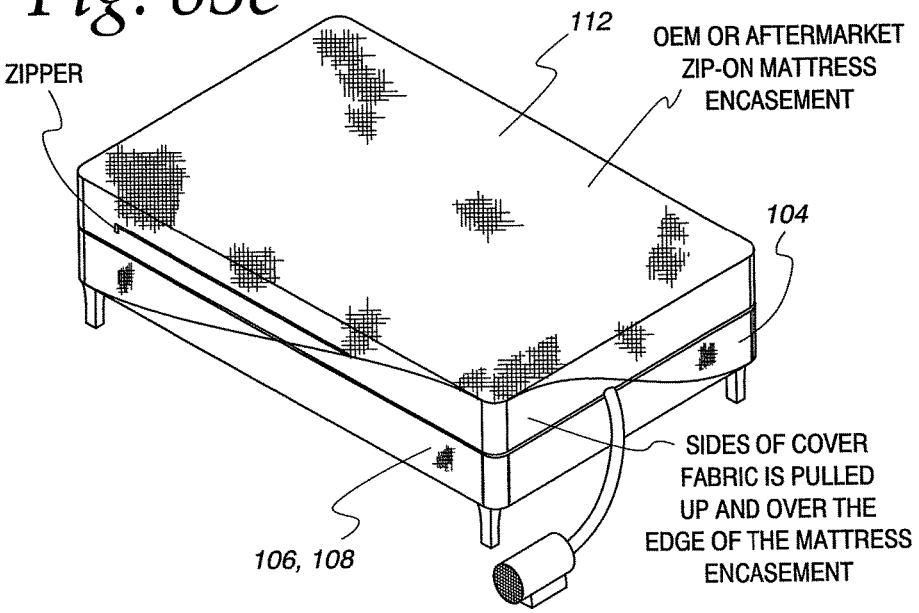
Figure 83D:
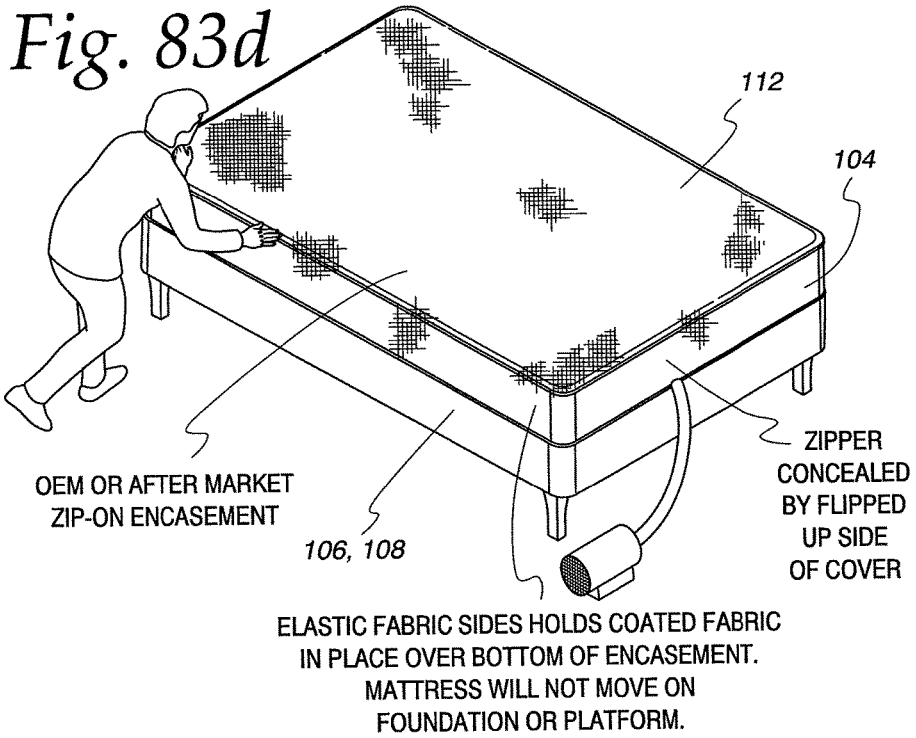

FIGS. 82*b* and 82*c* are similar to FIGS. 82*a* and 83*a* but shown without a bed skirt and with the mattress encased in an encasement, as illustrated in FIGS. 24*a* and 24*b*. FIG. 83*b* is similar to FIG. 83*a* but shown with the mattress encased in an encasement, as illustrated in FIGS. 24*a* and 24*b*. FIG. 83*c* is similar to FIG. 82*b* but without a bed skirt and illustrate how the cover hides the zipper on the encasement when it is flipped up.

FIGS. 84-91 illustrate the mattress management system being used to remove the mattress 360 from the platform 364 for example, to replace the bed skirt 362, and re-insert the mattress 360 over the platform 364 after the bed skirt 362 has been removed and optionally replaced.

Figure 88:
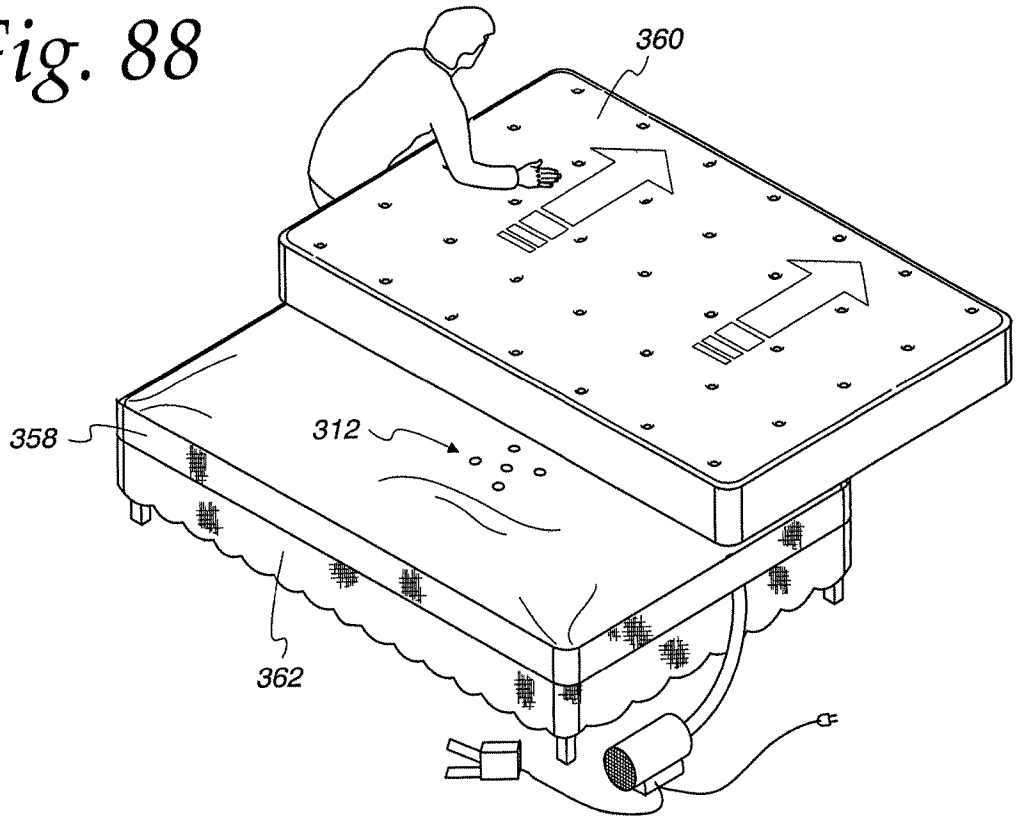
FIG. 88 is similar to FIG. 86 but illustrating a passive mode in which the mattress is removed without an air assist.
Figure 89:
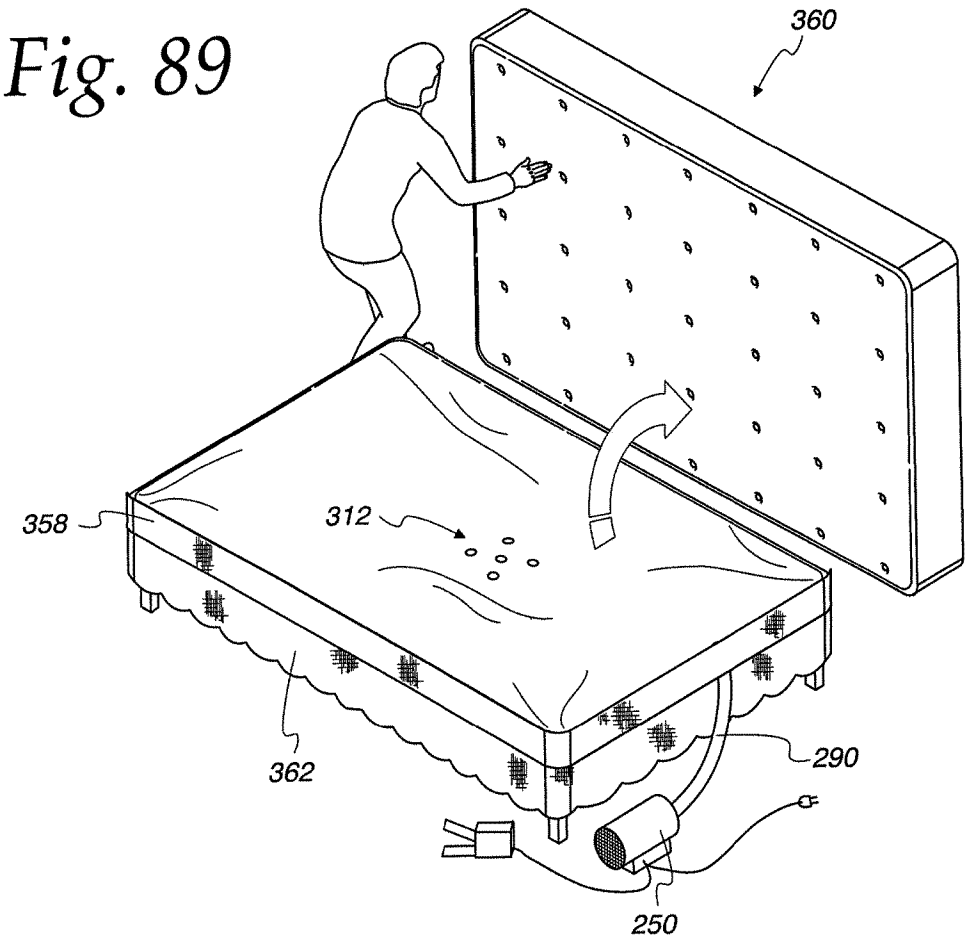
FIG. 89 is similar to FIG. 88 but shown with the mattress completely removed in the passive mode.
Figure 90:
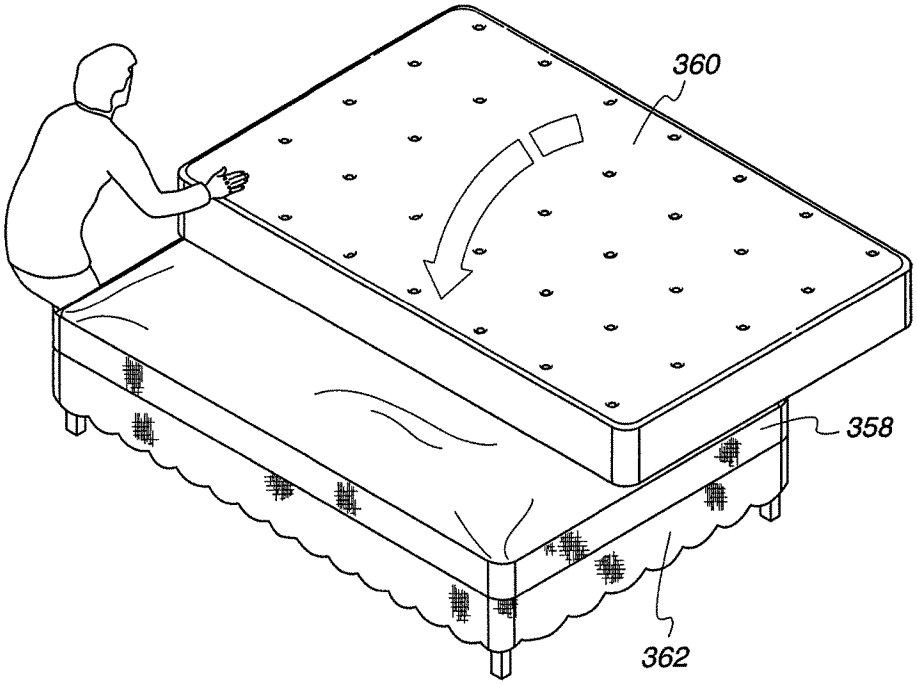
FIG. 90 illustrates a partial reinstallation of the mattress onto the foundation and illustrating the single cover in accordance with the present invention attached to the foundation.
Figure 91:
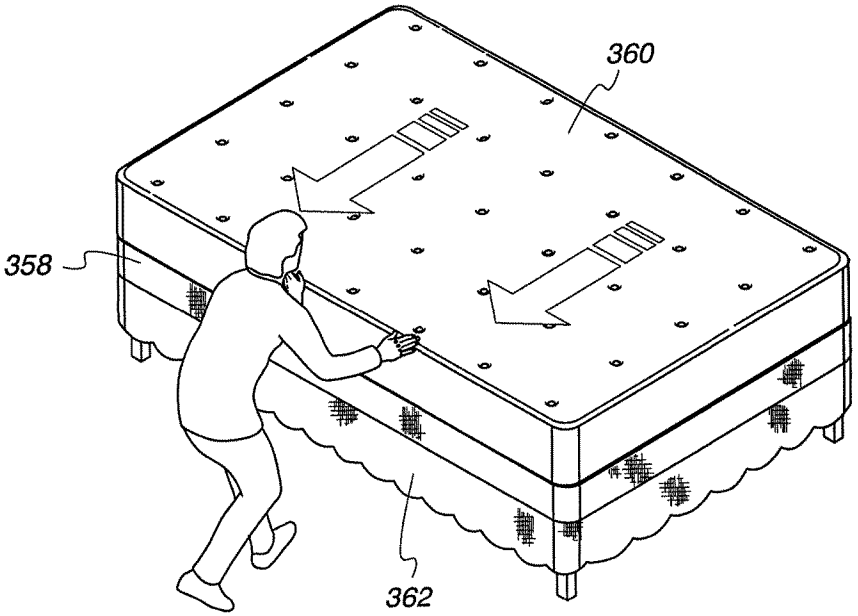
FIG. 91 is similar to FIG. 90 but illustrating the mattress fully installed over the foundation.

FIGS. 84-87 illustrate an air assisted application for removing the mattress from the platform 364. FIGS. 88 and 89 illustrate an application without an air assist. FIGS. 90 and 91 illustrate re-installation of the mattress 360 over the platform 364.

Figure 84:
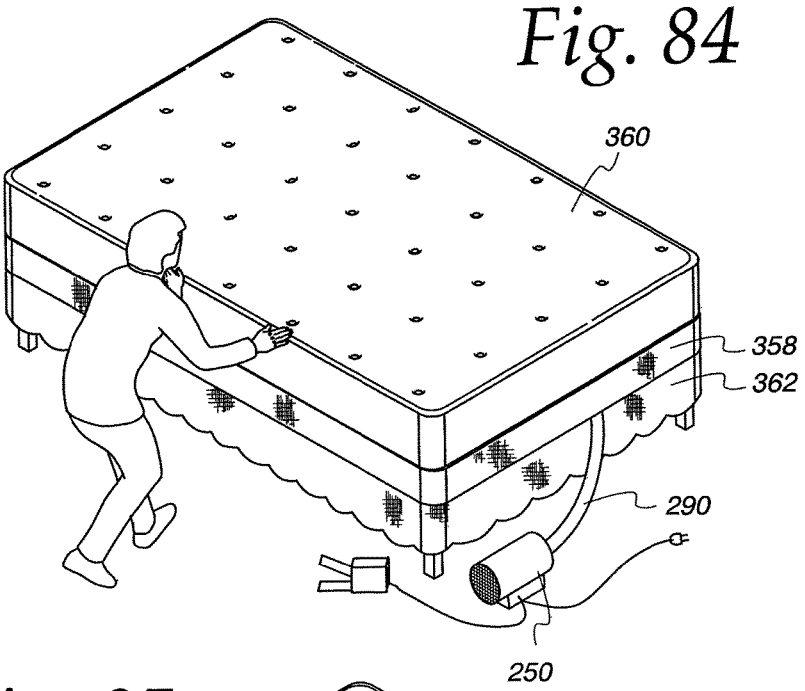
FIG. 84 illustrates another aspect of the invention which relates to changing the bed skirt, illustrating a user initiating removal of the mattress from the foundation.
Figure 85:
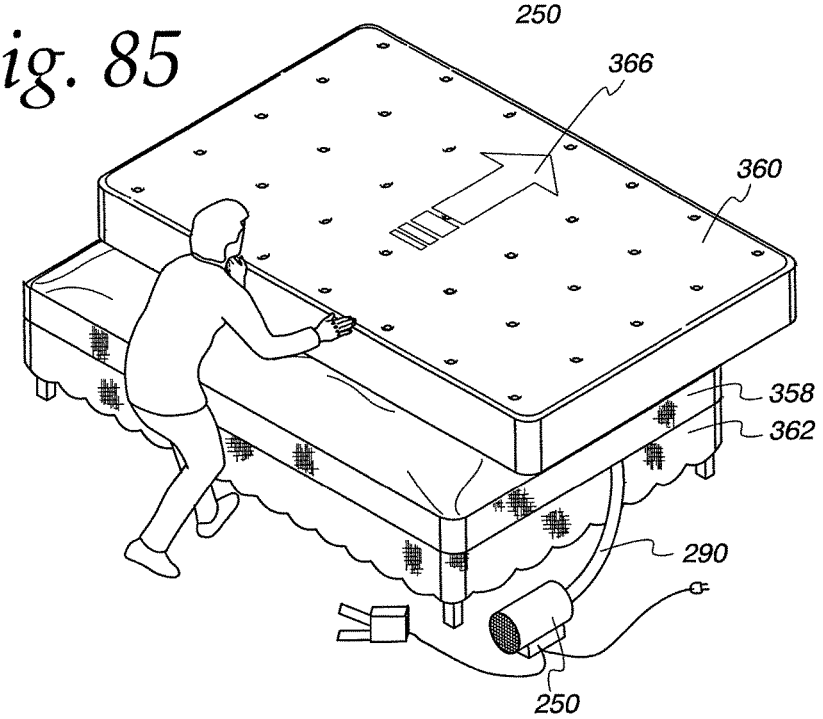
FIG. 85 is similar to FIG. 84 but showing the mattress partially removed.
Figure 86:
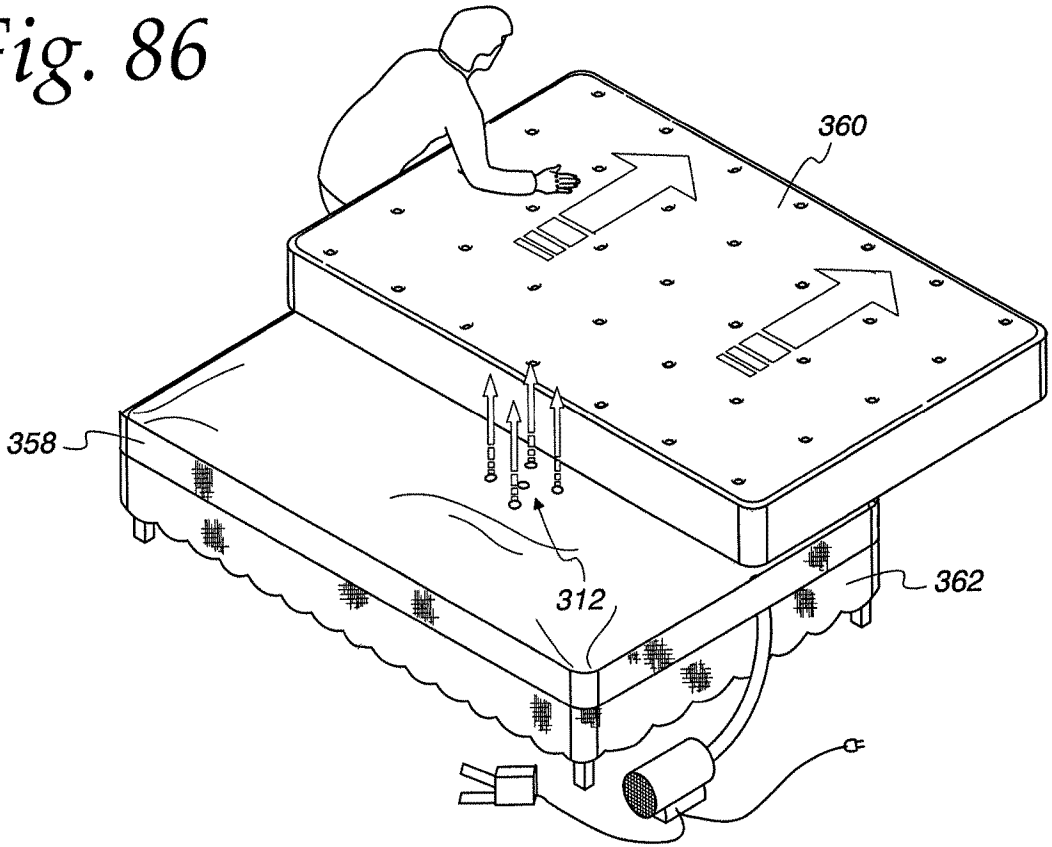
FIG. 86 is similar to FIG. 85 but showing the mattress removed to a position where the air exit holes on the cover are exposed.
Figure 87:
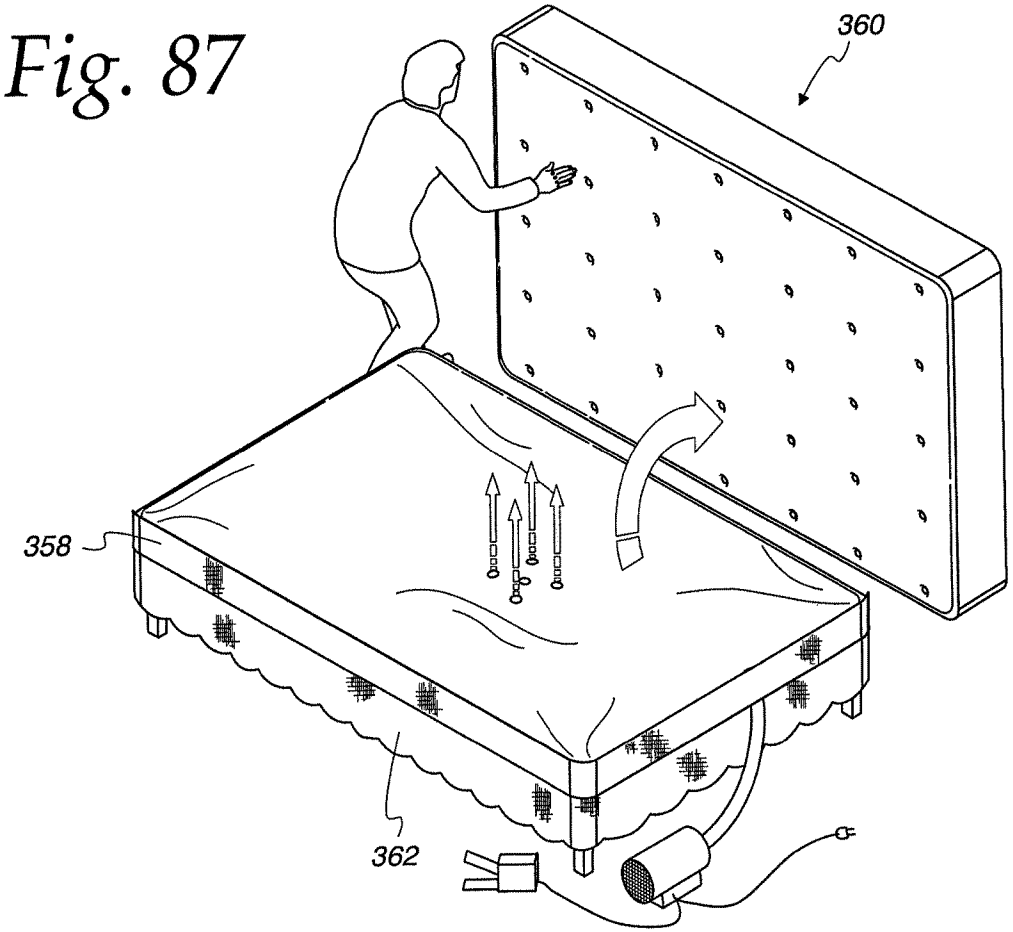
FIG. 87 is similar to FIG. 86 but showing the mattress totally removed.

Referring first to FIGS. 84-87, The cover 358 is detached from the underside of the mattress 360 and attached to the platform 364 over the bed skirt 362, as shown in FIG. 84. The air assist from the air pump 250 slightly lifts the mattress 360 relative to the platform 364 enabling the mattress to be pushed in the direction of the arrow 366 with little effort, as shown in FIG. 85. The momentum allows the mattress 360 to be continuously pushed with relatively less effort than normal, as illustrated in FIG. 86 until the mattress 360 is completely free of the foundation 364, as shown in FIG. 87.

FIGS. 88 and 89 illustrate removal of the mattress 360 from the foundation 364 without an air assist from the air pump 250. In this application, the cover 358 is detached from the underside of the mattress 360 and attached to the platform 364 to hold the bed skirt 362 in place. In this embodiment, the cover 358 is formed with a relatively slick surface which allows the mattress to be pushed and slid off the platform 364 without disturbing the bed skirt 362.

In all embodiments, once the mattress 360 is completely removed from the platform 364, the cover 358 and the bed skirt 362 are removed. A new bed skirt 362 is placed over the platform 364 and the cover 358 is attached to the platform 364 over the bed skirt 362.

In both the air assist and non-air assist applications, the mattress 360 is juxtaposed over the foundation under the influence of gravity, as generally illustrated in FIG. 90. As shown, the mattresses 360 falls over the air exit holes 312. In an air assisted application, the mattress 360 can be pulled or pushed into position, as shown in FIG. 91 with little effort. In a non-air assisted application, the mattress can be pushed into position, as shown in FIG. 91 with relatively less effort due to the slick surface on the cover 358. In both applications, once the mattress 360 is in place, as indicated in FIG. 91, the cover 358 is detached from the platform 364 and re-attached to the underside of the mattress 360.

FIGS. 152-157 are similar to FIGS. 84-91 but illustrate the mattress encased in an encasement, as illustrated in FIG. 24*a* or 24*b*.

Figure 92:
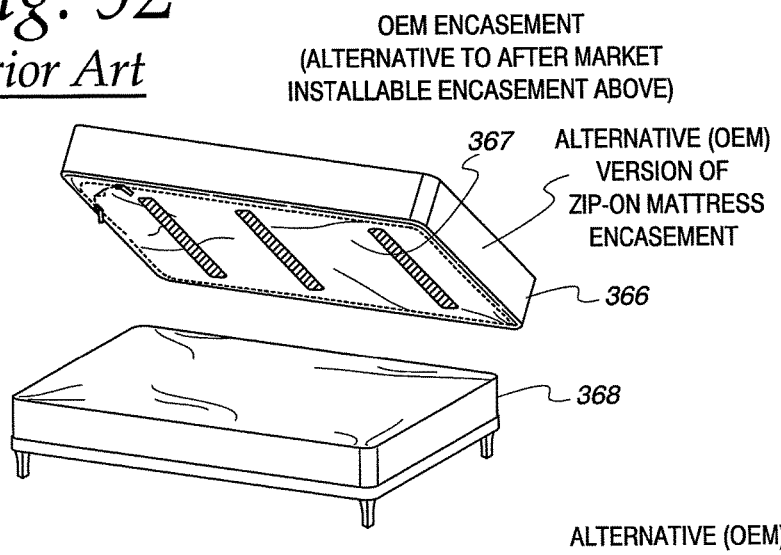
Fig. 92 Prior Art
FIG. 92 is an isometric view of a prior art bed shown with the mattress removed.
Figure 93:
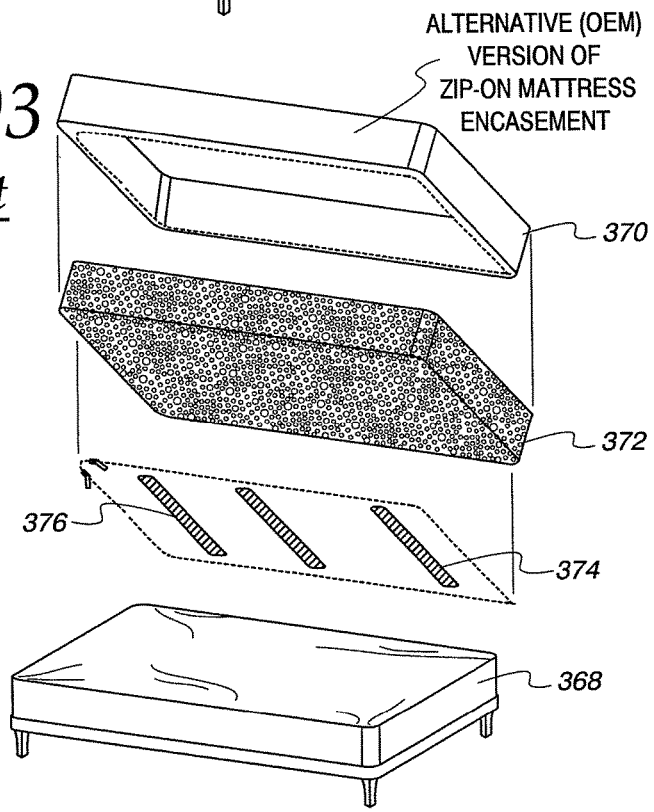
Fig. 93 Prior Art
FIG. 93 is similar to FIG. 92 but illustrates the mattress in an exploded view.

FIG. 92 illustrates a mattress 366 and a foundation 368 that are known in the prior art. FIG. 93 illustrates the mattress 366 and the foundation 368, with the mattress 366 shown in an exploded view. Referring to FIG. 93, the mattress 366 includes a mattress shell 370, a foam rubber mattress support 372 and a bottom panel 374, attached to the mattress shell 370 by way of a zipper (not shown). A plurality of friction strips 376 is located on the underside of the panel 374. The friction strips 376 help prevent the mattress assembly 366 from sliding with respect to the foundation 368. The foundation 368 consists of fixed platform, for example, box springs.

FIGS. 94-121 illustrate various embodiments of mattress management system in accordance with the present invention incorporated into the mattress assembly 366 and platform 368, illustrated in FIGS. 92 and 93. FIG. 122 illustrates a known bed with an adjustable platform. FIGS. 123 and 124 illustrate various embodiments of the mattress management system incorporated into the bed illustrated in FIG. 122.

Figure 94:
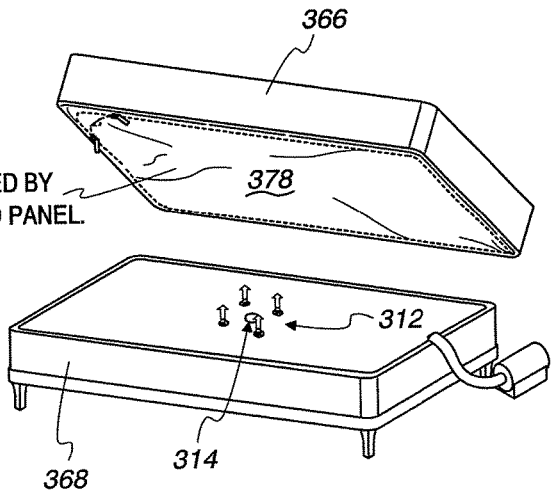
FIG. 94 is similar to FIG. 92 but illustrates a one cover embodiment of the invention with a rectangular stitch pattern embedded in the foundation and a slick surface panel embedded in the underside of the mattress.

Referring first to the embodiments illustrated in FIGS. 94-121, the first of such embodiments is illustrated in FIG. 94. In that embodiment, the zip-out panel 374 is replaced with a panel 378 having a slick surface facing downward. Moreover, the zip-out panel in the embodiments illustrated in FIGS. 96, 98, 100,102, 104, 106, 108, 110 and 112 is likewise replaced with a panel 378 having a slick surface facing downward. An exemplary two piece cover 380 in accordance with present invention is attached or embedded in the foundation 368. The exemplary cover 368 is configured so the center points of the two sheets forming the cover are attached, as indicated by the reference numeral 314. The exemplary cover 380 also includes a plurality of air exit holes 312. FIG. 95 illustrates another exemplary embodiment. In this embodiment, the zip=out panel 374 is replaced by a cover (not shown) with a slick bottom side. A cover 382 is zipped into the underside of the mattress 366. The cover includes air exit holes 312 and includes the connection 314 between the two sheets forming the cover 382. The cover 382 includes an elastic collar that is attached to the mattress 366 to allow the mattress 360 to be slid or rotated with respect to the foundation 368. The side of the cover facing the foundation 368 is formed with a relatively slick surface. In order to prevent rotation of the mattress 366 with respect to the foundation 368, the collar 384 is disconnected from the mattress 366 and connected to the foundation.

FIGS. 140*a*-140*b* are similar to FIG. 95 but are shown and shown with attachment members on both the cover and the mattress for selectively securing the cover to the mattress.

Figure 96:
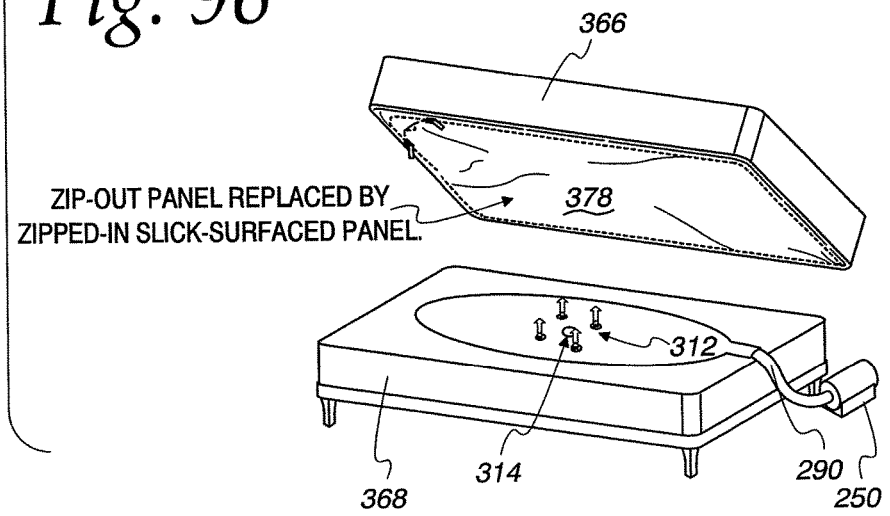
FIG. 96 is similar to FIG. 94 but illustrating an circular or oval stitch pattern.
Figure 97:
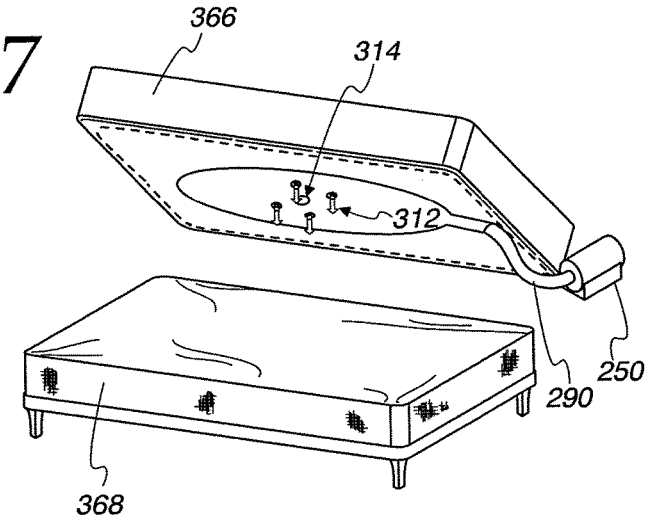
FIG. 97 is similar to FIG. 95 but illustrating a circular or oval stitch pattern.

FIGS. 96 and 97 are similar to FIGS. 94 and 95 and differ with respect to the stitch patterns used for creating the inflatable air volume. FIGS. 94 and 95 illustrate a generally rectangular air volume while FIGS. 96 and 97 illustrate an oval or circular stitch pattern.

Figure 100:
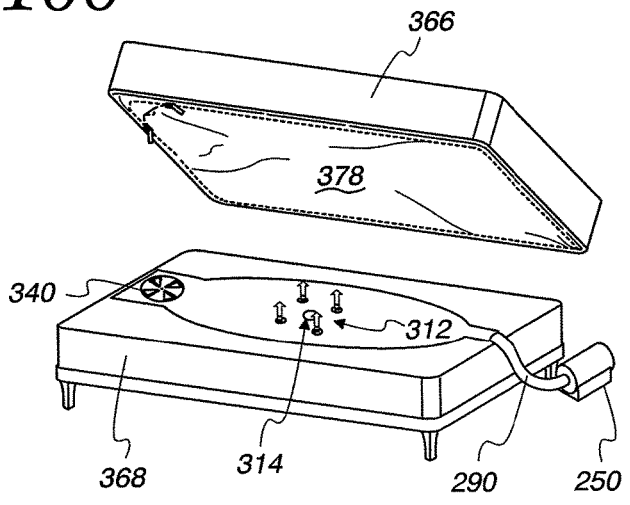
FIG. 100 is similar to FIG. 96 but also illustrating a first embodiment of an adjustable air exit valve.
Figure 101:
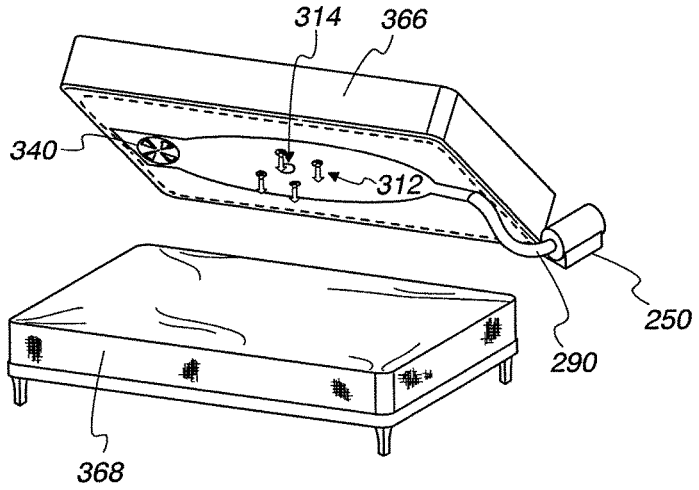
Figure 104:
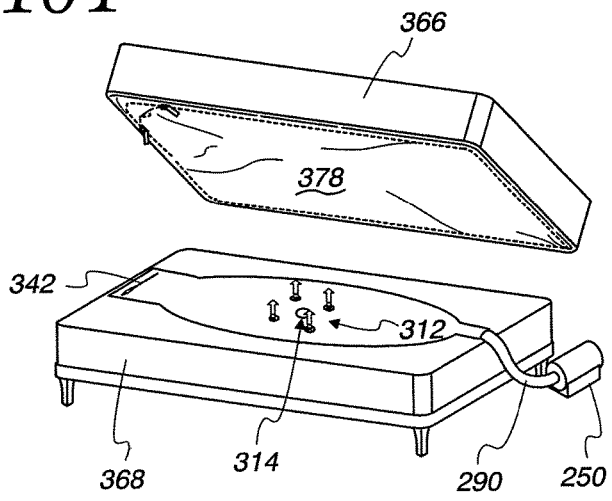
Figure 105:
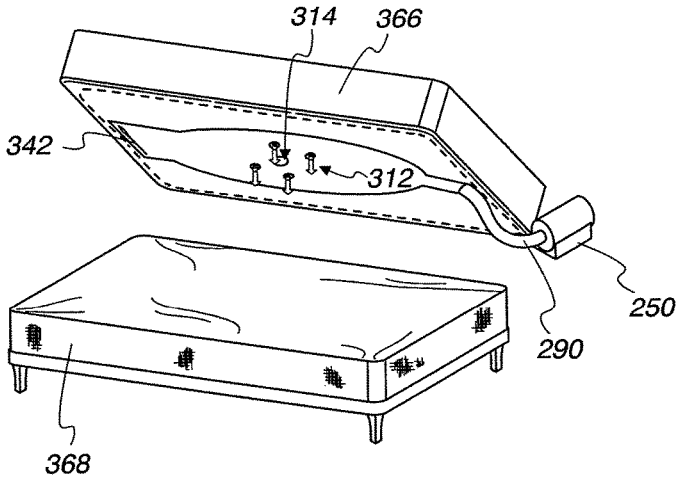
Figure 106:
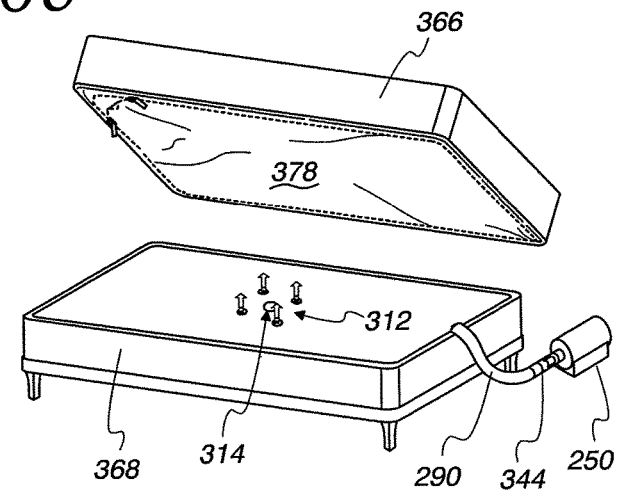
Figure 107:
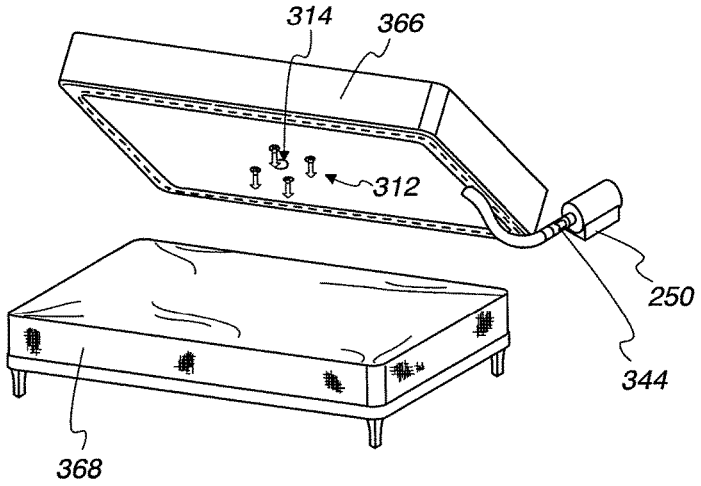
Figure 108:
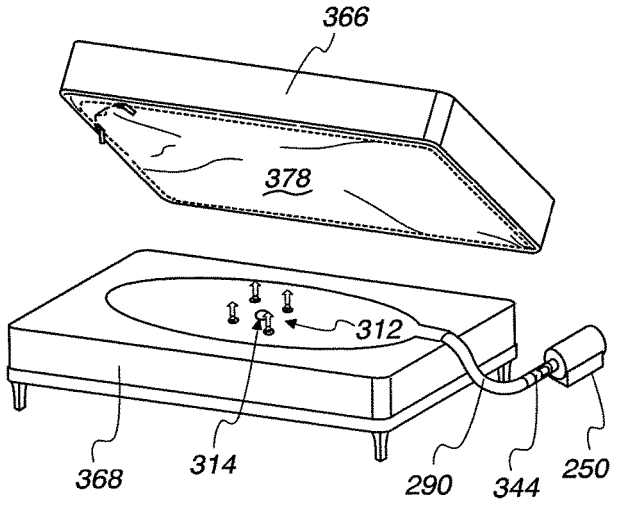
Figure 109:
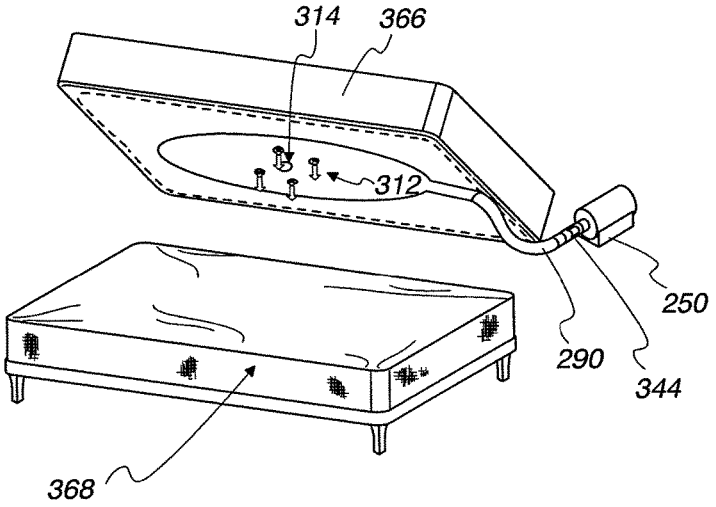

FIGS. 98-109 are similar to FIGS. 94-97 but illustrate different stitch patterns and include adjustable air exit valves. FIGS. 98 and 99 are similar to FIGS. 94 and 95 but include an adjustable air exit valve, as illustrated in FIG. 54. FIGS. 100 and 101 are similar to FIGS. 96 and 97 but include an adjustable air valve 340. FIGS. 102 and 103 are similar to FIGS. 94 and 95 but include an adjustable air exit valve 342, as illustrated in FIG. 57. FIGS. 104 and 105 are similar to FIGS. 96 and 97 but include an adjustable air valve 342. FIGS. 106 and 107 are similar to FIGS. 94 and 95 but include an adjustable air exit valve 344, as illustrated in FIGS. 60-62. FIGS. 108 and 109 are similar to FIGS. 96 and 97 but include the adjustable air exit valve 344.

Figure 95A:
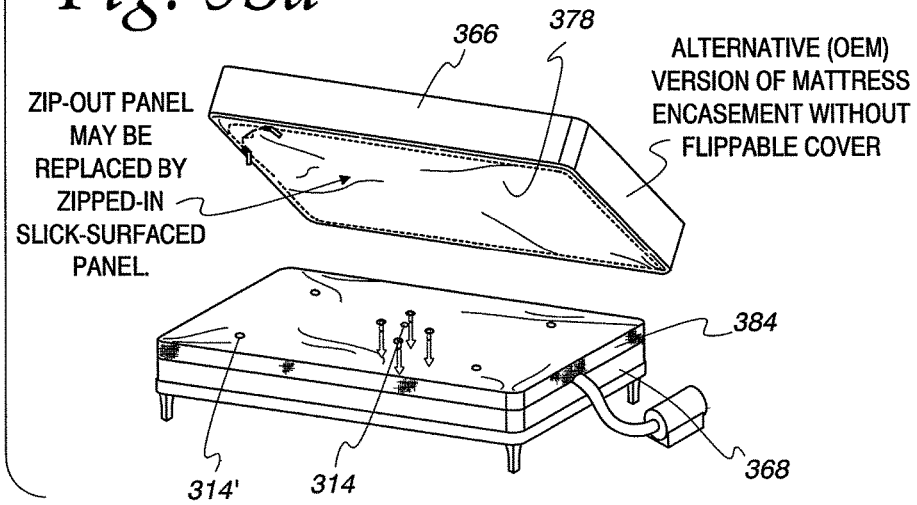
FIGS. 95*a* and 95*b* are similar to FIGS. 94 and 95 but illustrate multiple grommets or connection points joining the 2 sheets of the single cover.
Figure 95B:
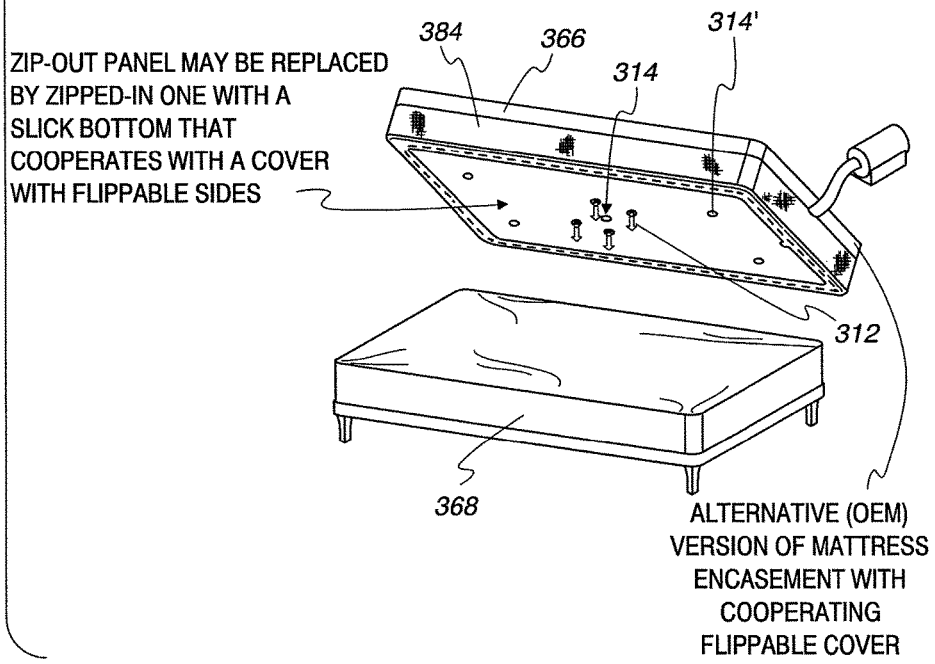
Figure 110:
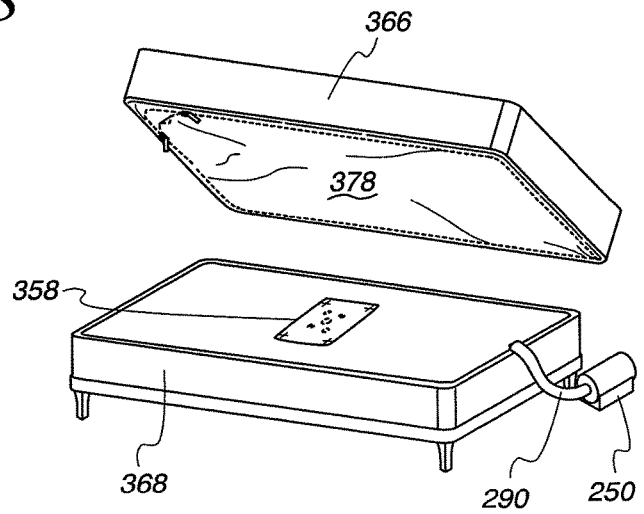

FIGS. 110 and 111 are similar to FIGS. 94 and 95 but include a small piece of supplemental interfacing material 358 over the air exit holes 312. FIGS. 112 and 113 are similar to FIGS. 96 and 97 but include a small piece of supplemental interfacing material 358 over the air exit holes 312. FIGS. 95*a* and 95*b* are similar to FIGS. 94 and 95 except those embodiments illustrate multiple grommets connections point as used herein grommets can be individual connections point or continuous stitching. Grommets can be physical grommets or stitching or any other conventional technique for connecting the two sheets together.

FIGS. 114 and 115 are similar to FIGS. 113 and 112 but illustrate a built in pump. FIG. 116 is similar to FIG. 97 but without air exit holes. In this embodiment the air exits by way of the inherent porosity of the material as indicated in FIG. 117. The arrows, generally identified with the reference numeral 365, illustrate the air flow through the material of the mattress shell 370 (FIG. 93) and the foam rubber mattress support 372.

FIGS. 118 and 119 are similar to FIGS. 98 and 99 but do not include air exit holes. FIGS. 120 and 121 are similar to FIGS. 102 and 103 but do not include air exit holes.

FIG. 122 illustrates a conventional bed on an adjustable platform. The adjustable platform bed, generally identified with the reference numeral 390, includes a foundation 394. The foundation 394 includes a base 396 and an adjustable platform 398. The adjustable platform 398 is mechanically supported by the base 396. Electric motors (not shown) are used to adjust the position of the adjustable platform 396. The mattress 392 is known to have a zip-out panel (not shown). One or more slick surfaces may be incorporated into the adjustable platform bed 390 to facilitate bed making without the use of an air pump. Specifically, the adjustable platform 398 may be covered with a relatively a material having a relatively slick surface. The zip-out panel may be alternatively or in addition be replaced by different panel (not shown) with a slick surface. One or both of these slick surfaces can be used to facilitate bed making, thus forming a passive bed maker.

FIGS. 123 and 124 illustrate a mattress management system built in to the adjustable platform bed 390. FIG. 115 illustrates an embodiment in which an inflatable air volume 400 and air intake nozzle 402, as discussed below, are attached or embedded to the adjustable platform 398 for facilitating bed making, as discussed below. A conduit 404 and air pump 406 are attached to the air intake nozzle 402. The conduit 404 and air pump 406 may extend out one end of the adjustable platform bed 390 or may be located underneath the adjustable platform 398 with the conduit and/or the air intake nozzle 402 extending through the platform 398.

FIG. 124 is similar to FIG. 123 but shown with the inflatable air volume 400 on the underside of the mattress 392. As best shown in FIG. 123, the underside of the mattress 392 includes a zip-out panel 408. In the embodiment illustrated in FIG. 124, the zip out panel is replaces by a zippered panel 410 with an inflatable volume 400. As shown, an inflatable volume 400 with a circular stitch pattern with air exit holes and the center of the sheets forming the inflatable volume attached together. A piece of supplemental interfacing material 412 is attached over the air exit holes. However, it is to be understood that FIGS. 123 and 124 are exemplary embodiments. It is to be understood that all of the various permutations for the inflatable volume 400 are suitable for this application.

FIGS. 125-128 illustrates various versions of the inflatable air volume, generally identified with the reference numeral 420, generally identified with the 422-428, formed from two sheets of material, as discussed below, to form a single cover. Each cover 422-428 includes a plurality of side panels, generally identified with the reference numeral 430. In order to secure the inflatable volume 420 with respect to the mattress or foundation, the panels 430 provide a relatively tight grip relative to the mattress or foundation. The fabrication of a inflatable volume formed as a single cover is discussed below.

The cover 422-428 may be installed on the underside of a mattress or on a foundation. The covers 422-428 may be formed with all of the permutations discussed herein. FIGS. 125-128 merely represent exemplary embodiments.

FIG. 125 illustrates the cover 422 with a rectangular stitch pattern and no air exit holes. The two sheets making up the cover 422 are attached together in roughly the center of the two sheets, as indicated by the reference numeral 430. In this embodiment, the air escapes as a function of the porosity of the material, as indicated by the reference numeral 440 and FIG. 117. FIG. 126 is similar to FIG. 125 but illustrates a circular stitch pattern for the inflatable air volume 420. FIGS. 127 and 128 are similar to FIGS. 125 and 126 but include air exit holes 312.

FIGS. 129 and 130 illustrate exemplary applications of the mattress management system in accordance with the present invention. In this embodiment, the cover 426 (FIG. 127) is installed on the underside of a mattress 444. A bed skirt 445 is placed over the foundation 446. In this embodiment, the air flow is downward. The air flows through the bed skirt and is opposed by a top panel 448 of the foundation 446 to allow the mattress 444 to be levitated, as discussed below. The top panel 448 may be attached to a top surface of the foundation by any conventional means, for example stitching, as indicated by the reference numeral 449

FIG. 130 is similar to FIG. 129 but utilizes the cover 128, illustrated in FIG. 128. The only physical difference between the covers 426 and 428 is the stitch pattern The cover 426 illustrates a rectangular stitch pattern while the cover 428 illustrates a circular stitch pattern for the inflatable volume. FIGS. 131 and 132 are similar to FIGS. 129 and 130 but do not include the panel 448.

FIGS. 133 and 134 are similar to FIGS. 129 and 130. The only difference is that the inflatable volumes are built into the mattress.

As mentioned below, an exemplary mattress encasement version is provided as illustrated in FIGS. 24*a* and 24*b*. The exemplary mattress encasement version is comprised of 2 individual king size sheets of Nylon RipStop fabric (polyurethane coated on 1 side), joined together via perimeter and center stitching, with 4 air exit holes around the center stitch, stitched to replace the bottom panel of an encasement-type mattress protector, and an air inlet to accommodate an air-inlet hose attached to an air pump. Once actuated, the pump provides a continuous source of air into the expandable volume located on the underside of the encasement, provided by the 2 layers of joined Nylon fabric, to provide mattress lift for the purpose of facilitating ease of sheet tucking between the mattress and mattress foundation. This sample is designed to install over the mattress as a mattress encasement variation of the BedMaker™ technology.

Exemplary specifications for the mattress encasement version are set forth below.

| | |
|---|---|
| Fabric: | 2 x Sheets of polyurethane coated Nylon Ripstop, 75" × 79" each |
| Mattress encasement: | 1 x Protect-A-Bed AllerZip bed bug/waterproof bedding encasement |
| Conduit: | 1 x PVC Hosing, 1.5" i.d. × 2.5' length |
| Air Pump: | 1 x Coleman 120 V Electric Quick Pump (Model #5999C120) |

An alternative 2 cover embodiment of the mattress encasement version is contemplated. The two cover version is comprised of 2 individual king size sheets of Nylon RipStop fabric (polyurethane coated on 1 side), joined together via perimeter and center stitching, with 4 air exit holes around the center stitch, stitched to replace the bottom panel of an encasement-type mattress protector, and an air inlet to accommodate an air-inlet hose attached to an air pump. Once actuated, the pump provides a continuous source of air into the expandable volume located on the underside of the encasement, provided by the 2 layers of joined Nylon fabric, to provide mattress lift for the purpose of facilitating ease of sheet tucking between the mattress and mattress foundation. This sample is designed to install over the mattress as a mattress encasement variation of the Bed Maker™ technology. In addition, a $2^{nd}$, single layer Nylon RipStop cover (polyurethane coated on one side/slick coated on the other), with perimeter-sewn polyester side-skirt material, works in unison with the single cover BedMaker™ unit to allow for mattress maneuvering by flipping this cover up over the mattress or down over the foundation.

Exemplary specifications for this embodiment are set forth below.

| | |
|---|---|
| Fabric: | 2 x Sheets of polyurethane coated Nylon Ripstop, 75" × 79" each |
| Mattress encasement: | 1 x Protect-A-Bed AllerZip bed bug/waterproof bedding encasement |
| Fabric 2nd Cover: | 1x Sheet of polyurethane/slick coat Nylon Ripstop, 75" × 79" each |
| Side-panel: | 1 x Polyurethane coated Polyester Jersey-knit material 10" depth |
| Conduit: | 1 x PVC Hosing, 1.5" i.d. × 2.5' length |
| Air Pump: | 1 x Coleman 120 V Electric Quick Pump (Model #5999C120) |

Bed Maker™

A stand-alone system and method is disclosed for facilitating making beds of all sizes with one or more flat sheets by minimizing lifting of the top mattress so that flat sheets and/or blankets can be tucked between the upper mattress and the box spring or platform without lifting the top mattress. As used herein, box spring is to be understood to be a box spring or a platform.

More particularly, the present invention relates to a levitation device that can be centrally located between the mattress and the box spring. The levitation device is driven by an air source, such as an air pump or other source of air, and has a normal mode and an active mode. In a normal mode, the air source is off and the levitation device is relatively flat. In an active mode, the air source is on and the levitation device is expanded lifting the top mattress relative to the box spring. By centrally locating the levitation device relative to the mattress and the box spring, a portion of the mattress is lifted, thus relieving the weight of mattress along the edges. As such, during an active mode, flat sheets and blankets can be tucked between a mattress and box spring virtually effortlessly without the need to lift the top mattress. When the bed is made the air source is simply turned off allowing the mattress to be lowered onto the box spring.

Figure 40:
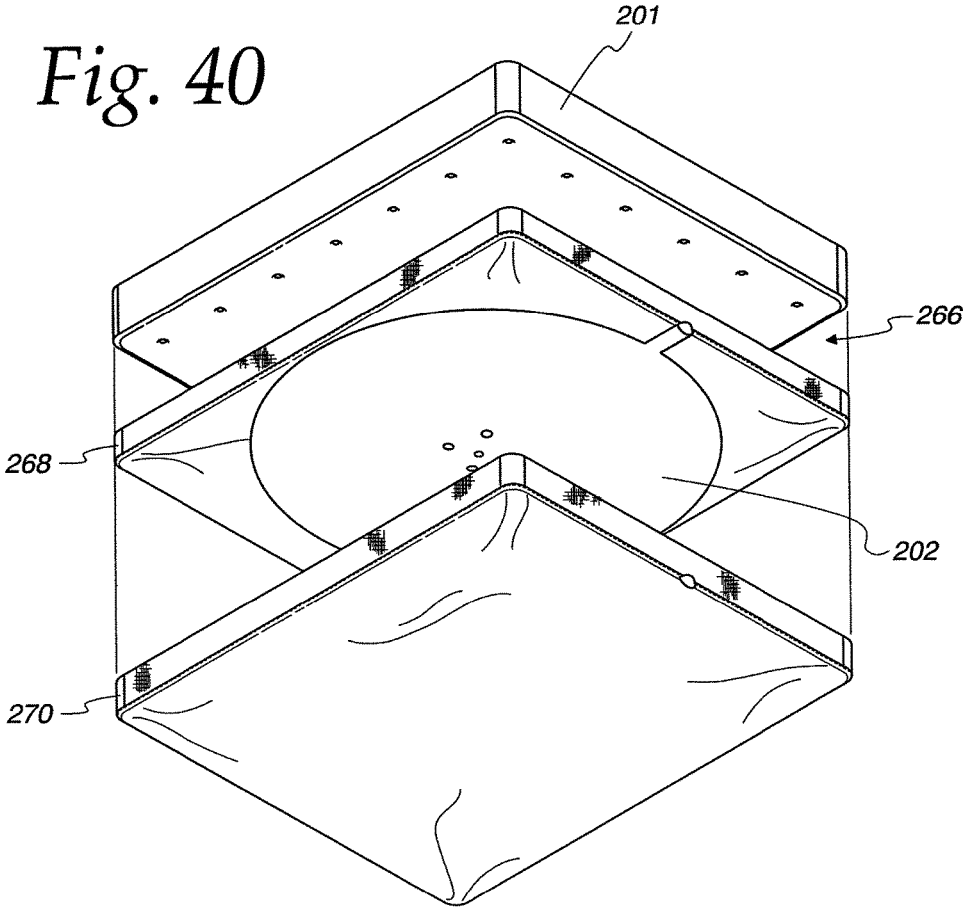
FIG. 40 is an exploded isometric view of another alternate embodiment of the levitation device illustrated in FIG. 30*b* in which the levitation device is configured as an aftermarket device that is installable on either mattress or the box spring in which the levitation device is formed from two (2) covers.

As mentioned above, this embodiment is illustrated in FIGS. 30-43. In particular, FIGS. 30-37 illustrate an embodiment in which the levitation device is embedded into one or the other of a mattress or a box spring. FIGS. 38, 39, 42 and 43 illustrate an aftermarket embodiment in which the levitation device is formed as a single cover that can easily be installed on either the mattress or the box spring by a consumer or a commercial facility. FIGS. 40 and 41 illustrate an alternative aftermarket device formed as two covers.

The invention described herein is useful when a bed is properly made, as discussed above, with one or more flat sheets. As used herein, flat sheets are defined to mean a rectangular sheet of cloth having a standard size for covering a standard mattress as described below.

US standard mattress and standard flat sheet sizes are provided below. It is to be noted that the principles of the invention are also applicable to non-US mattress and flat sheet sizes, as well as non-standard sizes and also apply to so-called "deep pocket" mattresses and flat sheets.

TABLE 1

US Standard Mattress Sizes

| Common Term | Size in inches | Size in Centimeters |
|---|---|---|
| Twin | 39 × 75 | 99 × 190 |
| X-Long Twin | 39 × 80 | 99 × 203 |
| Full | 54 × 75 | 137 × 190 |
| Queen | 60 × 80 | 153 × 203 |
| King | 76 × 80 | 198 × 203 |
| California King | 72 × 84 | 182 × 213 |

TABLE 2

US Standard Flat Sheet Sizes

| Common Term | Size in inches | Size in Centimeters |
|---|---|---|
| Twin | 66 × 96 | 167 × 243 |
| X-Long Twin | 66 × 102 | 167 × 259 |
| Full | 81 × 96 | 205 × 243 |
| Queen | 90 × 102 | 228 × 259 |
| King | 108 × 102 | 274 × 259 |
| California King | 108 × 102 | 274 × 259 |

Figure 30A:
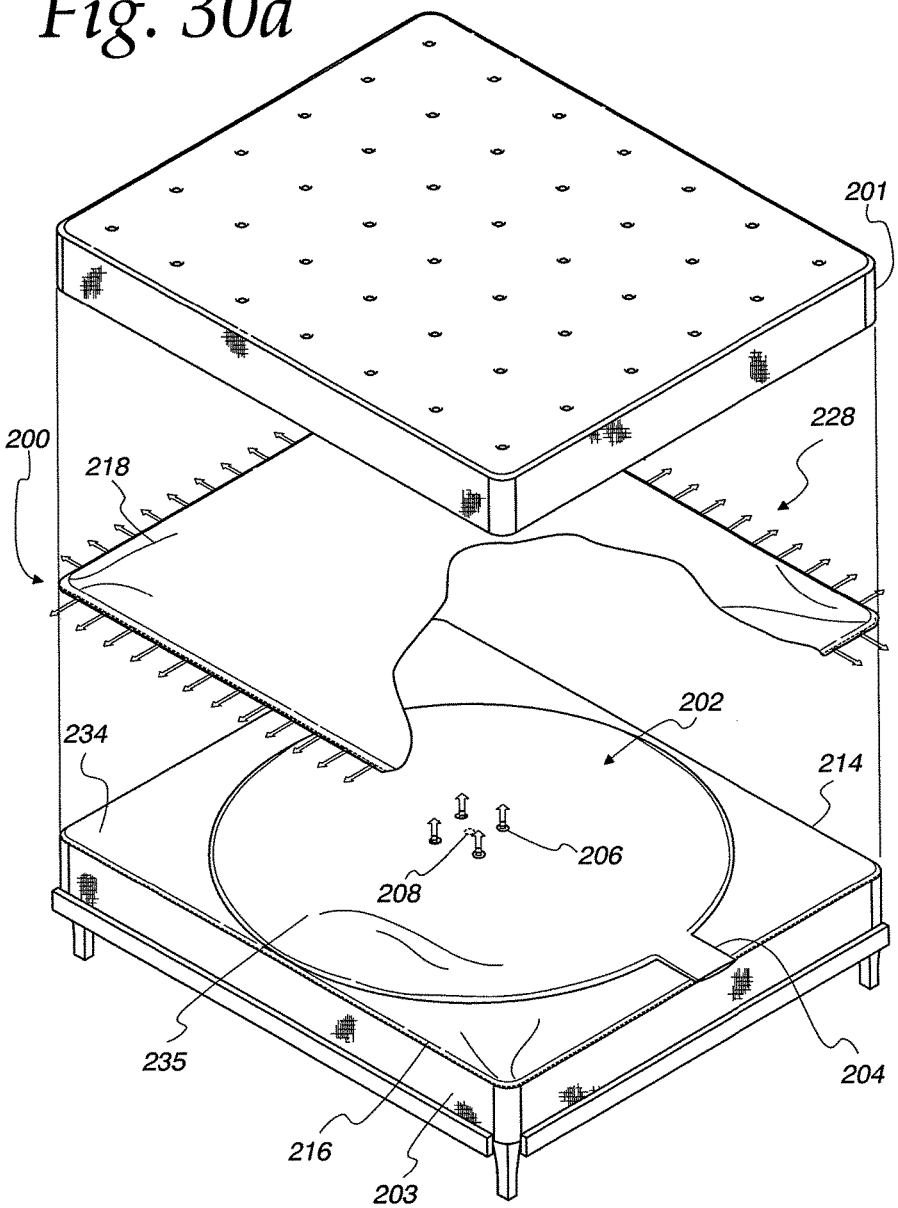
FIG. 30*a* is an exploded isometric view of an embodiment of an invention that facilitates making a bed in which a levitation device embedded in the box spring or the cover.

Referring first to FIGS. 30*a*-37, a first embodiment of the BedMaker™ device is illustrated. In this embodiment, the levitation device may be embedded in either the underside of the mattress or the top side of the box spring, as illustrated in FIGS. 30*a* and 30*b*. As defined herein, "embedded" is defined to mean permanently attached, for example, by stitching, or removably attached using a fastener system, such as a zipper or a Velcro fastening system to the surface of a box spring or mattress. Moreover, although the various embodiments, illustrated in FIGS. 30-43, show the air flow from the levitation device in an upward direction, the principles of the invention are applicable to embodiments in which the air flow from the levitation device is in a generally downward or upward direction.

Figure 44:
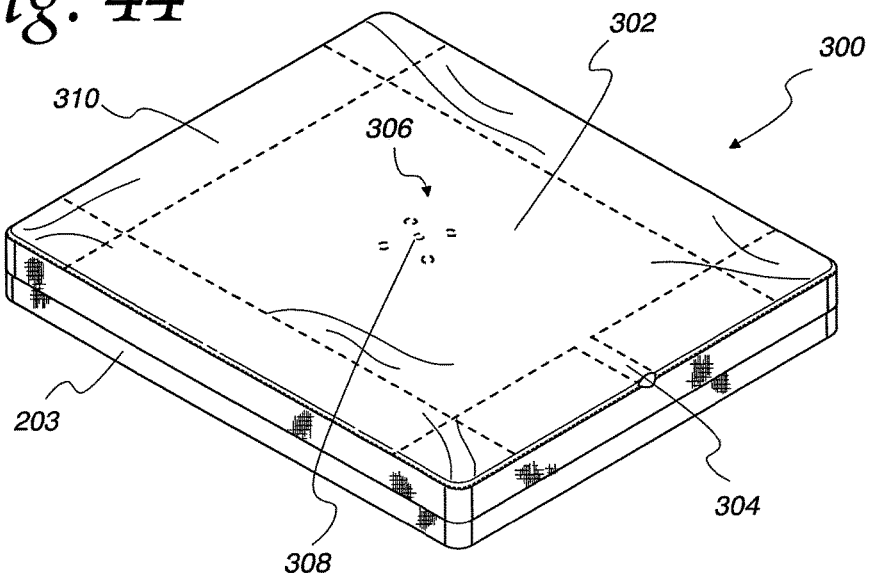
FIG. 44 is an isometric view of a levitation device installed on a box spring with an alternate exemplary pattern for the levitation device shown in phantom.
Figure 45:
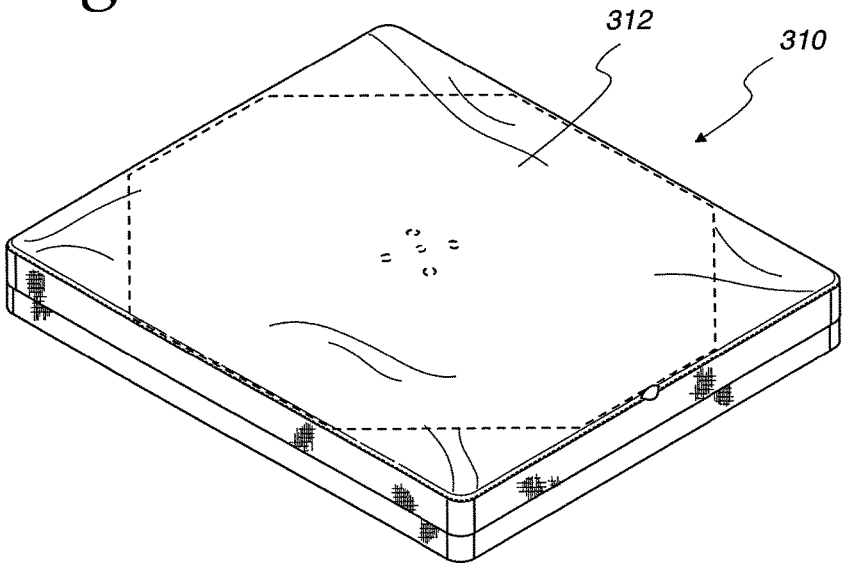
FIG. 45 is an isometric view of a levitation device installed on a box spring with another alternate exemplary pattern for the levitation device shown in phantom.

Referring first to FIG. 30*a*, a top mattress 201 and a box spring 203 are shown. The levitation device is generally identified with the reference numeral 200. The levitation device 200 includes an inflatable volume, formed from two sheets of material, stitched or otherwise fastened together, generally identified with the reference numeral 202. As shown in FIG. 30*a*, the inflatable volume may be formed with a circular shape, as shown in FIG. 30 or rectangular or octagonal shapes, as shown in FIGS. 44 and 45, respectively or virtually any shape, as further illustrated in FIGS. 135*a*-135*c*, 136*a*-136*c*, 137 and 138.

Figure 33:
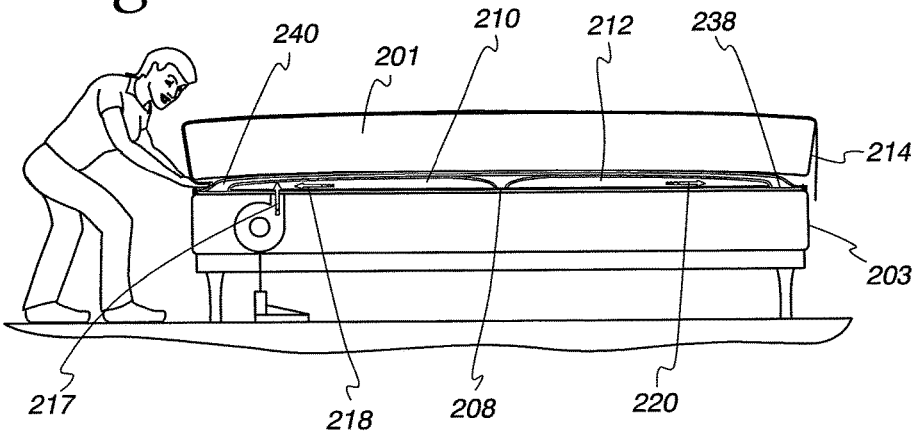
FIG. 33 is similar to FIG. 31 and illustrates a user tucking a sheet or blanket between one end of a mattress and a box spring, shown with an embodiment in which the levitation device is embedded in the box spring.
Figure 34:
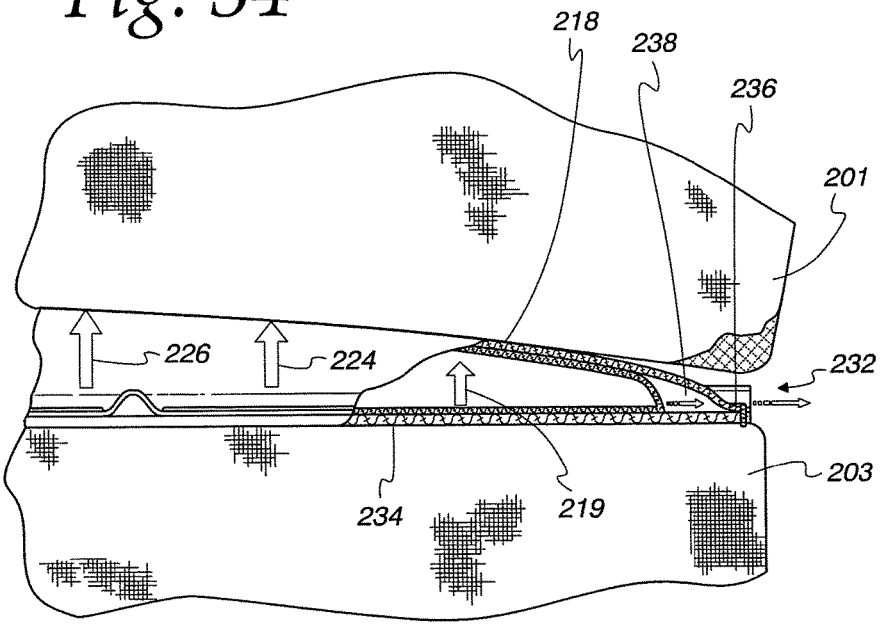
FIG. 34 is a partial side elevational view of the invention illustrated in FIG. 30*a*, shown in an active position installed on a box spring.

The inflatable volume 202 includes an air inlet nozzle 204 and one or more vent holes, generally identified with the reference numeral 206. Four (4) vent holes are shown. More or fewer vent holes 206 could be used. The vent holes 206 are used to exhaust excess air from the inflatable volume 202 during an active mode when an air supply is applied to the air inlet nozzle 204 while maintaining the inflatable volume 202 in an expanded condition as shown in FIGS. 33 and 34.

One or more grommets or stitches 208 may be used to create one or more air pockets within the inflatable volume 202. As best shown in FIG. 33, the grommet 208 creates a donut shaped air pocket defining air pocket portions 210 and 212 when an air supply is connected to the air inlet nozzle 204 (FIG. 30*a*). These air pocket portions 210, 212 lift the cover 218 and the upper mattress 201. Even though the pocket portions 210 and 212 do not extend to the edges of the sides 214 and 216, the mattress 201 tends to rise along the sides 214 and 216.

In one embodiment, the levitation device 200 includes the inflatable volume 202, formed from two sheets, and a cover 218 forming a third sheet. The cover 218 is used to provide resistance to the air flow from the air exit holes. In other embodiments in which the material from the underside of the mattress or the foundation is found to provide sufficient resistance, the cover 218 may be eliminated. As shown in FIGS. 30*a*, 33 and 34, air is applied to the air inlet nozzle 204, as indicated by the arrow 217 (FIG. 33), for example, by way of an air pump 250 ((FIG. 39) in order to fill up the pocket portions 210 and 212 as indicated by the arrows 219 (FIG. 34), 220 and 222 (FIG. 33). Excess air is vented through the vent holes 208 (FIG. 30*a*) to create an air cushion under the cover 218, as indicated by the arrows 224 and 226 (FIG. 34). This air cushion acting through the air pressure under the cover 218 may be used to support the upward force created by the expansion of the pockets 210 and 212 to lift the upper mattress 214, as shown in FIGS. 33 and 34. With a continuous air supply, the cover 218 is configured as a sieve to leak excess air, for example, around the perimeter, as generally indicated by the arrows 228 (FIG. 30*a*), 230 (FIG. 32) and 232 (FIG. 34) when an air supply is connected to the air inlet nozzle 204. The sieve is configured so that the leakage from the top cover 218 and the air flow from the vent holes 208, for a given amount of air flow into the air inlet nozzle 204, is sufficient to maintain the air pocket portions 210, 212 (FIG. 33) in an expanded position, as best shown in FIG. 33. Once the bed is made, the air supply to the air inlet nozzle 204 (FIG. 30*a*) is turned off. Subsequently, the air in the pockets is vented through the vent holes 208 and the sieve.

As mentioned above, the levitation device 200 includes an inflatable volume 202 and a cover 218 (FIG. 30*a*). In an embedded embodiment, there are several embodiments for the inflatable volume. In one embodiment, the inflatable volume can be formed as a separate device and added to a standard box spring 203. In this embodiment, the inflatable volume 202 is formed from two (2) sheets 234, 235 of an air impermeable material, such as, PU coated nylon ripstop or PU/PVC coated nylon taffeta or material of similar or lesser air permeability. In this embodiment, the sheets are cut into an appropriate shape, such as a circle, as shown in FIG. 30*a*, or other shapes, such as a rectangular or octagonal shape, shown in FIGS. 44 and 45, respectively or virtually any other shapes, as further illustrated in FIGS. 135*a*-135*c*, 136*a*-136*c*, 137 and 138. Alternatively, the shape of the inflatable volume 202 can be created by sewing two (2) sheets together in a desired shape.

The air inlet nozzle 204 is also integrally formed in the sheets. The sheets are then fastened together in a desired shape, as discussed above, using a fastening method appropriate for the material used for the sheets, such as sewing for fabric sheets or for polymer based sheets, adhesives and/or heat sealing.

Figure 32:
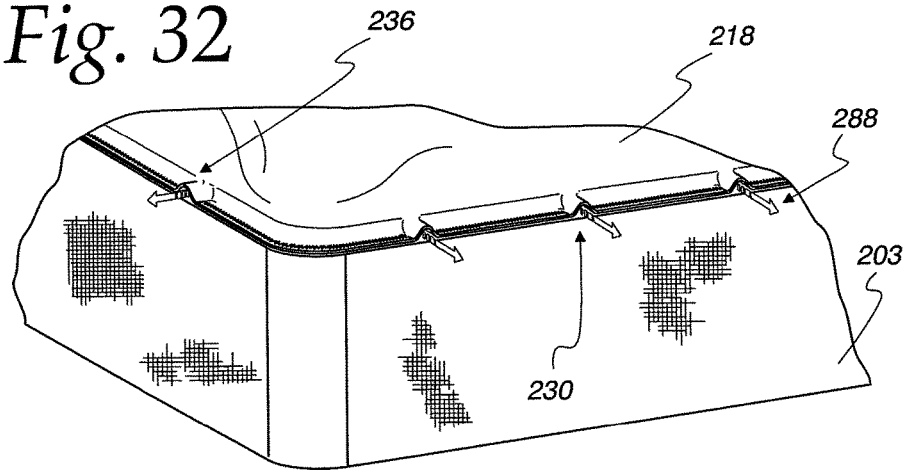
FIG. 32 illustrates an embodiment of the invention illustrated in FIG. 30*a* in which the levitation device is embedded in a box spring, shown with the mattress removed.

In an embodiment with an independent inflatable volume 244 (FIGS. 38-41), the inflatable volume can simply be placed on top of the box spring 203 so that air inlet nozzle 204 extends outwardly therefrom. Alternatively, the inflatable volume 202 (FIG. 30*a*) may be secured to the underside of the cover 218 (FIG. 34) or secured to a top surface 234 of the box spring 203. In both embodiments, the cover 218 is secured to the box spring 203. As best shown in FIG. 32, the cover 218 is secured to the box spring 203 in such way to create a sieve by way of a plurality of air channels, generally identified with the reference numeral 236. As mentioned above, the sieve functions to exhaust excess air from under the cover, as indicated by the arrows 228 (FIG. 30*a*).

The cover 218 simply rests on the inflatable volume 202 (FIG. 30*a*) to enable the air released from the vent holes 206 to collect in the air pocket portions 238 and 240 (FIG. 33), formed between the inflatable volume 202 and the underside of the cover 218. The excess air in the air pocket portions 238 and 240 is expelled through the air channels 236 (FIGS. 32, 34). As defined herein, excess air means air pressure beyond the amount of air pressure required to lift the top mattress 201 (FIG. 33).

Alternatively, the inflatable air volume 202 can be incorporated into the top cover 218 or incorporated into the top surface 234 (FIG. 30*a*) of the box spring 203. Incorporating the inflatable volume 202 can be accomplished in multiple ways. One way is to form the inflatable volume as an independent item from two sheets of material and to secure the inflatable volume 202 to either the cover 218 or the top surface 234 of the box spring 203 by suitable means, as discussed above.

Alternatively, the cover 218 or top surface 234 can be used to form a portion of the inflatable volume. In these embodiments, the cover 218 or top surface 234 of the box spring 203 is formed from an air impermeable material. In this embodiment, the inflatable volume 202, is formed by cutting a piece of air impermeable material in the shape of the inflatable volume 202 and securing it to the top cover 218 or top surface 234 of the box spring 203.

In addition to or in lieu of air impermeable material, a material may be used that is air permeable with a leakage rate comparable to leakage through the air channels 236 (FIG. 32). An exemplary material is nylon taffeta or polyester. In such an embodiment, the air channels 236 are eliminated and the top cover 218 is completely attached around the periphery of the box spring 203.

Figure 42:
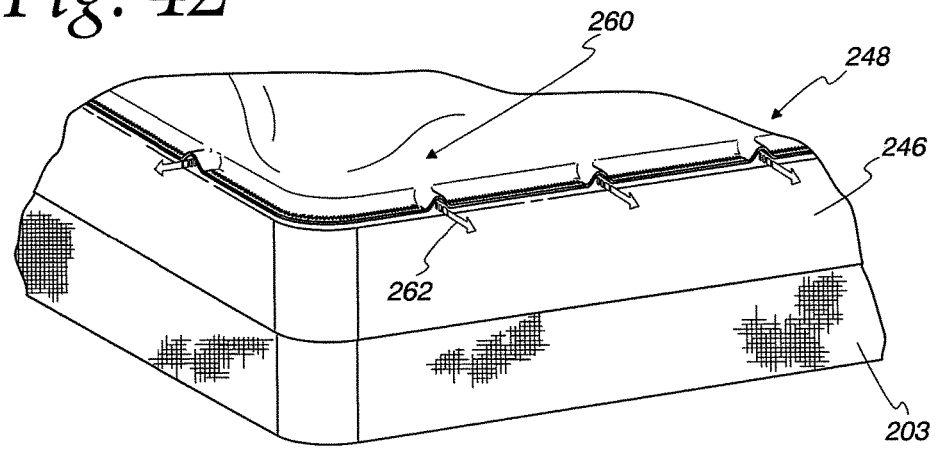
FIG. 42 is a partial isometric view of the single cover embodiment illustrated in FIG. 38 installed on a box spring and shown in an active mode of operation.
Figure 43:
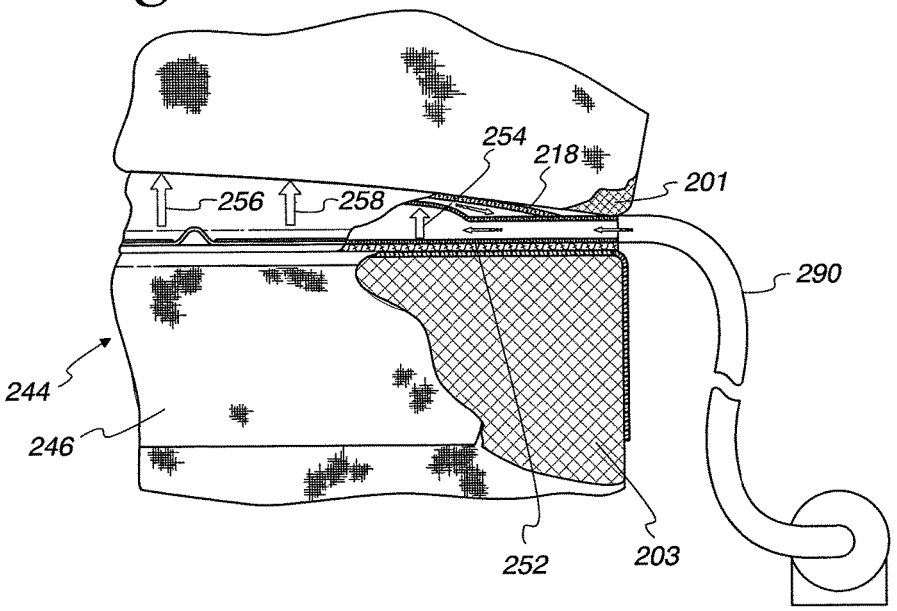
FIG. 43 is a partial elevation view of a single cover levitation device illustrated in FIG. 38 installed on a box spring with a mattress on top, shown with the levitation device in an active mode.

An alternate embodiment of the invention is illustrated in FIGS. 38, 39, 42 and 43. In this embodiment, the levitation device, generally identified with the reference numeral 242 includes an inflatable volume 244 and a cover 246. This embodiment is an aftermarket item that can be installed after a bed is purchased. In this embodiment, the cover 246 is formed as a fitted sheet to allow it to be installed by a consumer or housekeeper in a commercial facility after a bed has been purchased. The levitation device 242 may be fabricated as discussed above or below. As shown in FIGS. 42 and 43, the cover 246 may be formed with a plurality of air channels 248 or alternatively, as discussed above.

Figure 30B:
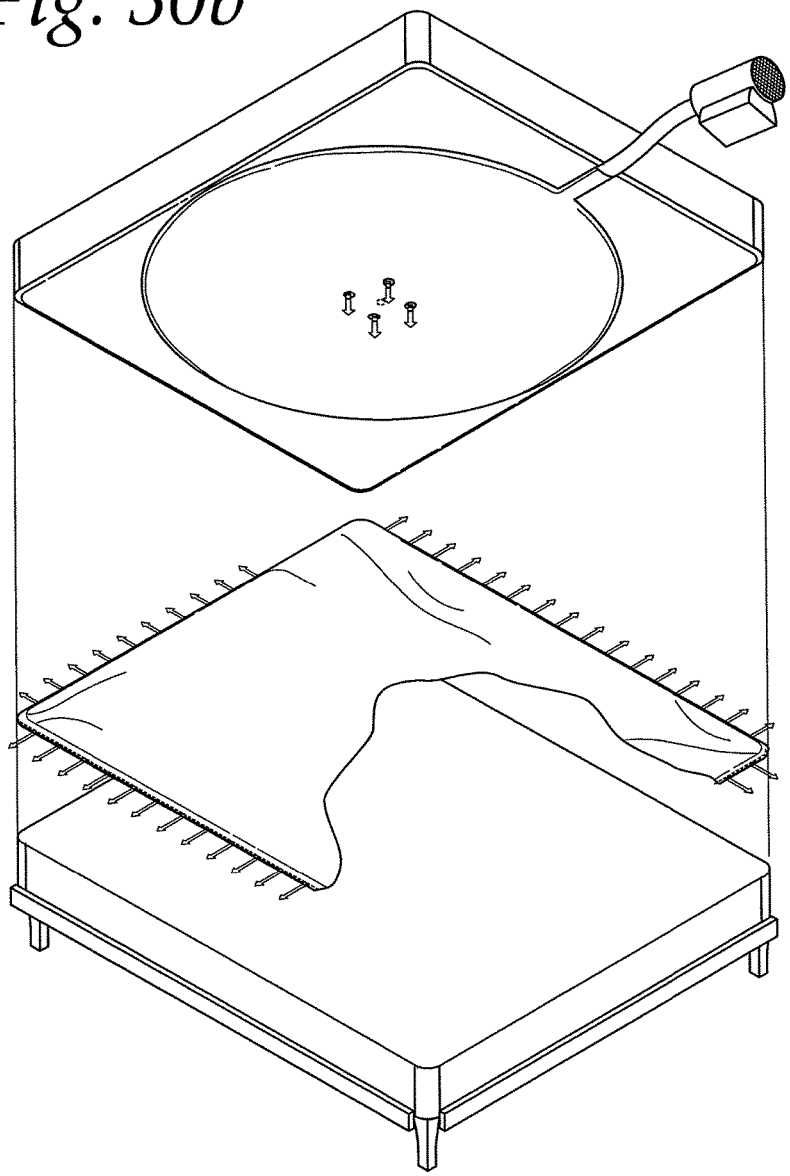
FIG. 30*b* is similar to FIG. 30*a* but shown with the levitation device embedded in the mattress.
Figure 30C:
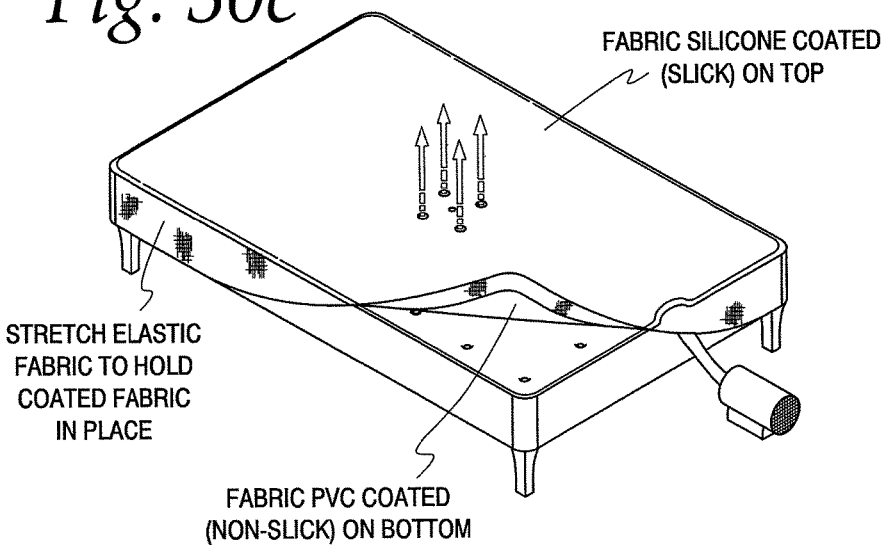
FIGS. 30*c* and 30*d* illustrate an embodiment are similar to FIG. 30*a* which includes a cover which forms the inflatable air volume, shown with the cover attached to the foundation.
Figure 30D:
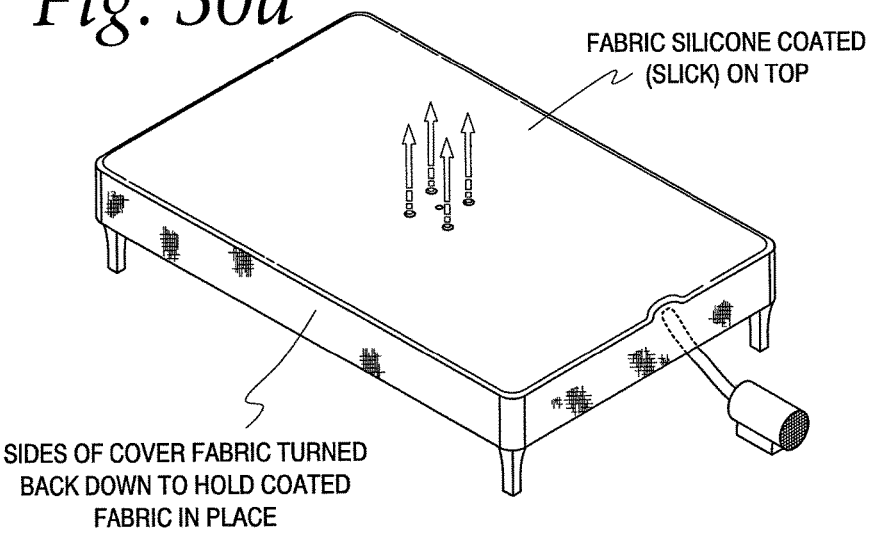

FIG. 30*b* is similar to FIG. 30*a*. In FIG. 30*b*, the inflatable air volume may be embedded in the underside of a mattress. FIGS. 30*c* and 30*d* illustrate an embodiment in which the inflatable air volume is embodied in a cover. FIGS. 139*a*-139*g* are similar to FIG. 30*b* in which the inflatable air volume is embedded in the underside of the mattress and shown with attachment members on both the cover and the mattress for selectively securing the cover to the mattress.

FIGS. 145-148 are similar to FIG. 139*g* but illustrate a cover with no side panels and a different attachment method for securing the mattress to the foundation. except the cover has no side panels and the vertical attachment members are attached on the edge of the cover. FIGS. 149-151 are similar to FIG. 139 *h* except the cover has no side panels and the vertical attachment members are attached on the edge of the cover The embodiment illustrated in FIGS. 38, 39, 42 and 43 operates in the same manner as the embodiment illustrated in FIGS. 30*a*-37. In particular, with reference to FIG. 43, air from the air supply 250 is received into the inflatable air volume 244, as indicated by the arrows, generally indicated with the reference numeral 252. causing the pockets 254 within the inflatable air volume 244 to expand, thus lifting the cover 218, which, in turn, lifts the upper mattress 201, as shown and indicated by the arrows 256 and 258. As discussed above, excess air is vented through the vent holes (not shown) and moves between the inflatable volume 244 and the cover 248 and out air channels 260 formed in the cover 248, as indicated by the arrows 262 (FIG. 42), or alternatively as discussed above.

A third embodiment of the invention is illustrated in FIGS. 40 and 41. This embodiment is an after-market embodiment, generally identified with the reference numeral 266 and includes two covers 268 and 270. Both covers 268 and 270 are formed as fitted sheets and are both installed either the upper mattress 201 with air blowing down, as shown in FIG. 40 or on the box spring 203 with air blowing up, as shown in FIG. 41. The covers 268 and 270 may be formed as discussed below in connection with FIG. 5, or as discussed above. In this embodiment, excess air naturally escapes between the covers 268 and 270, thus eliminating the need for sieves.

Figure 35:
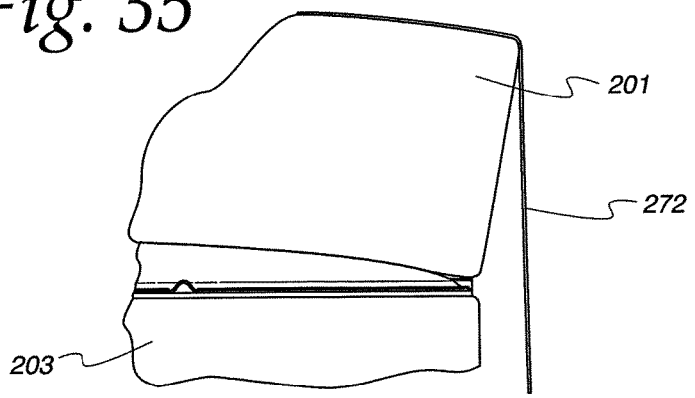
FIGS. 35-37 illustrate tucking of a sheet or blanket between a mattress and box spring with the aid of one embodiment of the levitation device in accordance with the present invention.
Figure 36:
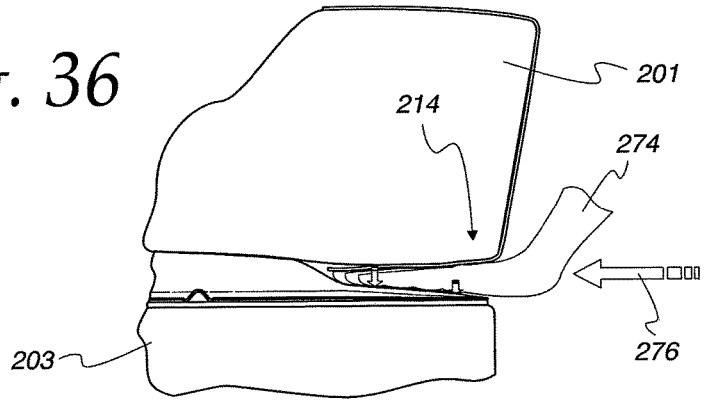
Figure 37:
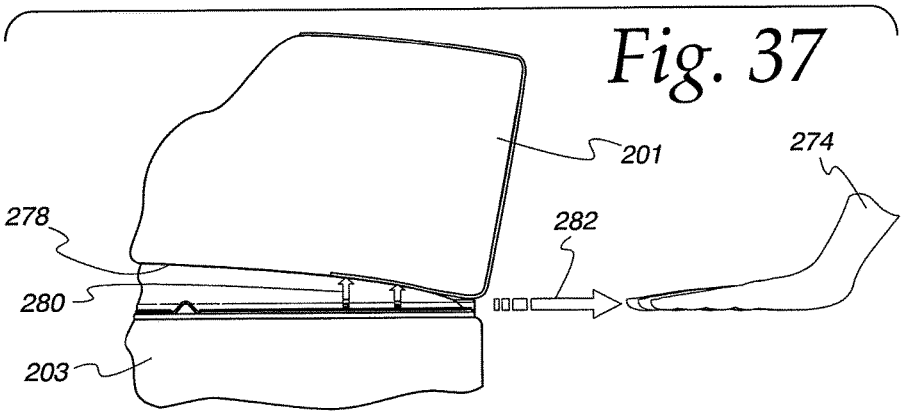
Figure 38:
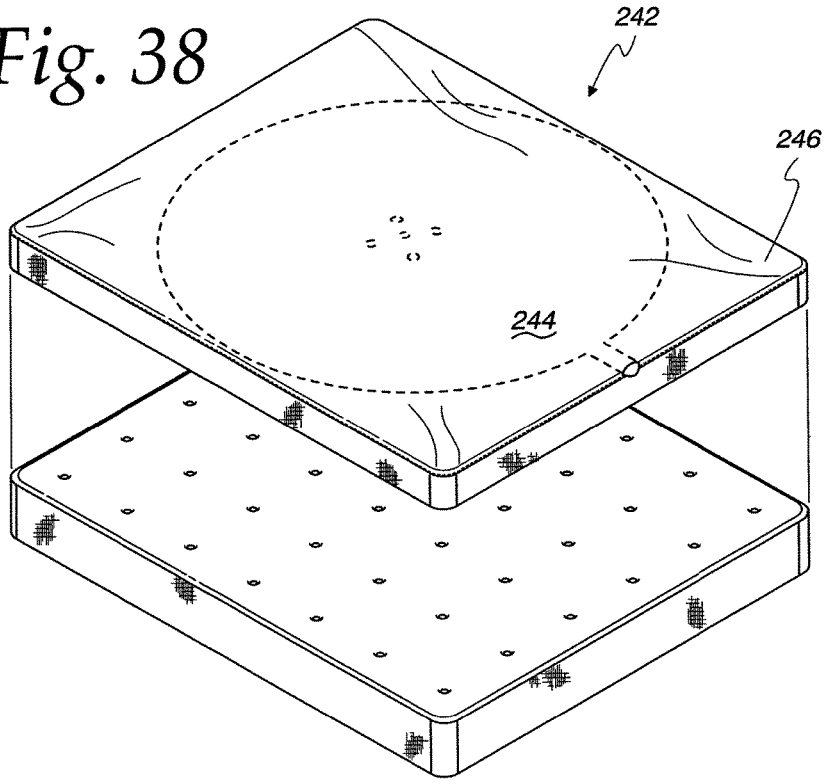
FIG. 38 is an exploded isometric view of an alternate embodiment of the levitation device illustrated in FIG. 30*a* in which the levitation device is configured as an aftermarket device that is installable on either mattress or the box spring in which the levitation device is formed from a single cover.
Figure 39:
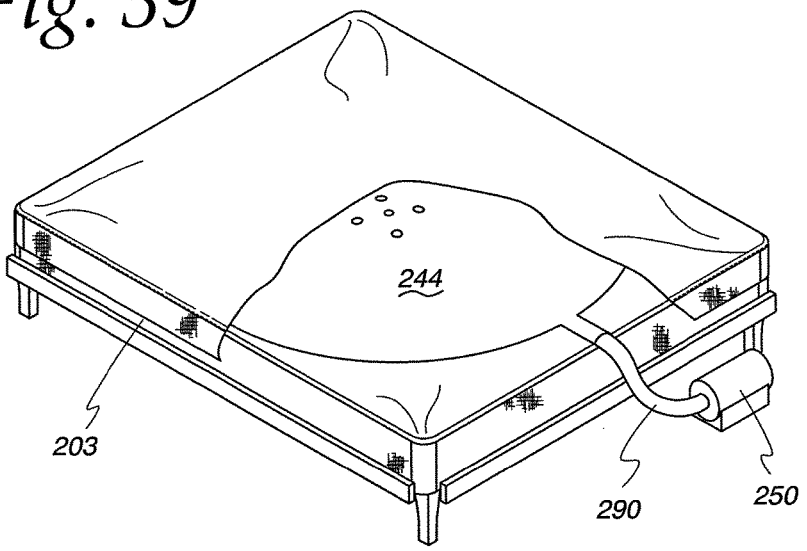
FIG. 39 illustrates the aftermarket levitation device, illustrated in FIG. 38, installed on a box spring.

All of the embodiments discussed above with respect to the embodiments of the invention for facilitating making a bed operate in a similar manner and are explained with reference to FIGS. 35-37. Referring first to FIG. 35, portions of the mattress 201 around the edges lift when the air supply 250 (FIG. 43) is attached to the air inlet nozzle 204 (FIG. 30) and turned on defining an active mode.

As shown in FIG. 35, a sheet or blanket 272 is shown dangling from an edge of the mattress 201. Next, as shown in FIG. 36. The free end of the blanket or sheet 272 is tucked between the mattress 201 and the box spring 203. Since the weight of the mattress 201 is being supported by the levitation device 200 (FIG. 30) and the edges of the mattress are slightly lifted, a consumer or commercial housekeeper is able to easily and virtually effortlessly slide their hand in the direction of the arrow 276 between the mattress 201 (FIG. 36) and box spring 203. As illustrated in FIG. 36, that action slightly lifts the edge 214 of the mattress 201 to enable the blanket or sheet 272 to be tucked between the top of the cover 218 (FIG. 30) and a bottom surface 278 (FIG. 37) of the mattress 201. The lifting force of the levitation device 200 (FIG. 30), as indicated by the arrows 280, holds the sheet or blanket 272 in place as the user's hand 274 is removed, as indicated by the arrow 282 (FIG. 37).

Figure 31:
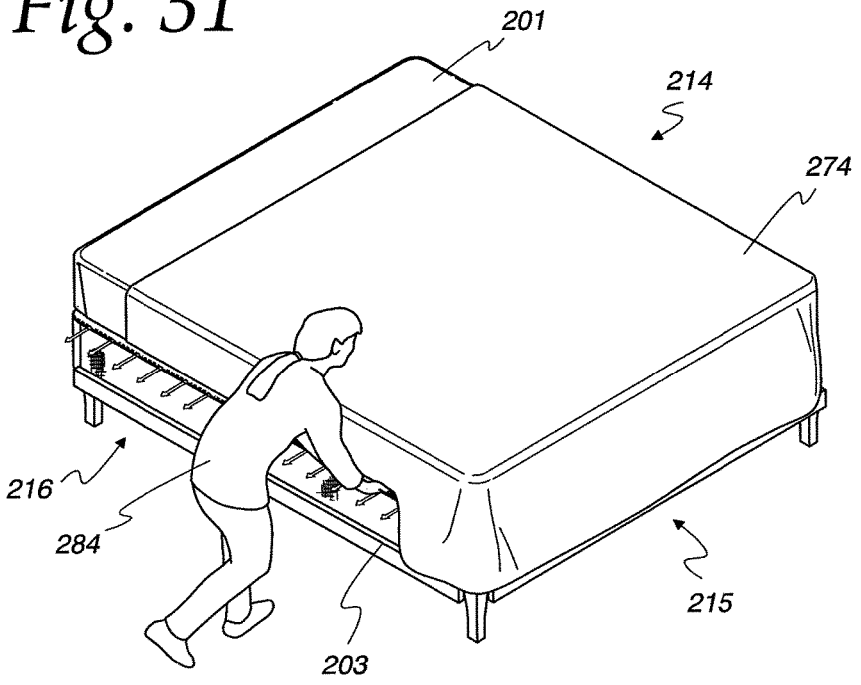
FIG. 31 illustrates a user tucking a sheet or blanket between a mattress and a box spring that incorporates the principles of the invention illustrated in FIG. 30*a*.

As shown in FIG. 31, the user proceeds down the opposing side edges 214 and 216 as well as the foot end edge 215 tucking in a sheet or blanket 274. As the user proceeds down the sides edges 214 and 216 and the foot end edge 215, the portions of the blanket or sheet 274 are held in place. The tucking continues until the blanket or sheet 274 is completely tucked between the mattress 201 and the box spring 203. The corners, generally identified with the reference numeral 286 may be tucked in either before or after the side edges 214-216. FIG. 31 illustrates an exemplary application in which the corners on the foot end 215 of the bed are tucked in last.

As shown in FIG. 32, while the bed is being made, excess air is being expelled in the direction of the arrows, generally identified with the reference numeral 288, in a manner as discussed above. When the bed is made, the air supply 250 (FIG. 39) is turned off, defining a normal mode. In this mode, the mattress 201 rests firmly on the box spring 203. The air supply 250 and its conduit 290 may be disconnected from the air supply nozzle 204 (FIG. 30).

An important aspect of the invention illustrated in FIGS. 40 and 41 is that it is multi-functional and thus forms a hybrid device. More specifically, the embodiment illustrated in FIGS. 40 and 41 can be used to facilitate making a bed, as discussed above or alternatively to rotate a mattress. In order to take advantage of this aspect of the invention, both covers 268 and 270 are attached to one or the other of the mattress 201 or the box spring 203, defining a bed making mode, as discussed above. By flipping the cover 270 so that the cover 270 is attached to one or the other of the mattress 201 and the box spring 203 and the cover 268 is attached to the other of mattress 201 or the box spring 203, the invention can be used to rotate the mattress 201, as discussed below, defining a mattress rotation mode.

Levitation Device

The levitation device 200 includes an inflatable volume 202 configured in a circular pattern, for example, as illustrated in FIG. 30*a*. The principles of the invention are also applicable to alternative patterns. For example, FIG. 44 illustrates a levitation device 300 with an inflatable volume 302 with a rectangular pattern. FIG. 45 illustrates a levitation device 310 with an inflatable volume 312 with an octagonal pattern. FIGS. 135*a*-135*c*, 136*a*-136*c*, 137 and 138 illustrate alternate embodiments to the stitch pattern. FIGS. 44 and 45 illustrate embodiments, which include a cover over the air exit holes of the inflatable air volume. Two sheet embodiments of the inflatable air volume in which the air exit holes are in contact with the material on the underside of a mattress or the material of the foundation that will contact the air exit holes.

Since the levitation devices 300 and 310 are essentially the same except for the pattern for the inflatable volume, only the levitation device 300 is described. Referring to FIG. 44 the levitation device 300 is formed with an inflatable volume 302 and air inlet nozzle 304, shown in phantom. The inflatable volume 302 includes one or more air exit holes, as shown in phantom and generally identified with the reference numeral 306 and one or more grommets 308 or stitched, as discussed above. In the exemplary embodiment shown, the inflatable volume 302 is covered with a cover and formed as single cover aftermarket device, similar to the levitation device shown in FIG. 38, attached to a box spring 203.

The materials used for the hybrid embodiment illustrated in FIGS. 40 and 41 are the same as discussed below. The materials for the embedded embodiment illustrated in FIGS. 30-37 may be as set forth below may be PU coated nylon ripstop and/or PV coated nylon taffeta. The materials for the aftermarket embodiment illustrated in FIGS. 38 and 39 may be as set forth above

Mattress 360™

FIGS. 1-29 relate to device for facilitating rotation of a mattress in a horizontal plane carried by a box spring or a platform. A first embodiment of the device is illustrated in FIGS. 5-8. In this embodiment, in order to facilitate rotation of the mattress with respect to the box spring, slick surfaces between the mattress and the box spring or platform are selectively placed in contact in order to reduce the normal friction therebetween. The slick surfaces are provided by two (2) separate covers; a first cover for the box spring or platform and a second cover for the mattress. The first cover is provided with a slick surface and non-slick surface. In order to further facilitate rotation, a second cover includes a slick surface on one side which also includes part of a levitation device. The other side of the second cover may be formed with a slick or a non-slick surface. The levitation device creates an air column or cushion between the covers on the mattress and the box spring under the influence of an air supply which lifts the mattress and allows the mattress to be rotated in a horizontal plane virtually effortlessly. Once the mattress has been rotated to the desired position, the air supply is removed and the first cover is attached to the underside of the mattress so that its non-slick side is in contact with the box spring or platform or bed skirt and its slick side is in contact with the slick side of the other cover and the levitation device defining a normal mode of operation.

In a rotate mode of operation, the first cover is attached to the box spring or platform or bed skirt so that its non-slick surface is in contact therewith. Alternatively, as illustrated in FIGS. 16-23, the first cover may be integrally incorporated into the box spring or a slick surface may be integrally formed on the platform that forms part of the platform bed. In that embodiment, in order to prevent movement of the mattress with respect to the box spring or platform, the mattress is secured relative to the box spring or platform by removable fasteners in a normal mode of operation, as shown in FIGS. 19-23.

Figure 5:
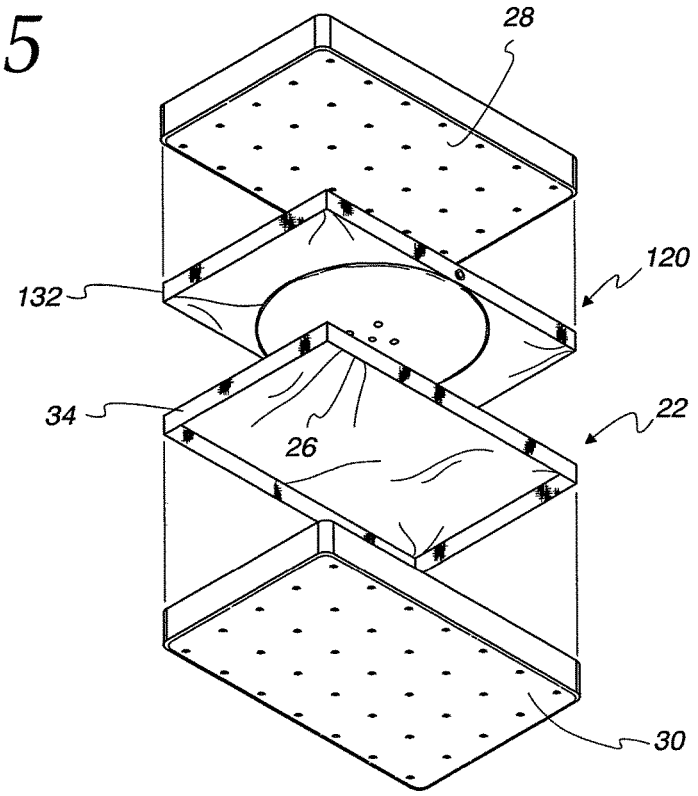
FIG. 5 is an exploded isometric view of one embodiment of the invention illustrating a conventional box spring and a conventional mattress and two covers in accordance with the present invention, shown with a portion of the levitation device integrated into one cover.
Figure 6:
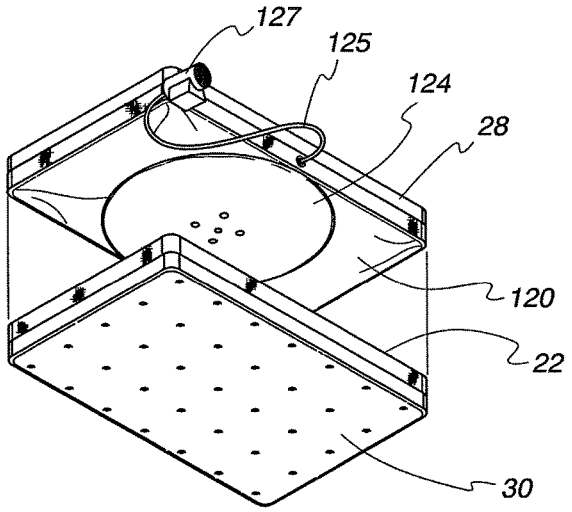
FIG. 6 is similar to FIG. 5 illustrating one of the covers shown in FIG. 5 installed on the mattress and one cover installed on the box spring.
Figure 7:
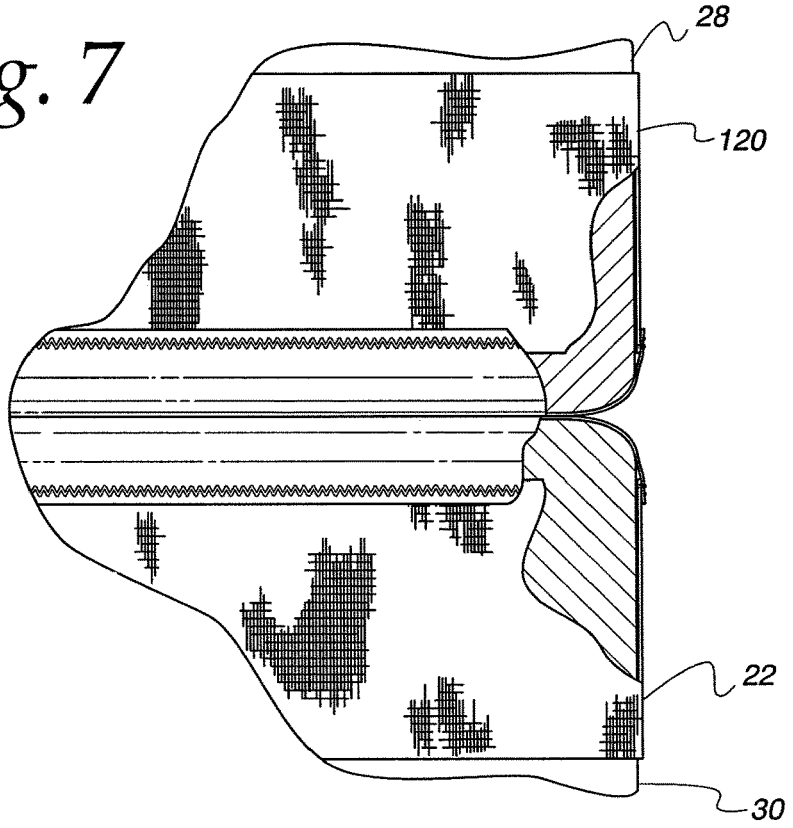
FIG. 7 is a partial side elevational view of the embodiment illustrated in FIG. 5, partially in section, illustrating one of the covers installed on the mattress and one cover installed on the box spring and shown in a rotate configuration in which the slick surfaces of the two covers are in contact with each other.
Figure 8:
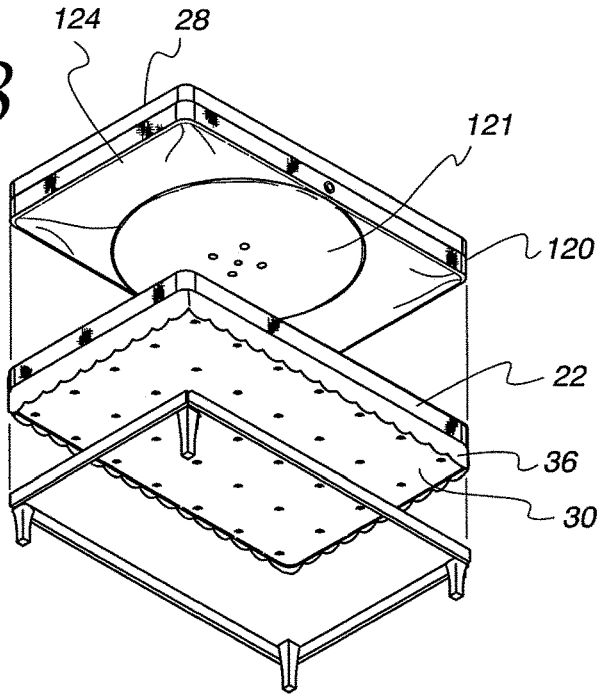
FIG. 8 is an exploded isometric view of an application of the invention illustrated in FIGS. 5-7 in which the bottom cover is to be placed over a bed skirt on the box spring securing it in place.

As best shown in FIG. 5, the first cover, identified with the reference numeral 22 includes a rectangular panel 26, configured to the size of a box spring 30. The cover 22 may include a stretchable band 34, attached to the periphery of the panel 26. The band 34, allows the cover 22 to be removably secured to the box spring 30, as generally shown in FIG. 6. The sides of the cover may be formed to be 9" deep and made of a PU coated polyester 1-way stretch (horizontal) material that fits tight around the mattress or box spring.

Figure 3:
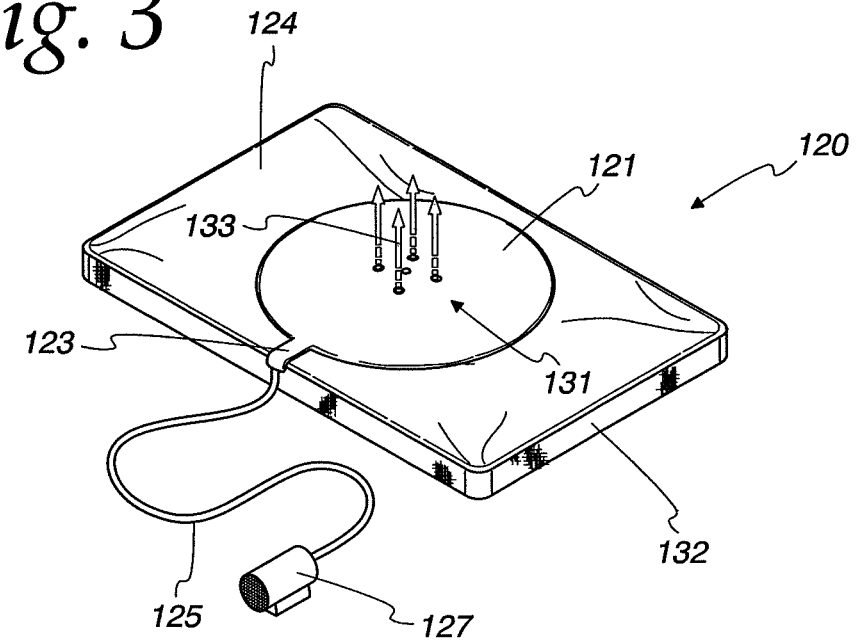
FIG. 3 is an isometric view of a levitation device for use with the present invention shown partially integrated onto one side of a cover.
Figure 4:
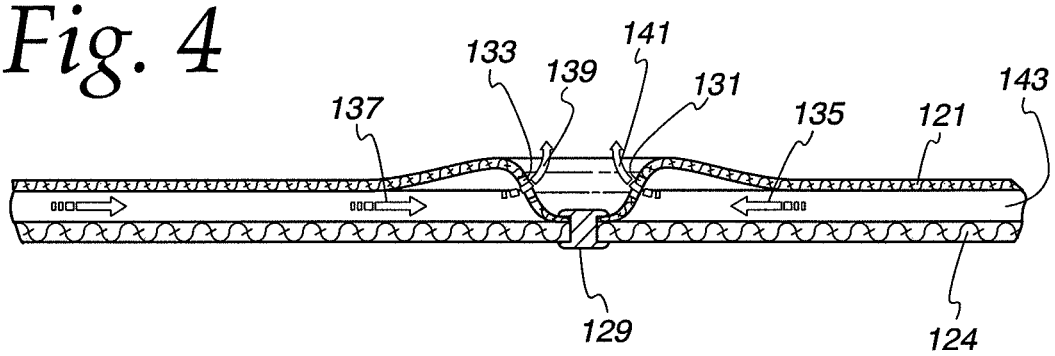
FIG. 4 is an elevational view of a portion of the levitation device illustrated in FIG. 3.

The second cover, as best illustrated in FIGS. 3 and 4 and generally identified with the reference numeral 120, includes a panel 124, configured to the size of a mattress 28 (FIG. 16). The cover 120 includes a stretchable band 132, attached to the periphery of the panel 124. The band 132, allows the cover 120 to be removably secured to the underside of the mattress 28, as generally shown in FIG. 6.

The panel 124 and the band 132 portion of the cover 120 are similar to the cover 22 except that the cover 120 additionally includes an integrally formed levitation device. More particularly, an expandable air volume or bladder is formed in a portion of the cover 120. The expandable volume may consist of a top layer 121 being secured, for example, by sewing or other means, over a portion of the panel 124. As shown, the top layer 121 may be formed from the same material as the panel 124 and formed in virtually any shape, as discussed above, such as a circular shape, and generally centrally located with respect to the cover 120. The top layer 121 and the panel 124 are formed with a slick surface facing outwardly. The other side of the cover 120 may be formed with either a slick surface or a non-slick surface.

The expandable volume includes an air intake nozzle 123 (FIG. 3) and one or more air discharge holes, generally identified with the reference numerals 131 and 133. A grommet 129 (FIG. 4) or other fastening means to attach a center point of the top cover 121 to the panel 124, such as heat sealing, stitching, glue or the like, may be centrally located with respect to the top layer 121 and used to secure a one point on the top cover 121 to the panel 124 and create the expandable volume which includes the air channels, identified by the reference numeral 143 to create the air flow as illustrated by the arrows 135*a* and 137 from the nozzle 123 to the discharge holes 131 and 133.

Figure 1:
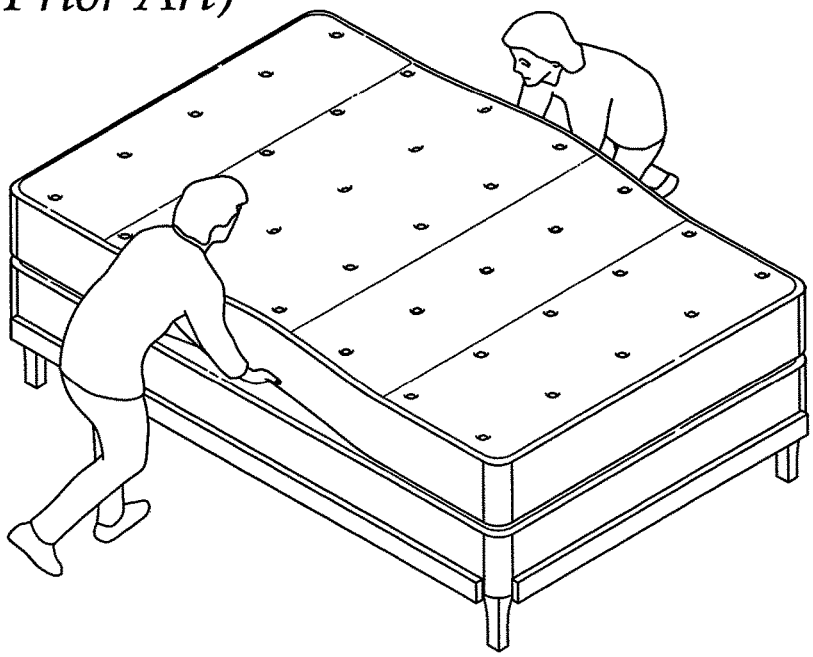
Fig. 1 (Prior Art)
FIG. 1 is an isometric drawing illustrating two people lifting a conventional mattress carried by a box spring in an attempt to rotate the mattress in a horizontal plane.
Figure 2:
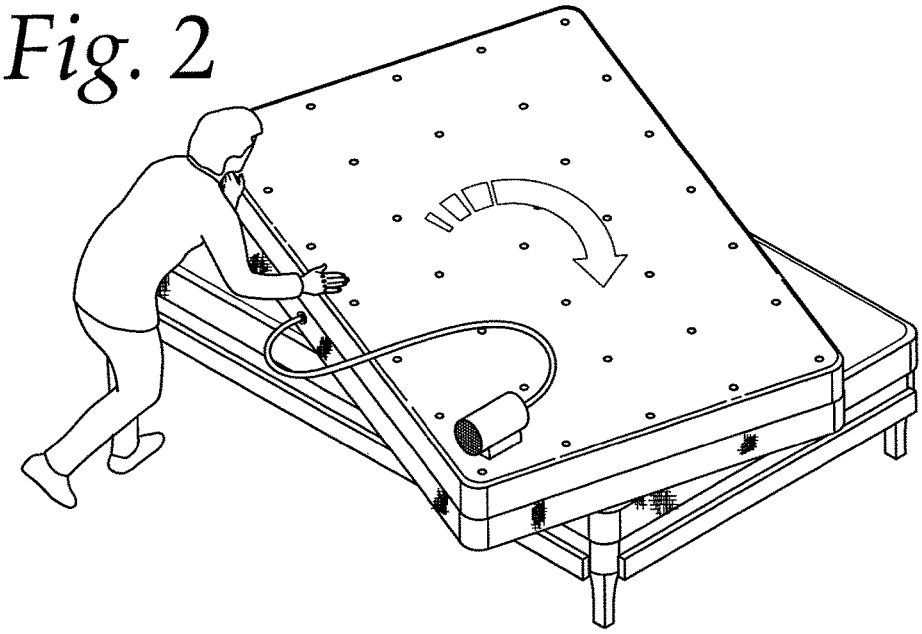
FIG. 2 is an isometric view of one person rotating a conventional mattress carried by a box spring incorporating the present invention, shown with the mattress partially rotated.

As shown in FIG. 4, once air is applied to the air intake nozzle 123 (FIG. 3), the expandable volume is inflated as shown and an air column to be formed adjacent the grommet 129. The air column lifts or levitates a surface in contact with the air column, such as a cover, whether or not embedded in the mattress 28, which, in turn, lifts a portion of the mattress 28 and relieving some of the weight along the periphery of the mattress 28. In as much as the slick surface of the cover 22 is in contact with the slick surfaces of the top cover 121 and the slick surface of the panel 124, the mattress 28 (FIG. 5) is virtually effortlessly rotated, as generally illustrated in FIG. 2. Once the mattress 28 has been rotated to the desired position, the cover 22 is attached to the mattress 28 causing its non-slick side to be contact with the box spring 30.

The bands 132 and 34 (FIGS. 3 and 5) may be formed from an elastic material, for example, spandex and other stretchable materials, such as mesh or an elastic banding and attached to the panels 124 and 26 respectively, for example, by sewing. Alternatively, the bands 32, 34 (FIG. 5) can be formed from a mesh or stretchable fabric. The bands 132 and 34 (FIG. 5) can also be formed from the same material as the panels 124 (FIG. 3) 24, 26 or same materials as sides of the mattress, mattress encasement, or box spring and secured to the mattress 28 and box spring or platform 30 by way the vertical attachments methods, as discussed below. Horizontal attachments methods may also be used to tighten the grip of the cover with respect to the mattress, box spring, or foundation. The single cover and coverless embodiments, including aftermarket encasements and mattress covers with zip-out bottom panels as discussed above may also include the attachment methods described in conjunction with the two cover embodiment. of a drawstring (not shown) or other attachment method.

Figure 28A:
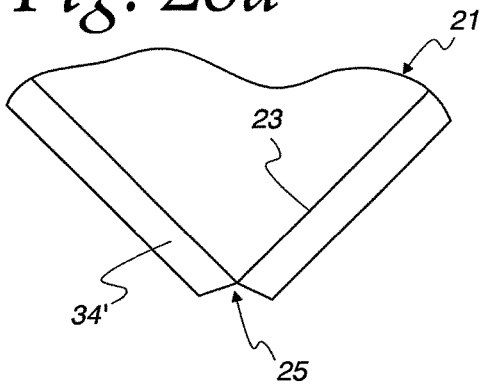
FIG. 28*a* is a partial isometric view of a material blank for use as a cover with the present invention, shown with fold lines on adjacent edges and an obtuse angle cut-out at one corner.
Figure 28B:
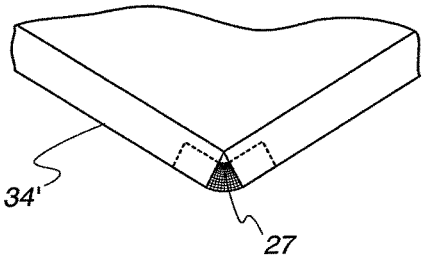
FIG. 28*b* is similar to FIG. 28*a* but illustrating an elastic material joining the strips defined by the fold lines and bridging the cut-out.

The bands 132 and 34 may also be formed by less labor intensive methods, as illustrated in FIGS. 28*a*-28*b* and FIGS. 29*a*-29*c*. The methods illustrated in these figures, reduce the amount of sewing and thus the labor involved. For simplicity, only one cover 22 is described and illustrated. However, these teachings also apply to the band 132 and panel 124 of the cover 120. Referring first to FIGS. 28*a* and 28*b*, one corner of a cover blank, generally identified with the reference numeral 21, is illustrated for simplicity. The cover blank 21 is formed as a generally rectangular piece of material with fold lines, generally identified with the reference numeral 23, adjacent to each edge of the rectangular piece of material. As shown in FIG. 28*a*, a piece of material is cut out of each corner defining, for example, an obtuse angle. The cut-out is identified with the reference numeral 25. The bands 34' are folded down as shown in FIG. 28*b*. A piece of flexible material, such as elastic, identified with the reference number 27, is used to bridge the cut-out 25. The flexible material 27 is secured to the ends of the contiguous bands 34'. As will be appreciated by those of ordinary skill in the art, the embodiment illustrated in FIGS. 28*a* and 28*b* significantly reduces the labor costs.

Figure 29A:
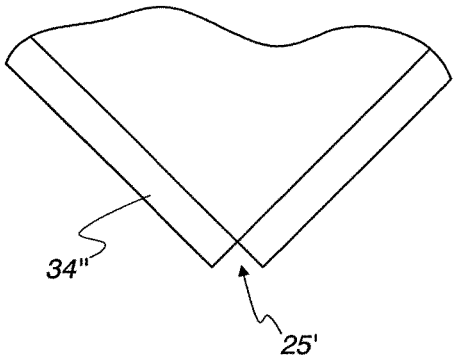
FIG. 29*a* is similar to FIG. 28*a* but illustrates a cut-out at other than an obtuse angle.
Figure 29B:
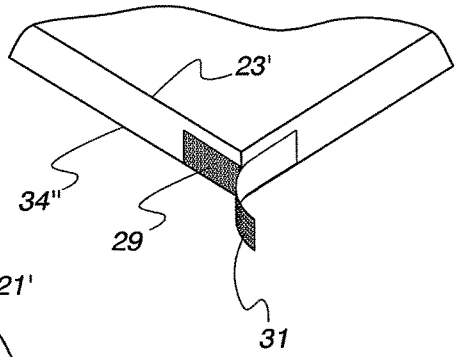
FIG. 29*b* illustrates the material blank illustrated in FIG. 29*a* with an integrated fastener strip on the strips defined by the fold lines shown with a cooperating removable fastener strip partially attached to the integrated fastener strip.
Figure 29C:
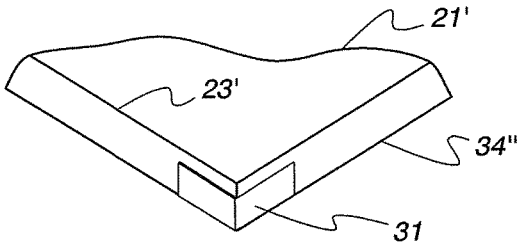
FIG. 29*c* is similar to FIG. 29*b* but shown with the removable fastener strip completely attached to the integrated fastener strip.

A second technique to reduce labor costs is illustrated in FIGS. 29*a*-29*c*. In this embodiment, the corners of the material blank 21' are cut to form a cut-out 25' that is not an obtuse angle. The exemplary cut-out 25' is shown at roughly a 90 degree angle. In this embodiment, a fastener strip 29 is affixed to each end of the band 34", adjacent the cut-out 25'. A cooperating removable fastener strip 31 may be attached to the fastener strips 29 to secure the adjacent bands 34" together. The fastener strips 29 and 31 may be Velcro or other type of fastener. The embodiment illustrated in FIGS. 29*a*-29*c* allows the material blank 21' to be juxtaposed over the mattress 28 or box spring 30 with the removable fastener strips 31, as least partially removed, for example, as shown in FIG. 29*b*. and secured to the exposed cooperating fastener strip 29, once the cover 20 is in place, as shown in FIG. 29*c*.

Figure 29D:
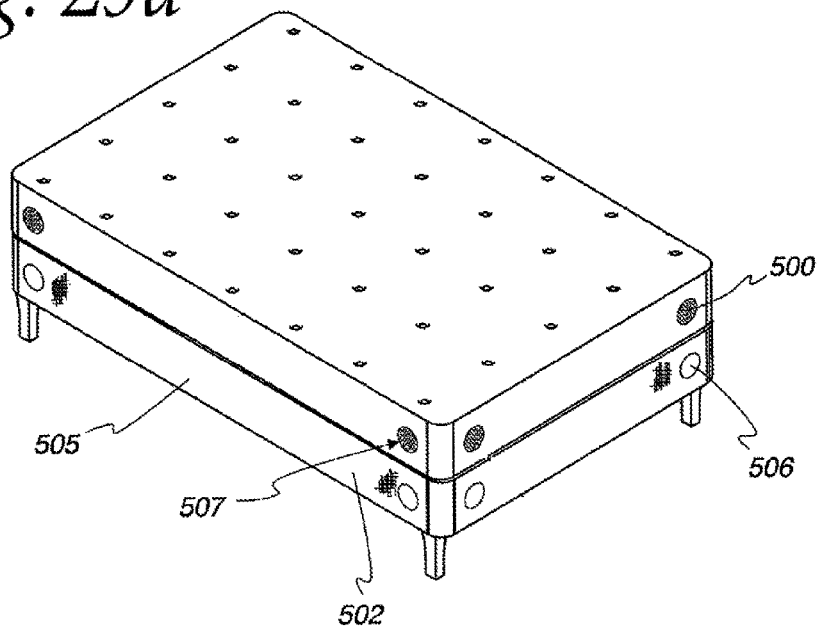
FIGS. 29*d* and 29*e* illustrate an application of the mattress management system which includes a cover with four side panels in which conventional fasteners attached to the mattress and the foundation to hold the cover in place.
Figure 29E:
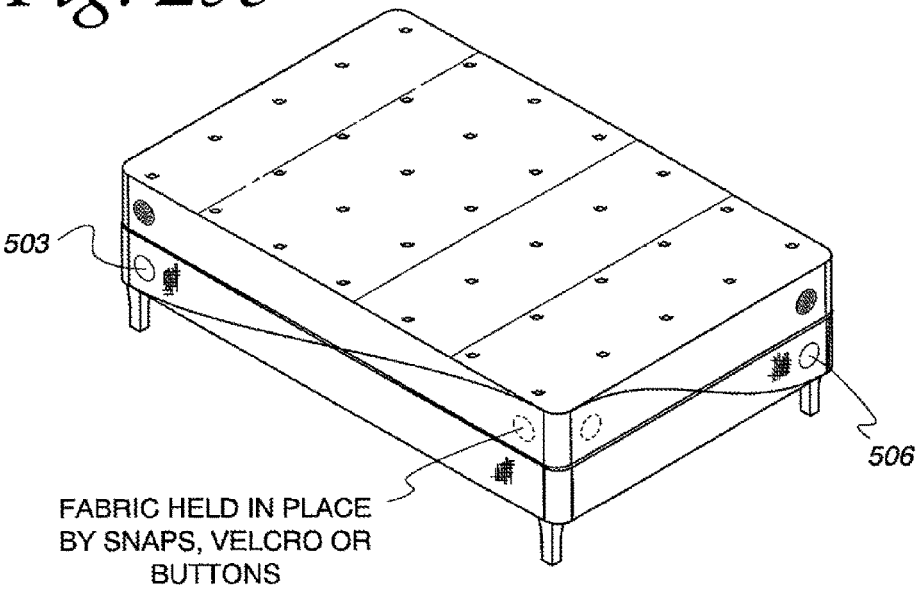

FIGS. 29*e*-29*j* illustrate various techniques to tighten the grip of the cover, for example, the one cover mattress management system described herein, with respect to a mattress or foundation. As shown in FIGS. 29*d* and 29*e*, conventional fasteners, such as snaps, Velcro or buttons, generally identified with the reference numeral 504 are rigidly affixed to the mattress 500 and/or the foundation 502. Mating fasteners 506 may be provided on the cover 503. As shown in FIG. 29*d*, the cover 503 is attached to the foundation 502. As the cover 503 is attached to the mattress 500, the mating fasteners 500 and 506 are joined together to secure the cover 503 relative to the mattress, as illustrated in FIG. 29*e*. It is also contemplated to dispose additional mating fasteners on the cover 503 and the foundation to secure the cover 503 to the foundation 502.

Figure 29F:
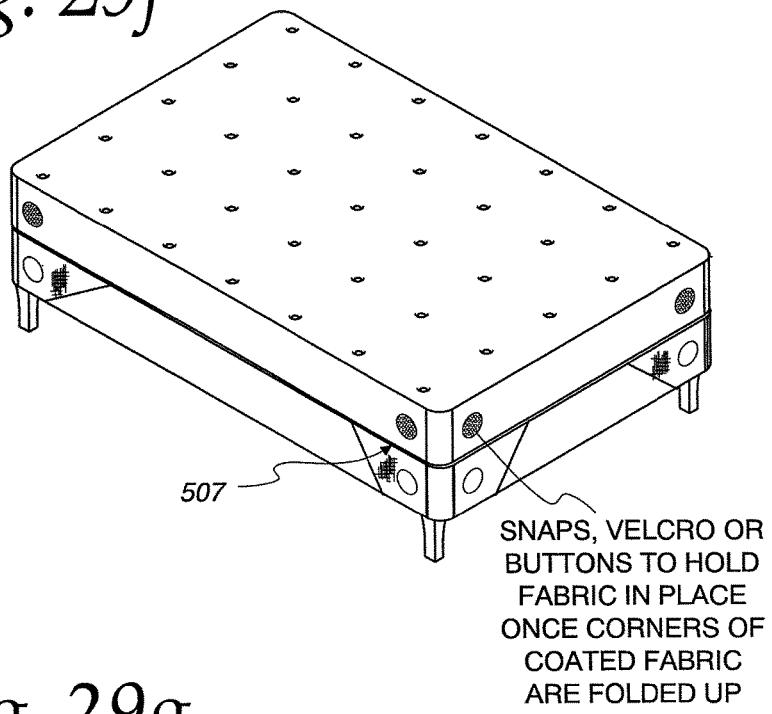
FIGS. 29*f* and 29*g* are similar to FIGS. 29*d* and 29*e* but only includes four corner pieces that are used to hold the cover in place.
Figure 29G:
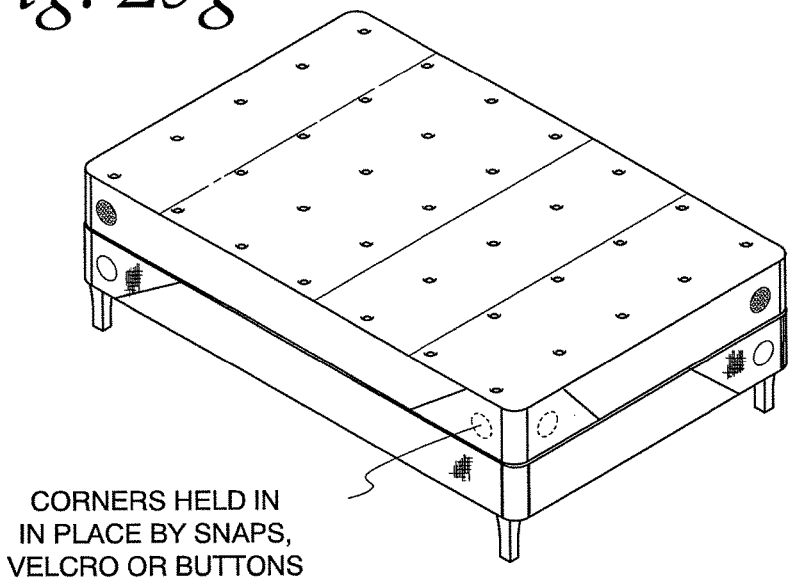

FIGS. 29*f* and 29*g* are similar to FIGS. 29*d* and 29*e*. In this embodiment, the cover 503 is not provided with full side panels 505, as illustrated in FIGS. 29*d* and 29*e*, but rather corner flaps, generally identified with the reference numeral 507. FIGS. 29*m* and 29*m* are similar to FIGS. 29*d* and 29*e* but illustrate the mattress encased in an encasement, as illustrated in FIGS. 24*a* 24*b*. FIGS. 29*o* and 29*p* are similar to FIGS. 29*f* and 29*g* but show a mattress encased with a zip-on encasement.

Figure 29H:
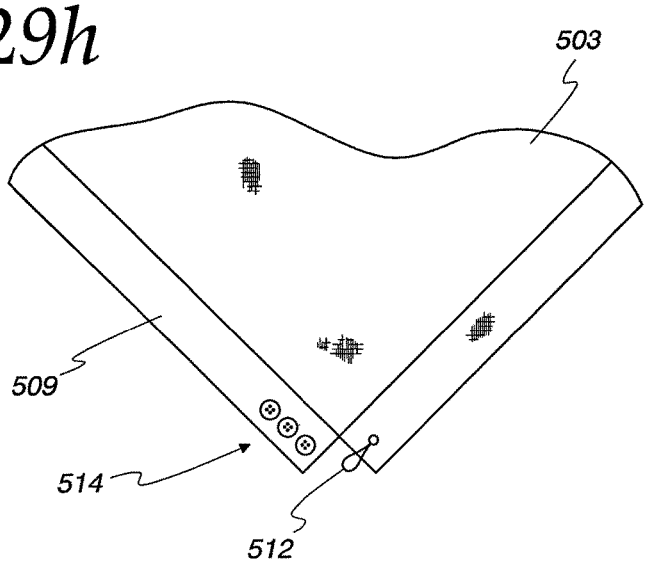
FIGS. 29*h* and 29*i* illustrate alternate configurations for securing the cover with respect to the foundation or mattress.
Figure 29I:
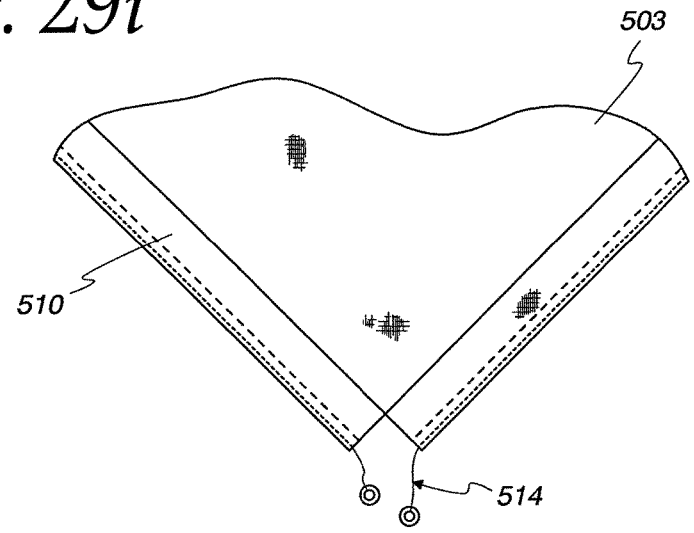

FIGS. 29*h* and 29*i* illustrate different exemplary techniques for providing a tight grip between the cover 503. In these embodiments, at least two of the side panels 509, 510 are not attached together, as shown. In FIG. 29*h*, the end of one side panel 509 includes a loop 512. The adjacent side panel 509 includes a plurality of buttons, generally identified with the reference numeral 514, for receiving the loop 512. The grip of the cover 503 is adjusted depending on the particular button selected to catch the loop. FIG. 29*i* is similar but utilizes a drawstring 514 to tighten the grip of the cover 503 with respect to a mattress or foundation. FIGS. 29*k* and 29l represent an alternative method for securing the cover 503 with respect to a mattress or foundation.

Figure 29J:
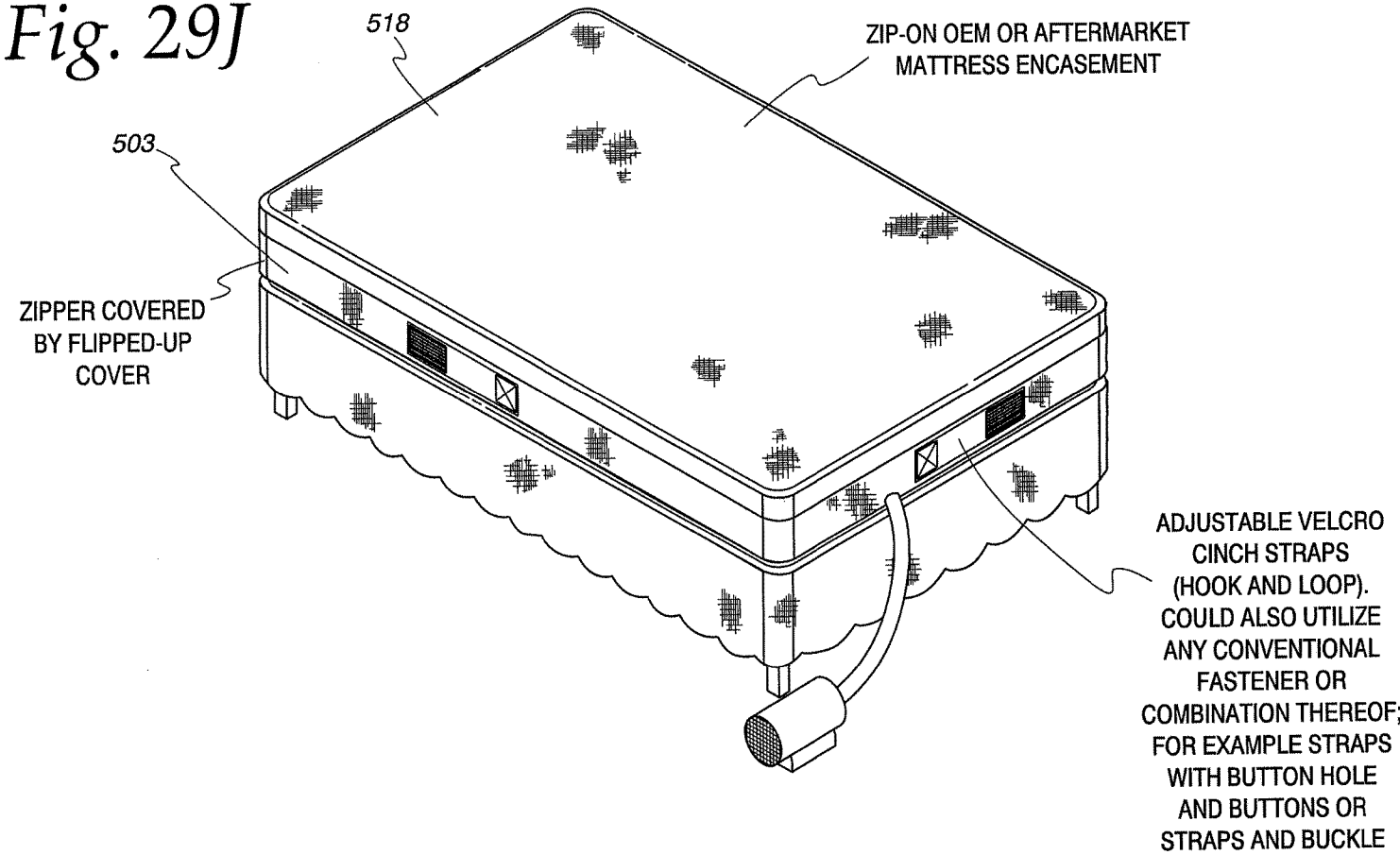
FIG. 29*j* illustrates another alternate embodiment for securing the side panels to the mattress or foundation.
Figure 29K:
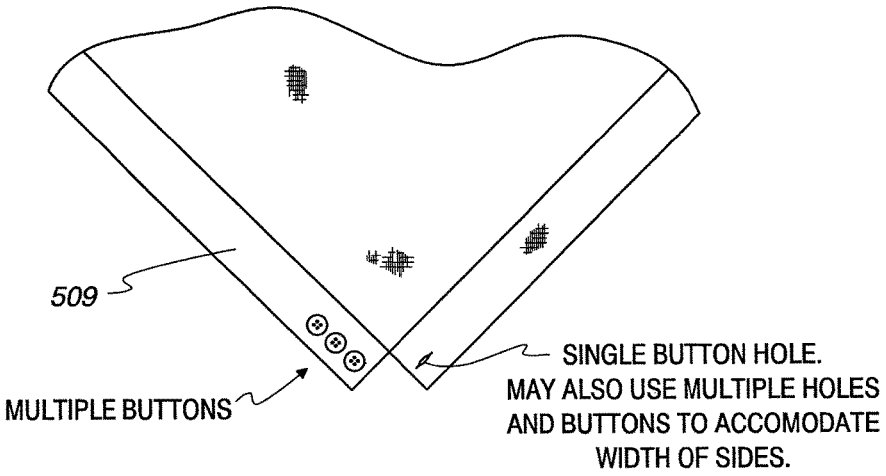
FIG. 29*k* illustrates another alternate embodiment for securing the side panels to the mattress or foundation
Figure 29L:
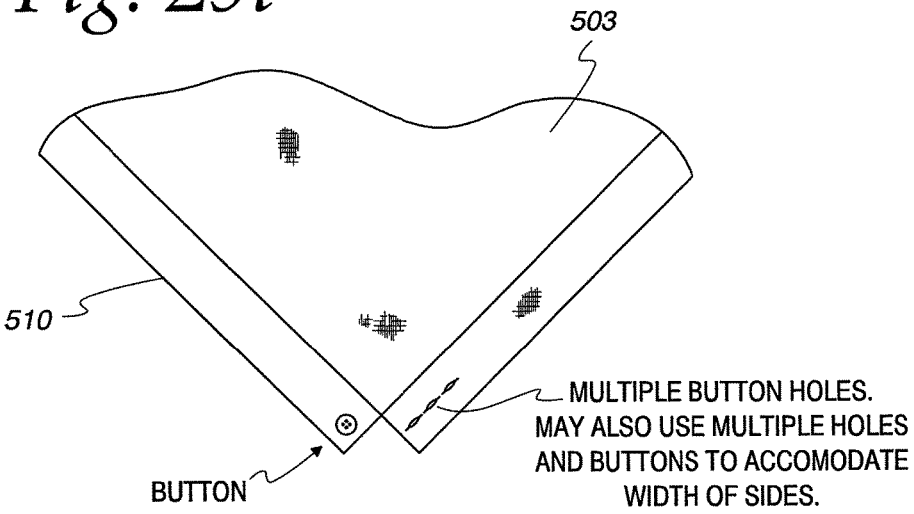
FIG. 29*l* illustrates another alternate embodiment for securing the side panels to the mattress or foundation.
Figure 29M:
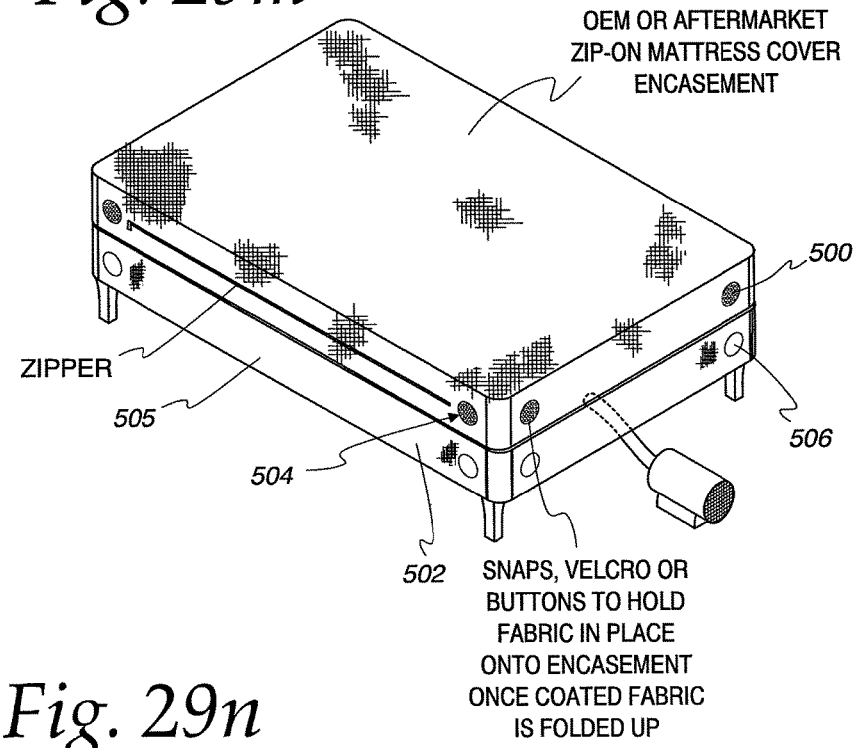
FIG. 29*m* illustrates an alternate embodiment of the invention illustrated in FIG. 29*d* illustrating the mattress encased in an encasement as illustrated in FIG. 24*a* or FIG. 24*b*.
Figure 29N:
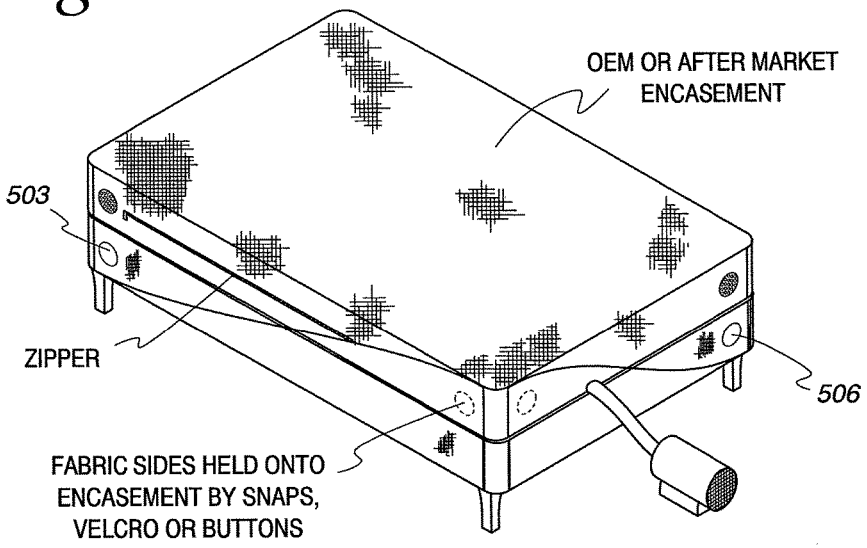
FIG. 29*n* illustrates an alternate embodiment of the invention illustrated in FIG. 29*d* illustrating the mattress encased in an encasement as illustrated in FIG. 24*a* or FIG. 24*b*.
Figure 29O:
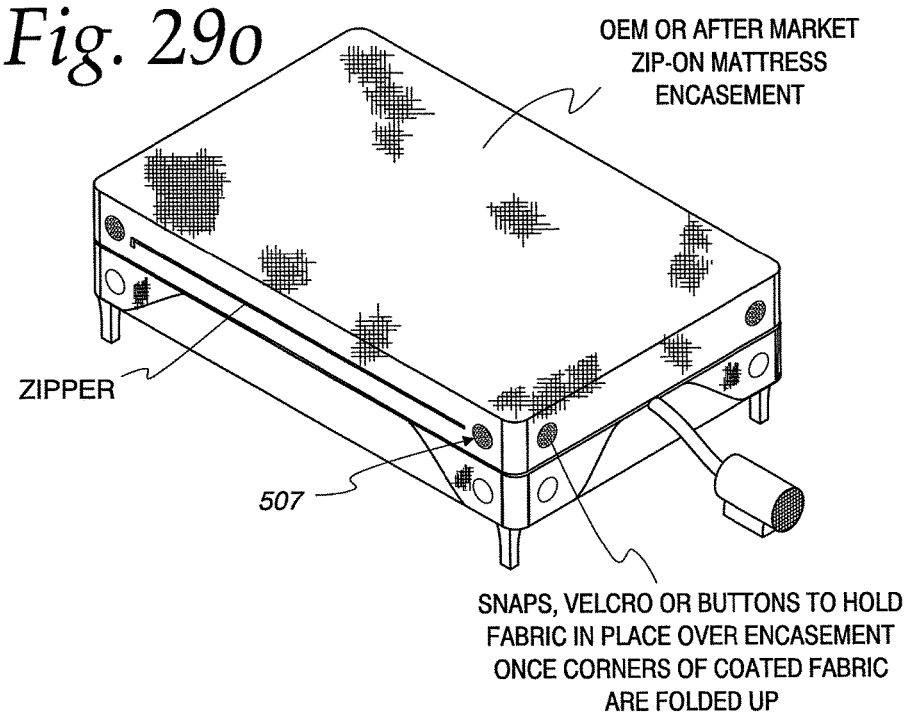
FIGS. 29*o* and 29*p* are similar to FIGS. 29*f* and 29*g* except the mattress is covered in a zip-on encasement.
Figure 29P:
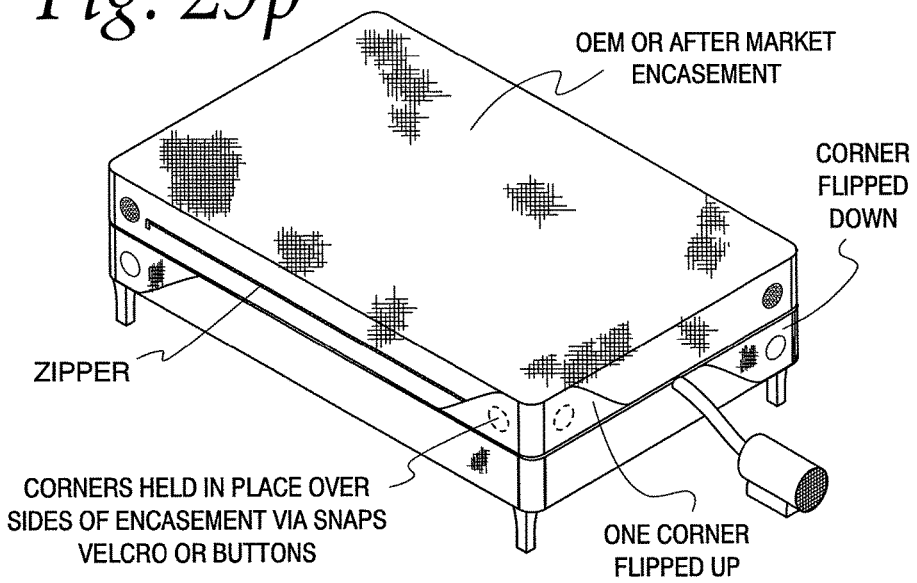

FIG. 29*j* illustrates a cover 503 in which all of the side panels are connected forming a fitted sheet. In this embodiment, each side panel may include a strap and Velcro, as generally indicated by the reference numeral 516. In this embodiment the strap can be tightened and attached to the Velcro in the tightened position to tighten the grip of the cover 503 relative to the mattress 518 or foundation (not shown).

In accordance with an important aspect of the invention, the cover 22 (FIG. 5) may have a "slick" side having a relatively low co-efficient of friction and a non-slick side having a relatively higher co-efficient of friction. The other cover 120 which includes a portion of the levitation device has at least one slick side and may have two slick sides. As such, when the slick surfaces of the two covers 120 and 22 are selectively placed in contact with each other, the mattress 28 can be rotated in a horizontal plane with minimal effort by one person in a configuration defining a rotate mode of operation, as discussed in more detail below. The non-slick side of the cover 22 is used to selectively be placed in contact with an uncovered surface of the box spring 30. The non-slick side provides a the uncovered surface of the box spring 30, platform or bed skirt 36 in order to reduce if not prevent unintended rotation of the mattress in a normal configuration.

Various materials, such as cloth, and other materials that are bendable and amenable to being folded are suitable for the panels 124, 26 for the covers 10, 22. The material for one cover 120, 22 need only have a slick side and a non-slick side. The non-slick side can be created on one side of a slick material by way of a coating or sewing or fusing a non-slick backing to one side of the non-slick material. Various conventionally available materials are suitable for the cover having a slick side and a non-slick side. For example, "30 Denier Heat Sealable (backside) 100% Nylon Rip Stop" material is suitable for use with the present invention or other materials with similar coefficients of friction on the slick and non-slick sides. Such material may be nylon, for example, 100% nylon with a coating on one side, for example, urethane or other thermal plastic or heat sealable coating. Such nylon rip stop material is known to come in widths of 58-86 inches wide and weighs about 1.1 to 4.4 ounces per square yard. Such material can easily be pieced together to accommodate various mattress widths if necessary.

Nylon rip stop material suitable for use with the present invention is available from various sources, such as, Quest Outfitters of Sarasota, Fla. (http:/questoutfitters.com). Their nylon taffeta material is described in detail at http:/questoutfitters.com/coated.html#HEAT_SEALABLE, hereby incorporated by reference. Suitable nylon taffeta material is also available from Rockywoods in Loveland, Colo. (http:/www.rockywoods.com). Their nylon taffeta material is described in detail at http:/www.rockywoods.com/Fabrics-Hardware-Patterns-Kits/Medium-Weight-Nylon-Fabrics/Heat-Sealable-70-Denier-Nylon-Taffeta, hereby incorporated by reference.

Non-woven materials may also be used for the cover 120, 22 having a slick side and a non-slick side. For example, Tyvek® polyethylene non-woven fabric, as manufactured by the DuPont Corporation and described in detail at http:/www2.dupont.com/Products_and_Services/en_VN/nwn.html may be used. Other materials having two slick sides can also be used, such as, silicone impregnated nylon rip stop, for example, as available from Seattle Fabrics, Inc., http:/www.seattlefabrics.com/nylons.html. Other materials can also be used with a coating applied to one side. Moreover, different materials can be used for each cover in an application.

As will be discussed in more detail below, several embodiments of the invention include an expandable air volume and no air exit holes or an adjustable air exit valve. These embodiments rely on the porosity of the material to provide a controlled release of the air from the expandable air volume.

Various embodiments discussed herein require one or two covers with a slick side and a non-slick side. The following materials are suitable for this purpose and are described below. For example, the following exemplary materials may be used:

- warp-knit fabric with a polyurethane laminate coating or a silicone coating.
- a non-woven material with a polyurethane laminate coating or a silicone coating.
- Tricot fabric with a polyurethane backing or a silicone coating.
- a stitch bond fabric with a polyurethane laminate coating or a silicone coating.

Nylon or polyester ripstop with a silicone coating on one side and a polyurethane coating on the other side a stitch bond fabric, available from Tietex, item no 944164, style no. C243, wherein the fabric is 32% rayon, 22% polyester, 6% twaron and 40% coat.

Materials having a similar co-efficient of friction and porosity characteristics may also be used. All such materials are considered to be within the broad scope of the invention.

The following textile materials may be also be used for the various surfaces discussed above. These textile materials can be used uncoated or coated on one or both sides as indicated below to control the co-efficient of friction to create a slick surface or a non-slick surface relative to the co-efficient of friction on the other uncoated or coated side.

70 DENIER×70 DENIER NYLON RIPSTOP
70 DENIER×70 DENIER POLYESTER RIPSTOP
70 DENIER NYLON & POLYESTER BLEND
70 DENIER NYLON TAFFETA
70 DENIER POLYESTER TAFFETA
30 DENIER POLYESTER OR NYLON RIPSTOP OR TAFFETA
210 DENIER OXFORD NYLON
210 DENIER OXFORM POLYESTER
210 DENIER NYLON & POLYESTER BLEND
WARP-KNIT FABRIC
POLYVINYL CHLORIDE (PVC)
POLYETHELENE SHEETING
POLYPROPOLENE SHEETING
NON-WOVEN FABRIC
OLEFIN (a.k.a. polyethylene & polypropylene)
STITCH-BOND FABRIC
COTTON BLEND
TERRY MATERIAL
TRICOT
HIGH DENSITY & MOLECULAR WEIGHT
POLYETHELYNE FILM The following coatings have a relatively high co-efficient of friction. These coatings may be used to provide a rough or non-slick surface.

POLYURETHANE coated/laminated/bonded/impregnated/backing

POLYVINYL CHLORIDE (PVC) coated/laminated/bonded/impregnated/backing

THERMO PLASTIC coated/laminated/bonded/impregnated/backing

RUBBER coated/laminated/bonded/impregnated/backing

HEAT SEALABLE coated/laminated/bonded/impregnated/backing

WATER REPELLENT coated/laminated/bonded/impregnated/backing

ACRYLIC coated/laminated/bonded/impregnated/backing

ADHESIVE coated/laminated/bonded/impregnated/backing

BLENDED COATING OF ANY OF THE ABOVE

UNCOATED (inherent COEFFICIENT OF FRICTION OF uncoated fabric)

The following coatings may be coated on a side of the materials provide a relatively low co-efficient of friction and thus may be used to provide a slick surface:

SILICONE coated/laminated/bonded/impregnated/backing

TEFLON coated/laminated/bonded/impregnated/backing

PETROLEUM BASE coated/laminated/bonded/impregnated/backing

BLENDED COATING OF ANY OF THE ABOVE

SLICK FIBER WOVEN INTO FABRIC

UNCOATED (inherent COEFFICIENT OF FRICTION OF uncoated fabric)

Referring first to FIGS. 5-8, a first cover 22 is attached to a box spring 30 so that its non-slick side is in contact with the box spring 30 and its slick side is facing upwardly. The second cover 120 which includes a portion of the levitation device is attached to the underside of a mattress 28. In a rotate mode of operation, the cover 22 is attached to the box spring 30 so that its non-slick side is in contact with the box spring 30 and its slick side is facing upwardly so that its slick side is in contact with the slick surfaces 121 and 124 of the cover 120. In a normal mode of operation, the cover 22 is attached to the mattress 28 so that its non-slick side contacts the box spring 28 and its slick side contacts the slick surfaces 121 and 124 of the cover 120, thereby reducing unintended movement of the mattress 28 relative to the box spring 30 or bed skirt 36 or platform.

A small air supply 127 is connected to the air intake nozzle 123 by way of a conduit 125, as generally shown in FIG. 3. Since the force required to lift the mattress 28 is proportional to the pressure multiplied by the area of the mattress 28, the area of the top cover 121 may be divided into the total weight of the mattress 28 by the amount of pressure required by the air pump 160. As shown, the diameter of the top cover 121 may be selected to be slightly less than the width of the mattress 28, as shown, for example, in FIG. 3.

Figure 14:
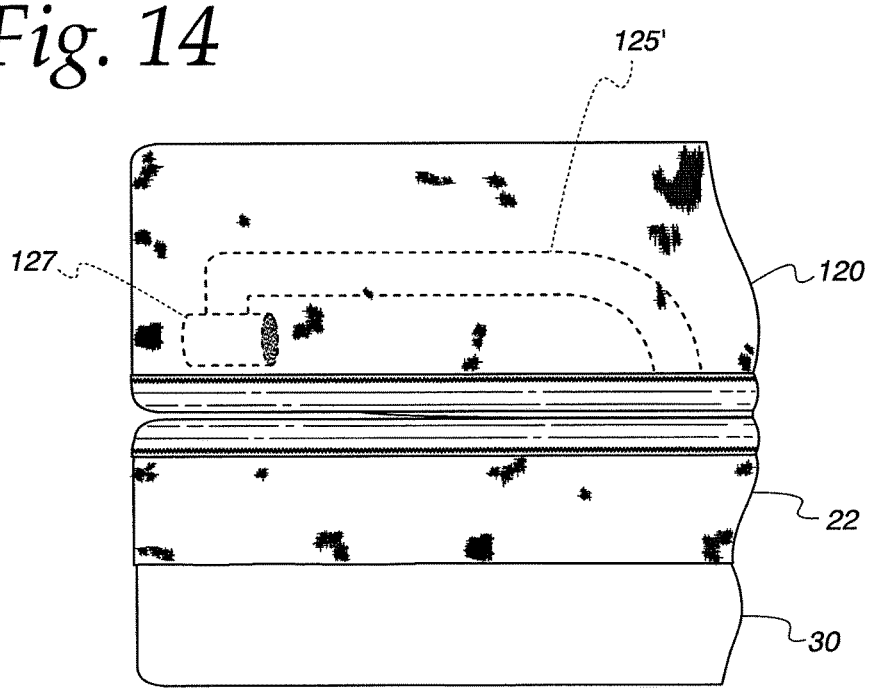
FIG. 14 illustrates an alternative embodiment of the system which includes an internal air pump built into the mattress, also illustrating the air conduit for supplying air to an expandable air volume which forms a portion of the levitation device, shown with a slick surface built into the mattress
Figure 15:
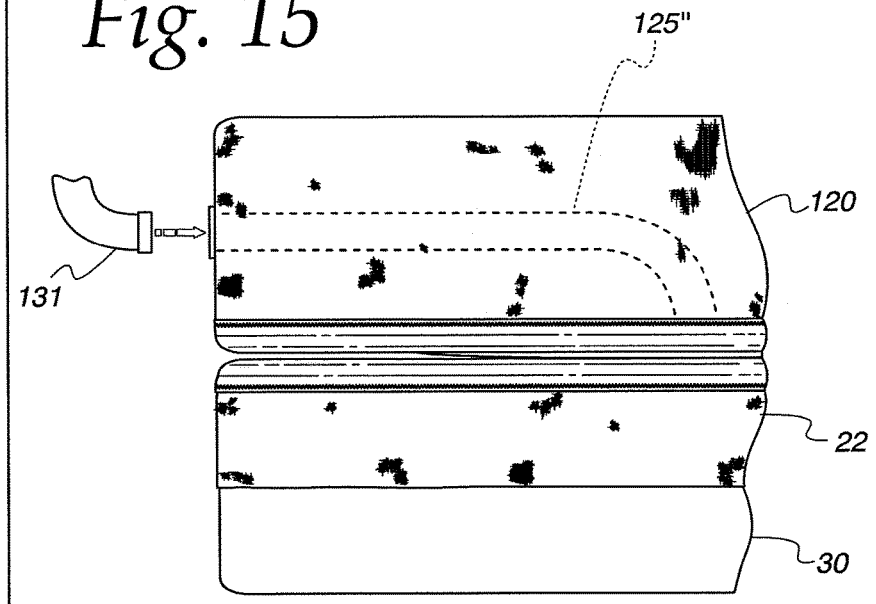
FIG. 15 is similar to FIG. 14 but illustrating an embodiment with an external air pump.

An alternate embodiment of the invention is illustrated in FIGS. 14 and 15. In this embodiment, a conduit 125' between the air intake nozzle 123 (FIG. 3) and the air pump 127 may be partially incorporated into the mattress 28. FIG. 16 illustrates yet another alternate embodiment in which includes an embedded conduit 125" the mattress 28 in that it is in fluid communication with the interior of the expandable volume and is connected to the air supply pump 127 (FIG. 3) external to the cover 120 by way of a connector 131.

Figure 9A:
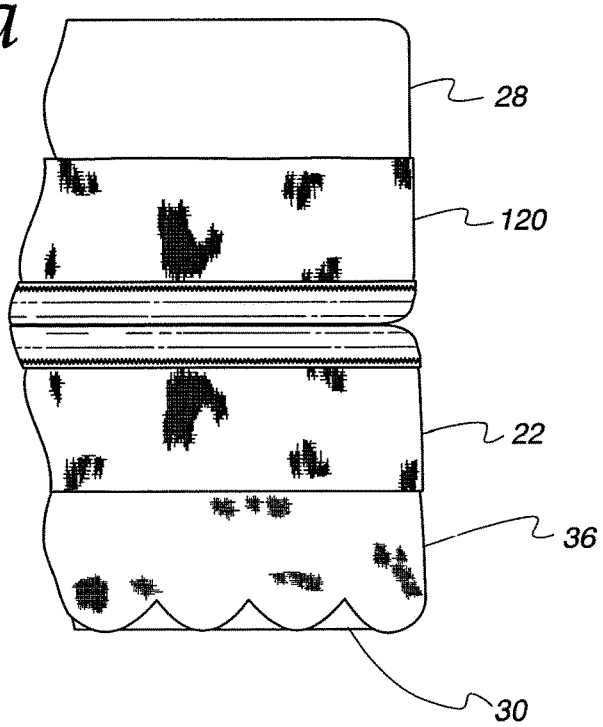
FIG. 9*a* is a partial side elevational view of the embodiment illustrated in FIG. 8, shown with one of the covers installed on the mattress and the other cover installed on the box spring illustrating a rotate configuration in which both slick surfaces are in contact with each other, illustrating the bottom cover installed over a bed skirt.
Figure 10A:
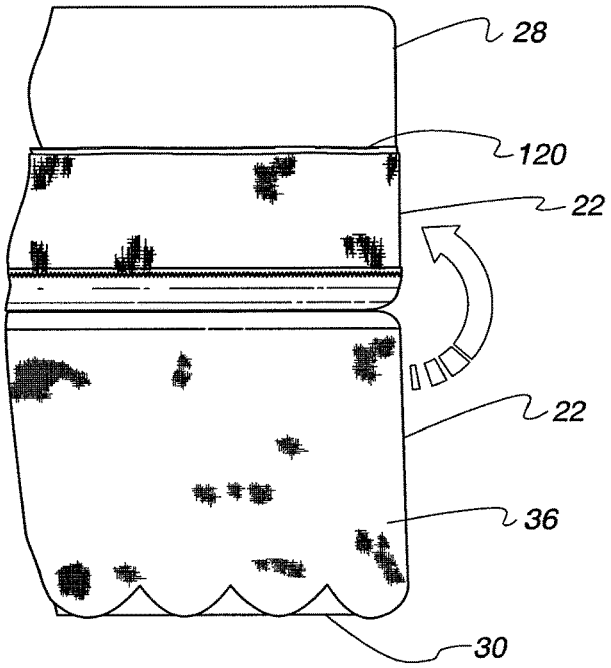
FIG. 10*a* is similar to FIG. 9*a* but shown with both covers installed on the mattress, illustrating a normal configuration in which a non-slick surface of the bottom cover is in contact with the surface of the bed skirt.

FIGS. **9*a*-13 illustrate one application of the covers 120 and 22 in which a bed skirt 36 is draped over the box spring 30, as generally shown in FIG. 9*a*. Heretofore rotation of a mattress 28 with a bed skirt 36 draped over the box spring 30 was a relatively cumbersome task. The present invention greatly simplifies rotation of the mattress 28 in such an application. More specifically, in this application, the cover 120 is attached to the underside of the mattress 28 so that its non-slick side or non-slick side, i.e. side not including the top cover 121, is in contact with the mattress 28 and its slick side, i.e. side including the top cover 121, is facing downward. The other cover 22 is attached to the box spring 30 over the bed skirt 36 so that its non-slick side is in contact with the bed skirt 36 and its slick side is facing upward, thereby placing the slick sides of the covers 120 and 22 in contact with each other, as shown in FIG. 9. The mattress 28 can then be rotated virtually effortlessly, as generally illustrated in FIG. 2**.

After the mattress 28 is rotated to the desired position, the cover 22 is detached from the box spring 30 and attached to the mattress 28 over the cover 120, as shown in FIG. **10*a*. This places the non-slick side of the cover 22 in contact with the bed skirt 36 to reduce if not prevent unintended rotation of the mattress 28. As shown in FIG. 10, the bed skirt 36 is uncovered and undisturbed since the cover 22 holds the bed skirt 36 in place during the rotation of the mattress 28**.

Figure 9B:
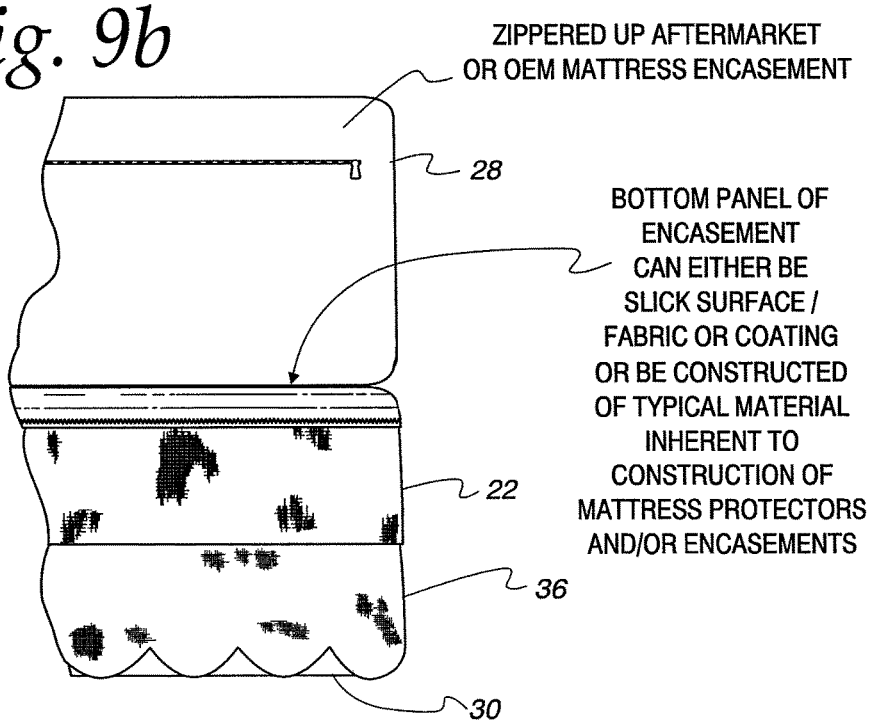
FIG. 9*b* is similar to FIG. 9*a* but shown with one cover and the mattress encased with an encasement as shown in FIGS. 24*a*, 24*b*.
Figure 10B:
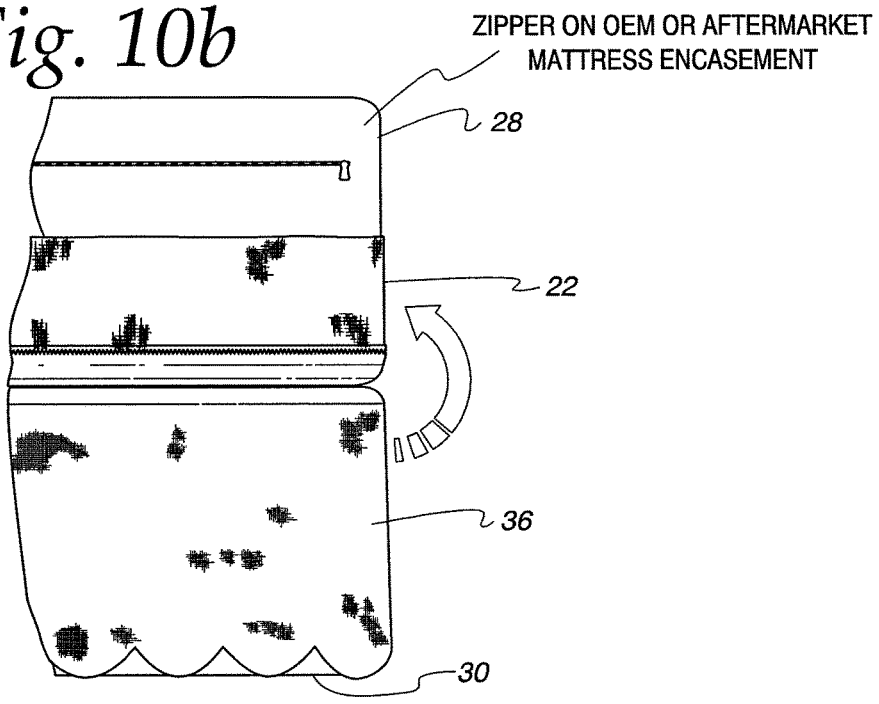
FIG. 10*b* is similar to FIG. 10*a* but shown with one cover and the mattress encased with an encasement with a single cover as shown in FIGS. 24*b* and 25*b*
Figure 11:
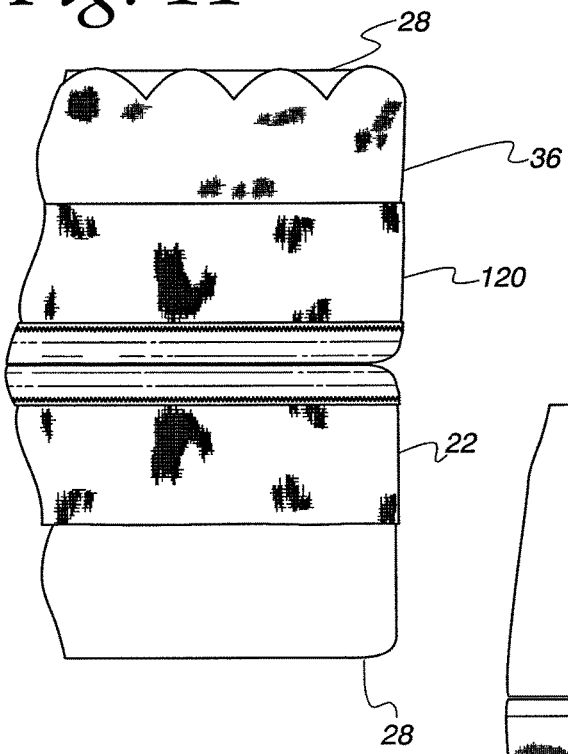
FIG. 11 is an alternative application of the embodiment illustrated in FIGS. 8-10*a* in which the bed skirt is used to hide both covers in a normal configuration, shown in a rotation configuration.
Figure 12:
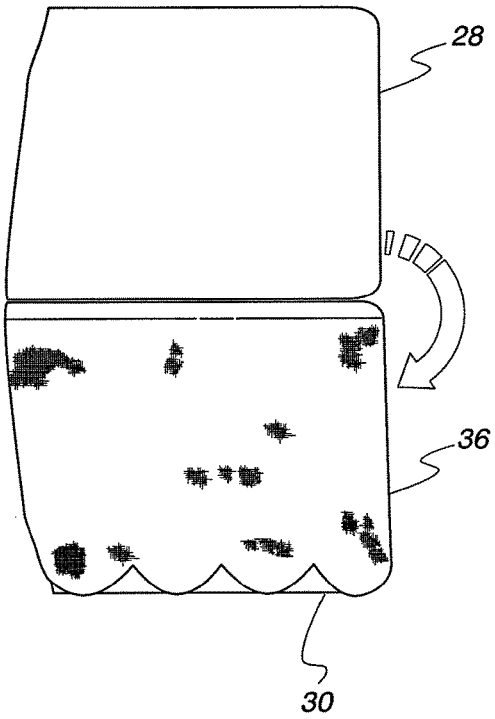
FIG. 12 is a partial elevational view of the application illustrated in FIG. 11 in a normal configuration in which the bed skirt is pulled down over the box spring hiding both of the covers.
Figure 13:
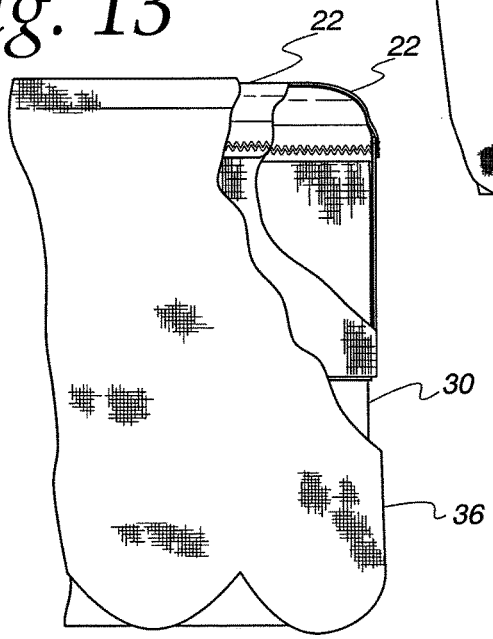
FIG. 13 is a partial elevational view of the box spring illustrated in FIG. 12, partially in section, shown in a normal configuration.

FIGS. 11-13 are similar to FIGS. **9*a* and 10*a* and illustrate another application in which the bed skirt 36 is used to hide the covers 120 and 22 in a normal configuration. Referring to FIG. 11, the bed skirt 36 is disposed around the mattress 28 so that its finished side is in contact with the mattress 28** and its unfinished side is facing outwardly. The cover 120 is attached to the mattress 28 over the bed skirt 36 so that its non-slick side is in contact with the bed skirt 36 and its slick side is facing downwardly. The other cover 22 is attached to the box spring 30 so that its non-slick side is in contact with the box spring 30 and its slick side is facing upwardly, thus placing the slick sides of the covers 120 and 22 in contact with each other. The mattress 30 can then be rotated in a horizontal plane virtually effortlessly by one person. Once the mattress 28 is in the desired position, the cover 120 is detached from the mattress 28 and attached to the box spring 30, over the other cover 22. This places the non-slick side of the cover 120 in contact with the underside of the bed skirt that is in contact with the mattress 28, thereby reducing unintended rotation of the mattress 28. Once the cover 120 is attached to the box spring 30, the bed skirt 36 is folded down over the box spring 30, thereby hiding both the first and second covers 120 and 22, as shown in FIGS. 12 and 13. FIGS. 9*b* and 10*b* are similar to FIGS. 10*a* and 10*b* but illustrate a one cover embodiment with the mattress encased in an encasement as illustrated in FIG. 24*a* or 24*b*.

FIGS. 24*a*, 24*b* and 25*a*, 25*b* relate to a mattress encasement version and illustrate an embodiment in which the cover 120 is replaced with a protective cover 40, such as a waterproof cover, that encapsulates the mattress 28. The cover 40 is formed with a portion of the levitation device, as illustrated in FIG. 24*a* and discussed above. The protective cover 40 is to size and shape of the mattress 28 to provide a relatively snug fit. An opening 42 is provided along one edge of the protective cover 40 to enable the mattress 28 to be placed inside the protective cover 40 so that the levitation device is facing downwardly. A conventional fastener, such as a zipper 44 may be used to close the opening 42. In this embodiment, one surface 46*a* of the cover 40 is provided with a slick surface 46*a* as is the top cover 121' of the levitation device or top surface of the box spring 22 (FIG. 24*a*).

Figure 25B:
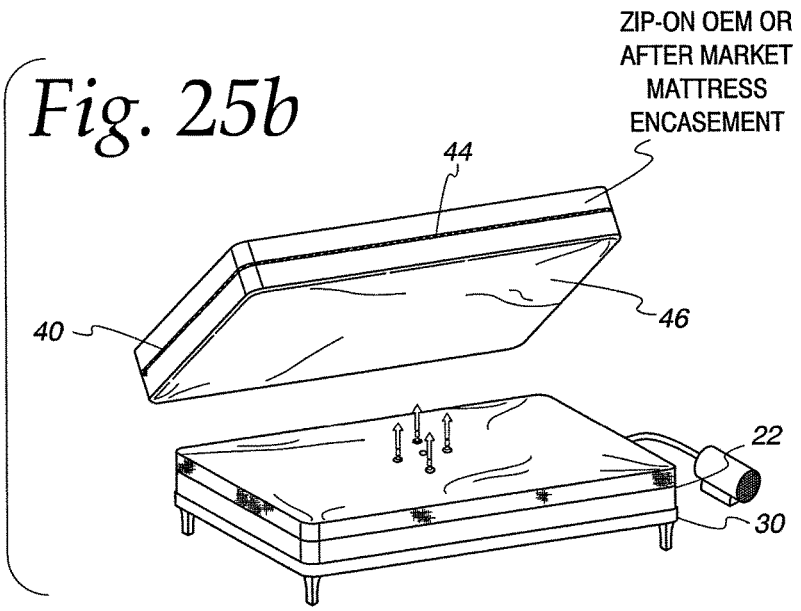
FIG. 25*b* is similar to FIG. 25*a* but illustrating the alternative embodiment of the encasement illustrated in FIG. 24*b*.

With reference to FIG. 24*a*, the mattress 28 and the cover 40 are configured so that the slick surface 46*a* faces the box spring 30. The cover 22 is formed with a slick surface and a non-slick surface. The cover 22 is attached to the box spring 30 so that its non-slick side is in contact with the box spring 30 and its non-slick side is facing upwardly. The slick side 46*a* of the cover 40 cooperates with the slick side of the cover 22 to facilitate rotation of the covered mattress 28 in a rotate mode. The cover 22 is as described above with a slick surface and a non-slick surface. More particularly, in a rotate mode of operation, the cover 22 is attached to the box spring 30 so that its non-slick surface is in contact with the box spring 30 and the slick surface faces upwardly in order to contact the slick surface of the protective cover 40. In this mode, the mattress 28 can be effortlessly rotated in a horizontal plane once the air pump 127 (FIG. 3) is turned on to fill and continue to feed the expandable air column with air creating a levitation effect. An alternative embodiment of the encasement is illustrated in FIGS. 24*b* and 25*b*.

In addition to the embodiments discussed above which require two covers, alternate embodiments are discussed below in which one or both of the covers 120 and 22 are integrally formed in the mattress or box spring 30, respectively. For example, as illustrated in FIGS. 16-23, one or both of the covers 120 and 22 may be eliminated and integrally formed in the mattress 28 or box spring 30. For example, assume that the cover 120 is integrally formed on the underside of the mattress 28. In this embodiment, the cover 22 is attached to the box spring 30 so that its non-slick surface is in contact with the box spring 30 and its slick surface faces upwardly in a rotate mode of operation. Once the mattress is rotated to the desired position, the cover 22 is attached to the mattress 28 so that its non-slick surface is in contact with the box spring 30 and its slick surface is in contact with the slick surfaces 121' and 124' of the cover 120' in a normal mode of operation.

Alternatively, as illustrated in FIGS. 16-18, both covers 120' and 22' can be integrally formed in the mattress 28 and box spring 30, respectively with their respective slick surfaces in constant contact. In this embodiment, the slick surfaces 121' and 124' of the cover 120' and the slick surface of the cover 22' is attached to the underside of the mattress 28 such that the slick surface faces downwardly and is in contact with the underside of the mattress 28. In a rotate mode of operation, the slick surface of the cover 120' is in contact with the slick surface integrally formed in the box spring 30.

Figure 19:
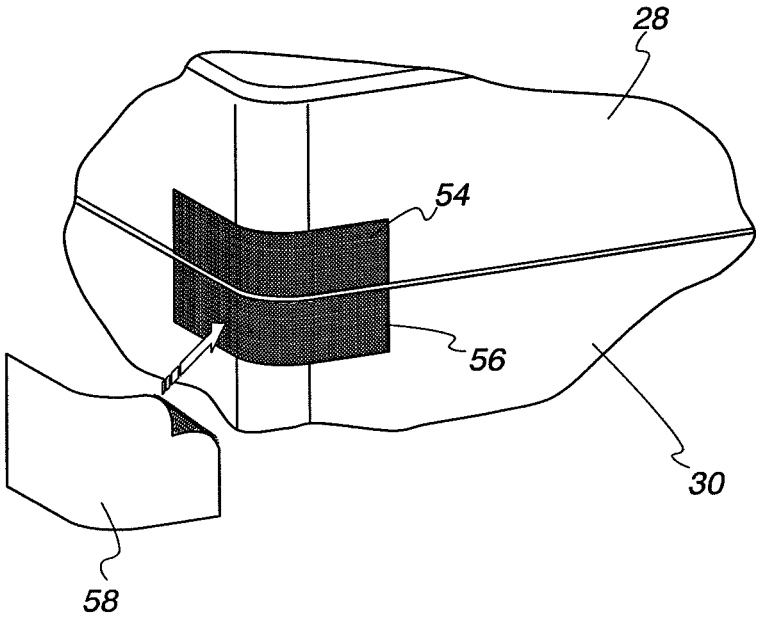
FIG. 19 is a partial elevational view illustrating one corner of a mattress disposed on a box spring illustrating integrated fastener strips aligned on each of the box spring and mattress, shown with a cooperating removable fastener strip removed.
Figure 20:
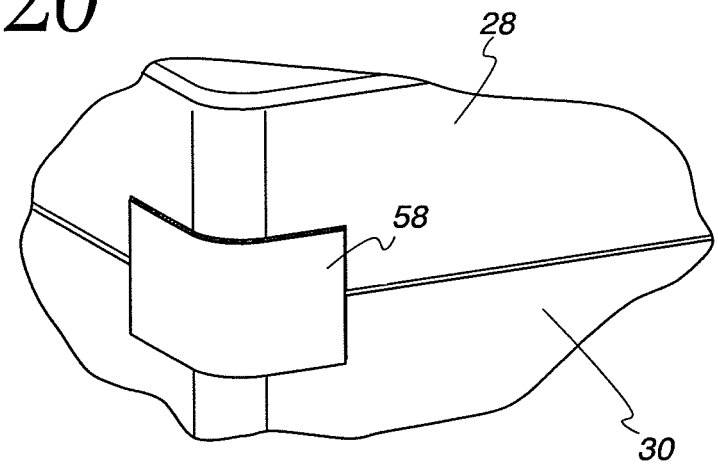
FIG. 20 is similar to FIG. 19 but shown with the removable fastener strip attached to the integrated fastener strips on the mattress and box spring.

In order to prevent movement of the mattress 28 with respect to the box spring 30 in a normal mode of operation, fasteners, for example, Velcro fasteners, may be provided on the corners of both the mattress 28 and the box spring 30. In particular, permanent fastener strips 54 are provided on the corners of the mattress 28, as shown in FIGS. 16, 17 and 19. Similarly, permanent fastener strips 56 are provided on the corners of the box spring 30. As shown in FIGS. 17 and 19, when the mattress 28 is correctly aligned with the box spring 30, the permanent fastener strips 54, 56 on the mattress 28 are aligned with the permanent fastener strips 56 on the box spring 30. In order to secure the mattress 28 relative to the box spring 30, removable cooperating fastener strips 58 are selectively attached to the permanent fastener strips 54 and 56 as shown in FIGS. 18 and 20 defining a normal mode of operation. The removable fastener strips 58 are simply removed in order to rotate the mattress 28 and replaced once the mattress 28 has been rotated.

An alternate embodiment of the invention is illustrated in FIGS. 143 and 144*a*. In this embodiment, the mattress is secured the foundation by way of a vertical attachment device, for example, as illustrated in FIG. 144*b*.

Figure 21:
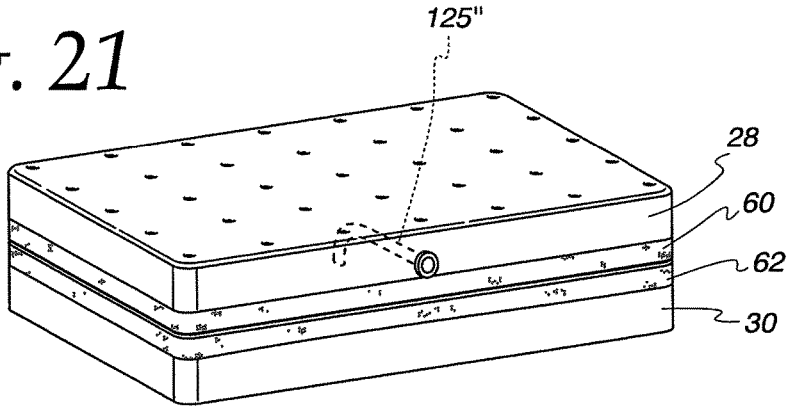
FIG. 21 is an isometric view of an alternative fastener configuration for securing the mattress to the box spring, illustrating a mattress disposed on a box spring in which the integrated fastener is disposed around the periphery of the box spring and the mattress, the mattress shown with an air inlet nozzle juxtaposed on a side of the mattress connected to a conduit, shown in phantom.
Figure 22:
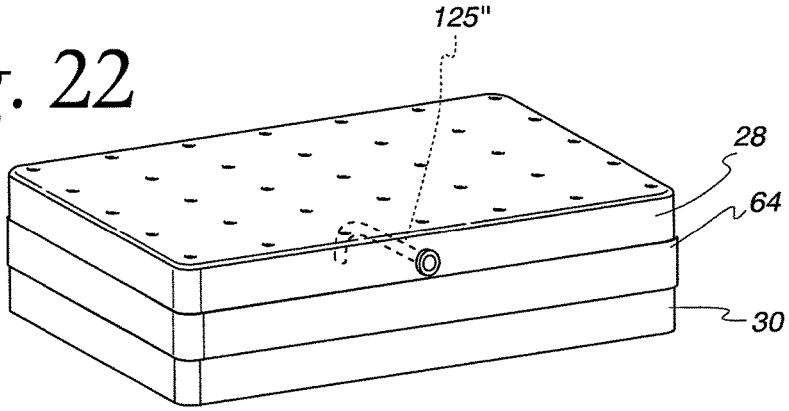
FIG. 22 is similar to FIG. 21 but shown with a cooperating removable fastener strip attached to the integrated fastener strips on the mattress and the box spring.
Figure 23:
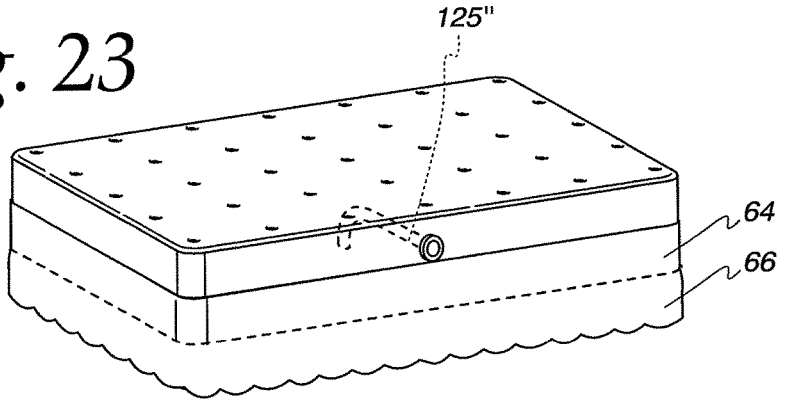
FIG. 23 is similar to FIG. 22 but illustrating a bed skirt which incorporates a removable fastening strip attached to the integrated fastening strips on the mattress and box spring.

Two alternate embodiments are illustrated in FIGS. 21-23. In the embodiment illustrated in FIGS. 21 and 22, permanent fastener strips 60 and 62 are located around the peripheries of the mattress 28 and the box spring 30, adjacent to the edges where the mattress 28 and the box spring 30 come together. As shown in FIG. 22, a cooperating removable fastener strip 64 is attached to the permanent fastener strips 60 and 62 on the mattress 28 and box spring 30, respectively. In yet another alternate embodiment as shown in FIG. 23, the cooperating removable fastener strip 64 may be affixed to the inside of a bed skirt 66. With such a configuration, not only are the mattress 28 and box spring 30 secured together, the configuration also allows a bed skirt 66 to be easily installed.

Figure 26:
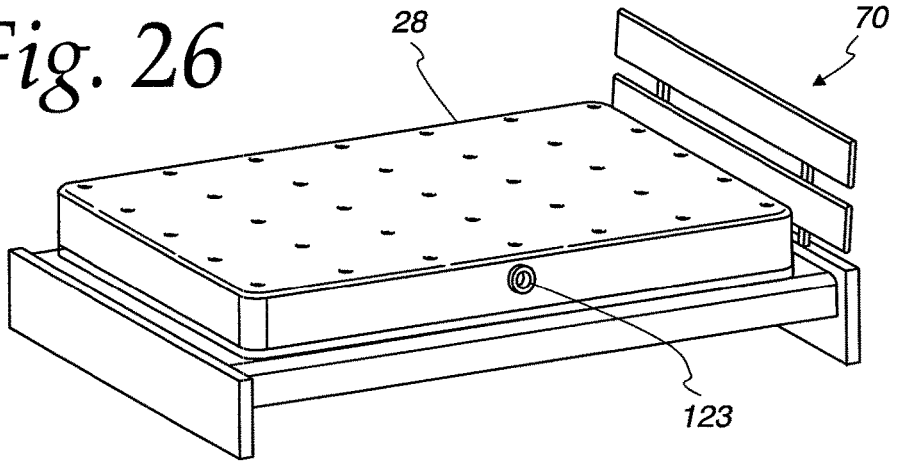
FIG. 26 is similar to FIG. 25 but illustrating a cover in accordance with the present invention installed on a platform forming a platform bed, shown with an air inlet nozzle juxtaposed on a side of the mattress.
Figure 27:
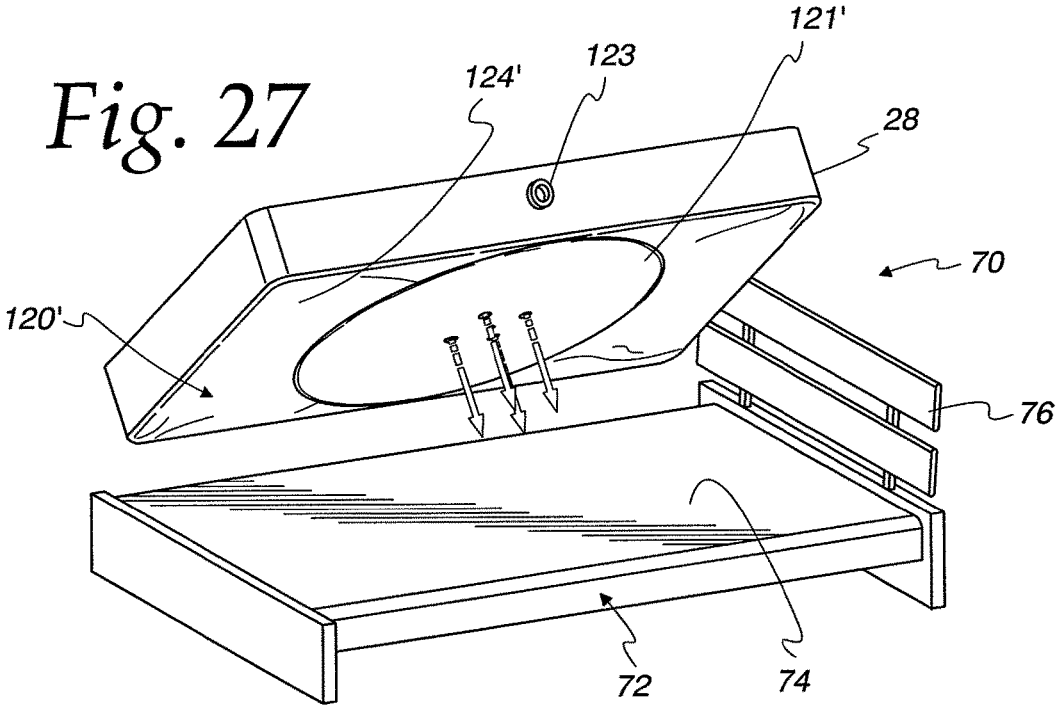
FIG. 27 is similar to FIG. 26 but showing the mattress with the cover in accordance with the present invention lifted from the platform.

FIGS. 26 and 27 illustrate an application of the invention on a platform bed, generally identified with the reference numeral 70. In this embodiment, the cover 120' is incorporated on the underside of a mattress 28. with the intake nozzle 123 terminated to one edge of the mattress 28. In this embodiment, the mattress 28 sits directly on a platform 72, which is formed with a slick surface 74 which cooperates with the slick surfaces 121' and 124' of the cover 120'. In a rotate mode of operation, air from an air supply (not shown) is applied to the intake nozzle 123 which causes the mattress 28 to levitate. The headboard 76 may be removed from the platform 74 or alternatively the mattress may be slid out away from the headboard and the mattress 28 before being rotated to its desired position. The air supply is then removed and the mattress returns to a rest position on the platform 72 and the headboard 76 is replaced in a normal mode. The mattress 28 is then secured to the platform 74 by a conventional fastener system or any of the attachment methods discussed below or any other conventional attachment methods.

Attachment Means

Various vertical and horizontal attachments are disclosed herein. Horizontal attachments are used to secure side panels together, for example as illustrated in FIGS. 28*a*-29*c*, and 29*h*-29*l*. Other attachment means such as illustrated in FIG. 24*j* may be used as well. Such horizontal attachments may also be used to tighten the grip of the side panels of the cover, or optionally the encasement, to a mattress or a foundation. Horizontal attachments methods may also be used to tighten the grip of the cover with respect to the mattress, box spring, or foundation. The single cover and coverless embodiments, including aftermarket encasements and mattress covers with zip-out bottom panels as discussed above may also include the attachment methods described in conjunction with the two cover embodiment.

Vertical attachments are used to secure a cover to a mattress (FIGS. 143-144*a* and 148); a cover to a mattress with a zip out bottom panel (FIGS. 139*h*-139*j*, 140*a*, 140*b*, and 149-151); and an aftermarket encasement (FIGS. 141*a*-*c*, and 145-147). Various other vertical attachments are illustrated for attaching a cover to a mattress (FIGS. 24*m*, 24*n*) and a mattress covered with an aftermarket encasement (FIGS. 24*o* and 24*p*).

In addition, a flip panel, straps, or other members (not shown) can either be attached to a mattress, mattress cover, encasement, or foundation. A fastener system can be imbedded in the flip panel, straps, or other members that cooperates with a mating fastener such as a zipper, buttons, buckles, or other fasteners to a cover or the foundation to secure the mattress to the foundation or to secure a cover to the mattress, mattress cover, or encasement, or foundation.

All fastener systems described and illustrated herein are suitable for both the vertical and horizontal attachments for all embodiments of the invention and can be used interchangeably or in combination with each other or any other conventional attachment methods.

Obviously, many modifications and variations of the present invention are possible in light of the above teachings. For example, the present invention can be utilized with only the cover 120. In this embodiment, the invention relies on the surface of the box spring 30 to cooperate with the levitation device. Also, the cover 22 can be provided with either two (2) slick sides or a slick side and a non-slick side. Thus, it is to be understood that, within the scope of the appended claims, the invention may be practiced otherwise than as specifically described above.

What is claimed and desired to be secured by a Letters Patent of the United States is:

1. A mattress management system for facilitating various tasks associated with a bed, the system comprising:

two or more layers of material attached together at a plurality of attachment points forming an inflatable volume;

an air intake nozzle in fluid communication with said inflatable volume and configured to be in fluid communication with a source of pressurized air;

fastening means for attaching said two or more layers of material together at one or more attachment points in addition to the attachment points used to attach said two or more layers of material together to form said inflatable volume;

an adjustable air exit valve in fluid communication with said inflatable volume for selectively controlling the amount of air released from the inflatable volume while pressurized to control the amount of lift of said mattress with respect to said foundation.

2. A mattress management system for facilitating tasks associated with maneuvering a mattress, the system comprising:

a levitation device configured to be disposed between a mattress and a foundation, said levitation device including an inflatable air volume formed from two layers of material attached together at a plurality of attachment points and an air intake in fluid communication with the inflatable air volume, said air intake nozzle configured to be in fluid communication with an external source of air, wherein said inflatable air volume includes at least one adjustable air exit valve and fastening means for attaching said two layers of material together at one or more attachment points in addition to the attachment points used to attach said two or more layers of material together to form said inflatable volume, said levitation device including an adjustable air exit valve in fluid communication with said inflatable air volume for selectively controlling the release of air from said inflatable air volume while air is pumped into said inflatable air volume to control the amount of lift of said mattress with respect to said foundation; and a first cover integrally formed with said levitation device, said cover configured to be selectively secured to said mattress or alternatively to said foundation.

3. A mattress management system as recited in claim 2, further including a second cover having a slick surface on one side and a non-slick surface on an opposing side, said second cover configured to cooperate with said levitation device to facilitate active and passive maneuvering of said mattress with respect to said foundation defining an active mattress maneuvering mode in which said inflatable air volume is inflated and a passive mattress maneuvering mode in which said inflatable air volume is not inflated and said passive maneuvering relies on the slick surface of said second cover configured to be selectively secured to said mattress or foundation.

4. The mattress management system as recited in claim 3, wherein said mattress management system is configured to enable active mattress maneuvering that enables bed making in an active mattress maneuvering mode in which the mattress is levitated from the foundation to facilitate tucking one or more sheets or blankets between the mattress and the foundation.

5. The mattress management system as recited in claim 3, wherein said mattress maneuvering in said passive mattress maneuvering mode includes one or more of the following maneuvering tasks:

installing, removing, re-installing, or sliding said mattress with respect to said foundation;

rotating said mattress with respect to said foundation; and holding a bed skirt in place over said foundation while said mattress is maneuvered.

6. The mattress management system as recited in claim 2, wherein said first levitation device is integrally formed as part of said mattress or foundation.

7. The mattress management system as recited in claim 2, further including an encasement for encasing a mattress, wherein said first levitation device is integrally formed as part of said encasement.

8. The mattress management system as recited in claim 7, wherein said second cover includes a slick surface and is configured to be selectively secured to said encasement.

9. A device for facilitating tucking one or more bed sheets or blankets between a mattress and a foundation, the device comprising:

a levitation device configured to be disposed between a mattress and a foundation, the levitation device configured to be selectively secured to said mattress or foundation, said levitation device comprising an inflatable air volume formed from two layers of material attached together defining a periphery, fastening means for attaching said two layers of material together at one or more attachment points in addition to the attachment points used to attach said two layers together to form said inflatable volume, an air inlet nozzle in fluid communication with said inflatable air volume, and an air exit hole, said air inlet nozzle in fluid communication with an external air supply that is configured to provide selectable variable amounts of air while said inflatable volume is receiving pressurized air in order to expand said inflatable air volume to levitate said mattress with respect to said foundation to facilitate tucking one or more bed sheets or blankets between the mattress and the foundation.

* * * * *